US012753552B2

(12) United States Patent
Kien et al.

(10) Patent No.: US 12,753,552 B2
(45) Date of Patent: Oct. 6, 2026

(54) WEB MATERIAL STRUCTURING BELT COMPRISING A SEAM AND METHOD FOR MAKING AND USING

(71) Applicant: The Procter & Gamble Company, Cincinnati, OH (US)

(72) Inventors: Kathryn Christian Kien, Cincinnati, OH (US); Jeffrey Glen Sheehan, Symmes Township, OH (US); Ward William Ostendorf, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 97 days.

(21) Appl. No.: 18/652,892

(22) Filed: May 2, 2024

(65) Prior Publication Data

US 2024/0368837 A1 Nov. 7, 2024

Related U.S. Application Data

(60) Provisional application No. 63/499,584, filed on May 2, 2023.

(51) Int. Cl.
*D21F 7/08* (2006.01)
*D21F 7/10* (2006.01)

(52) U.S. Cl.
CPC ..... *D21F 7/083* (2013.01); *D21F 7/10* (2013.01)

(58) Field of Classification Search
CPC ..... D21F 7/083; D21F 7/10; D21F 1/0036; D21F 1/0054; B32B 7/12
See application file for complete search history.

(56) References Cited

U.S. PATENT DOCUMENTS 3,546,054 A * 12/1970 Ross ..... F16G 3/10 156/137
4,514,345 A 4/1985 Johnson et al.
(Continued)

FOREIGN PATENT DOCUMENTS

CA 2271863 A1 5/1998
DE 1958335 A1 5/1971
(Continued)

OTHER PUBLICATIONS

PCT Search Report and Written Opinion for PCT/US2024/027175 dated Aug. 27, 2024, 13 pages.
(Continued)

*Primary Examiner* — Jose A Fortuna
(74) *Attorney, Agent, or Firm* — Richard L. Alexander

(57) ABSTRACT

Web material structuring belts that impart texture to a web material during a web material structuring operation/process and/or during a structured web material operation/process wherein the web material structuring belts include one or more seams ("seam-containing web material structuring belts"), method for making same and methods for using same to make structured web materials, such as structured sanitary tissue products such as structured toilet tissue, structured paper towels, structured facial tissue, structured wipes and/or structured components of absorbent products, such as structured top sheets for diapers and/or feminine hygiene products and/or adult incontinence products are provided.

18 Claims, 27 Drawing Sheets

(56) References Cited

U.S. PATENT DOCUMENTS

| | | | | |
|---|---|---|---|---|
| 5,217,415 | A * | 6/1993 | Wasylezuck | D21F 1/0054 474/256 |
| 5,789,052 | A * | 8/1998 | Miller | D21F 1/0054 428/57 |
| 6,124,015 | A | 9/2000 | Baker et al. | |
| 6,440,881 | B1 * | 8/2002 | Ercken | D21F 7/10 428/57 |
| 6,465,074 | B1 * | 10/2002 | FitzPatrick | D03D 1/0094 162/358.4 |
| 6,576,090 | B1 | 6/2003 | Trokhan et al. | |
| 7,141,144 | B2 * | 11/2006 | Rydin | D21F 1/0054 428/33 |
| 8,216,427 | B2 | 7/2012 | Klerelid et al. | |
| 8,999,115 | B2 * | 4/2015 | Salonen | D21G 1/0066 162/348 |
| 9,359,723 | B2 | 6/2016 | Walkenhaus et al. | |
| 9,657,443 | B2 | 5/2017 | Rekoske et al. | |
| 11,619,005 | B2 * | 4/2023 | Swaine | D21F 7/083 139/383 R |
| 12,325,956 | B2 * | 6/2025 | Kien | D21F 11/006 |
| 12,397,528 | B2 * | 8/2025 | Kien | B32B 5/024 |
| 2003/0221739 | A1 * | 12/2003 | Billings | D21F 1/0054 139/383 AA |
| 2004/0109960 | A1 * | 6/2004 | Rydin | D21F 7/10 428/33 |
| 2004/0157045 | A1 * | 8/2004 | Davenport | D21F 7/083 428/193 |
| 2007/0209770 | A1 | 9/2007 | Barrett et al. | |
| 2010/0065234 | A1 | 3/2010 | Klerelid | |
| 2010/0193149 | A1 | 8/2010 | Quigley | |
| 2011/0088859 | A1 | 4/2011 | Hultcrantz et al. | |
| 2011/0155340 | A1 | 6/2011 | Quigley | |
| 2013/0295328 | A1 | 11/2013 | Baran, Jr. et al. | |
| 2014/0345822 | A1 | 11/2014 | Walkenhaus et al. | |
| 2015/0211178 | A1 | 7/2015 | Barrett | |
| 2016/0069022 | A1 * | 3/2016 | Lee | D21F 7/083 162/202 |
| 2016/0145810 | A1 | 5/2016 | Miller, IV et al. | |
| 2018/0119350 | A1 | 5/2018 | Brent, Jr. et al. | |
| 2018/0168893 | A1 | 6/2018 | Ashraf | |
| 2019/0374388 | A1 | 12/2019 | Giovanni et al. | |
| 2020/0079054 | A1 | 3/2020 | Fujiwara | |
| 2020/0270811 | A1 | 8/2020 | Eberhardt et al. | |
| 2020/0360190 | A1 | 11/2020 | Ashraf et al. | |
| 2022/0325474 | A1 * | 10/2022 | Burazin | B65G 15/34 |
| 2023/0137354 | A1 | 5/2023 | Kien et al. | |
| 2023/0137439 | A1 | 5/2023 | Kien et al. | |
| 2023/0138090 | A1 | 5/2023 | Kien et al. | |
| 2023/0138680 | A1 | 5/2023 | Kien et al. | |
| 2023/0139935 | A1 | 5/2023 | Kien et al. | |
| 2023/0140783 | A1 | 5/2023 | Kien et al. | |
| 2024/0271364 | A1 * | 8/2024 | Rhett | D06N 3/14 |
| 2024/0301625 | A1 * | 9/2024 | Sealey | D21F 7/083 |
| 2024/0368837 | A1 * | 11/2024 | Kien | D21F 7/10 |
| 2025/0277337 | A1 * | 9/2025 | Kien | D21F 7/083 |
| 2025/0361720 | A1 * | 11/2025 | Kien | B32B 7/05 |
| 2026/0110137 | A1 * | 4/2026 | Kien | D21F 7/083 |

FOREIGN PATENT DOCUMENTS

| | | | | |
|---|---|---|---|---|
| DE | 112022005305 | T5 * | 8/2024 | D04H 1/32 |
| GB | 2627401 | A | 8/2024 | |
| JP | S54158080 | U | 11/1979 | |
| KR | 101436282 | B1 | 8/2014 | |
| WO | 9807926 | A2 | 2/1998 | |
| WO | 9966124 | A1 | 12/1999 | |
| WO | 2010030298 | A1 | 3/2010 | |
| WO | 2013083773 | A1 | 6/2013 | |
| WO | 2014172594 | A1 | 10/2014 | |
| WO | 2017178414 | A1 | 10/2017 | |
| WO | 2019028052 | A1 | 2/2019 | |
| WO | 2023081746 | A1 | 5/2023 | |
| WO | WO-2023081747 | A1 * | 5/2023 | D21F 11/006 |
| WO | WO-2024229080 | A1 * | 11/2024 | D21F 7/10 |

OTHER PUBLICATIONS

Gary A et al., Handbook for Pulp and Paper Technologists, Angus Wilde Publications, Second Edition, 2001, pp. 308-322.
U.S. Appl. No. 19/206,108, filed May 13, 2025, to Kathryn Christian Kien et. al. (See Patent Center).
Final Office Action; U.S. Appl. No. 17/980,087, dated Feb. 13, 2024; See Patent Center.
Final Office Action; U.S. Appl. No. 17/980,120, dated Aug. 25, 2025; See Patent Center.
Final Office Action; U.S. Appl. No. 17/980,120, dated Feb. 13, 2024; See Patent Center.
Final Office Action; U.S. Appl. No. 17/980,174, dated Jun. 24, 2025; See Patent Center.
Final Office Action; U.S. Appl. No. 17/980,208, dated Sep. 17, 2025; See Patent Center.
Non-Final Office Action; U.S. Appl. No. 17/980,038, dated Sep. 16, 2024; See Patent Center.
Non-Final Office Action; U.S. Appl. No. 17/980,063, dated Aug. 19, 2024; See Patent Center.
Non-Final Office Action; U.S. Appl. No. 17/980,087, dated Jun. 5, 2023; See Patent Center.
Non-Final Office Action; U.S. Appl. No. 17/980,087, dated Oct. 23, 2025; See Patent Center.
Non-Final Office Action; U.S. Appl. No. 17/980,120, dated Jun. 6, 2023; See Patent Center.
Non-Final Office Action; U.S. Appl. No. 17/980,120, dated Mar. 14, 2025; See Patent Center.
Non-Final Office Action; U.S. Appl. No. 17/980,174, dated Jan. 15, 2025; See Patent Center.
Non-Final Office Action; U.S. Appl. No. 17/980,174, dated Nov. 5, 2025; See Patent Center.
Non-Final Office Action; U.S. Appl. No. 17/980,208, dated Feb. 26, 2025; See Patent Center.
Notice of Allowance; U.S. Appl. No. 17/980,038, dated Apr. 30, 2025; See Patent Center.
Notice of Allowance; U.S. Appl. No. 17/980,063, dated Feb. 11, 2025; See Patent Center.
Notice of Allowance; U.S. Appl. No. 17/980,120, dated Jan. 28, 2026; See Patent Center.

* cited by examiner

WEB MATERIAL STRUCTURING BELT COMPRISING A SEAM AND METHOD FOR MAKING AND USING

CROSS REFERENCE TO RELATED APPLICATION

This application claims the benefit of U.S. Provisional Application No. 63/499,584, filed May 2, 2023, the substance of which is incorporated herein by reference.

FIELD OF THE INVENTION

The present invention relates to web material structuring belts, and more particularly to laminated, for example two or more pre-formed/pre-existing material layers that are associated with each other to form a belt, web material structuring belts and/or where one material layer is formed and associated and/or subsequently associated with a pre-formed/pre-existing material layer, that impart texture, for example structure, to a web material, for example fibrous structure, during a web material structuring operation/process and/or during a structured web material, for example structured fibrous structure, operation/process wherein the web material structuring belts comprise one or more seams ("seam-containing web material structuring belts"), method for making same and methods for using same to make textured web materials, for example structured web materials, for example structured fibrous structures, such as structured sanitary tissue products such as structured toilet tissue, structured paper towels, structured facial tissue, structured wipes, for example structured wet wipes, and/or structured components of absorbent products, such as structured top sheets for diapers and/or feminine hygiene products and/or adult incontinence products.

BACKGROUND OF THE INVENTION

Laminated web material structuring belts, for example laminated papermaking belts, comprising a structuring layer (a layer for imparting structure to a web material, for example a fibrous structure, during a web material making process, for example a fibrous structure making process), wherein the structuring layer is laminated to a support layer are known in the art. However, such known laminated web material structuring belts (especially seams of one or more layers, for example structuring layer and/or support layer) are prone to delamination of the layers in the x-y plane and additionally delamination in the z plane (for example orthogonal to the x-y plane) as a result of the presence of one or more seams within one or more of the layers. The negatives associated with seams of known laminated web material structuring belts include, but are not limited to insufficient seam strength and/or poor seam quality and/or discontinuities created in the layer material at the seam that impact durability and functional life of the laminated web material structuring belts due to the process conditions encountered during the web material, for example structured fibrous structure, making processes. In addition to the problems with seams in such known laminated web material structuring belts, such known laminated web material structuring belts may also result in less than sufficient and/or less than efficient drying of the web materials, for example structured fibrous structures, such as wet laid structured fibrous structures, made on the known laminated web material structuring belts. Known laminated web material structuring belts may also interfere with formation of structure in the web materials, for example fibrous structures, being formed by either or both over-structuring and/or pulling fibers into the support layer and/or by under-structuring and/or not maximally realigning the web material components, for example fibrous elements such as fibers, to impart structure into the web materials, for example fibrous structures, being formed thereon.

In addition to the above problems with the known laminated web material structuring belts, the known laminated web material structuring belts create negatives on and/or within the web materials, for example structured fibrous structures, formed on the known laminated web material structuring belts. For example, where and how the seams are used to connect one or more ends and/or edges of the structuring layer and/or support layer in the known laminated web material structuring belts creates negatives, for example discontinuities and/or disruptions, within the known laminated web material structure belts and/or the web materials, such as structured fibrous structures, made on such known laminated web material structuring belts.

As shown in Prior Art FIG. 1, a known seam 10, in this case a seam 10 in a structuring layer material 12 that forms a structuring layer, for example a polymeric netting alone or in combination with a support layer material 7 that forms a support layer, which comprises filaments 9, of a prior art web material structuring belt 5 may have one or more seams 10, in this case a structuring layer material seam. The seam 10 comprises a first structuring layer material edge 14 having a first terminus 16 and a second structuring layer material edge 18 having a second terminus 20, where the first terminus 16 abuts the second terminus 20 to form an abut structuring layer material seam (the junction). As shown in Prior Art FIG. 1, the seam 10 and its first and second structuring layer material edges 14 and 18 do not extend into the support layer material 7 and thus fail to provide sufficient seam strength to the seam 10.

As shown in Prior Art FIGS. 2A and 2B, a known seam 10, in this case a seam 10 in a structuring layer material 12 that forms a structuring layer, for example a nonwoven polymer lattice alone or in combination with a support layer material 7 that forms a support layer, of a prior art web material structuring belt 5 may have one or more seams 10, in this case a structuring layer material seam. The seam 10 comprises a first structuring layer material edge 14 having a first terminus 16 and a second structuring layer material edge 18 having a second terminus 20, where the first terminus 16 abuts the second terminus 20 to form an abut structuring layer material seam (the junction). As shown in Prior Art FIGS. 2A and 2B, the seam 10 and its first and second structuring layer material edges 14 and 18 do not extend into the support layer material 7 or the support layer and thus fail to provide sufficient seam strength to the seam 10.

As shown in FIGS. 3A and 3B, a known seam 10, in this case a seam 10 in a structuring layer material 12, for example a nonwoven polymer lattice alone or in combination with a support layer material 7, of a prior art web material structuring belt 5 may have one or more seams 10, in this case a structuring layer material seam. The seam 10 comprises a first structuring layer material edge 14 having a first terminus 16 and a second structuring layer material edge 18 having a second terminus 20, where the first terminus 16 abuts the second terminus 20 to form an abut structuring layer material seam (the junction). As shown in Prior Art FIGS. 3A and 3B, the seam 10 and its first and second structuring layer material edges 14 and 18 do not extend into the support layer 7 or the support layer and thus fail to provide sufficient seam strength to the seam 10.

As shown in Prior Art FIGS. 1-3B, examples of known seam-containing structure-imparting laminated web material structuring belts, for example fibrous structure making belts, such as papermaking belts, comprise a structuring layer comprising a seam wherein the seam and/or seam portions of the structuring layer are not associated with, for example do not extend into, a support layer, and thus does not provide increased strength offered by sufficiently associating with, for example extending into, the seam and/or seam portions, a support layer. At the most, the seam and/or seam portions of the prior art seam-containing structure-imparting laminated web material structuring belts, like non-seam portions of the structuring layer, may be at most superficially adhesively bonded to a surface of the support layer where there is no or less than 30 μm penetration of the structuring layer material into the support layer. These known laminated structure-imparting web material structuring belts are designed to superficially adhesively bond one or more seam portions of the structuring layer to a surface of the support layer and not to envelope and/or wrap components of the support layer, for example yarns and/or threads and/or filaments of the support layer. The seams and/or seam portions of the structuring layers of the known structure-imparting laminated web material structuring belts, for example structuring layer materials, do not extend into the support layers sufficiently, in fact, they fail to extend into the support layer greater than the thickness of a yarn and/or thread and/or filament of the surface of the support layer (the top-most yarns, threads, and/or filaments of the support layer) and/or fails to extend into the support layer greater than 30 μm and/or greater than 40 μm and/or greater than 50 μm and/or greater than 100 μm and/or to less than 5000 μm and/or to less than 4000 μm and/or to less than 3000 μm and/or to less than 2000 μm, in yet another example greater than the thickness of at least one individual component, for example at least one yarn, at least one thread and/or at least one filament, that at least partially defines an upper layer and/or upper surface for example at least one filament that forms at least a part of a surface of the support layer associated with the structuring layer, for example greater than 50 μm and/or greater than 75 μm and/or greater than 100 μm and/or greater than 150 μm and/or greater than 200 μm and/or greater than 300 μm and/or greater than 400 μm and/or greater than 500 μm and/or greater than 600 μm and/or to less than 5000 μm and/or to less than 4000 μm and/or to less than 3000 μm and/or to less than 2000 μm, in even yet another example greater than 5% and/or greater than 10% and/or greater than 20% and/or greater than 30% and/or greater than 40% and/or to less than 95% and/or to less than 90% and/or to less than 80% and/or to less than 70% and/or to less than 60% of the thickness (z-direction thickness) of the support layer, in still another example extends past the upper surface and/or upper surface plane of the support layer, in another example extends into the support layer more than 50% and/or greater than 75% and/or greater than 100% of the thickness of individual components, for example yarns, threads and/or filaments, that define an upper layer and/or an upper surface of the support layer, in even yet another example extends into the support layer such that at least a portion of the structuring layer envelopes and/or wraps one or more individual components, for example yarns, threads and/or filaments, that define the upper layer and/or upper surface of the support layer), but less than entirely through the support layer, resulting in no increased strength of the seam of the structuring layer. Similar problems exist with seams of support layers when present in known web material structuring belts.

Accordingly, known problems with known seam-containing structure-imparting laminated web material structuring belts include (1) failure of the structuring layer seam itself and/or delamination of the seam and/or seam portions of the structuring layer from the support layer and/or vice versa, (2) inability of the known seam-containing structure-imparting laminated web material structuring belts to run at speeds greater than 1000 fpm run at faster speeds for extended periods of time, (3) inability of the known seam-containing structure-imparting laminated web material structuring belts to survive processing temperatures of 300° F. or higher survive high processing temperatures during a web material, (4) withstand higher shear and/or compression forces during a web material structuring belt process, for example fibrous structure, making process, which may lead to increased oxidation and/or increased material fatigue, and/or (5) inability of the known seam-containing structure-imparting laminated web material structuring belts to survive more than 350,000 cycles around a paper machine, and/or (6) inability of the known seam-containing structure-imparting laminated web material structuring belts to run for longer periods of time, for example at least 500 hours, in some instances without losing greater than 5% caliper, during the web material, for example fibrous structure, making process due to insufficient strength and/or integrity of such known seams of known seam-containing structure-imparting laminated web material structuring belts, (7) insufficient air flow of the known seam-containing structure-imparting laminated web material structuring belts to achieve faster run speeds and/or cost effective drying during the web material, for example fibrous structure, making process, excessively low air permeability of the known seam-containing structure-imparting laminated web material structuring belts to achieve structuring, for example molding, of the fibrous structure into the known seam-containing structure-imparting laminated web material structuring belt, and/or issues with generating sufficient force to rearrange the fibrous elements, for example fibers, into the known seam-containing structure-imparting laminated web material structuring belt, unnecessarily high air perm so that structuring, for example molding, of the fibrous structure into the known seam-containing structure-imparting laminated web material structuring belt results in fibrous elements, for example fibers, penetrating into and/or through the support layer resulting in fiber build-up in the web material, for example fibrous structure, making process and/or insufficient seam strength and/or seam quality of the known seam-containing structure-imparting laminated web material structuring belts may lead to discontinuities, for example pin holes, within the resulting web material, for example resulting fibrous structure, such as resulting structured fibrous structure, made on the known seam-containing structure-imparting laminated web material structuring belt.

In light of the foregoing, there exists a need for a laminated web material structuring belt (for example two or more pre-formed/pre-existing material layers that are associated with each other to form a belt, web material structuring belts and/or where one material layer is formed and associated and/or subsequently associated with a pre-formed/pre-existing material layer) comprising one or more seams that overcomes the negatives associated with known seam-containing structure-imparting laminated web material structuring belts, especially known seam-containing laminated structuring papermaking belts.

SUMMARY OF THE INVENTION

The present invention fulfills the needs described above by providing laminated, for example two or more pre-formed/pre-existing material layers that are associated with each other to form a belt, web material structuring belts and/or where one material layer is formed and associated and/or subsequently associated with a pre-formed/pre-existing material layer, web material structuring belts for imparting texture, for example structure, to a web material, for example a fibrous structure, such as a wet laid fibrous structure, which can be used to make a structured web material, such as a structured fibrous structure, for example a structured sanitary tissue product, wherein the laminated web material structuring belt comprises one or more seams having one or more seam portions in one or more material layers, for example a support layer and/or a structuring layer and/or an associating layer. At least one of the one or more seams and/or at least one of the one or more seam portions of the support layer and/or the structuring layer and/or an associating layer is associated with one or more of the other layers, for example a seam or a seam portion of the structuring layer is associated with the support layer, such that the seam and/or the seam portion of the structuring layer seam extends into (in one example greater than 30 μm and/or greater than 40 μm and/or greater than 50 μm and/or greater than 100 μm and/or to less than 5000 μm and/or to less than 4000 μm and/or to less than 3000 μm and/or to less than 2000 μm, in yet another example greater than the thickness of at least one individual component, for example at least one yarn, at least one thread and/or at least one filament, that at least partially defines an upper layer and/or upper surface for example at least one filament that forms at least a part of a surface of the support layer associated with the structuring layer, for example greater than 50 μm and/or greater than 75 μm and/or greater than 100 μm and/or greater than 150 μm and/or greater than 200 μm and/or greater than 300 μm and/or greater than 400 μm and/or greater than 500 μm and/or greater than 600 μm and/or to less than 5000 μm and/or to less than 4000 μm and/or to less than 3000 μm and/or to less than 2000 μm, in even yet another example greater than 5% and/or greater than 10% and/or greater than 20% and/or greater than 30% and/or greater than 40% and/or to less than 95% and/or to less than 90% and/or to less than 80% and/or to less than 70% and/or to less than 60% of the thickness (z-direction thickness) of the support layer, in still another example extends past the upper surface and/or upper surface plane of the support layer, in another example extends into the support layer more than 50% and/or greater than 75% and/or greater than 100% of the thickness of individual components, for example yarns, threads and/or filaments, that define an upper layer and/or an upper surface of the support layer, in even yet another example extends into the support layer such that at least a portion of the structuring layer envelopes and/or wraps one or more individual components, for example yarns, threads and/or filaments, that define the upper layer and/or upper surface of the support layer), but less than entirely through the support layer and/or vice versa, at least one of the one or more seams and/or at least one of the one or more seam portions of the support layer extending into but less than entirely through the structuring layer as described above with reference to the seam and/or seam portion of the structuring layer extending into but less than entirely through the support layer, and even in another example, at least one of the one or more seams and/or at least one of the one or more seam portions, for example two or more seam portions of the support layer and/or the structuring layer extending into but less than entirely through the support layer and/or structuring layer as described above with reference to the seam and/or seam portion of the structuring layer extending into but less than entirely through the support layer, and/or where at least a portion of an associating layer extends into, but less than entirely through a support layer and/or structuring layer at one or more seams and/or one or more seam portions of the support layer and/or structuring layer as described above with reference to the seam and/or seam portion of the structuring layer extending into but less than entirely through the support layer, methods for making such seam-containing web material structuring belts and methods for using such seam-containing web material structuring belts to make structured web materials, such as a structured fibrous structures, for example a structured wet laid fibrous structures. In even another example, one or more seams and/or seam portions of a structuring layer and/or support layer is associated with an associating layer such that the one or more seams and/or seam portions extends into, but less than entirely through the associating layer and/or such that one or more portions of the associating layer extends into, but less than entirely through one or more of the seams and/or seam portions of the structuring layer and/or support layer. In even yet another example, one or more seams and/or seam portions of a structuring layer and/or support layer is associated with a bonding material such that the one or more seams and/or seam portions extends into, but less than entirely through the bonding material and/or such that one or more portions of the bonding material extends into, but less than entirely through one or more of the seams and/or seam portions of the structuring layer and/or support layer.

In addition to structured sanitary tissue products such as structured toilet tissue, structured paper towels, structured facial tissue, structured wipes, for example structured wet wipes, which may be made using the web material structuring belts of the present invention, nonwoven fabrics and/or nonwoven substrates comprising a first surface and a second surface and a visually discernible pattern of three-dimensional features on one of the first or second surfaces may also be made using the web material structuring belts of the present invention. Each of the three-dimensional features of such nonwoven fabrics and/or nonwoven substrates may define a microzone comprising a first region and a second region. The first and second regions may have a difference in values for an intensive property, wherein the intensive property may be one, two, or all three of the following: thickness, basis weight, and volumetric density. The thickness, basis weight, and volumetric density may all be greater than zero. Such nonwovens are described in PCT publication WO 2017/105997, U.S. Pat. Application Publication No. US 2018/0168893, U.S. Pat. Application Publication No. US 2018/0216271, U.S. Pat. Application Publication No. US 2018/0214318, U.S. Pat. Application Publication No. US 2020/0268572, U.S. Pat. Application Publication No. US 2020/0299880, and U.S. Pat. Application Publication No. US 2021/0369511. The web material structuring belts of the present invention may also be used to generate nonwoven fabrics and substrates via the spunbond process as described in U.S. Pat. Application Publication No. US 2017/0314163. In one example, the web material structuring belts of the present invention may also be used to generate nonwoven fabrics and/or nonwoven substrates as described in the records incorporated by reference and may also be consolidated and converted using through air bonding to create a through air bonded, spunbond nonwoven.

One solution to the problems identified above with known seam-containing web material structuring belts, for example known seam-containing structure-imparting papermaking belts, is to provide better seam formation and/or seam strength and/or seam quality and/or better control of seam formation (to impact air permeability and/or structuring/molding properties of the web material structuring belts and/or strength of the seam and/or integrity of the seam) by providing one or more of the following: 1) improved penetration and/or impregnation and/or embedment and/or extension of one or more seams and/or seam portions of the structuring layer into the support layer and/or one or more seams and/or seam portions of the support layer into the structuring layer, 2) improved penetration and/or impregnation and/or embedment and/or extension of one or more seams and/or seam portions of the structuring layer into an associating layer and/or one or more seams and/or seam portions of the support layer into an associating layer, 3) improved penetration and/or impregnation and/or embedment and/or extension of at least a portion of an associating layer into one or more seams and/or seam portions of the structuring layer and/or at least a portion of an associating layer into one or more seams and/or seam portions of the support layer, 4) better adhesion between one or more seams and/or seam portions of the structuring layer and at least a portion of the support layer and/or better adhesion between one or more seams and/or seam portions of the support layer and at least a portion of the structuring layer, 5) better adhesion between one or more seams and/or seam portions of the structuring layer and at least a portion of an associating layer and/or better adhesion between one or more seams and/or seam portions of the support layer and at least a portion of an associating layer, 6) wrapping and/or enveloping of one or more components, for example yarns, threads and/or filaments and/or other physical features, such as particles and/or additive manufacturing elements, of the support layer by one or more seams and/or seam portions of the structuring layer, for example wrapping and/or enveloping at least a portion of the yarns, threads and/or filaments and/or other physical features, such as particles and/or additive manufacturing elements, of the support layer (for example at least the yarns, threads and/or filaments and/or other physical features, such as particles and/or additive manufacturing elements, of, at a minimum, the surface of the support layer that is associated with the one or more seams and/or seam portions of the structuring layer, for example the top-most yarns, threads and/or filaments and/or other physical features, such as particles and/or additive manufacturing elements, of the support layer) by one or more seams and/or seam portions of the structuring layer such that the support layer is enabled to bear at least a portion of the load of any delamination force and/or vice versa where one or more seams and/or seam portions of the support layer wraps and/or envelopes one or more components, for example yarns, threads and/or filaments and/or other physical features, such as particles and/or additive manufacturing elements, of the structuring layer as described immediately above with reference to a structuring layer wrapping and/or enveloping components of the support layer, 7) wrapping and/or enveloping of one or more components, for example yarns, threads and/or filaments and/or other physical features, such as particles and/or additive manufacturing elements, of one or more seams and/or seam portions of the support layer and/or structuring layer by a portion of an associating layer, for example wrapping and/or enveloping at least a portion of the yarns, threads and/or filaments and/or other physical features, such as particles and/or additive manufacturing elements, of the support layer and/or the structuring layer (for example at least the yarns, threads and/or filaments and/or other physical features, such as particles and/or additive manufacturing elements, of, at a minimum, the surface of the support layer and/or the structuring layer that is associated with the associating layer, for example the top-most yarns, threads and/or filaments and/or other physical features, such as particles and/or additive manufacturing elements, of the support layer and/or the structuring layer) by one or more portions of the associating layer such that the support layer and/or the structuring layer is enabled to bear at least a portion of the load of any delamination force, 8) wrapping and/or enveloping of one or more components, for example yarns, threads and/or filaments and/or other physical features, such as particles and/or additive manufacturing elements, of the structuring layer by one or more seams and/or seam portions of the support layer, for example wrapping and/or enveloping at least a portion of the yarns, threads and/or filaments and/or other physical features, such as particles and/or additive manufacturing elements, of the structuring layer (for example at least the yarns, threads and/or filaments and/or other physical features, such as particles and/or additive manufacturing elements, of, at a minimum, the surface of the structuring layer that is associated with the one or more seams and/or seam portions of the support layer, for example the top-most yarns, threads and/or filaments and/or other physical features, such as particles and/or additive manufacturing elements, of the structuring layer) by at least a portion of support layer such that the structuring layer is enabled to bear at least a portion of the load of any delamination force, wrapping and/or enveloping of one or more components, for example yarns, threads and/or filaments and/or other physical features, such as particles and/or additive manufacturing elements, of the structuring layer by one or more seams and/or seam portions of the support layer, for example wrapping and/or enveloping at least a portion of the yarns, threads and/or filaments and/or other physical features, such as particles and/or additive manufacturing elements, of the structuring layer (for example at least the yarns, threads and/or filaments and/or other physical features, such as particles and/or additive manufacturing elements, of, at a minimum, the surface of the structuring layer that is associated with the one or more seams and/or seam portions of the support layer, for example the top-most yarns, threads and/or filaments and/or other physical features, such as particles and/or additive manufacturing elements, of the structuring layer) by at least a portion of support layer such that the structuring layer is enabled to bear at least a portion of the load of any delamination force, 9) increased contact area between at least a portion of one or more seams of the structuring layer and at least a portion of the support layer and/or between at least a portion of one or more seams of a support layer and at least a portion of the structuring layer and/or between at least a portion of one or more seams of an associating layer and at least a portion of the support layer and/or the structuring layer, 10) improved selective bonding between at least a portion of one or more seams of the structuring layer and at least a portion of the support layer, and 11) including alternative function layers, such as air perm function layers and/or associating function layers that improve the seam formation and/or strength and/or quality and/or operational properties of the web material structuring belts.

Without being bound by theory, the use of one or more of the above-identified solutions to produce a seam-containing web material structuring belt that can be used to produce a web material, for example a structured web material, at faster speeds and higher temperatures and effectively structure the web material by imparting desired fibrous element realignment while still drying the web material effectively and efficiently.

In one example of the present invention, a web material structuring belt comprising:

a. a support layer, for example 1) a support layer that exhibits an air perm of greater than 400 scfm and/or greater than 500 scfm and/or greater than 600 scfm and/or greater than 700 scfm and/or greater than 800 scfm and/or to about 1500 scfm and/or to about 1400 scfm and/or to about 1300 scfm and/or to about 1200 scfm and/or to about 1100 scfm and/or to about 1000 scfm and/or 2) a non-batted support layer, for example a non-felt support layer, for example a woven support layer; and b. a structuring layer;

wherein at least one of the support layer and the structuring layer comprises a seam that is associated with the other layer, is provided.

In one example of the present invention, a web material structuring belt comprising:

a. a support layer, for example 1) a support layer that exhibits an air perm of greater than 400 scfm and/or greater than 500 scfm and/or greater than 600 scfm and/or greater than 700 scfm and/or greater than 800 scfm and/or to about 1500 scfm and/or to about 1400 scfm and/or to about 1300 scfm and/or to about 1200 scfm and/or to about 1100 scfm and/or to about 1000 scfm and/or 2) a non-batted support layer, for example a non-felt support layer, for example a woven support layer; and b. a structuring layer comprising a seam wherein the seam comprises at least one seam portion that is associated with the support layer, for example wherein the at least one seam portion is associated with the support layer such that the at least one seam portion of the structuring layer extends into, but less than entirely through the support layer, is provided.

In another example of the present invention, a web material structuring belt comprising:

a. a woven support layer, for example a fabric support layer, that exhibits an air perm of greater than 50 scfm and/or greater than 100 scfm and/or greater than 150 scfm and/or greater than 200 scfm and/or greater than 250 scfm and/or greater than 300 scfm and/or greater than 400 scfm and/or greater than 500 scfm and/or greater than 600 scfm and/or greater than 700 scfm and/or greater than 800 scfm and/or to about 1500 scfm and/or to about 1400 scfm and/or to about 1300 scfm and/or to about 1200 scfm and/or to about 1100 scfm and/or to about 1000 scfm; and b. a structuring layer comprising a seam wherein the seam comprises at least one seam portion that is associated with the woven support layer such that the at least one seam portion of the structuring layer extends into, but less than entirely through the woven support layer, is provided.

In another example of the present invention, a web material structuring belt comprising:

a. a non-batted support layer; and b. a structuring layer comprising a seam wherein the seam comprises at least one seam portion that is associated with the non-batted support layer, for example wherein the at least one seam portion is associated with the non-batted support layer such that the at least one seam portion of the structuring layer extends into, but less than entirely through the non-batted support layer, is provided.

In another example of the present invention, a web material structuring belt comprising:

a. a non-felt support layer; and b. a structuring layer comprising a seam wherein the seam comprises at least one seam portion that is associated with the non-felt support layer such that the at least one seam portion of the structuring layer extends into, but less than entirely through the non-felt support layer, is provided.

In one example of the present invention, a web material structuring belt comprising:

a. a support layer, for example 1) a support layer that exhibits an air perm of greater than 400 scfm and/or greater than 500 scfm and/or greater than 600 scfm and/or greater than 700 scfm and/or greater than 800 scfm and/or to about 1500 scfm and/or to about 1400 scfm and/or to about 1300 scfm and/or to about 1200 scfm and/or to about 1100 scfm and/or to about 1000 scfm and/or 2) a non-batted support layer, for example a non-felt support layer, for example a woven support layer; and b. a structuring layer;

wherein the support layer comprises a seam comprising at least one seam portion that is associated with the structuring layer, for example wherein the at least one seam portion of the support layer is associated with the structuring layer such that the at least one seam portion of the support layer extends into, but less than entirely through the structuring layer, is provided.

In another example of the present invention, a web material structuring belt comprising:

a. a support layer that exhibits an air perm of greater than 400 scfm and/or greater than 500 scfm and/or greater than 600 scfm and/or greater than 700 scfm and/or greater than 800 scfm and/or to about 1500 scfm and/or to about 1400 scfm and/or to about 1300 scfm and/or to about 1200 scfm and/or to about 1100 scfm and/or to about 1000 scfm; and b. a structuring layer;

wherein the support layer comprises a seam comprising at least one seam portion that is associated with the structuring layer such that the at least one seam portion of the support layer extends into, but less than entirely through the structuring layer, is provided.

In another example of the present invention, a web material structuring belt comprising:

a. a woven support layer; and b. a structuring layer;

wherein the woven support layer comprises a seam comprising at least one seam portion that is associated with the structuring layer such that the at least one seam portion of the woven support layer extends into, but less than entirely through the structuring layer, is provided.

In another example of the present invention, a web material structuring belt comprising:

a. a woven support layer, for example a fabric support layer, that exhibits an air perm of greater than 50 scfm and/or greater than 100 scfm and/or greater than 150 scfm and/or greater than 200 scfm and/or greater than 250 scfm and/or greater than 300 scfm and/or greater than 400 scfm and/or greater than 500 scfm and/or greater than 600 scfm and/or greater than 700 scfm and/or greater than 800 scfm and/or to about 1500 scfm and/or to about 1400 scfm and/or to about 1300 scfm and/or to about 1200 scfm and/or to about 1100 scfm and/or to about 1000 scfm; and b. a structuring layer;

wherein the woven support layer comprises a seam comprising at least one seam portion that is associated with the structuring layer such that the at least one seam portion of the woven support layer extends into, but less than entirely through the structuring layer, is provided.

In another example of the present invention, a web material structuring belt comprising:

a. a non-batted support layer; and b. a structuring layer;

wherein the non-batted support layer comprises a seam comprising at least one seam portion that is associated with the structuring layer such that the at least one seam portion of the non-batted support layer extends into, but less than entirely through the structuring layer, is provided.

In another example of the present invention, a web material structuring belt comprising:

a. a non-felt support layer; and b. a structuring layer;

wherein the non-felt support layer comprises a seam comprising at least one seam portion that is associated with the structuring layer such that the at least one seam portion of the non-felt support layer extends into, but less than entirely through the structuring layer, is provided.

In another example of the present invention, a web material structuring belt comprising:

a. a support layer; and b. a structuring layer comprising a seam wherein the seam comprises at least one seam portion that is associated with the support layer, wherein the at least one seam portion comprises one or more fibrous elements that are associated with the support layer, is provided.

In another example of the present invention, a web material structuring belt comprising:

a. a support layer; and b. a structuring layer comprising a seam wherein the seam comprises at least one seam portion that is associated with the support layer, wherein the at least one seam portion comprises a woven material that is associated with the support layer, is provided.

In another example of the present invention, a method for making a web material structuring belt comprises the steps of:

a. providing a support layer according to the present invention;

b. providing a structuring layer comprising a seam wherein the seam comprises at least one seam portion according to the present invention;

c. associating the at least one seam portion of the structuring layer with the support layer such that a web material structuring belt is formed, is provided.

In another example of the present invention, a method for making a web material structuring belt comprises the steps of:

a. providing a support layer according to the present invention;

b. providing a structuring layer comprising a seam wherein the seam comprises at least one seam portion according to the present invention;

c. associating the at least one seam portion of the structuring layer with the support layer such that a web material structuring belt comprising the at least one seam portion of the structuring layer that extends into, but less than entirely through the support layer is formed, is provided.

In another example of the present invention, a method for making a web material structuring belt comprises the steps of:

a. providing a support layer comprising a seam wherein the seam comprises at least one seam portion according to the present invention;

b. providing a structuring layer according to the present invention;

c. associating the at least one seam portion of the support layer with the structuring layer such that a web material structuring belt comprising the at least one seam portion of the support layer that extends into, but less than entirely through the structuring layer is formed, is provided.

In another example of the present invention, a method for making a web material structuring belt comprises the steps of:

a. providing a support layer according to the present invention;

b. forming a structuring layer comprising a seam wherein the seam comprises at least one seam portion according to the present invention on at least one surface of the support layer such that the at least one seam portion of the structuring layer is associated with the support layer forming a web material structuring belt, is provided.

In another example of the present invention, a method for making a web material structuring belt comprises the steps of:

a. providing a support layer according to the present invention;

b. forming a structuring layer comprising a seam wherein the seam comprises at least one seam portion according to the present invention on at least one surface of the support layer such that a web material structuring belt comprising the at least one seam portion of the structuring layer that extends into, but less than entirely through the support layer is formed, is provided.

In another example of the present invention, a method for making a web material structuring belt comprises the steps of:

a. providing a structuring layer according to the present invention;

b. forming a support layer comprising a seam wherein the seam comprises at least one seam portion according to the present invention on at least one surface of the structuring layer such that the at least one seam portion of the support layer is associated with the structuring layer forming a web material structuring belt, is provided.

In another example of the present invention, a method for making a web material structuring belt comprises the steps of:

a. providing a structuring layer according to the present invention;

b. forming a support layer comprising a seam wherein the seam comprise at least one seam portion according to the present invention on at least one surface of the support layer such that a web material structuring belt comprising the at least one seam portion of the a support layer that extends into, but less than entirely through the structuring layer is formed, is provided.

In even another example of the present invention, a method for making a fibrous structure, for example a structured web material, the method comprising the step of imparting structure to a web material using a web material structuring belt according to the present invention, is provided.

In another example of the present invention, a fibrous structure, for example a structured web material made by a method of the present invention, is provided.

In yet another example of the present invention, a method for making a web material structuring belt, the method comprising the steps of:

a. providing a support layer;
b. providing a structuring layer comprising a seam; and
c. associating the seam of the structuring layer with the support layer to form a web material structuring belt, is provided.

In even still another example of the present invention, a method for making a web material structuring belt, the method comprising the steps of:

a. providing a support layer comprising a seam;
b. providing a structuring layer; and
c. associating the seam of the support layer with the structuring layer to form a web material structuring belt, is provided.

In still another example of the present invention, a method for making a web material structuring belt, the method comprising the steps of:

a. providing a support layer comprising a seam;
b. providing a structuring layer comprising a seam; and
c. associating the seam of the support layer with the structuring layer and the seam of the structuring layer with the support layer to form a web material structuring belt, is provided.

In another example of the present invention, a method for making a web material structuring belt, the method comprising the steps of:

a. providing a support layer;
b. providing a structuring layer comprising a seam;
c. providing an associating layer;
d. associating the seam of the structuring layer with the associating layer; and
e. associating the support layer with the associating layer such that the associating layer is present between the support layer and the structuring layer to form a web material structuring belt, is provided.

In still another example of the present invention, a method for making a web material structuring belt, the method comprising the steps of:

a. providing a support layer comprising a seam;
b. providing a structuring layer;
c. providing an associating layer;
d. associating the seam of the support layer with the associating layer; and
e. associating the structuring layer with the associating layer such that the associating layer is present between the support layer and the structuring layer to form a web material structuring belt, is provided.

In yet another example of the present invention, a method for making a web material structuring belt, the method comprising the steps of:

a. providing a support layer comprising a seam;
b. providing a structuring layer comprising a seam;
c. providing an associating layer;
d. associating the seam of the support layer with the associating layer; and
e. associating the seam of the structuring layer with the associating layer such that the associating layer is present between the support layer and the structuring layer to form a web material structuring belt, is provided.

In yet another example of the present invention, a method for making a web material, for example a structured web material, the method comprising the step of depositing web material components, for example fibrous elements, such as fibers and/or filaments, and/or film-making components, onto a web material structuring belt according to the present invention such that a web material, for example a structured web material, is formed, is provided.

In still yet another example of the present invention, a method for making a fibrous structure, for example a structured fibrous structure, the method comprising the step of depositing a plurality of fibrous elements, for example fibers and/or filaments, onto a web material structuring belt according to the present invention such that a fibrous structure, for example a structured fibrous structure, is formed, is provided.

In even yet another example of the present invention, a method for making a wet laid fibrous structure, for example a structured wet laid fibrous structure, the method comprising the step of depositing a plurality of pulp fibers, for example wood pulp fibers, onto a web material structuring belt according to the present invention such that a wet laid fibrous structure, for example a structured wet laid fibrous structure, is formed, is provided.

In even still another example of the present invention, a method for making a film, for example a structured film, the method comprising the step of depositing a film-forming material onto a web material structuring belt according to the present invention such that a film, for example a structured film, is formed, is provided.

In another example of the present invention, a web material, for example a structured web material, for example a structured fibrous structure, such as a structured wet laid fibrous structure, for example a structured sanitary tissue product, formed according to a method of the present invention, is provided.

In another example of the present invention, a film, for example a structured film, formed according to a method of the present invention, is provided.

Accordingly, the present invention provides novel seam-containing web material structuring belts, methods for making such seam-containing web material structuring belts, methods for making web materials, for example, structured web materials, for example structured fibrous structures, such as structured wet laid fibrous structures, such as structured sanitary tissue products, and web materials, for example structured web materials, for example structured fibrous structures, such as structured wet laid fibrous structures, such as structured sanitary tissue products made using the novel web material structuring belts and methods.

DETAILED DESCRIPTION OF THE INVENTION

Definitions

Figure 1:
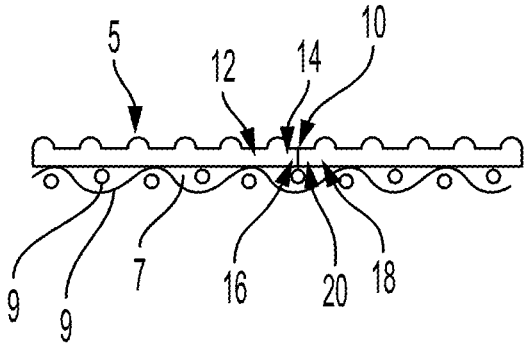
FIG. 1 PRIOR ART
FIG. 1 is a cross-sectional view of an example of a prior art structuring papermaking belt similar to the prior art structuring papermaking belt shown in U.S. Pat. No. 10,208,426.
Figure 2A:
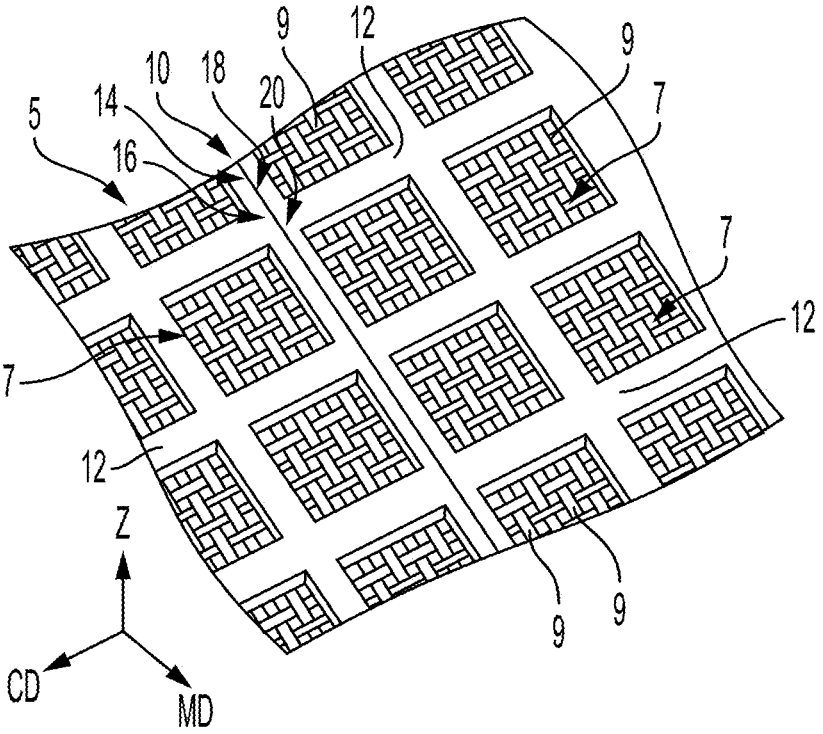
FIG. 2A PRIOR ART
FIG. 2A is a top plan view of an example of a prior art structuring papermaking belt similar to the prior art structuring papermaking belt shown in U.S. Pat. No. 10,584,444.
Figure 2B:
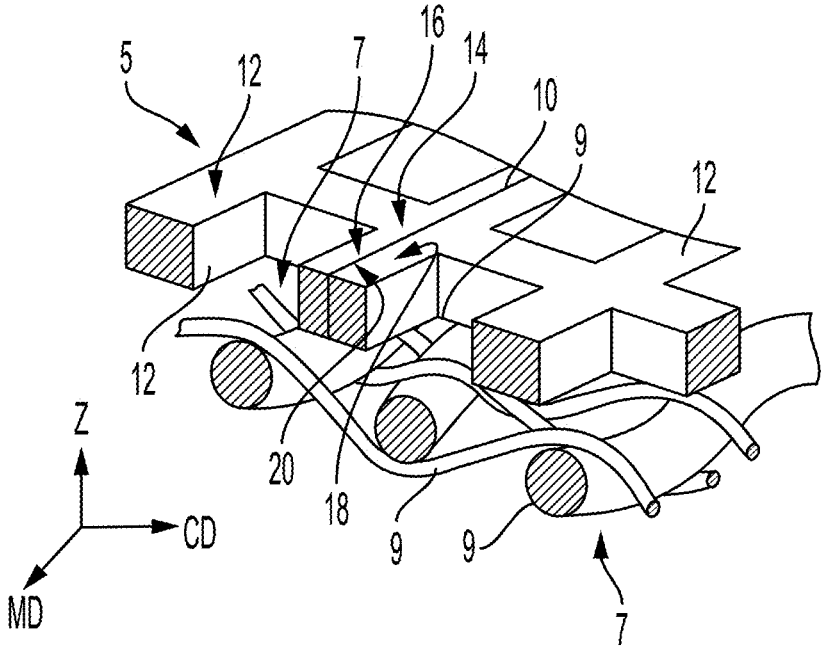
FIG. 2B PRIOR ART
FIG. 2B is a detailed perspective view of the prior art structuring papermaking belt of FIG. 2A.
Figure 3A:
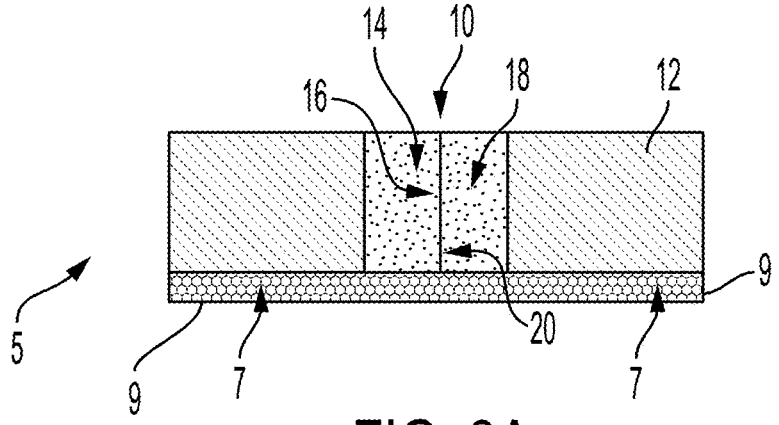
FIG. 3A PRIOR ART
FIG. 3A is a cross-sectional view of a portion of an example of a prior art structuring papermaking belt similar to the prior art structuring papermaking belt shown in U.S. Pat. No. 10,731,301.
Figure 3B:
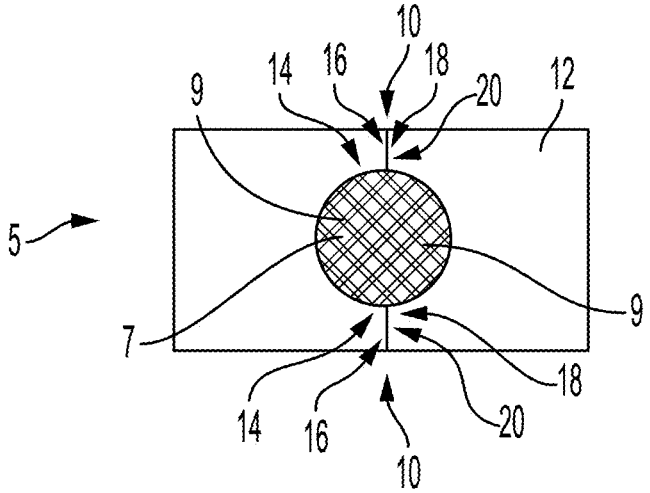
FIG. 3B PRIOR ART
FIG. 3B is a top view of the portion of FIG. 3A.

"Extends into, but less than entirely through" as used herein with respect to a first material, such as a structuring layer material (for example a portion, which may be a seam and/or seam portion), a support layer material (for example a portion, which may be a seam and/or seam portion), an associating layer material (for example a portion, which may be a seam and/or seam portion), a bonding material, extending into a second material, such as a structuring layer material (for example a portion, which may be a seam and/or seam portion), a support layer material (for example a portion, which may be a seam and/or seam portion), an associating layer material (for example a portion, which may be a seam and/or seam portion), a bonding material, and/or the second material extending into the first material means that the first material extends into the second material and/or the second material extends into the first material 1) greater than 30 μm and/or greater than 40 μm and/or greater than 50 μm and/or greater than 100 μm and/or to less than 5000 μm and/or to less than 4000 μm and/or to less than 3000 μm and/or to less than 2000 μm and/or 2) greater than the thickness of at least one individual component, for example at least one yarn, at least one thread and/or at least one filament, that at least partially defines an upper layer and/or upper surface for example at least one filament that forms at least a part of a surface of the first material and/or second material associated with the other material, for example greater than 50 μm and/or greater than 75 μm and/or greater than 100 μm and/or greater than 150 μm and/or greater than 200 μm and/or greater than 300 μm and/or greater than 400 μm and/or greater than 500 μm and/or greater than 600 μm and/or to less than 5000 μm and/or to less than 4000 μm and/or to less than 3000 μm and/or to less than 2000 μm, and/or 3) greater than 5% and/or greater than 10% and/or greater than 20% and/or greater than 30% and/or greater than 40% and/or to less than 95% and/or to less than 90% and/or to less than 80% and/or to less than 70% and/or to less than 60% of the thickness (z-direction thickness) of the first material and/or second material, and/or 4) past the upper surface and/or upper surface plane of the first material and/or second material, and/or more than 50% and/or greater than 75% and/or greater than 100% of the thickness of individual components, for example yarns, threads and/or filaments, that define an upper layer and/or an upper surface of the first material and/or second material, and/or 5) such that at least a portion of the first material and/or second material envelopes and/or wraps one or more individual components, for example yarns, threads and/or filaments, that define the upper layer and/or upper surface of the other material, but less than entirely through the other material and/or other layer However, in one example, a first material, such as a structuring layer material (for example a portion, which may be a seam and/or seam portion), a support layer material (for example a portion, which may be a seam and/or seam portion), an associating layer material (for example a portion, which may be a seam and/or seam portion), a bonding material, extending into a second material, such as a structuring layer material (for example a portion, which may be a seam and/or seam portion), a support layer material (for example a portion, which may be a seam and/or seam portion), an associating layer material (for example a portion, which may be a seam and/or seam portion), a bonding material, and/or the second material extending into and entirely through the first material means that the first material extends into and entirely through the second material and/or the second material extends into and through the first material "Seam" for example a "material seam" such as a "structuring layer material seam" and/or a "support layer material seam" as used herein means a junction defined by the termini (ends) of two or more opposing edges of one or more materials. Non-limiting examples of junctions are defined by 1) the termini (ends) of two or more opposing edges of one or more materials abutting each other such that the junction is defined as the abutment (referred to herein as "an abut seam" or "an abut material seam"), and/or 2) the termini (ends) of two or more opposing edges of one or more materials create a gap, which is void of material, between the termini such that the junction is defined across the gap, for example the void (referred to herein as "a gap seam" or "a gap material seam") and/or 3) the termini (ends) of two or more opposing edges of one or more materials overlapping physically (in contact with one another) in the z-direction (for example one termini is spatially distanced in the z-direction from another termini) and/or spatially in the x-y direction (for example such that the junction is defined between the termini of the two or more most distanced opposing edges of the one or more materials (both referred to herein as "an overlap seam" or "an overlap material seam" wherein the material may be a structuring layer material and/or a support layer material and/or an associating layer material and/or a bonding material).

Figure 4:
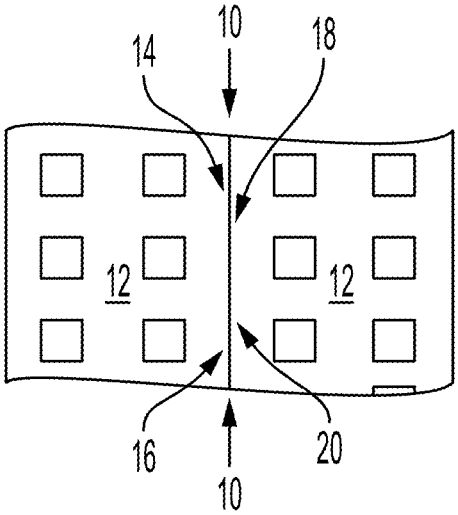
FIG. 4 is a schematic top view of an example of an abut seam according to the present invention.

FIG. 4 illustrates one example of a seam 10, in this case a structuring layer material seam. The seam 10 shown in FIG. 4 is an abut seam, in this case an abut structuring layer material seam comprising a structuring layer material 12 that forms a structuring layer, wherein the structuring layer material 12 comprises a first structuring layer material seam portion 14 having a first terminus 16 and a second structuring layer material edge 18 having a second terminus 20, where the first terminus 16 abuts the second terminus 20 to form an abut structuring layer material seam (the junction). In one example, the structuring layer material 12 is the same for both structuring layer material edges 14, 18, which are seam portions. In another example, the structuring layer material 12 is different for the first structuring layer material edge 14 and the second structuring layer material edge 18.

Figure 5:
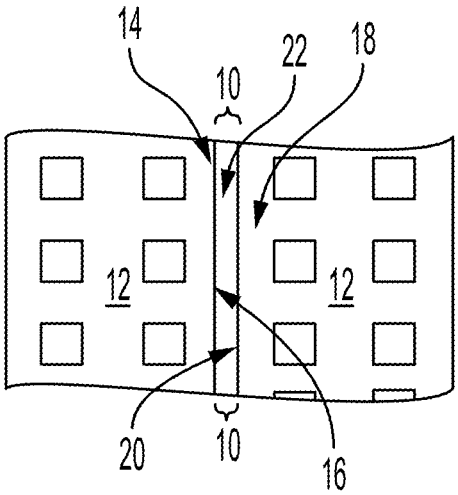
FIG. 5 is a schematic top view of an example of a gap seam according to the present invention.

FIG. 5 illustrates another example of a seam 10, in this case a structuring layer material seam. The seam 10 shown in FIG. 5 is a gap seam, in this case a gap structuring layer material seam comprising a structuring layer material 12 that forms a structuring layer, wherein the structuring layer material 12 comprises a first structuring layer material edge 14 having a first terminus 16 and a second structuring layer material edge 18 having a second terminus 20, where the first terminus 16 and the second terminus 20 create a gap 22 (a void of the structuring layer material 12) between the first and second termini 16, 20 such that a gap structuring layer material seam (the junction) is defined across the gap 22 (void). In one example, the structuring layer material 12 is the same for both structuring layer material edges 14, 18, which are seam portions. In another example, the structuring layer material 12 is different for the first structuring layer material edge 14 and the second structuring layer material edge 18.

Figure 6A:
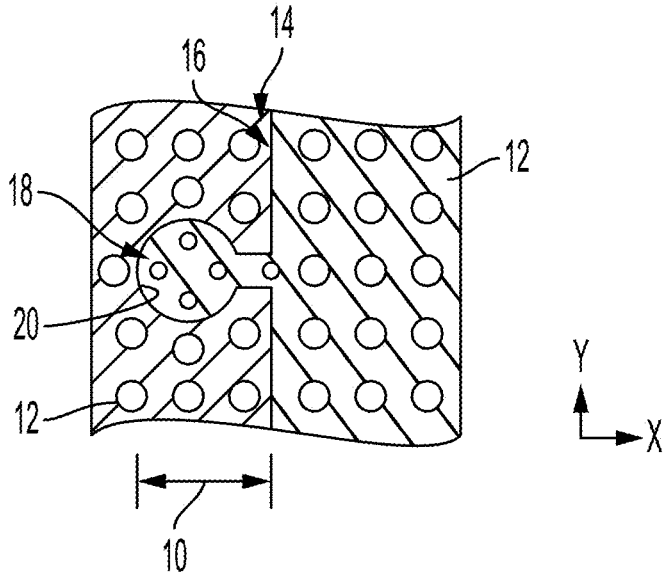
FIG. 6A is a schematic top view of an example of an abut overlap x-y interlocking seam according to the present invention.
Figure 6B:
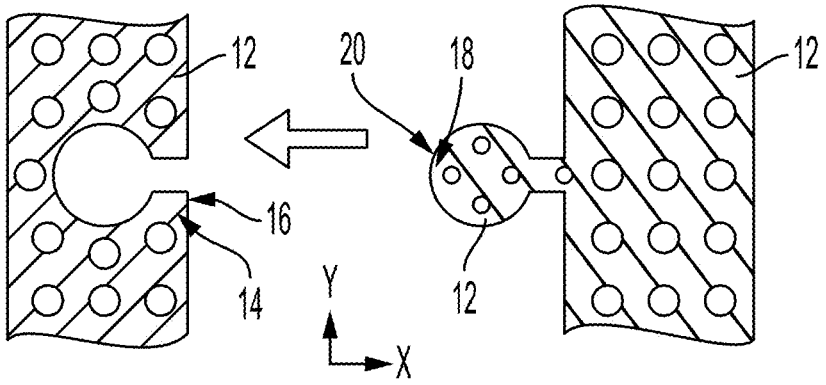
FIG. 6B is a schematic top view of the abut overlap x-y interlocking seam of FIG. 6A prior to forming of the seam.

FIGS. 6A and 6B illustrates another example of a seam 10, in this case a structuring layer material seam. The seam 10 shown in FIG. 6A is an overlap seam, in this case an overlap structuring layer material x-y interlocking seam comprising a structuring layer material 12 that forms a structuring layer, wherein the structuring layer material 12 comprises a first structuring layer material edge 14 having a first terminus 16 and a second structuring layer material edge 18 comprising a second terminus 20, where the first terminus 16 and the second terminus 20 create portions of the structuring layer material 12 that overlap in this case in a x-y interlocking configuration such that an overlap structuring layer material x-y interlocking seam (the junction) is defined by the overlap, which in this case is forms an abut spatial overlap structuring layer material seam. In one example, the structuring layer material 12 is the same for both structuring layer material edges 14, 18, which are seam portions. In another example, the structuring layer material 12 is different for the first structuring layer material edge 14 and the second structuring layer material edge 18.

Figure 7A:
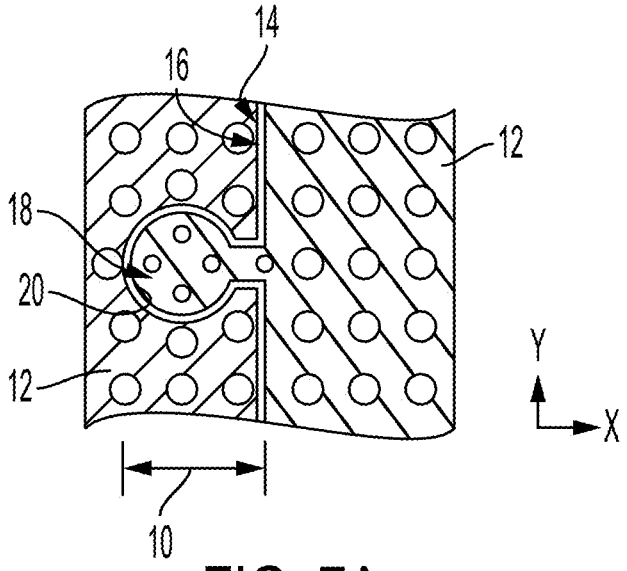
FIG. 7A is a schematic top view of an example of a gap overlap x-y interlocking seam according to the present invention.
Figure 7B:
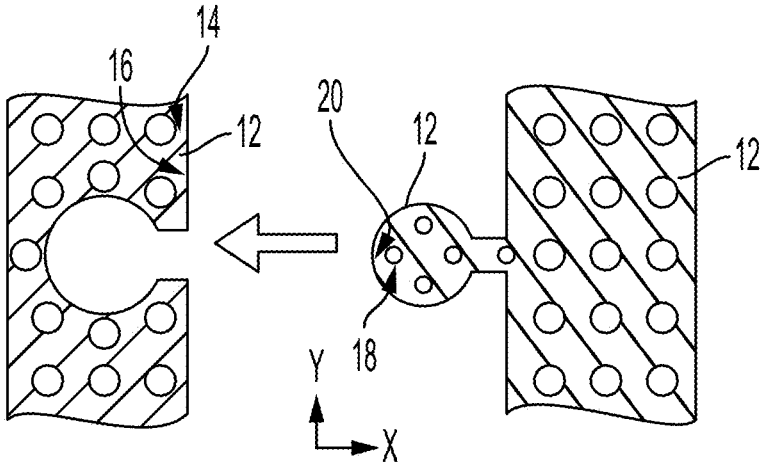
FIG. 7B is a schematic top view of the gap overlap x-y interlocking seam of FIG. 7A prior to forming of the seam.

FIGS. 7A and 7B illustrates another example of a seam 10, in this case a structuring layer material seam. The seam 10 shown in FIG. 7A is an overlap seam, in this case an overlap structuring layer material x-y interlocking seam comprising a structuring layer material 12 that forms a structuring layer, wherein the structuring layer material 12 comprises a first structuring layer material edge 14 having a first terminus 16 and a second structuring layer material edge 18 comprising a second terminus 20, where the first terminus 16 and the second terminus 20 create portions of the structuring layer material 12 that overlap in this case in a x-y interlocking configuration such that an overlap structuring layer material x-y interlocking seam (the junction) is defined by the overlap, which in this case is forms a gap spatial overlap structuring layer material seam. In one example, the structuring layer material 12 is the same for both structuring layer material edges 14, 18, which are seam portions. In another example, the structuring layer material 12 is different for the first structuring layer material edge 14 and the second structuring layer material edge 18.

Figure 8A:
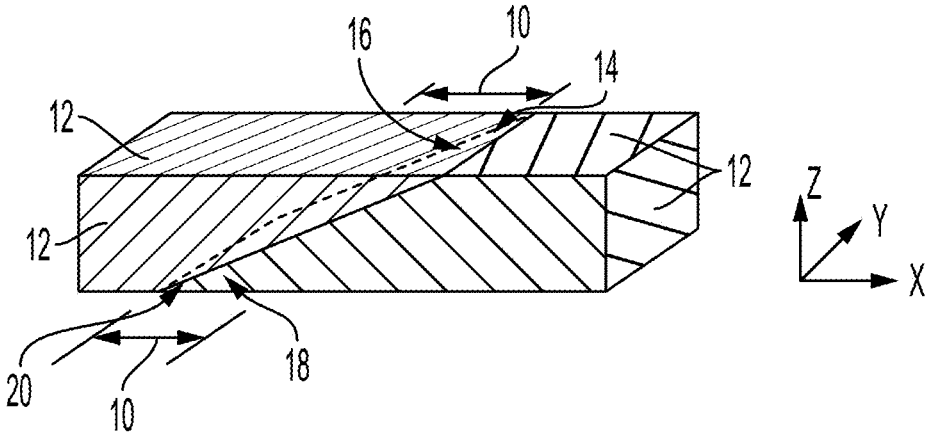
FIG. 8A is a schematic perspective view of an example of an overlap z interlocking seam according to the present invention.
Figure 8B:
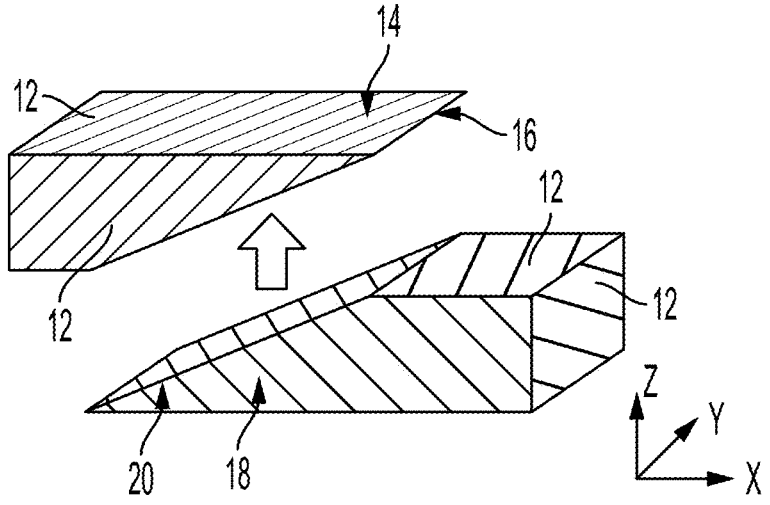
FIG. 8B is a schematic perspective view of the overlap z interlocking seam of FIG. 8A prior to forming of the seam.

FIGS. 8A and 8B illustrates another example of a seam 10, in this case a structuring layer material seam. The seam 10 shown in FIG. 8A is an overlap seam, in this case an overlap structuring layer material z interlocking seam comprising a structuring layer material 12 that forms a structuring layer, wherein the structuring layer material 12 comprises a first structuring layer material edge 14 having a first terminus 16 and a second structuring layer material edge 18 comprising a second terminus 20, where the first terminus 16 and the second terminus 20 create portions of the structuring layer material 12 that overlap in this case in a z interlocking configuration such that an overlap structuring layer material z interlocking seam (the junction) is defined by the overlap. In one example, the structuring layer material 12 is the same for both structuring layer material edges 14, 18, which are seam portions. In another example, the structuring layer material 12 is different for the first structuring layer material edge 14 and the second structuring layer material edge 18.

Figure 9A:
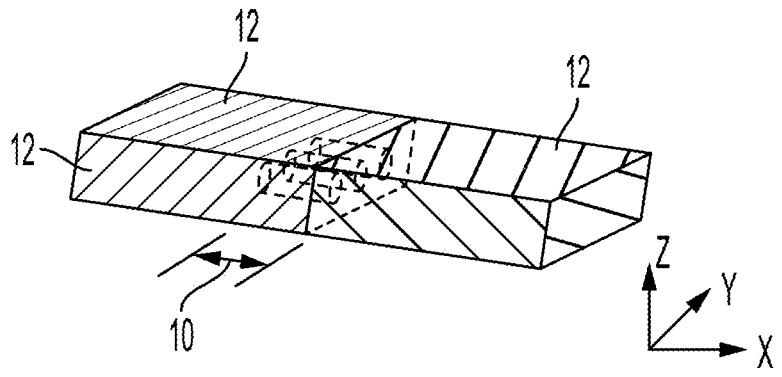
FIG. 9A is a schematic perspective view of an example of an overlap x-y and z interlocking seam according to the present invention.
Figure 9B:
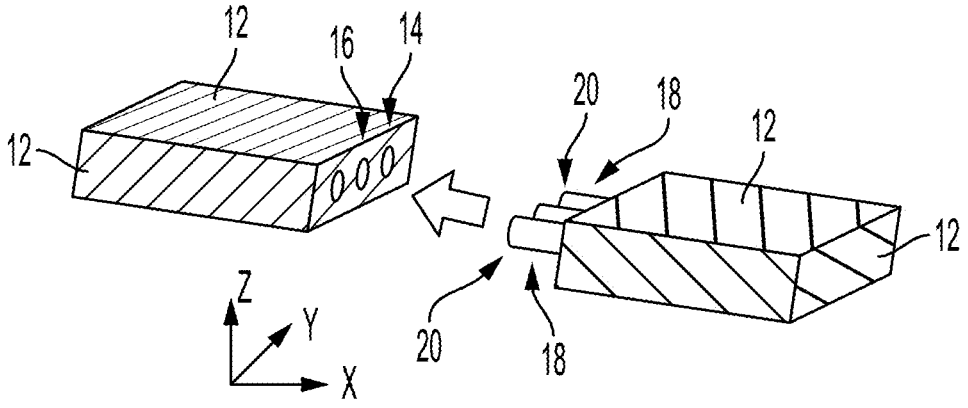
FIG. 9B is a schematic perspective view of the overlap x-y and z interlocking seam of FIG. 9A prior to forming of the seam.

FIGS. 9A and 9B illustrates another example of a seam 10, in this case a structuring layer material seam. The seam 10 shown in FIG. 9A is an overlap seam, in this case an overlap structuring layer material combination x-y and z interlocking seam comprising a structuring layer material 12 that forms a structuring layer, wherein the structuring layer material 12 comprises a first structuring layer material edge 14 having a first terminus 16 and a second structuring layer material edge 18 comprising a second terminus 20, where the first terminus 16 and the second terminus 20 create portions of the structuring layer material 12 that overlap in this case in a combined x-y and z interlocking configuration such that an overlap structuring layer material combined x-y and z interlocking seam (the junction) is defined by the overlap. In one example, the structuring layer material 12 is the same for both structuring layer material edges 14, 18, which are seam portions. In another example, the structuring layer material 12 is different for the first structuring layer material edge 14 and the second structuring layer material edge 18.

Figure 10A:
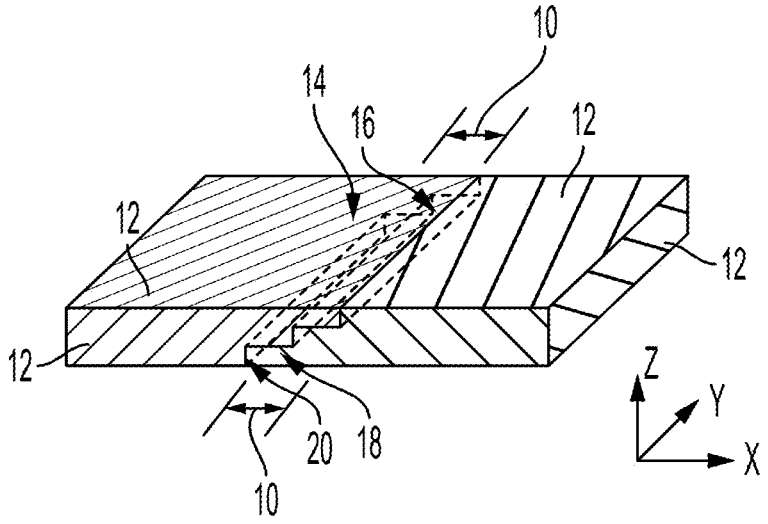
FIG. 10A is a schematic perspective view of an example of an overlap z interlocking seam according to the present invention.
Figure 10B:
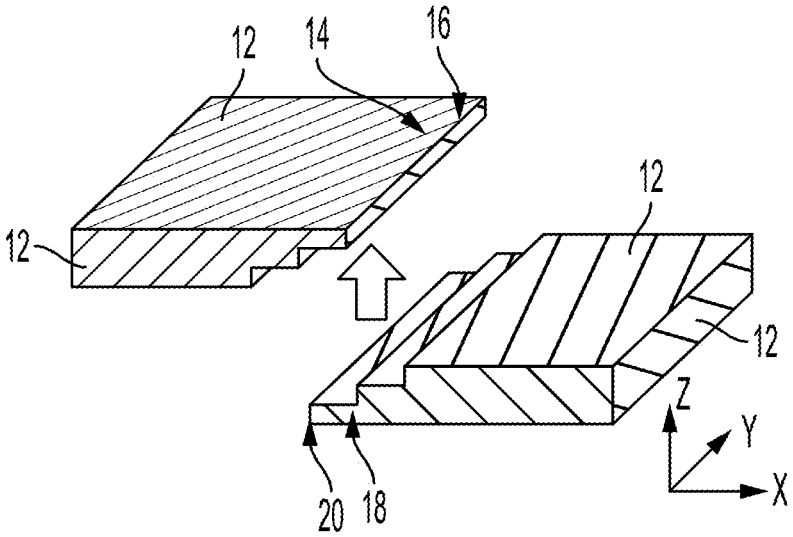
FIG. 10B is a schematic perspective view of the overlap z interlocking seam of FIG. 10A prior to forming of the seam.

FIGS. 10A and 10B illustrates another example of a seam 10, in this case a structuring layer material seam. The seam 10 shown in FIG. 10A is an overlap seam, in this case an overlap structuring layer material z interlocking seam comprising a structuring layer material 12 that forms a structuring layer, wherein the structuring layer material 12 comprises a first structuring layer material edge 14 having a first terminus 16 and a second structuring layer material edge 18 comprising a second terminus 20, where the first terminus 16 and the second terminus 20 create portions of the structuring layer material 12 that overlap in this case a z interlocking configuration such that an overlap structuring layer material z interlocking seam (the junction) is defined by the overlap. In one example, the structuring layer material 12 is the same for both structuring layer material edges 14, 18, which are seam portions. In another example, the structuring layer material 12 is different for the first structuring layer material edge 14 and the second structuring layer material edge 18.

Figure 11A:
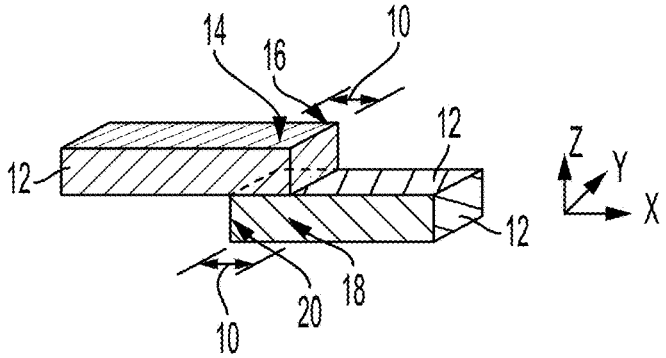
FIG. 11A is a schematic perspective view of an example of an overlap z interlocking seam according to the present invention.
Figure 11B:
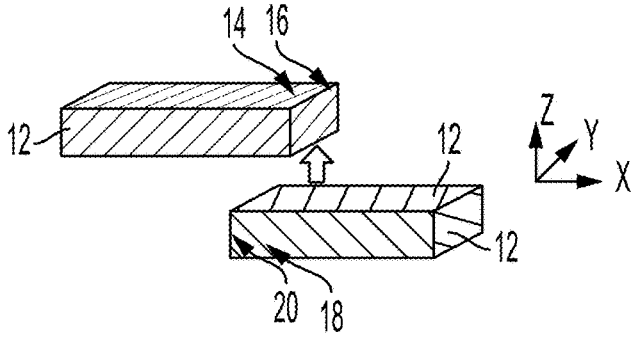
FIG. 11B is a schematic perspective view of the overlap z interlocking seam of FIG. 11A prior to forming of the seam.

FIGS. 11A and 11B illustrates another example of a seam 10, in this case a structuring layer material seam. The seam 10 shown in FIG. 11A is an overlap seam, in this case an overlap structuring layer material z interlocking seam comprising a structuring layer material 12 that forms a structuring layer, wherein the structuring layer material 12 comprises a first structuring layer material edge 14 having a first terminus 16 and a second structuring layer material edge 18 comprising a second terminus 20, where the first terminus 16 and the second terminus 20 create portions of the structuring layer material 12 that overlap in this case a z interlocking configuration such that an overlap structuring layer material z interlocking seam (the junction) is defined by the overlap. In one example, the structuring layer material 12 is the same for both structuring layer material edges 14, 18, which are seam portions. In another example, the structuring layer material 12 is different for the first structuring layer material edge 14 and the second structuring layer material edge 18.

Figure 12:
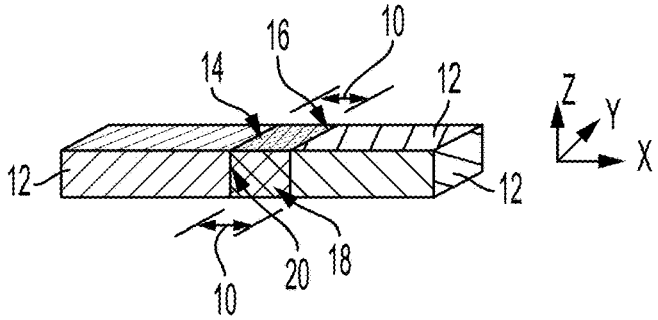
FIG. 12 is a schematic perspective view of an example of an overlap z interlocking seam according to the present invention.

FIG. 12 illustrates another example of a seam 10, in this case a structuring layer material seam. The seam 10 shown in FIG. 12 is an overlap seam, in this case an overlap structuring layer material z interlocking seam comprising a structuring layer material 12 that forms a structuring layer, wherein the structuring layer material 12 comprises a first structuring layer material edge 14 having a first terminus 16 and a second structuring layer material edge 18 comprising a second terminus 20, where the first terminus 16 and the second terminus 20 create portions of the structuring layer material 12 that overlap in this case a z interlocking configuration such that an overlap structuring layer material z interlocking seam (the junction) is defined by the overlap. The seam 10 results from the combination of the materials of the first structuring layer material edge 14, which is a seam portion, and the second structuring layer material edge 18, which is a seam portion, for example such that a new region/zone of the structuring layer material 12 different from at least one other region/zone of the structuring layer material 12 is formed. In one example, the structuring layer material 12 is the same for both structuring layer material edges 14, 18. In another example, the structuring layer material 12 is different for the first structuring layer material edge 14 and the second structuring layer material edge 18.

Figure 13:
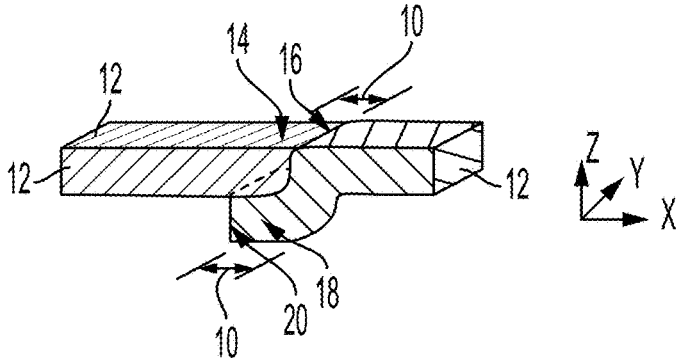
FIG. 13 is a schematic perspective view of an example of an overlap z interlocking seam according to the present invention.

FIG. 13 illustrates another example of a seam 10, in this case a structuring layer material seam. The seam 10 shown in FIG. 13 is an overlap seam, in this case an overlap structuring layer material z interlocking seam comprising a structuring layer material 12 that forms a structuring layer, wherein the structuring layer material 12 comprises a first structuring layer material edge 14 having a first terminus 16 and a second structuring layer material edge 18 comprising a second terminus 20, where the first terminus 16 and the second terminus 20 create portions of the structuring layer material 12 that overlap in this case a z interlocking configuration such that an overlap structuring layer material z interlocking seam (the junction) is defined by the overlap. The seam 10 in this example results from the displacement in the z direction of the material of the second structuring layer material edge 18, which is a seam portion, by the first structuring layer material edge 14, which is a seam portion. In one example, the structuring layer material 12 is the same for both structuring layer material edges 14, 18. In another example, the structuring layer material 12 is different for the first structuring layer material edge 14 and the second structuring layer material edge 18.

Even though the various seams described above in FIGS. 4-13 have been shown and described with reference to a structuring layer material of a structuring layer, the various seams of FIGS. 4-13 may be present in other layer materials, for example in a support layer material of a support layer and/or an associating layer material of an associating layer and/or even in a bonding material.

As described above a seam in a material, for example a structuring layer material, a support layer material, an associating material and/or a bonding material, may comprise one or more types of termini junctions (overlapping, abutting and/or gap) such that the seam may comprise two or more seam components selected from the group consisting of: overlap seams, abut seams, and gap seams.

An overlap seam exhibits a measurable width and may have a variable width along the length of the overlap seam.

A gap seam exhibits a measurable width and may have a variable width along the length of the gap seam.

An abut seam does not exhibit a measurable width and may be and/or is constant along the length of the abut seam.

"Overlap x-y interlocking seam", for example an "overlap structuring layer material x-y interlocking seam" as used herein means that the two or more opposing material edges, for example two or more opposing structuring layer material ends, of one or more materials of an overlap structuring layer material seam overlap spatially in the x-y direction (for example the MD-CD plane) of the structuring layer material and/or the web material structuring belt comprising the structuring layer material. In one example, the overlap structuring layer material x-y interlocking seam comprises an abut spatial overlap structuring layer material seam as shown in FIG. 6A. In one example, the overlap structuring layer material x-y interlocking seam comprises a gap spatial overlap structuring layer material seam as shown in FIG. 7A.

"Overlap z interlocking seam" for example an "overlap structuring layer material z interlocking seam" as used herein means that the two or more opposing material edges, for example two or more opposing structuring layer material ends, of one or more structuring layer materials of an overlap structuring layer material seam overlap physically in the z direction of the structuring layer material and/or the web material structuring belt comprising the structuring layer material as shown in FIGS. 8A, 10A, 11A, 12 and 13. In one example, the overlap structuring layer material z interlocking seam comprises an overlap physical overlap structuring layer material seam such as a stepwise lock-and-key arrangement and/or a tapered/wedge lock and key arrangement and/or a simple material to material overlap arrangement.

In one example, an overlap material seam may comprise a combination of an overlap material x-y interlocking seam and an overlap material z interlocking seam as shown in FIG. 9A.

"Web material" as used herein means a material comprising at least one planar surface. Web materials are typically flexible and oftentimes relatively thin. Non-limiting examples of web materials include fibrous structures, for example nonwoven fibrous structures, such as wet laid fibrous structures, for example wet laid fibrous structures comprising pulp fibers, such as sanitary tissue products, and/or synthetic polymer nonwovens, for example polyolefin, such as polypropylene and/or polyethylene, and/or polyester meltblown and/or spunbond nonwovens, woven fibrous structures, films, for example polymeric films, and metals.

"Structured web material" as used herein means a web material, for example a fibrous structure, such as a wet laid fibrous structure, for example a sanitary tissue product comprising at least one surface comprising a pattern, for example a three-dimensional (3D) pattern, such as a non-random 3D pattern, for example a non-random repeating 3D pattern, where the pattern is imprinted, for example mechanically imprinted, from a web material structuring belt, for example at least the structuring layer of the web material structuring belt, to the web material by rearranging fibrous elements of the web material to permanently relocate such fibrous elements resulting in the structured web material comprising the pattern. The step of imprinting the pattern into the web material may be assisted by a vacuum that helps to pull one or more portions of the web material into the web material structuring belt. For clarity, merely imparting texture to a surface of a web material without permanently imparting structure into the web material such that a structured web material according to the present invention is formed does not amount to structuring of the web material. In one example, the structured web material, for example the structured fibrous structure, such as the structured wet laid fibrous structure, for example the structured sanitary tissue product of the present invention may comprise one or more common intensive properties that differ in value. In one example, the structured web material of the present invention exhibits one or more common intensive properties that differ in value, for example two or more regions of the structured web material that exhibit different values of a common intensive property, for example density, basis weight, thickness, elevation and/or opacity. In one example, the structured web material of the present invention comprises a surface comprising substantially filled protrusions, which means the protrusions have some mass and thus are not holes or apertures, sometimes referred to as discrete pillows (protrusions), and connecting regions, for example depressions, which may be in the form of a continuous network region, disposed between the protrusions, sometimes referred to as a continuous knuckle (connecting region). In one example, the structured web material of the present invention comprises a surface comprising a substantially filled network protrusion, which means the network protrusion has some mass and thus is not a hole or aperture, sometimes referred to as a continuous pillow (network protrusion) that connects regions, for example discrete depressions, disposed within the network protrusion, sometimes referred to as discrete knuckles (discrete depressions). In another example, the structured web material comprises a surface comprising substantially filled semi-continuous protrusions, which means the semi-continuous protrusions have some mass and thus are not holes or apertures, sometimes referred to as semi-continuous pillows (protrusions), and semi-continuous regions, for example semi-continuous depressions, sometimes referred to as semi-continuous knuckles.

"Common Intensive Property" as used herein means an intensive property possessed by more than one region within a structured web material, for example a structured fibrous structure. Such intensive properties of the structured web material include, without limitation, density, basis weight, thickness, elevation, opacity and combinations thereof. For example, if density is a common intensive property of two or more different regions, a value of the density in one region can differ from a value of the density in one or more other regions. Regions (such as, for example, a first region and a second region and/or a continuous network region and at least one of a plurality of discrete zones) are identifiable areas visually discernible and/or visually distinguishable from one another by distinct intensive properties.

"Differential density", as used herein, means a structured web material, for example a structured fibrous structure, such as a structured wet laid fibrous structure, for example a structured sanitary tissue product that comprises one or more regions of relatively low fibrous element density, which are referred to as pillow regions, and one or more regions of relatively high fibrous element density, which are referred to as knuckle regions.

"Densified", as used herein means a portion of structured web material, for example a structured fibrous structure, such as a structured wet laid fibrous structure, for example a structured sanitary tissue product that is characterized by regions of relatively high fibrous element density (knuckle regions).

"Non-densified", as used herein, means a portion of a structured web material, for example a structured fibrous structure, such as a structured wet laid fibrous structure, for example a structured sanitary tissue product that exhibits a lesser density (one or more regions of relatively lower fibrous element density) (pillow regions) than another portion (for example a knuckle region) of the structured web material, for example a structured fibrous structure, such as the structured wet laid fibrous structure, for example the structured sanitary tissue product.

"Substantially continuous" or "continuous" region refers to an area within which one can connect any two points by an uninterrupted line running entirely within that area throughout the line's length. That is, the substantially continuous region has a substantial "continuity" in all directions parallel to a first plane, for example a surface of a web material and is terminated only at edges of that region. The term "substantially," in conjunction with continuous, is intended to indicate that while an absolute continuity is preferred, minor deviations from the absolute continuity may be tolerable as long as those deviations do not appreciably affect the performance of the structured web material, for example structured fibrous structure as designed and intended.

"Substantially semi-continuous" or "semi-continuous" region refers to an area which has "continuity" in at least one, but not all directions, parallel to a first plane, for example a surface of a web material, and are typically straight lines and/or curvilinear lines in the machine direction or cross-machine direction.

"Discontinuous" or "discrete" regions or zones refer to discrete, and separated from one another areas or zones that are discontinuous in all directions parallel to the first plane.

"Web material structuring belt" is a structural element that is used as a support for a web material and/or web material components during a web material making process, for example during a web material structuring operation within a web material making process, for example a structured web material making process to impart structure, for example a pattern, for example a 3D pattern, such as a non-random 3D pattern, for example a non-random repeating 3D pattern, to at least one surface of a web material, for example a fibrous structure, such as a wet laid fibrous structure, for example a sanitary tissue product, for example during a structured web material making operation and/or process. As used herein, the web material structuring belt of the present invention comprises at least two distinct layers of materials, for example a support layer and a structuring layer that have been associated with each other to form the web material structuring belt of the present invention. In one example, the web material structuring belt comprises a laminated web material structuring belt wherein laminated web material structuring belt means 1) one pre-formed/pre-existing solid material layer associated with at least one other pre-formed/pre-existing solid material layer, in one example, the association of a pre-formed/pre-existing structuring layer, such as plastic netting and/or an additive manufactured or 3D printed solid material layer, with a pre-formed/pre-existing support layer, such as a through-air-drying fabric, and/or 2) the association of a solid material layer formed directly on a surface of at least one pre-formed/pre-existing solid material layer, for example the extrusion of a fluid material, such as one or more polymer filaments, that when solidified form the solid material layer, for example a structuring layer on the pre-formed/pre-existing solid material layer, for example a support layer. Other non-limiting examples of forming a solid material layer directly on a surface of a pre-formed/pre-existing solid material layer include traditional coating processes, rotary printing, screen printing, droplet printing, piezoelectric printing, spray, roll coating, curtain coating, gravure printing, and additive manufacturing (e.g., 3-D printing). For purposes of the present invention, a cast and cure process where a fluid material is applied to a pre-formed/pre-existing solid material, for example a support layer, such that the fluid material penetrates entirely throughout the pre-formed/pre-existing solid material and the fluid material is then selectively cured to solidify resulting in a web material structuring belt, is expressly not within the scope of the present invention.

In one example, the web material structuring belt, for example a laminated web material structuring belt may be formed by associating a structuring layer, at least a portion of which if not the entirety of the structuring layer may be pre-formed/pre-existing prior to association with a pre-formed/pre-existing support layer and/or may be formed on a surface of the pre-formed/pre-existing support layer during the association process. In another example, the web material structuring belt, for example a laminated web material structuring belt may be formed by associating a support layer, at least a portion of which if not the entirety of the support layer may be pre-formed/pre-existing prior to association with a pre-formed/pre-existing structuring layer and/or may be formed on a surface of the pre-formed/pre-existing structuring layer during the association process.

"Layer" as used herein with respect a web material structuring belt, means a distinct, z-direction thickness portion of a web material structuring belt that forms a support layer that is different from another distinct, z-direction thickness portion of the web material structuring belt that forms the structuring layer. In one example, the support layer and structuring layer and optionally an associating layer of a web material structuring belt may be identified as layered according to their function; namely, the support layer exhibits at least a function of supporting the structuring layer and/or the structuring layer exhibits at least a function of imparting texture, for example structure, to a web material during a web material making process when the web material contacts at least the structuring layer of the web material structuring belt and/or the associating layer exhibit at least a function of associating at least two layers together, for example associating a support layer with a structuring layer to form the web material structuring belt. In one example a web material structuring belt of the present invention comprises two or more distinct, visually discernible layers in z-direction thickness cross-section. In one example, layers of a web material structuring belt, for example a support layer and/or structuring layer and/or associating layer may be identified based upon timing of making each layer. In one example, layers of a web material structuring belt, for example a support layer and/or structuring layer and/or associating layer may be identified based upon timing of making each layer.

In one example, a layer, for example a support layer and/or structuring layer and/or associating layer may comprise one or more, and/or two or more and/or three or more sub-layers that together form the layer.

"Fibrous structure" as used herein means a structure that comprises a plurality of fibrous elements, for example fibers and/or filaments. In one example, the fibrous structure comprises an orderly arrangement of fibrous elements within a structure in order to perform a function. In one example, the fibrous structure, for example a wet laid fibrous structure comprises a plurality of pulp fibers, for example wood pulp fibers. In another example, the fibrous structure, for example a co-formed fibrous structure comprises a mixture of pulp fibers and filaments, for example a commingled mixture of a plurality of pulp fibers and a plurality of filaments, for example meltblown and/or spunbond filaments. In even another example, the fibrous structure, for example a non-woven meltblown and/or spunbond fibrous structure comprises a plurality of inter-entangled filaments, for example inter-entangled meltblown and/or spunbond filaments, to form a plurality of pulp fibers. In one example, the fibrous structure may comprise a plurality of wood pulp fibers. In another example, the fibrous structure may comprise a plurality of non-wood pulp fibers, for example plant fibers, synthetic staple fibers, and mixtures thereof. In still another example, in addition to pulp fibers, the fibrous structure may comprise a plurality of filaments, such as polymeric filaments, for example thermoplastic filaments such as polyolefin filaments (i.e., polypropylene filaments) and/or hydroxyl polymer filaments, for example polyvinyl alcohol filaments and/or polysaccharide filaments such as starch filaments. Non-limiting examples of fibrous structures of the present invention include paper.

Non-limiting examples of processes for making fibrous structures include known wet laid papermaking processes, for example through-air-dried papermaking processes, and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet laid processes is oftentimes referred to as a fiber slurry. The fibrous slurry is then used to deposit a plurality of fibers onto a forming wire, fabric and/or belt, any of which may be a web material structuring belt according to the present invention, after which drying results in a structured fibrous structure. Further processing the structured fibrous structure may be carried out such that a finished structured fibrous structure is formed. For example, in typical papermaking processes, the finished structured fibrous structure is the structured fibrous structure that is wound on the reel at the end of papermaking, often referred to as a parent roll, and may subsequently be converted into a finished product, e.g. a single- or multi-ply structured sanitary tissue product.

The fibrous structures of the present invention may be homogeneous or may be layered. If layered, the fibrous structures may comprise at least two and/or at least three and/or at least four and/or at least five layers of fibrous elements (fiber and/or filament compositions). "Layer" as used herein with respect a web material, for example a fibrous structure means a distinct, z-direction thickness portion of a fibrous structure that comprises one fibrous element composition, for example hardwood pulp fibers, that is different from another distinct, z-direction thickness portion of the fibrous structure that comprises a different fibrous element composition, for example softwood pulp fibers. Such layered web materials and/or fibrous structures may, in addition to the two or more layers, comprise one or more transition zones between the layers where the fibrous elements of a first layer intermingle with fibrous elements of a second layer. In addition to identifying layers by different fibrous element compositions in the z-direction thickness of web material, for example fibrous structure, a web material may also be identified as layered according to the fibrous element supply, for example if two or more different fibrous element compositions are delivered to a stratified headbox such that the different fibrous element compositions are delivered from different chambers within the stratified headbox such that a layered web material, for example layered fibrous structure is formed.

In one example a layered fibrous structure comprises two or more distinct, visually discernible layers in its z-direction thickness cross-section.

In one example, the fibrous structure of the present invention consists essentially of fibers, for example pulp fibers, such as cellulosic pulp fibers and more particularly wood pulp fibers.

In another example, the fibrous structure of the present invention comprises fibers and is void of filaments.

In still another example, the fibrous structures of the present invention comprises filaments and fibers, such as a co-formed fibrous structure.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Fibrous element" as used herein means an elongate particulate having a length greatly exceeding its average diameter, i.e. a length to average diameter ratio of at least about 10. A fibrous element may be a filament or a fiber. In one example, the fibrous element is a single fibrous element rather than a yarn comprising a plurality of fibrous elements.

The fibrous elements of the present invention may be spun from polymer melt compositions via suitable spinning operations, such as meltblowing and/or spunbonding and/or they may be obtained from natural sources such as vegetative sources, for example trees.

The fibrous elements of the present invention may be monocomponent and/or multicomponent. For example, the fibrous elements may comprise bicomponent fibers and/or filaments. The bicomponent fibers and/or filaments may be in any form, such as side-by-side, core and sheath, islands-in-the-sea and the like.

"Filament" as used herein means an elongate particulate as described above that exhibits a length of greater than or equal to 5.08 cm (2 in.) and/or greater than or equal to 7.62 cm (3 in.) and/or greater than or equal to 10.16 cm (4 in.) and/or greater than or equal to 15.24 cm (6 in.).

Filaments are typically considered continuous or substantially continuous in nature. Filaments are relatively longer than fibers. Non-limiting examples of filaments include meltblown and/or spunbond filaments. Non-limiting examples of polymers that can be spun into filaments include natural polymers, such as starch, starch derivatives, cellulose, such as rayon and/or lyocell, and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments, polyesteramide filaments, and polycaprolactone filaments. The filaments may be monocomponent or multicomponent, such as bicomponent filaments.

The filaments may be made via spinning, for example via meltblowing and/or spunbonding, from a polymer, for example a thermoplastic polymer, such as polyolefin, for example polypropylene and/or polyethylene, and/or polyester. Filaments are typically considered continuous or substantially continuous in nature.

"Meltblowing" is a process for producing filaments directly from polymers or resins using high-velocity air or another appropriate force to attenuate the filaments before collecting the filaments on a collection device, such as a belt, for example a patterned belt or molding member. In a meltblowing process the attenuation force is applied in the form of high speed air as the material (polymer) exits a die or spinnerette.

"Spunbonding" is a process for producing filaments directly from polymers by allowing the polymer to exit a die or spinnerette and drop a predetermined distance under the forces of flow and gravity and then applying a force via high velocity air or another appropriate source to draw and/or attenuate the polymer into a filament.

"Fiber" as used herein means an elongate particulate as described above that exhibits a length of less than 5.08 cm (2 in.) and/or less than 3.81 cm (1.5 in.) and/or less than 2.54 cm (1 in.).

Fibers are typically considered discontinuous in nature. Non-limiting examples of fibers include pulp fibers, such as wood pulp fibers, and synthetic staple fibers such as polypropylene fibers, polyethylene fibers, polyester fibers, fibers of copolymers thereof, regenerated cellulose fibers, for example rayon and/or lyocell fibers, glass fibers and polyvinyl alcohol fibers.

Staple fibers may be produced by spinning a filament tow and then cutting the tow into segments of less than 5.08 cm (2 in.) thus producing fibers; namely, staple fibers.

"Pulp fibers" as used herein means fibers that have been derived from vegetative sources, such as plants and/or trees. In one example of the present invention, "pulp fiber" refers to papermaking fibers. In one example of the present invention, a fiber may be a naturally occurring fiber, which means it is obtained from a naturally occurring source, such as a vegetative source, for example a tree and/or plant, such as trichomes. Such fibers are typically used in papermaking and are oftentimes referred to as papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to fibrous structures made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. Also applicable to the present invention are fibers derived from recycled paper, which may contain any or all of the above categories of fibers as well as other non-fibrous polymers such as fillers, softening agents, wet and dry strength agents, and adhesives used to facilitate the original papermaking.

In one example, the wood pulp fibers are selected from the group consisting of hardwood pulp fibers, softwood pulp fibers, and mixtures thereof. The hardwood pulp fibers may be selected from the group consisting of: tropical hardwood pulp fibers, northern hardwood pulp fibers, and mixtures thereof. The tropical hardwood pulp fibers may be selected from the group consisting of: eucalyptus fibers, acacia fibers, and mixtures thereof. The northern hardwood pulp fibers may be selected from the group consisting of: cedar fibers, maple fibers, and mixtures thereof.

In addition, the pulp fibers may be selected from the group consisting of: oak fibers, gum fibers, aspen fibers, and mixtures thereof.

In addition to the various wood pulp fibers, other cellulosic fibers such as non-wood pulp fibers, for example cotton linters, rayon, lyocell, trichomes, seed hairs, rice straw, wheat straw, bamboo, manila hemp (abaca), *Hesperaloe*, agave, cannabis hemp, kapok, milkweed, coconut coir, kenaf, jute, flax, ramie, sisal, esparto, sabai grass, switchgrass, lemon grass and bagasse fibers can be used in this invention. Other sources of cellulose in the form of fibers or capable of being spun into fibers include grasses and grain sources.

"Trichome" or "trichome fiber" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one example, the outgrowth is a trichome fiber. The outgrowth may be a hairlike or bristlelike outgrowth from the epidermis of a plant.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

"Sanitary tissue product" as used herein means a soft, low density (i.e. <about 0.15 g/cm$^3$) article comprising one or more fibrous structure plies according to the present invention, wherein the sanitary tissue product is useful as a wiping implement for post-urinary and post-bowel movement cleaning (toilet tissue), for otorhinolaryngological discharges (facial tissue), for food consumption related cleaning (paper napkins) and multi-functional absorbent and cleaning uses (absorbent towels). The sanitary tissue product may be convolutedly wound upon itself about a core or without a core to form a sanitary tissue product roll. Alternatively, the sanitary tissue product may be cut and stacked.

The sanitary tissue products and/or fibrous structures of the present invention may exhibit a basis weight of greater than 15 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue products and/or fibrous structures of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$.

The sanitary tissue products of the present invention may exhibit a sum of MD and CD dry tensile strength of greater than about 59 g/cm (150 g/in) and/or from about 78 g/cm to about 394 g/cm and/or from about 98 g/cm to about 335 g/cm. In addition, the sanitary tissue product of the present invention may exhibit a sum of MD and CD dry tensile strength of greater than about 196 g/cm and/or from about 196 g/cm to about 394 g/cm and/or from about 216 g/cm to about 335 g/cm and/or from about 236 g/cm to about 315 g/cm. In one example, the sanitary tissue product exhibits a sum of MD and CD dry tensile strength of less than about 394 g/cm and/or less than about 335 g/cm.

In another example, the sanitary tissue products of the present invention may exhibit a sum of MD and CD dry tensile strength of greater than about 196 g/cm and/or greater than about 236 g/cm and/or greater than about 276 g/cm and/or greater than about 315 g/cm and/or greater than about 354 g/cm and/or greater than about 394 g/cm and/or from about 315 g/cm to about 1968 g/cm and/or from about 354 g/cm to about 1181 g/cm and/or from about 354 g/cm to about 984 g/cm and/or from about 394 g/cm to about 984 g/cm.

In another example, the sanitary tissue products of the present invention may exhibit a geometric mean dry tensile strength of greater than about 100 g/in and/or greater than about 250 g/in and/or less than about 2500 g/in. Geometric mean dry tensile is calculated by taking the square root of the product of the machine direction (MD) dry tensile and the cross direction (CD) dry tensile of the sanitary tissue product.

In another example, the sanitary tissue products of the present invention may exhibit a cross direction dry tensile strength of greater than about 50 g/in and/or greater than about 100 g/in and/or greater than about 150 g/in and/or less than about 1100 g/in and/or less than about 2500 g/in.

In another example, the sanitary tissue products of the present invention may exhibit a machine direction dry tensile strength of greater than about 200 g/in and/or greater than about 300 g/in and/or less than about 1100 g/in and/or less than about 2500 g/in.

The sanitary tissue products of the present invention may exhibit an initial sum of MD and CD wet tensile strength of less than about 78 g/cm and/or less than about 59 g/cm and/or less than about 39 g/cm and/or less than about 29 g/cm.

In another example, the sanitary tissue products of the present invention may exhibit a cross direction (CD) wet tensile strength of less than about 500 g/in and/or less than about 50 g/in and/or greater than about 3 g/in.

In another example, the sanitary tissue products of the present invention may exhibit a machine direction (MD) wet tensile strength of less than about 650 g/in and/or less than about 100 g/in and/or less than about 80 g/in and/or greater than about 3 g/in.

The sanitary tissue products of the present invention may exhibit an initial sum of MD and CD wet tensile strength of greater than about 118 g/cm and/or greater than about 157 g/cm and/or greater than about 196 g/cm and/or greater than about 236 g/cm and/or greater than about 276 g/cm and/or greater than about 315 g/cm and/or greater than about 354 g/cm and/or greater than about 394 g/cm and/or from about 118 g/cm to about 1968 g/cm and/or from about 157 g/cm to about 1181 g/cm and/or from about 196 g/cm to about 984 g/cm and/or from about 196 g/cm to about 787 g/cm and/or from about 196 g/cm to about 591 g/cm.

The sanitary tissue products of the present invention may exhibit a density of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may exhibit a sheet bulk of greater than about 1.67 g/cm$^3$ and/or greater than about 3.00 g/cm$^3$ and/or greater than about 5.00 g/cm$^3$ and/or greater than about 10.0 g/cm$^3$ and/or greater than about 14.0 g/cm$^3$ and/or greater than about 20.0 g/cm$^3$ and/or from about 5.0 g/cm$^3$ to about 100.0 g/cm$^3$ and/or from about 10.0 g/cm$^3$ to about 50.0 g/cm$^3$.

The sanitary tissue products of the present invention may exhibit an Emtec TS7 value of less than about 33.0 dB V$^2$ rms and/or less than about 20.0 dB V$^2$ rms and/or less than about 18.0 dB V$^2$ rms and/or greater than about 2.0 dB V$^2$ rms and/or greater than about 4.0 dB V$^2$ rms and/or greater than about 5.0 dB V$^2$ rms and/or greater than about 6.0 dB V$^2$ rms and/or greater than about 8.0 dB V$^2$ rms and/or from about 4.5 dB V$^2$ rms to about 7.5 dB V$^2$ rms and/or from about 5.0 dB V$^2$ rms to about 12.0 dB V$^2$ rms and/or from about 8.0 dB V$^2$ rms to about 10.0 dB V$^2$ rms and/or from about 15.0 dB V$^2$ rms to about 19.0 dB V$^2$ rms and/or from about 15.0 dB V$^2$ rms to about 31.0 dB V$^2$ rms as measured according to the Emtec Test Method described herein.

The sanitary tissue products of the present invention may exhibit a Dry Modulus/Tensile of greater than about 1.5 where modulus is measured in units of g/cm and tensile is measured in units of g/in as measured according to the Dry Tensile Test Method described herein. The sanitary tissue products of the present invention may exhibit a CD dry modulus/CD dry tensile of greater than about 2.0 and less than about 10.0 where modulus is measured in units of g/cm and tensile is measured in units of g/in. In addition, the sanitary tissue products may exhibit a MD dry modulus/MD dry tensile of greater than about 1.0 and/or less than about 10.0 where modulus is measured in units of g/cm and tensile is measured in units of g/in. The sanitary tissue products of the present invention may exhibit a GM Modulus/GM tensile, sometimes referred to as Stiffness Index, of greater than about 3.0 and/or greater than about 4.0 and/or less than about 20.0 and/or less than about 12.0 where modulus is measured in units of g/in and tensile is measured in units of g/in.

In one example, any of the fibrous structures of the present invention described herein may be in the form of rolled tissue products (single-ply or multi-ply), for example a dry fibrous structure roll, and may exhibit a roll bulk (in units of cm3/g) of greater than 4 and/or greater than 6 and/or greater than 8 and/or greater than 10 and/or greater than 12 and/or to about 30 and/or to about 18 and/or to about 16 and/or to about 14 and/or from about 4 to about 20 and/or from about 4 to about 12 and/or from about 8 to about 20 and/or from about 12 to about 16 $cm^3/g$.

Additionally, any of the fibrous structures of the present invention described herein may be in the form of a rolled tissue products (single-ply or multi-ply), for example a dry fibrous structure roll, and may have a percent compressibility (in units of %) of less than 10 and/or less than 8 and/or less than 7 and/or less than 6 and/or less than 5 and/or less than 4 and/or less than 3 to about 0 and/or to about 0.5 and/or to about 1 and/or from about 4 to about 10 and/or from about 4 to about 8 and/or from about 4 to about 7 and/or from about 4 to about 6% as measured according to the Percent Compressibility Test Method described herein.

In yet another example of the present invention, a sanitary tissue product roll comprising a web, wherein the sanitary tissue product roll exhibits a Roll Diameter of greater than 3.25 and/or greater than 3.9 and/or greater than 6.25 and/or greater than 8 and/or greater than 8.25 and/or at least 9.00 inches and/or at least 10.00 inches and/or at least 11.00 inches and/or at least 12.00 inches and/or at least 15.00 inches and/or greater than 8.25 inches to about 30.00 inches as measured according to the Roll Diameter Test Method described herein.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets.

In another example, the sanitary tissue products may be in the form of discrete sheets that are stacked within and dispensed from a container, such as a box.

The fibrous structures and/or sanitary tissue products of the present invention may comprise additives such as surface softening agents, for example silicones, quaternary ammonium compounds, aminosilicones, lotions, and mixtures thereof, temporary wet strength agents, permanent wet strength agents, bulk softening agents, wetting agents, latexes, especially surface-pattern-applied latexes, dry strength agents such as carboxymethylcellulose and starch, and other types of additives suitable for inclusion in and/or on sanitary tissue products.

"Creped" as used herein means the web material, for example structured web material, is creped off of a Yankee dryer or other similar roll, such as a drying cylinder, and/or fabric creped and/or belt creped. Rush transfer of a web material alone does not result in a "creped" fibrous structure or "creped" sanitary tissue product for purposes of the present invention.

"Embossed" as used herein with respect to a web material, such as a structured web material, for example a structured fibrous structure, such as a structured wet laid fibrous structure, for example a structured sanitary tissue product means that a web material, for example a structured web material has been subjected to a process which imparts a decorative pattern, oftentimes referred to as a macro pattern, by replicating a design on one or more emboss rolls, which form a nip through which the web material, for example structured web material passes/travels. Embossed does not include creping, microcreping, printing or other processes, including structuring processes, for example web material structuring operations and/or process that utilize a web material structuring belt according to the present invention, that also impart a texture and/or decorative pattern to a web material. Embossing is a dry deformation process that occurs after the web material his substantially dry, for example less than 10% by weight moisture and/or less than 7% by weight moisture and/or less than 5% by weight moisture and/or less than 3% by weight moisture. Embossing is not structuring and thus does not create a structured web material, for example a structured fibrous structure according to the present invention. One or ordinary skill in the art appreciates that embossing is a converting process that occurs on an already formed, for example a dry web material, such as a dry fibrous structure after the web material making process has formed the web material. In other words, one of ordinary skill in the art understands that embossing is not an operation that occurs during a web material making process, for example a fibrous structure making process, such as a wet laid fibrous structure making process.

"Basis Weight" as used herein is the weight per unit area of a sample reported in lbs/3000 $ft^2$ or $g/m^2$ (gsm) and is measured according to the Basis Weight Test Method described herein.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral web material, such as a structured web material, for example a structured fibrous structure, such as a structured wet laid fibrous structure, for example a structured sanitary tissue product after the web material has been dried, such as after creping off a drying cylinder, for example a Yankee dryer, and/or after the web material is ready for winding/reeling.

"Plies" as used herein means two or more individual, integral web materials, such as structures web materials, for example structured fibrous structures, such as structured wet laid fibrous structures disposed in a substantially contiguous, face-to-face relationship with one another, forming a multi-ply web material, such as a structured multi-ply web material, for example a structured multi-ply fibrous structure, such as a structured multi-ply wet laid fibrous structure, for example a structured multi-ply sanitary tissue product. It is also contemplated that an individual, integral web material can effectively form a multi-ply web material, for example, by being folded on itself.

Web Material Structuring Belt

A seam-containing web material structuring belt of the present invention may impart texture, for example structure, to a web material, for example a fibrous structure, such as a wet laid fibrous structure, depending upon the process used to make the web material. In one example, a seam-containing web material structuring belt of the present invention can be used to impart structure to a web material, for example a wet laid fibrous structure. In one example, a seam of the seam-containing web material structuring belt may exhibit properties, for example strength, resiliency, suppleness and/or integrity to withstand a transfer process, such as a rush transfer process, during a structured web material making process. In another example, a seam of the seam-containing web material structuring belt may exhibit properties to withstand a dry transfer process during a web material making process, such as a transfer of a web material from the seam-containing web material structuring belt to a Yankee surface in a pressure roll nip. In yet another example, a seam of the seam-containing web material structuring belt may exhibit properties to withstand a belt cleaning process during a web material making process, such as surviving mechanical forces applied during showering or vacuuming of the belt. In even another example, a seam of the seam-containing web material structuring belt may exhibit properties to withstand installation and removal of the seam-containing web material structuring belt to web material making equipment, such as a paper machine and/or a nonwoven making equipment. In one example, a seam-containing web material structuring belt of the present invention can be used to impart structure in a fabric creped and/or belt creped fibrous structure making process. In another example, a seam-containing web material structuring belt of the present invention may be used to impart structure in an NTT fibrous structure making process. In yet another example, a seam-containing web material structuring belt of the present invention may be used to impart structure in a PrimeLine TEX and/or a PrimeLine TAD fibrous structure making process. In yet another example, a seam-containing web material structuring belt of the present invention may be used to impart structure in a QRT fibrous structure making process. In still another example, a seam-containing web material structuring belt of the present invention may be used to impart structure in an ATMOS fibrous structure making process. In yet another example, a seam-containing web material structuring belt of the present invention may be used to impart structure in a through air-dried (TAD) fibrous structure making process, creped or uncreped. In yet another example, a seam-containing web material structuring belt of the present invention can be used on a conventional wet press papermaking machine in a manner to create structure in the conventional wet pressed wet laid fibrous structure and/or to create texture, with or without creating structure, on a surface of the conventional wet pressed wet laid fibrous structure. In even another example, a seam-containing web material structuring belt of the present invention may be used to impart structure in a dry laid fibrous structure making process, such as a spun filament-containing nonwoven making process.

In one example, the seam-containing web material structuring belt imparts texture, for example structure, for example a pattern, for example a 3D pattern, such as a non-random 3D pattern, for example a non-random repeating 3D pattern, to a web material during a web material making process, for example during a web material structuring operation of a web material making process to form a structured web material. The structuring via the seam-containing web material structuring belt may occur during a web material forming operation, for example the seam-containing web material structuring belt may be used in the forming operation of a web material making process and/or during a web material structuring operation of a web material making process. In one example the structuring via the seam-containing web material structuring belt occurs during the structured web material making process where the seam-containing web material structuring belt contacts the web material, such as an embryonic web material, such as an embryonic fibrous structure, for example during an operation where components of the web material, for example fibrous elements, such as example fibers within the fibrous structure, for example fibers within the embryonic fibrous structure, are rearranged.

Figure 14A:
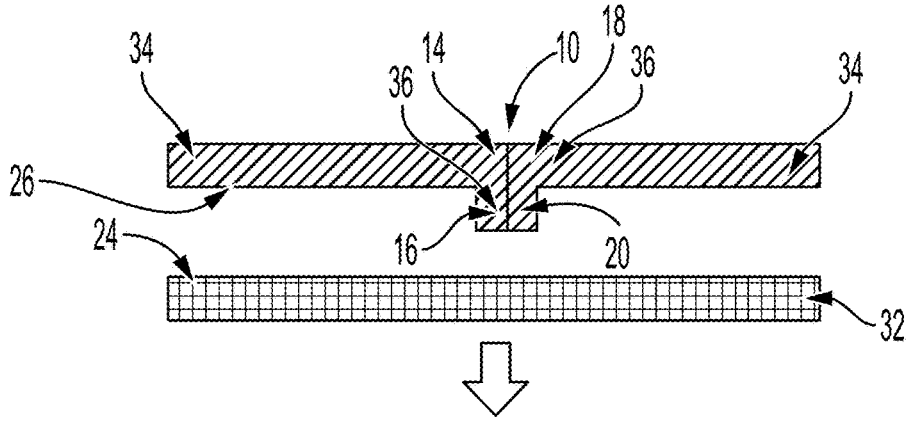
FIG. 14A is a cross-sectional representation of an example of a support layer and a structuring layer prior to forming a web material structuring belt according to the present invention.
Figure 14B:
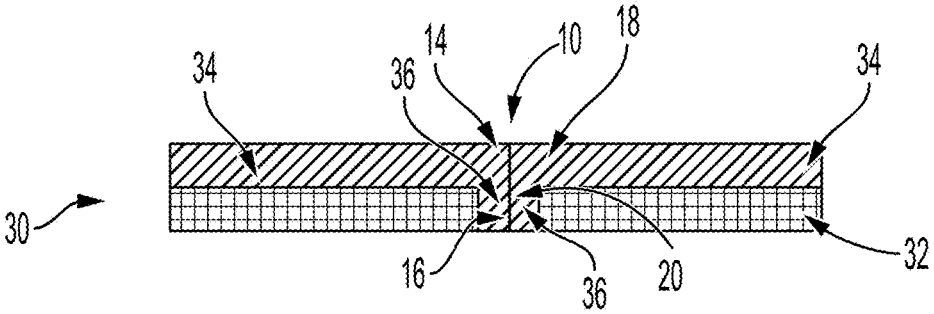
FIG. 14B is a cross-sectional representation of the web material structuring belt from FIG. 14A.

As shown in FIGS. 14A and 14B, a seam-containing web material structuring belt 30 comprises a support layer 32 and a structuring layer 34 comprising a seam 10, in this case an abut seam, wherein the seam 10 comprises at least one seam portion 36, formed by one or more of a first structuring layer material edge 14 having a first terminus 16 and/or a second structuring layer material edge 18 having a second terminus 20 that abut each other resulting in the abut seam. In one example, at least one seam portion 36 of the structuring layer 34, in this case two seam portions 36 of the structuring layer 34 is/are associated with the support layer 32 at the support layer's surface 24 and the structuring layer's surface 26 such that the at least one seam portion 36 of the structuring layer 34 extends into, but less than entirely through the support layer 32. In addition to extending into the support layer 32, the at least one seam portion 36 of the structuring layer 34 may be co-planar with at least a portion of the support layer 32, in other words, the at least one seam portion 36 of the structuring layer 34 does not extend into the support layer 32.

Figure 15A:
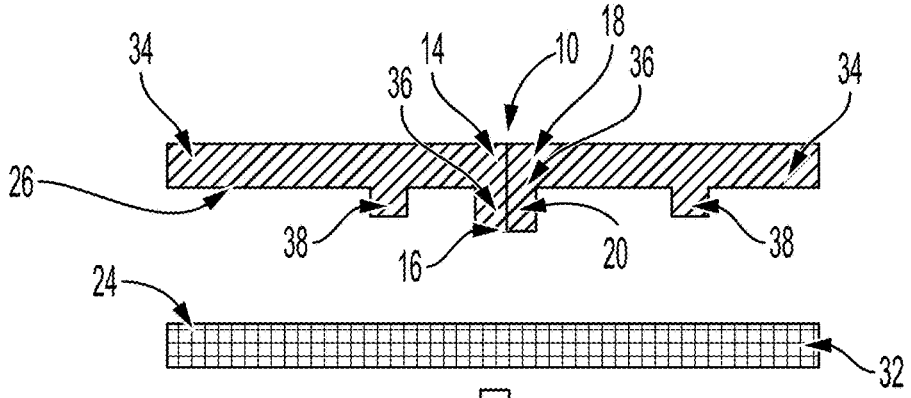
FIG. 15A is a cross-sectional representation of an example of a support layer and a structuring layer prior to forming a web material structuring belt according to the present invention.
Figure 15B:
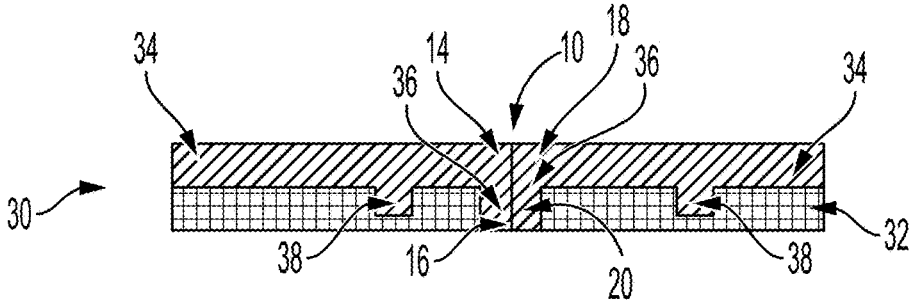
FIG. 15B is a cross-sectional representation of the web material structuring belt from FIG. 15A.

As shown in FIGS. 15A and 15B, a seam-containing web material structuring belt 30 comprises a support layer 32 and a structuring layer 34 comprising a seam 10, in this case an abut seam, wherein the seam 10 comprises at least one seam portion 36, formed by one or more of a first structuring layer material edge 14 having a first terminus 16 and/or a second structuring layer material edge 18 having a second terminus 20 that abut each other resulting in the abut seam. In one example, at least one seam portion 36 of the structuring layer 34, in this case two seam portions 36 of the structuring layer 34 is/are associated with the support layer 32 at the support layer's surface 24 and the structuring layer's surface 26 such that the at least one seam portion 36 of the structuring layer 34 extends into, but less than entirely through the support layer 32. In addition to extending into the support layer 32, the at least one seam portion 36 of the structuring layer 34 may be co-planar with at least a portion of the support layer 32, in other words, the at least one seam portion 36 of the structuring layer 34 does not extend into the support layer 32. In one example as shown in FIGS. 15A and 15B, the structuring layer 34 may further comprise one or more protuberances 38 of the structuring layer 34 that associate with the support layer 32, for example at least one of the protuberances 38 extends into, but less than entirely through the support layer 32.

Figure 16A:
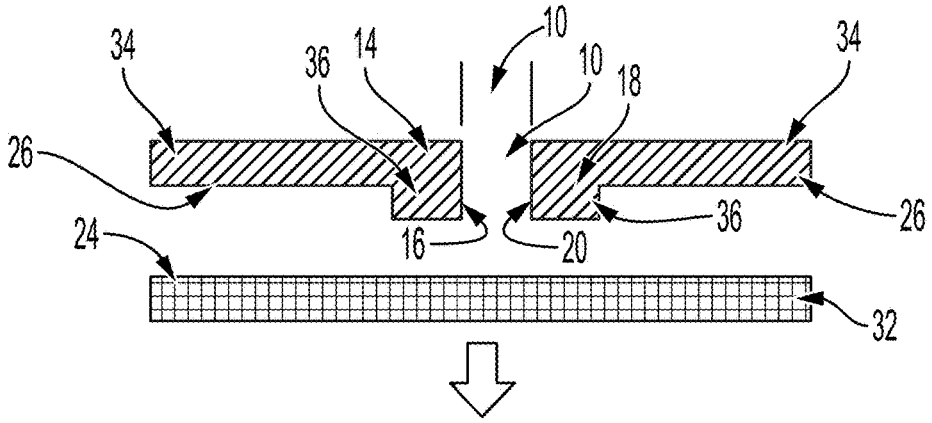
FIG. 16A is a cross-sectional representation of an example of a support layer and a structuring layer prior to forming a web material structuring belt according to the present invention.
Figure 16B:
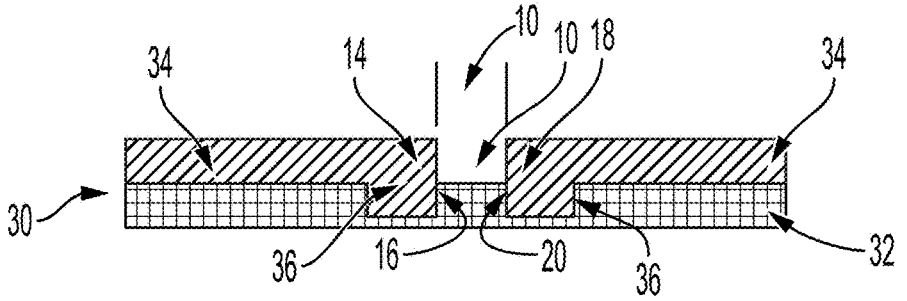
FIG. 16B is a cross-sectional representation of the web material structuring belt from FIG. 16A.

As shown in FIGS. 16A and 16B, a seam-containing web material structuring belt 30 comprises a support layer 32 and a structuring layer 34 comprising a seam 10, in this case a gap seam, wherein the seam 10 comprises at least one seam portion 36, formed by one or more of a first structuring layer material edge 14 having a first terminus 16 and/or a second structuring layer material edge 18 having a second terminus 20 that create a gap between them such that the gap seam is formed. In one example, at least one seam portion 36 of the structuring layer 34, in this case two seam portions 36 of the structuring layer is/are associated with the support layer 32 at the support layer's surface 24 and the structuring layer's surface 26 such that the at least one seam portion 36 of the structuring layer 34 extends into, but less than entirely through the support layer 32. In addition to extending into the support layer 32, the at least one seam portion 36 of the structuring layer 34 may be co-planar with at least a portion of the support layer 32, in other words, the at least one seam portion 36 of the structuring layer 34 does not extend into the support layer 32.

As shown in FIGS. 16C and 16D, a seam-containing web material structuring belt 30 comprises a support layer 32 and a structuring layer 34 comprising a structuring layer material seam 10, in this case a gap seam, wherein the structuring layer material seam 10 has a continuous structuring layer material seam portion 36 that joins both termini 14, 18 of the structuring layer material seam 10. In one example, the structuring layer material seam portion 36 comprises an embedment material that penetrates and extends into the support layer 32. The structuring layer material seam portion 36 is associated with the support layer 32 at the support layer's surface 24 and the structuring layer's surface 26 such that the structuring layer material seam portion 36 extends into, but less than entirely through the support layer 32.

Figure 17A:
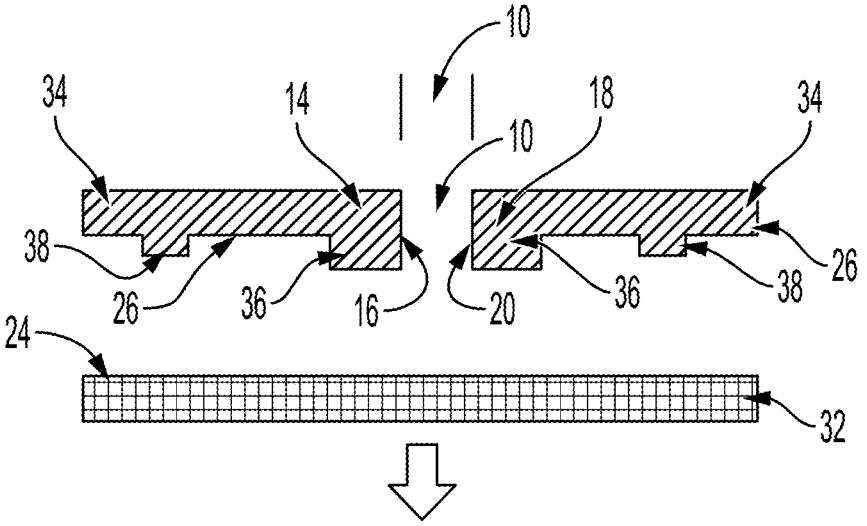
FIG. 17A is a cross-sectional representation of an example of a support layer and a structuring layer prior to forming a web material structuring belt according to the present invention.
Figure 17B:
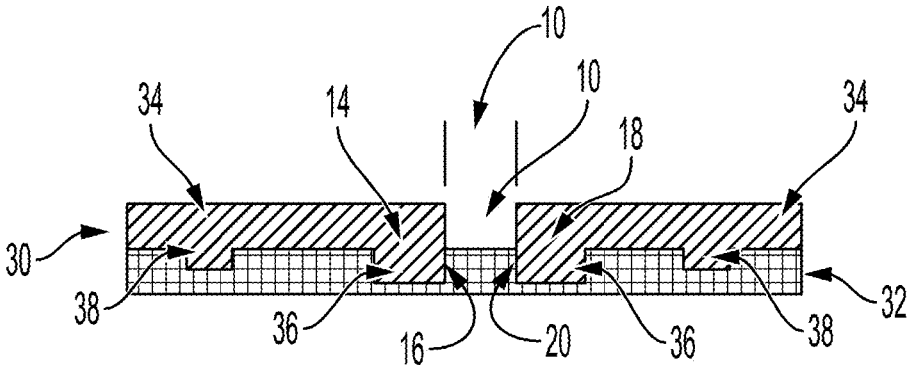
FIG. 17B is a cross-sectional representation of the web material structuring belt from FIG. 17A.

As shown in FIGS. 17A and 17B, a seam-containing web material structuring belt 30 comprising a support layer 32 and a structuring layer 34 comprising a seam 10, in this case a seam, wherein the seam 10 comprises at least one seam portion 36, formed by one or more of a first structuring layer material edge 14 having a first terminus 16 and/or a second structuring layer material edge 18 having a second terminus 20 that create a gap between them such that the gap seam is formed. In one example, at least one seam portion 36 of the structuring layer 34, in this case two seam portions 36 of the structuring layer 34 is/are associated with the support layer 32 at the support layer's surface 24 and the structuring layer's surface 26 such that the at least one seam portion 36 of the structuring layer 34 extends into, but less than entirely through the support layer 32. In addition to extending into the support layer 32, the at least one seam portion 36 of the structuring layer 34 may be co-planar with at least a portion of the support layer 32, in other words, the at least one seam portion 36 of the structuring layer 34 does not extend into the support layer 32. In one example as shown in FIGS. 17A and 17B, the structuring layer 34 may further comprise one or more protuberances 38 of the structuring layer 34 that associate with the support layer 32, for example at least one of the protuberances 38 extends into, but less than entirely through the support layer 32.

As shown in FIGS. 17C and 17D, a seam-containing web material structuring belt 30 comprising a support layer 32 and a structuring layer 34 comprising a seam 10, in this case a gap seam, wherein the seam 10 comprises at least one structuring material seam portion 36, formed by one or more of a first structuring layer material edge 14 having a first terminus 16 and/or a second structuring layer material edge 18 having a second terminus 20 that create a gap between them such that the gap seam is formed. In one example, the structuring layer material seam portion 36 comprises an embedment material In one example, at least one seam portion 36 of the structuring layer 34, in this case two seam portions 36 of the structuring layer 34 is/are associated with the support layer 32 at the support layer's surface 24 and the structuring layer's surface 26 such that the at least one seam portion 36 of the structuring layer 34 extends into, but less than entirely through the support layer 32. In addition to extending into the support layer 32, the at least one seam portion 36 of the structuring layer 34 may be co-planar with at least a portion of the support layer 32, in other words, the at least one seam portion 36 of the structuring layer 34 does not extend into the support layer 32. In one example as shown in FIGS. 17A and 17B, the structuring layer 34 may further comprise one or more protuberances 38 of the structuring layer 34 that associate with the support layer 32, for example at least one of the protuberances 38 extends into, but less than entirely through the support layer 32.

Figure 18A:
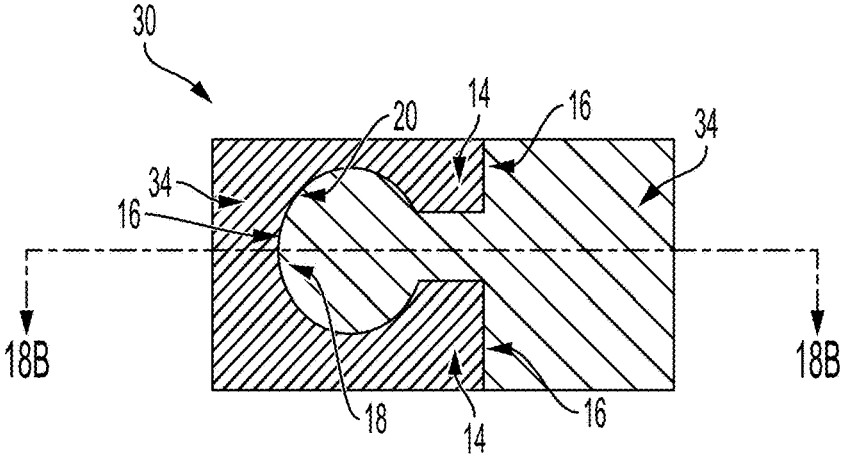
FIG. 18A is a schematic top view of a web material structuring belt according to the present invention.
Figure 18B:
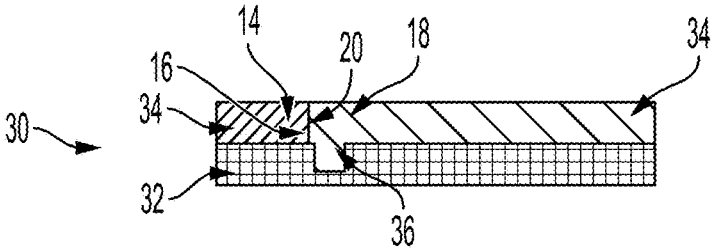
FIG. 18B is a cross-sectional representation of the web material structuring belt of FIG. 18A.

As shown in FIGS. 18A and 18B, a seam-containing web material structuring belt 30 comprising a support layer 32 and a structuring layer 34 comprising a seam 10, in this case an overlap seam, more specifically an overlap x-y interlocking seam, even more specifically an abut spatial overlap structuring layer material seam, wherein the seam 10 comprises at least one seam portion 36, formed by one or more of a first structuring layer material edge 14 having a first terminus 16 and/or a second structuring layer material edge 18 having a second terminus 20 that abut each other resulting in the abut spatial overlap structuring layer material seam. In one example, at least one seam portion 36 of the structuring layer 34, in this case two seam portions 36 of the structuring layer 34 is/are associated with the support layer 32 at the support layer's surface 24 and the structuring layer's surface 26 such that the at least one seam portion 36 of the structuring layer 34 extends into, but less than entirely through the support layer 32. In one example, at least one seam portion 36 of the structuring layer 34, in this case two seam portions 36 of the structuring layer is/are associated with the support layer 32 such that the at least one seam portion 36 of the structuring layer 34 extends into, but less than entirely through the support layer 32. In addition to extending into the support layer 32, the at least one seam portion 36 of the structuring layer 34 may be co-planar with at least a portion of the support layer 32, in other words, the at least one seam portion 36 of the structuring layer 34 does not extend into the support layer 32.

Figure 19A:
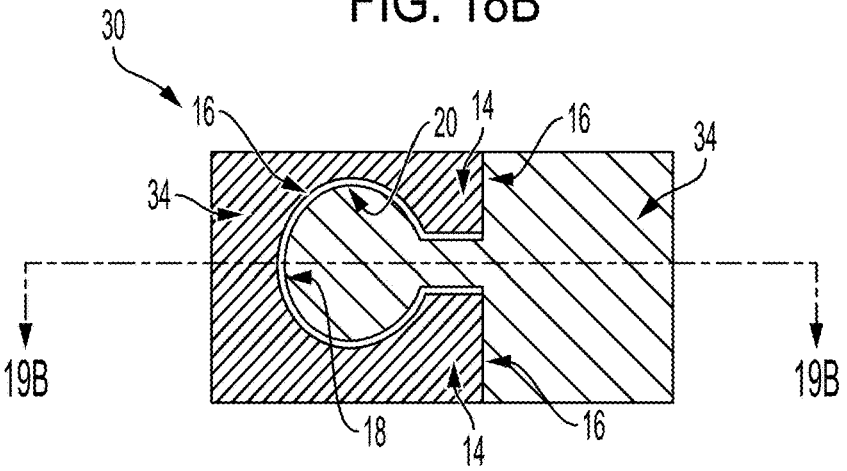
FIG. 19A is a schematic top view of a web material structuring belt according to the present invention.
Figure 19B:
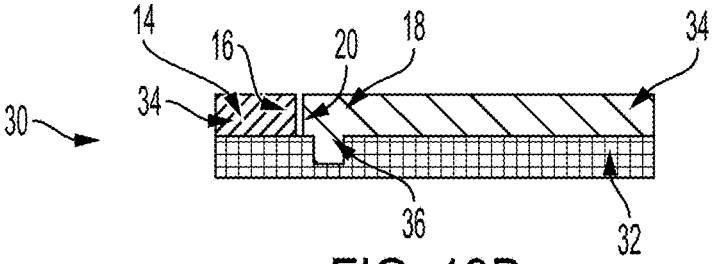
FIG. 19B is a cross-sectional representation of the web material structuring belt of FIG. 19A.

As shown in FIGS. 19A and 19B, a seam-containing web material structuring belt 30 comprising a support layer 32 and a structuring layer 34 comprising a seam 10, in this case an overlap seam, more specifically an overlap x-y interlocking seam, even more specifically a gap spatial overlap structuring layer material seam, wherein the seam 10 comprises at least one seam portion 36, formed by one or more of a first structuring layer material edge 14 having a first terminus 16 and/or a second structuring layer material edge 18 having a second terminus 20 that create a gap between them such that the gap spatial overlap structuring layer material seam is formed. In one example, at least one seam portion 36 of the structuring layer 34, in this case two seam portions 36 of the structuring layer is/are associated with the support layer 32 at the support layer's surface 24 and the structuring layer's surface 26 such that the at least one seam portion 36 of the structuring layer 34 extends into, but less than entirely through the support layer 32. In addition to extending into the support layer 32, the at least one seam portion 36 of the structuring layer 34 may be co-planar with at least a portion of the support layer 32, in other words, the at least one seam portion 36 of the structuring layer 34 does not extend into the support layer 32.

Figure 20A:
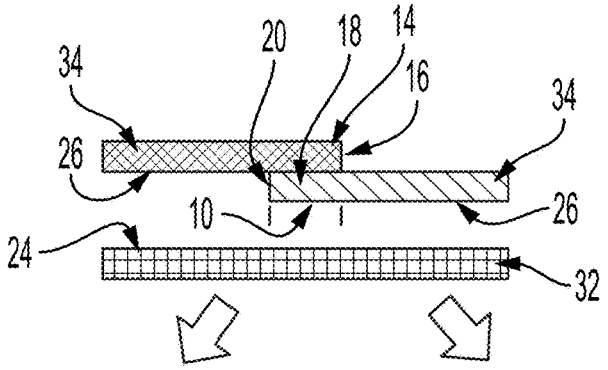
FIG. 20A is a cross-sectional representation of an example of a support layer and a structuring layer prior to forming a web material structuring belt according to the present invention.
Figure 20B:
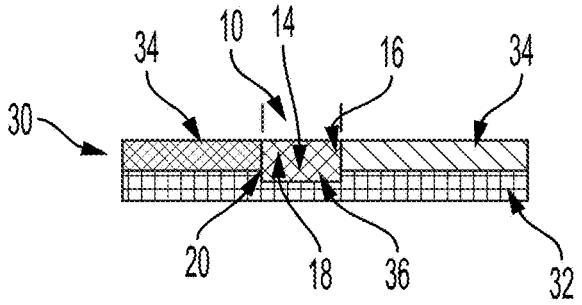
FIG. 20B is a cross-sectional representation of the web material structuring belt from FIG. 20A.
Figure 20C:
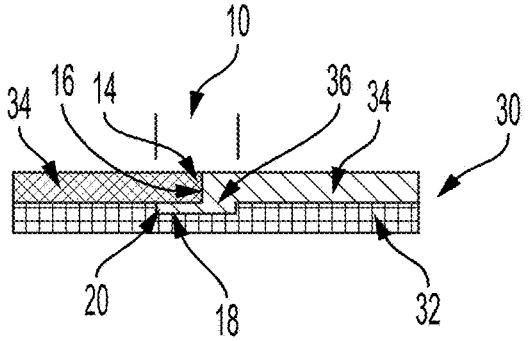
FIG. 20C is a cross-sectional representation of the web material structuring belt from FIG. 20A.

As shown in FIGS. 20A-20C, a seam-containing web material structuring belt 30 comprising a support layer 32 and a structuring layer 34 comprising a seam 10, in this case an overlap seam, more specifically an overlap z interlocking seam, wherein the seam 10 comprises at least one seam portion 36, formed by one or more of a first structuring layer material edge 14 having a first terminus 16 and/or a second structuring layer material edge 18 having a second terminus 20 that overlap each other resulting in the overlap z interlocking structuring layer material seam. In one example as shown in FIG. 20B, a first structuring layer material edge 14 having a first terminus 16 commingles and/or fuses and/or blends and/or mixes with a second structuring layer material edge 18 having a second terminus 20, such that a resulting seam portion 36 is associated with the support layer 32 at the support layer's surface 24 and the structuring layer's surface 26 such that the resulting seam portion 36 extends into, but less than entirely through the support layer 32. In one example as shown in FIG. 20C, at least one seam portion 36 is formed by a first structuring layer material edge 14 having a first terminus 16 that displaces and/or forces a second structuring layer material edge 18 having a second terminus 20 into the support layer 32 such that a resulting seam portion 36 is associated with the support layer 32 such that the resulting seam portion 36 extends into, but less than entirely through the support layer 32.

Figure 21A:
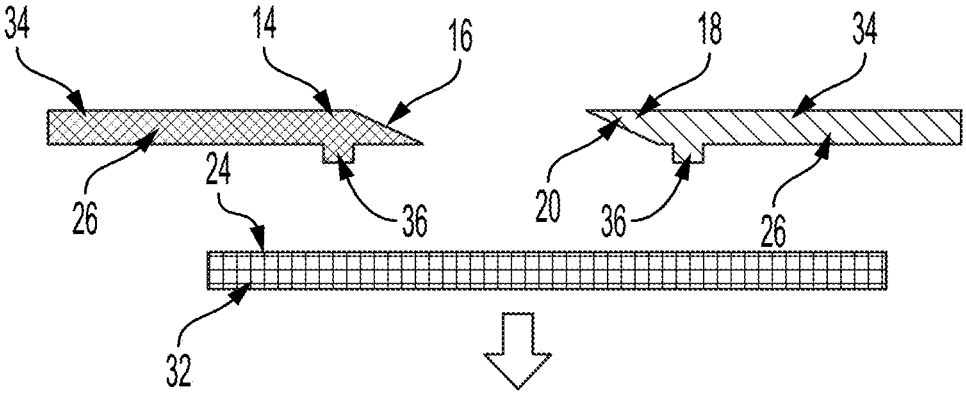
FIG. 21A is a cross-sectional representation of an example of a support layer and a structuring layer prior to forming a web material structuring belt according to the present invention.
Figure 21B:
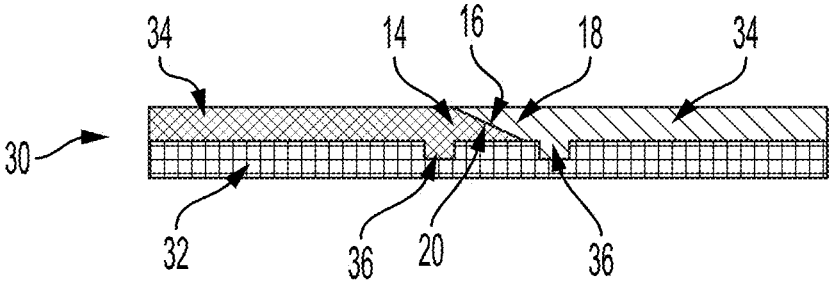
FIG. 21B is a cross-sectional representation of the web material structuring belt from FIG. 21A.
Figure 22A:
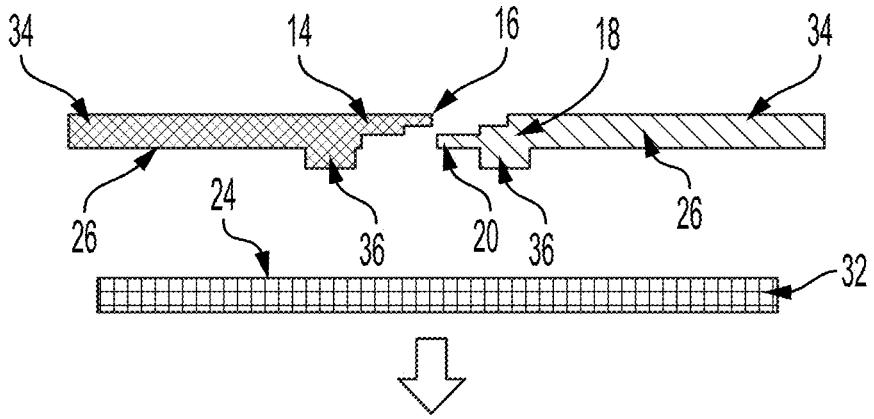
FIG. 22A is a cross-sectional representation of an example of a support layer and a structuring layer prior to forming a web material structuring belt according to the present invention.
Figure 22B:
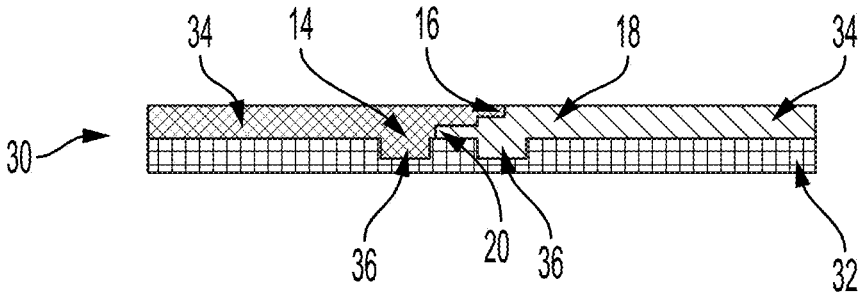
FIG. 22B is a cross-sectional representation of the web material structuring belt from FIG. 22A.

As shown in FIGS. 21A and 21B, a seam-containing web material structuring belt 30 comprising a support layer 32 and a structuring layer 34 comprising a seam 10, in this case an overlap seam, more specifically an overlap z interlocking seam, wherein the seam 10 comprises at least one seam portion 36 formed by one or more of a first structuring layer material edge 14 having a first terminus 16 and/or a second structuring layer material edge 18 having a second terminus 20 that overlap each other resulting in the overlap z interlocking structuring layer material seam. As shown in FIG. 21B, two seam portions 36, one from the first structuring layer material edge 14 and one from the second structuring layer material edge 18 are associated with the support layer 32 at the support layer's surface 24 and the structuring layer's surface 26 such that at least one of the seam portions 36 extends into, but less than entirely through the support layer 32.

Figure 23A:
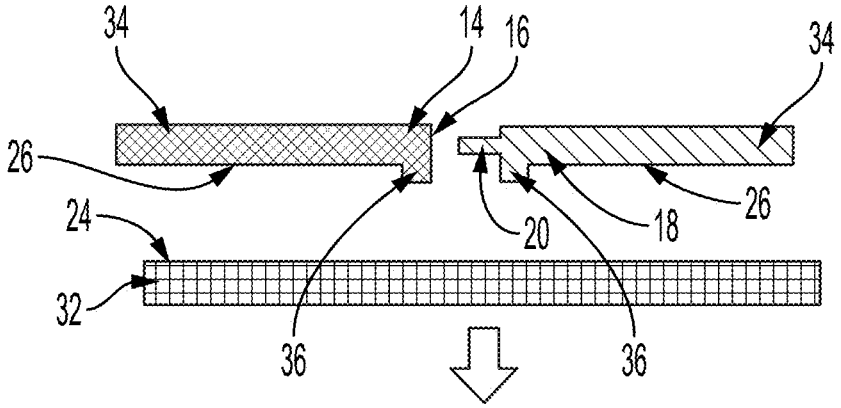
FIG. 23A is a cross-sectional representation of an example of a support layer and a structuring layer prior to forming a web material structuring belt according to the present invention.
Figure 23B:
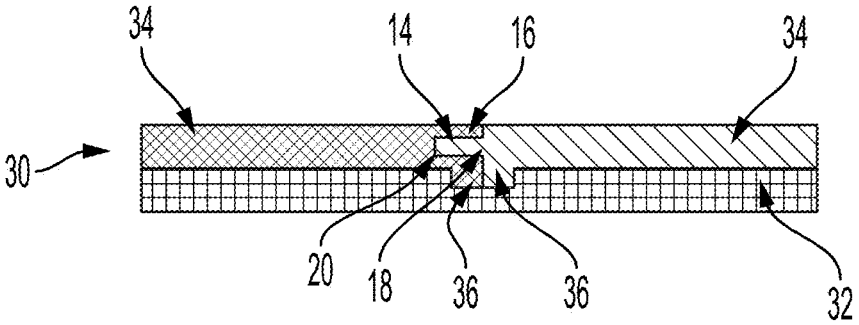
FIG. 23B is a cross-sectional representation of the web material structuring belt from FIG. 23A.

As shown in FIGS. 23A and 23B, a seam-containing web material structuring belt 30 comprising a support layer 32 and a structuring layer 34 comprising a seam 10, in this case an overlap seam, more specifically an overlap combined x-y and z interlocking seam, wherein the seam 10 comprises at least one seam portion 36 formed by one or more of a first structuring layer material edge 14 having a first terminus 16 and/or a second structuring layer material edge 18 having a second terminus 20 that overlap each other resulting in the overlap combined x-y and z interlocking structuring layer material seam. As shown in FIG. 23B, two seam portions 36, one from the first structuring layer material edge 14 and one from the second structuring layer material edge 18 are associated with the support layer 32 at the support layer's surface 24 and the structuring layer's surface 26 such that at least one of the seam portions 36 extends into, but less than entirely through the support layer 32.

Figure 24A:
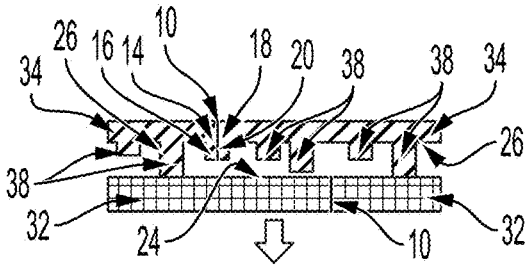
FIG. 24A is a cross-sectional representation of an example of a support layer and a structuring layer prior to forming a web material structuring belt according to the present invention.
Figure 24B:
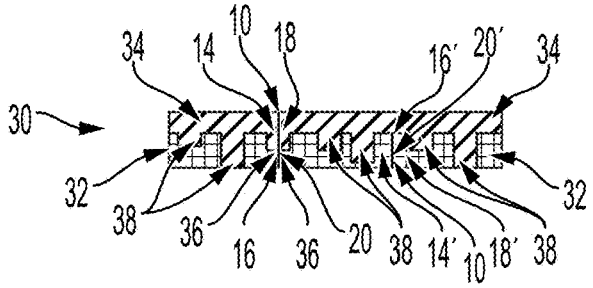
FIG. 24B is a cross-sectional representation of the web material structuring belt from FIG. 24A.

As shown in FIGS. 24A and 24B, a seam-containing web material structuring belt 30 comprising a support layer 32 comprising a seam 10, in this case an abut seam, wherein the seam 10 comprises at least one seam portion 36, formed by one or more of a first support layer material edge 14' having a first terminus 16' and/or a second support layer material edge 18' having a second terminus 20' that abut each other resulting in the abut seam and a structuring layer 34 comprising a seam 10, in this case an abut seam, wherein the seam 10 comprise at least one seam portion 36, formed by one or more of a first structuring layer material edge 14 having a first terminus 16 and/or a second structuring layer material edge 18 having a second terminus 20 that abut each other resulting in the abut seam. In one example, at least one seam portion 36 of the structuring layer 34, in this case two seam portions 36 of the structuring layer 34 is/are associated with the support layer 32 at the support layer's surface 24 and the structuring layer's surface 26 such that the at least one seam portion 36 of the structuring layer 34 extends into, but less than entirely through the support layer 32. In addition to the at least one seam portion 36 of the structuring layer 34 extending into the support layer 32, at least one seam portion 36 of the support layer 32 may be co-planar with at least a portion of the structuring layer 34, in other words, the at least one seam portion 36 of the support layer 32 does not extend into the structuring layer 34. In one example as shown in FIGS. 24A and 24B, the structuring layer 34 may further comprise one or more protuberances 38 of the structuring layer 34 that associate with the support layer 32, for example at least one of the protuberances 38 extends into, but less than entirely through the support layer 32.

Figure 25A:
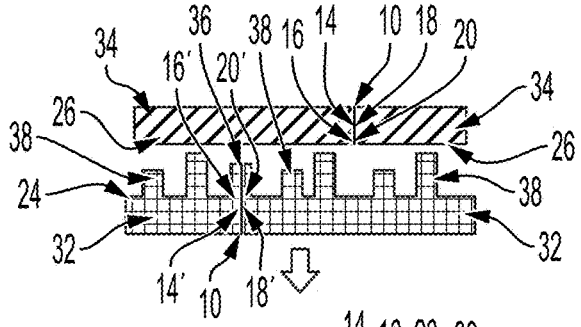
FIG. 25A is a cross-sectional representation of an example of a support layer and a structuring layer prior to forming a web material structuring belt according to the present invention.
Figure 25B:
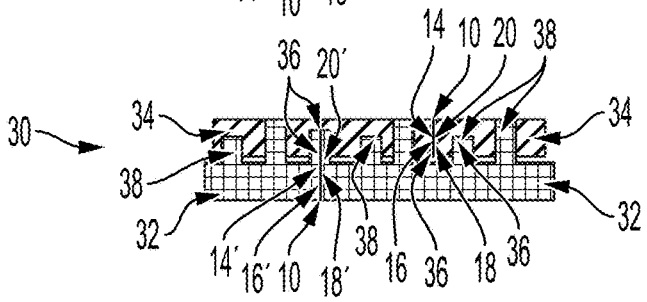
FIG. 25B is a cross-sectional representation of the web material structuring belt from FIG. 25A.

As shown in FIGS. 25A and 25B, a seam-containing web material structuring belt 30 comprising a support layer 32 comprising a seam 10, in this case an abut seam wherein the seam 10 comprises at least one seam portion 36, formed by one or more of a first support layer material edge 14' having a first terminus 16' and/or a second support layer material edge 18' having a second terminus 20' that abut each other resulting in the abut seam and a structuring layer 34 comprising a seam 10, in this case an abut seam, wherein the seam 10 comprise at least one seam portion 36, formed by one or more of a first structuring layer material edge 14 having a first terminus 16 and/or a second structuring layer material edge 18 having a second terminus 20 that abut each other resulting in the abut seam. In one example, at least one seam portion 36 of the support layer 32, in this case two seam portions 36 of the support layer 32 is/are associated with the structuring layer 34 at the support layer's surface 24 and the structuring layer's surface 26 such that the at least one seam portion 36 of the support layer 32 extends into, but less than entirely through the structuring layer 34. In addition to the at least one seam portion 36 of the support layer 32 extending into the structuring layer 34, at least one seam portion 36 of the structuring layer 34 may be co-planar with at least a portion of the support layer 32, in other words, the at least one seam portion 36 of the structuring layer 34 does not extend into the support layer 32. In one example as shown in FIGS. 25A and 25B, the support layer 32 may further comprise one or more protuberances 38 of the support layer 32 that associate with the structuring layer 34, for example at least one of the protuberances 38 extends into, but less than entirely through the structuring layer 34.

Figure 26A:
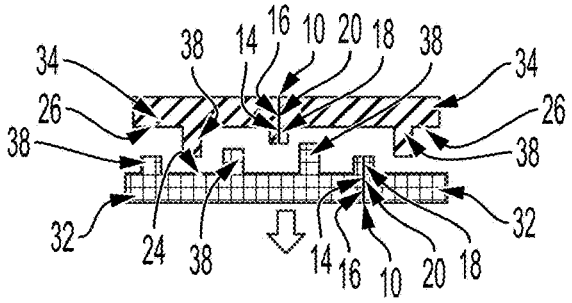
FIG. 26A is a cross-sectional representation of an example of a support layer and a structuring layer prior to forming a web material structuring belt according to the present invention.
Figure 26B:
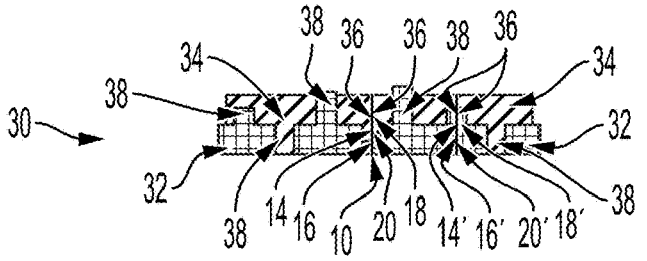
FIG. 26B is a cross-sectional representation of the web material structuring belt from FIG. 26A.

As shown in FIGS. 26A and 26B, a seam-containing web material structuring belt 30 comprising a support layer 32 comprising a seam 10, in this case an abut seam, wherein the seam 10 comprises at least one seam portion 36, formed by one or more of a first support layer material edge 14' having a first terminus 16' and/or a second support layer material edge 18' having a second terminus 20' that abut each other resulting in the abut seam and a structuring layer 34 comprising a seam 10, in this case an abut seam, wherein the seam 10 comprise at least one seam portion 36, formed by one or more of a first structuring layer material edge 14 having a first terminus 16 and/or a second structuring layer material edge 18 having a second terminus 20 that abut each other resulting in] the abut seam. and a structuring layer 34 comprising a seam 10, in this case an abut seam, wherein the seams 10 comprise at least one seam portion 36, formed by one or more of a first structuring layer material edge 14 having a first terminus 16 and/or a second structuring layer material edge 18 having a second terminus 20 that abut each other resulting in the abut seams. In one example, at least one seam portion 36 of the support layer 32, in this case two seam portions 36 of the support layer 32 is/are associated with the structuring layer 34 at the support layer's surface 24 and the structuring layer's surface 26 such that the at least one seam portion 36 of the support layer 32 extends into, but less than entirely through the structuring layer 34 and at least one seam portion 36 of the structuring layer 34, in this case two seam portions 36 of the structuring layer is/are associated with the support layer 32 at the support layer's surface 24 and the structuring layer's surface 26 such that the at least one seam portion 36 of the structuring layer 34 extends into, but less than entirely through the support layer 32. As shown in FIGS. 26A and 26B, the support layer 32 may further comprise one or more protuberances 38 of the support layer 32 that associate with the structuring layer 34, for example at least one of the protuberances 38 extends into, but less than entirely through the structuring layer 34 and the structuring layer 34 may further comprise one or more protuberances 38 of the structuring layer 34 that associate with the support layer 32, for example at least one of the protuberances 38 extends into, but less than entirely through the support layer 32.

Figure 27A:
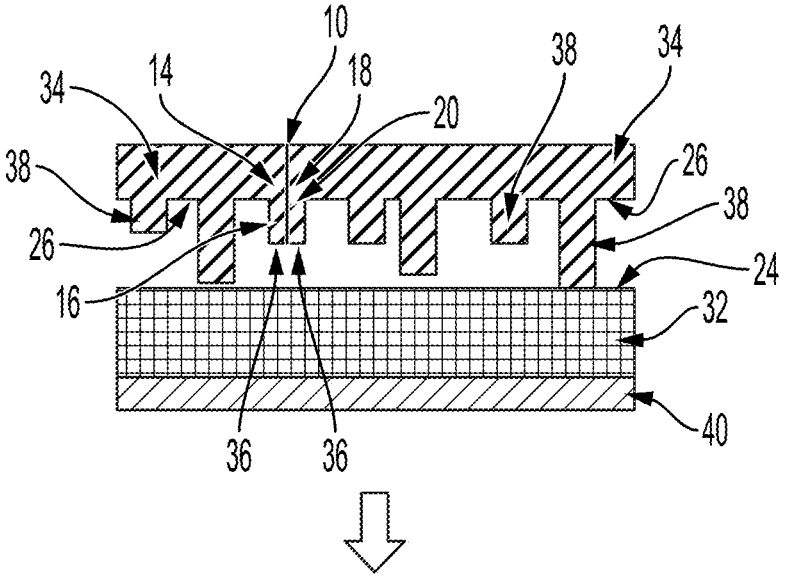
FIG. 27A is a cross-sectional representation of an example of a support layer, a structuring layer and a backing layer prior to forming a web material structuring belt according to the present invention.
Figure 27B:
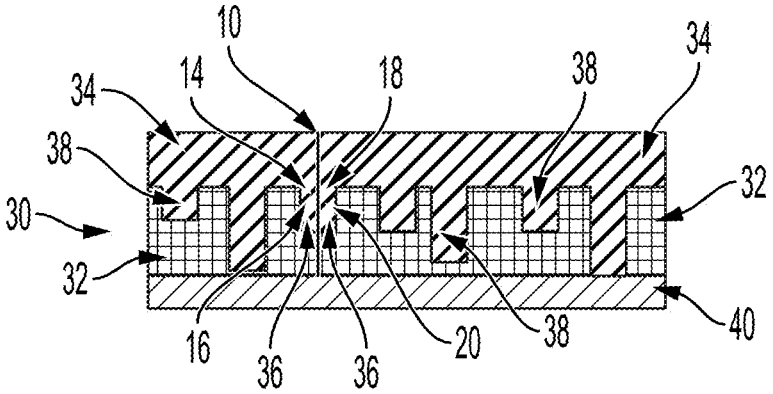
FIG. 27B is a cross-sectional representation of the web material structuring belt from FIG. 27A.

As shown in FIGS. 27A and 27B, a seam-containing web material structuring belt 30 comprising a support layer 32 and a structuring layer 34 comprising a seam 10, in this case an abut seam, wherein the seam 10 comprises at least one seam portion 36, formed by one or more of a first structuring layer material edge 14 having a first terminus 16 and/or a second structuring layer material edge 18 having a second terminus 20 that abut each other resulting in the abut seam. In addition to the support layer 32 and the structuring layer 34, the seam-containing web material structuring belt 30 further comprises a backing layer 40. In one example, the backing layer 40 may be present on at least a portion of the support layer's 32 surface opposite the structuring layer 34. In one example, at least one seam portion 36 of the structuring layer 34, in this case two seam portions 36 of the structuring layer 34 is/are associated with the support layer 32 such that the at least one seam portion 36 of the structuring layer 34 extends into, but less than entirely through the support layer 32. In one example as shown in FIGS. 27A and 27B, the structuring layer 34 may further comprise one or more protuberances 38 of the structuring layer 34 that associate with the support layer 32, for example at least one of the protuberances 38 extends into, but less than entirely through the support layer 32.

Figure 28A:
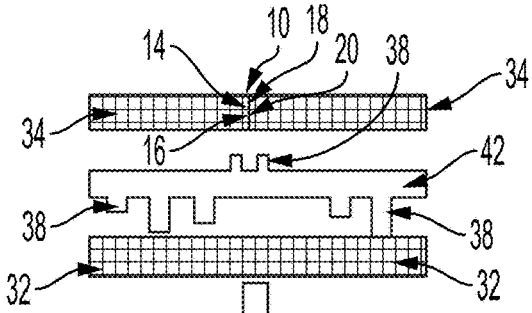
FIG. 28A is a cross-sectional representation of an example of a support layer, a structuring layer and an associating layer prior to forming a web material structuring belt according to the present invention.
Figure 28B:
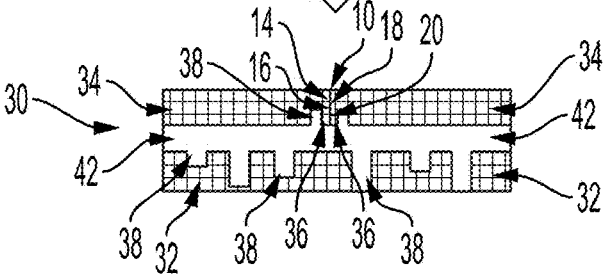
FIG. 28B is a cross-sectional representation of the web material structuring belt from FIG. 28A.

As shown in FIGS. 28A and 28B, a seam-containing web material structuring belt 30 comprising a support layer 32 and a structuring layer 34 comprising a seam 10, in this case an abut seam, wherein the seam 10 comprises at least one seam portion 36, formed by one or more of a first structuring layer material edge 14 having a first terminus 16 and/or a second structuring layer material edge 18 having a second terminus 20 that abut each other resulting in the abut seam. In addition to the support layer 32 and the structuring layer 34, the seam-containing web material structuring belt 30 further comprises an associating layer 42. In one example, the associating layer 42 associates the support layer 32 with the structuring layer 34. In one example, the associating layer 42 comprises one or more protuberances 38 that associate with one or more of the seam portions 36 of the seam 10 of the structuring layer 34 by extending into, but less than entirely through the structuring layer 34. In one example, the associating layer 42 comprises one or more protuberances 38 that extends into, for example extends into, but less than entirely through, one or more non-seam portions of the structuring layer 34. In one example, the associating layer 42 comprises one or more protuberances 38 that extends into, for example extends into, but less than entirely through the support layer 32.

Figure 29A:
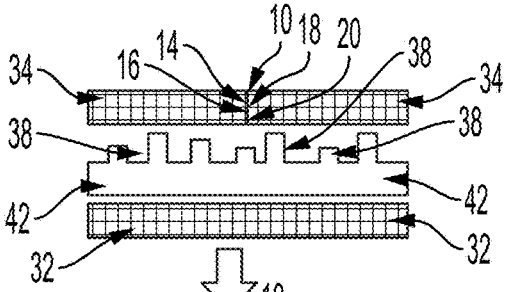
FIG. 29A is a cross-sectional representation of an example of a support layer, a structuring layer and an associating layer prior to forming a web material structuring belt according to the present invention.
Figure 29B:
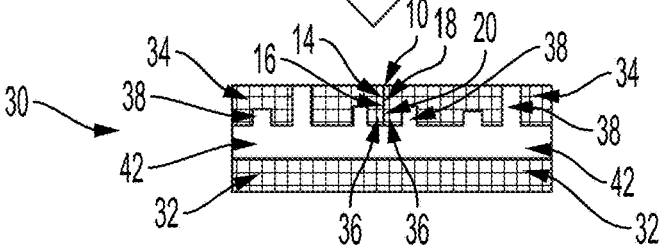
FIG. 29B is a cross-sectional representation of the web material structuring belt from FIG. 29A.

As shown in FIGS. 29A and 29B, a seam-containing web material structuring belt 30 comprising a support layer 32 and a structuring layer 34 comprising a seam 10, in this case an abut seam, wherein the seam 10 comprises at least one seam portion 36, formed by one or more of a first structuring layer material edge 14 having a first terminus 16 and/or a second structuring layer material edge 18 having a second terminus 20 that abut each other resulting in the abut seam. In addition to the support layer 32 and the structuring layer 34, the seam-containing web material structuring belt 30 further comprises an associating layer 42. In one example, the associating layer 42 associates the support layer 32 with the structuring layer 34. In one example, the associating layer 42 comprises one or more protuberances 38 that associate with one or more of the seam portions 36 of the seam 10 of the structuring layer 34 by extending into, but less than entirely through the structuring layer 34. In one example, the associating layer 42 comprises one or more protuberances 38 that extends into, for example extends into, but less than entirely through, one or more non-seam portions of the structuring layer 34.

Figure 30A:
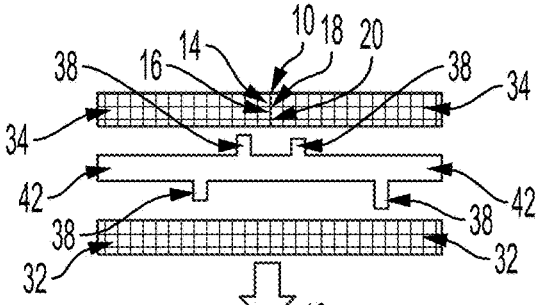
FIG. 30A is a cross-sectional representation of an example of a support layer, a structuring layer and an associating layer prior to forming a web material structuring belt according to the present invention.
Figure 30B:
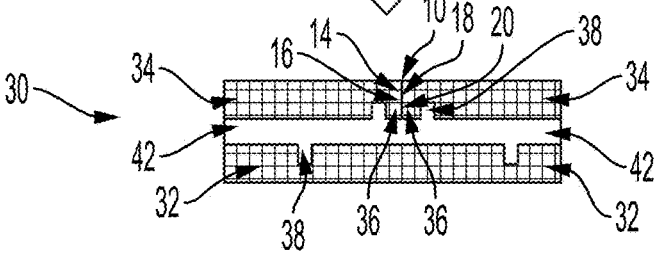
FIG. 30B is a cross-sectional representation of the web material structuring belt from FIG. 30A.

As shown in FIGS. 30A and 30B, a seam-containing web material structuring belt 30 comprising a support layer 32 and a structuring layer 34 comprising a seam 10, in this case an abut seam, wherein the seam 10 comprises at least one seam portion 36, formed by one or more of a first structuring layer material edge 14 having a first terminus 16 and/or a second structuring layer material edge 18 having a second terminus 20 that abut each other resulting in the abut seam. In addition to the support layer 32 and the structuring layer 34, the seam-containing web material structuring belt 30 further comprises an associating layer 42. In one example, the associating layer 42 associates the support layer 32 with the structuring layer 34. In one example, the associating layer 42 comprises one or more protuberances 38 that associate with one or more of the seam portions 36 of the seam 10 of the structuring layer 34 by extending into, but less than entirely through the structuring layer 34. In one example, the associating layer 42 comprises one or more protuberances 38 that extends into, for example extends into, but less than entirely through the support layer 32.

Figure 31A:
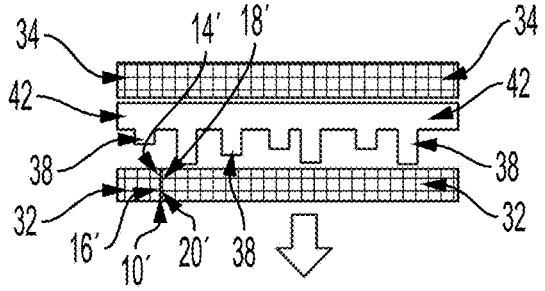
FIG. 31A is a cross-sectional representation of an example of a support layer, a structuring layer and an associating layer prior to forming a web material structuring belt according to the present invention.
Figure 31B:
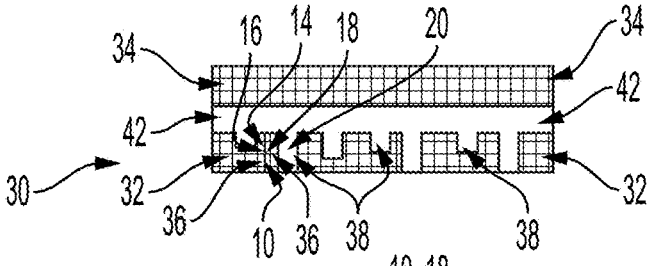
FIG. 31B is a cross-sectional representation of the web material structuring belt from FIG. 31A.

As shown in FIGS. 31A and 31B, a seam-containing web material structuring belt 30 comprising a support layer 32 comprising a seam 10, in this case an abut seam, wherein the seam 10 comprises at least one seam portion 36, formed by one or more of a first support layer material edge 14' having a first terminus 16' and/or a second support layer material edge 18' having a second terminus 20' that abut each other resulting in the abut seam and a structuring layer 34. In addition to the support layer 32 and the structuring layer 34, the seam-containing web material structuring belt 30 further comprises an associating layer 42. In one example, the associating layer 42 associates the support layer 32 with the structuring layer 34. In one example, the associating layer 42 comprises one or more protuberances 38 that associate with one or more of the seam portions 36 of the seam 10 of the support layer 32 by extending into, but less than entirely through the support layer 32. In one example, the associating layer 42 comprises one or more protuberances 38 that extends into, for example extends into, but less than entirely through, one or more non-seam portions of the support layer 32.

Figure 32A:
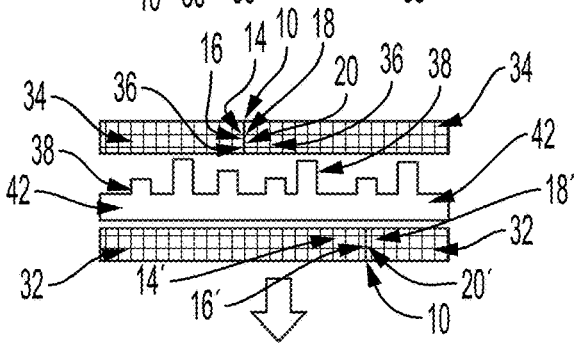
FIG. 32A is a cross-sectional representation of an example of a support layer, a structuring layer and an associating layer prior to forming a web material structuring belt according to the present invention.
Figure 32B:
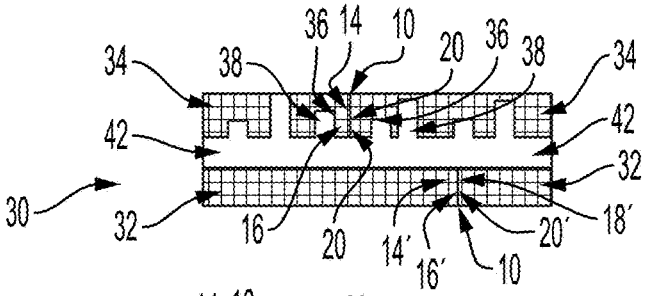
FIG. 32B is a cross-sectional representation of the web material structuring belt from FIG. 32A.

As shown in FIGS. 32A and 32B, a seam-containing web material structuring belt 30 comprising a support layer 32 comprising a seam 10, in this case an abut seam, wherein the seam 10 comprises at least one seam portion 36, formed by one or more of a first support layer material edge 14' having a first terminus 16' and/or a second support layer material edge 18' having a second terminus 20' that abut each other resulting in the abut seam and a structuring layer 34 comprising a seam 10, in this case an abut seam, wherein the seam 10 comprise at least one seam portion 36, formed by one or more of a first structuring layer material edge 14 having a first terminus 16 and/or a second structuring layer material edge 18 having a second terminus 20 that abut each other resulting in the abut seam. In addition to the support layer 32 and the structuring layer 34, the seam-containing web material structuring belt 30 further comprises an associating layer 42. In one example, the associating layer 42 associates the support layer 32 with the structuring layer 34. In one example, the associating layer 42 comprises one or more protuberances 38 that associate with one or more of the seam portions 36 of the seam 10 of the structuring layer 34 by extending into, but less than entirely through the structuring layer 34. In one example, the associating layer 42 comprises one or more protuberances 38 that extends into, for example extends into, but less than entirely through, one or more non-seam portions of the structuring layer 34. In one example, one or more seam portions 36 of the support layer 32 may be co-planar with at least a portion of the structuring layer 34, in other words, the at least one seam portion 36 of the support layer 32 does not extend into the structuring layer 34.

Figure 33A:
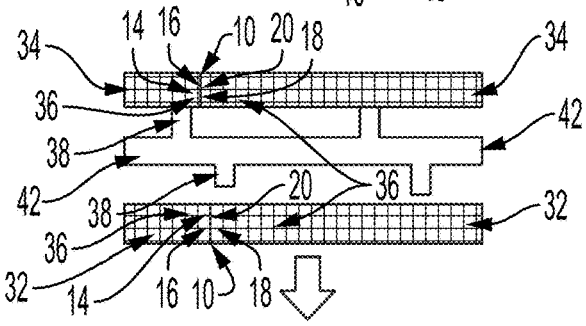
FIG. 33A is a cross-sectional representation of an example of a support layer, a structuring layer and an associating layer prior to forming a web material structuring belt according to the present invention.
Figure 33B:
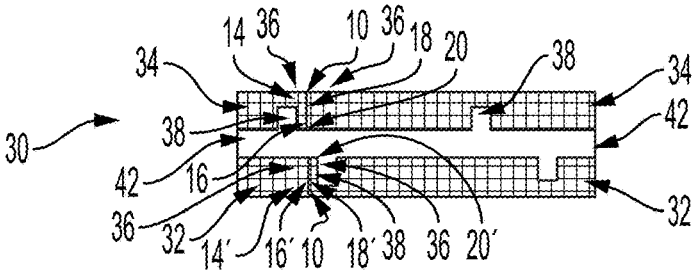
FIG. 33B is a cross-sectional representation of the web material structuring belt from FIG. 33A.

As shown in FIGS. 33A and 33B, a seam-containing web material structuring belt 30 comprising a support layer 32 comprising a seam 10, in this case an abut seam, wherein the seam 10 comprises at least one seam portion 36, formed by one or more of a first support layer material edge 14' having a first terminus 16' and/or a second support layer material edge 18' having a second terminus 20' that abut each other resulting in the abut seam and a structuring layer 34 comprising a seam 10, in this case an abut seam, wherein the seam 10 comprise at least one seam portion 36, formed by one or more of a first structuring layer material edge 14 having a first terminus 16 and/or a second structuring layer material edge 18 having a second terminus 20 that abut each other resulting in the abut seam. In addition to the support layer 32 and the structuring layer 34, the seam-containing web material structuring belt 30 further comprises an associating layer 42. In one example, the associating layer 42 associates the support layer 32 with the structuring layer 34. In one example, the associating layer 42 comprises one or more protuberances 38 that associate with one or more of the seam portions 36, in this case one seam portion 36, of the seam 10 of the structuring layer 34 by extending into, but less than entirely through the structuring layer 34. In one example, the associating layer 42 comprises one or more protuberances 38 that extends into, for example extends into, but less than entirely through, one or more non-seam portions of the structuring layer 34. In one example, the associating layer 42 comprises one or more protuberances 38 that associate with one or more of the seam portions 36, in this case one seam portion 36, of the seam 10 of the support layer 32 by extending into, but less than entirely through the support layer 32. In one example, the associating layer 42 comprises one or more protuberances 38 that extends into, for example extends into, but less than entirely through, one or more non-seam portions of the support layer 32.

Figure 34A:
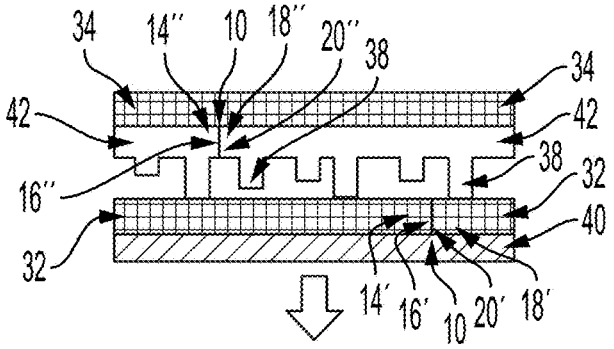
FIG. 34A is a cross-sectional representation of an example of a support layer, a structuring layer, a backing layer and an associating layer prior to forming a web material structuring belt according to the present invention.
Figure 34B:
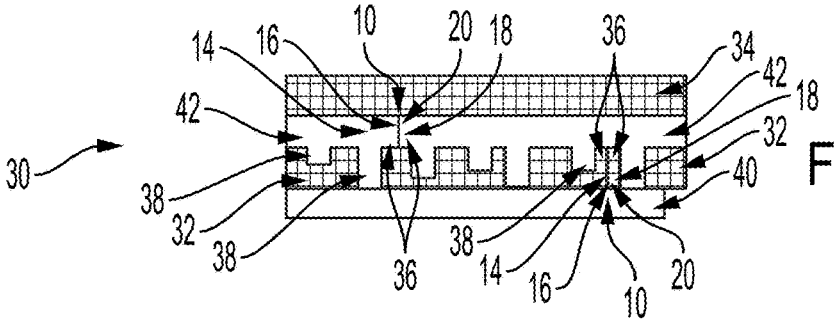
FIG. 34B is a cross-sectional representation of the web material structuring belt from FIG. 34A.

As shown in FIGS. 34A and 34B, a seam-containing web material structuring belt 30 comprising a support layer 32 comprising a seam 10, in this case an abut seam, and a structuring layer 34. The seam 10 of the support layer 32 is formed by one or more of a first support layer material edge 14' having a first terminus 16' and/or a second support layer material edge 18' having a second terminus 20' that abut each other resulting in the abut seam. In addition to the support layer 32 and the structuring layer 34, the seam-containing web material structuring belt 30 further comprises an associating layer 42 that associates the support layer 32 with the structuring layer 34 and a backing layer 40. In one example, the associating layer 42 comprises a seam 10, in this case an abut seam, which is formed by one or more of a first associating layer material edge 14" having a first terminus 16" and/or a second associating layer material edge 18" having a second terminus 20" that abut each other resulting in the abut seam. In one example, the associating layer 42 comprises one or more protuberances 38 that associate with one or more of the seam portions 36, in this case two seam portions 36, of the seam 10 of the support layer 32 by extending into, but less than entirely through the support layer 32. In one example, the associating layer 42 comprises one or more protuberances 38 that extends into, for example extends into, but less than entirely through, one or more non-seam portions of the support layer 32. In one example, one or more seam portions 36 of the associating layer 42 may be co-planar with at least a portion of the support layer 32 and/or the structuring layer 34, in other words, the at least one seam portion 36 of the associating layer 42 does not extend into the support layer 32 and/or the structuring layer 34. In one example, one or more protuberances 38 of the associating layer 42 extend entirely through the support layer 32 to contact the backing layer 40. In one example, the backing layer 40 may be present on at least a portion of the support layer's 32 surface opposite the associating layer 42.

Figure 35:
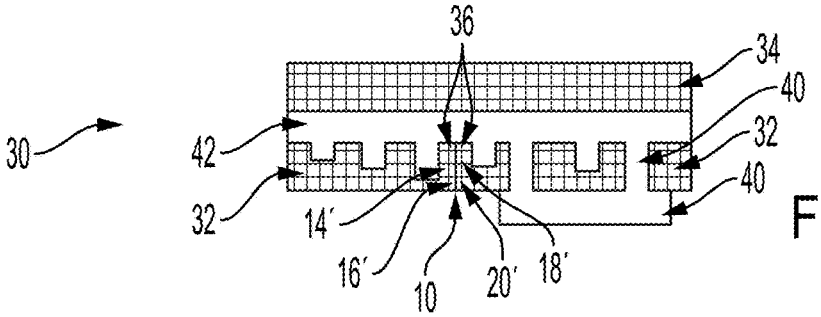
FIG. 35 is a cross-sectional representation of an example of a support layer, a structuring layer, a backing layer and an associating layer prior to forming a web material structuring belt according to the present invention.

As shown in FIG. 35, a seam-containing web material structuring belt 30 comprising a support layer 32 comprising a seam 10, in this case an abut seam, and a structuring layer 34. The seam 10 of the support layer 32 is formed by one or more of a first support layer material edge 14' having a first terminus 16' and/or a second support layer material edge 18' having a second terminus 20' that abut each other resulting in the abut seam. In addition to the support layer 32 and the structuring layer 34, the seam-containing web material structuring belt 30 further comprises an associating layer 42 that associates the support layer 32 with the structuring layer 34 and a backing layer 40. In one example, the associating layer 42 comprises one or more protuberances 38 that associate with one or more of the seam portions 36, in this case two seam portions 36, of the seam 10 of the support layer 32 by extending into, but less than entirely through the seam portion 36 of the support layer 32. In one example, the associating layer 42 comprises one or more protuberances 38 that extends into, for example extends into, but less than entirely through, one or more non-seam portions of the support layer 32. In one example, one or more seam portions 36 of the support layer 32 may be co-planar with at least a portion of the associating layer 42, in other words, the at least one seam portion 36 of the support layer 32 does not extend into the associating layer 42. In one example, the backing layer 40 may be present on at least a portion of the support layer's 32 surface opposite the associating layer 42 and may extend through the support layer 32 into contact with the associating layer 42.

Figure 36:
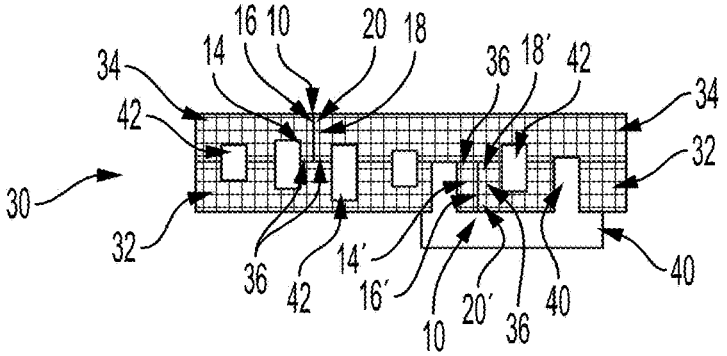
FIG. 36 is a cross-sectional representation of an example of a support layer, a structuring layer, a backing layer and an associating layer prior to forming a web material structuring belt according to the present invention.

As shown in FIG. 36, a seam-containing web material structuring belt 30 comprising a support layer 32 comprising a seam 10, in this case an abut seam, and a structuring layer 34 comprising a seam 10, in this case an abut seam. The seam 10 of the support layer 32 is formed by one or more of a first support layer material edge 14' having a first terminus 16' and/or a second support layer material edge 18' having a second terminus 20' that abut each other resulting in the abut seam. The seam 10 of the structuring layer 34 is formed by one or more of a first support layer material edge 14 having a first terminus 16 and/or a second support layer material edge 18 having a second terminus 20 that abut each other resulting in the abut seam. In addition to the support layer 32 and the structuring layer 34, the seam-containing web material structuring belt 30 further comprises an associating layer 42 that associates the support layer 32 with the structuring layer 34 and a backing layer 40. In one example, the associating layer 42 is present as discrete associating layer material portions that associate with one or more of the seam portions 36, in this case one seam portion 36, of the seam 10 of the support layer 32 by extending into, but less than entirely through the seam portion 36 of the support layer 32. In one example, the associating layer 42 comprises one or more associating layer material portions that extends into, for example extends into, but less than entirely through, one or more non-seam portions of the support layer 32. In one example, at least one of the associating layer material portions extends into, but less than entirely through the support layer 32 and/or the structuring layer 34. In one example, one or more seam portions 36 of the support layer 32 may be co-planar with at least a portion of the associating layer 42, in other words, the at least one seam portion 36 of the support layer 32 does not extend into the associating layer 42. In one example, the backing layer 40 may be present on at least a portion of the support layer's 32 surface opposite the associating layer 42 and may extend through the support layer 32 into contact with the associating layer 42. The backing layer 40 may extend into, for example may extend into, but less that entirely through the support layer 32 and/or the one or more seam portion 36.

Figure 37:
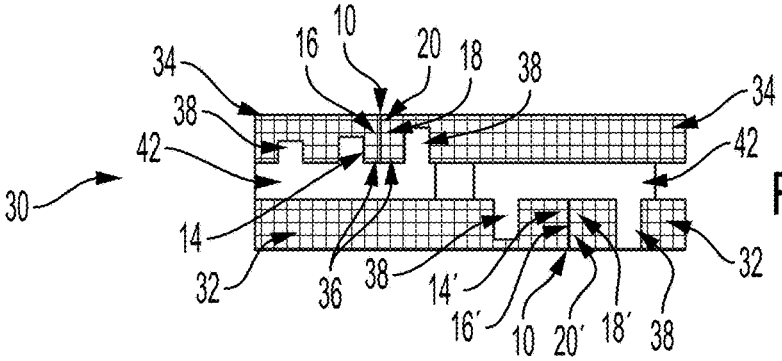
FIG. 37 is a cross-sectional representation of an example of a support layer, a structuring layer, a backing layer and an associating layer prior to forming a web material structuring belt according to the present invention.

As shown in FIG. 37, a seam-containing web material structuring belt 30 comprising a support layer 32 comprising a seam 10, in this case an abut seam, and a structuring layer 34 comprising a seam 10, in this case an abut seam. The seam 10 of the support layer 32 is formed by one or more of a first support layer material edge 14' having a first terminus 16' and/or a second support layer material edge 18' having a second terminus 20' that abut each other resulting in the abut seam. The seam 10 of the structuring layer 34 is formed by one or more of a first support layer material edge 14 having a first terminus 16 and/or a second support layer material edge 18 having a second terminus 20 that abut each other resulting in the abut seam. In addition to the support layer 32 and the structuring layer 34, the seam-containing web material structuring belt 30 further comprises an associating layer 42 that associates the support layer 32 with the structuring layer 34. In one example, the associating layer 42 is present as discrete associating layer material portions that associate with one or more of the seam portions 36, in this case two seam portions 36, of the seam 10 of the structuring layer 34 by extending into, but less than entirely through the seam portion 36 of the structuring layer 34. In one example, the associating layer 42 comprises one or more associating layer material portions that extends into, for example extends into, but less than entirely through, one or more non-seam portions of the support layer 32 and/or the structuring layer 34. In one example, at least one of the associating layer material portions extends into, but less than entirely through the support layer 32 and/or the structuring layer 34. In one example, one or more seam portions 36 of the support layer 32 may be co-planar with at least a portion of the associating layer 42, in other words, the at least one seam portion 36 of the support layer 32 does not extend into the associating layer 42.

Figure 38A:
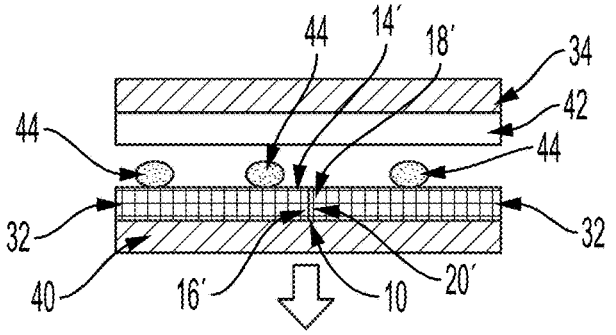
FIG. 38A is a cross-sectional representation of an example of a support layer, a structuring layer, a backing layer, an associating layer and a bonding material prior to forming a web material structuring belt according to the present invention.
Figure 38B:
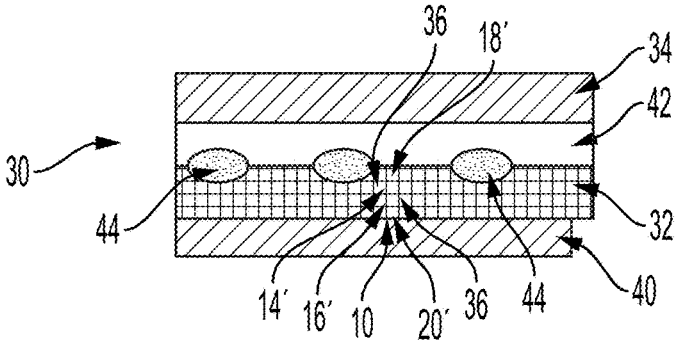
FIG. 38B is a cross-sectional representation of the web material structuring belt from FIG. 38A.

As shown in FIGS. 38A and 38B, a seam-containing web material structuring belt 30 comprising a support layer 32 comprising a seam 10, in this case an abut seam, and a structuring layer 34. The seam 10 of the support layer 32 is formed by one or more of a first support layer material edge 14' having a first terminus 16' and/or a second support layer material edge 18' having a second terminus 20' that abut each other resulting in the abut seam. In addition to the support layer 32 and the structuring layer 34, the seam-containing web material structuring belt 30 further comprises an associating layer 42 that associates the support layer 32 with the structuring layer 34 and a bonding material 44. In one example, the bonding material 44 is present as discrete bonding material portions that associate with one or more of the seam portions 36, in this case one seam portion 36, of the seam 10 of the support layer 32 by extending into, but less than entirely through the seam portion 36 of the support layer 32. In one example, the bonding material 44 comprises one or more bonding material portions that extends into, for example extends into, but less than entirely through, one or more non-seam portions of the support layer 32 and/or the associating layer 42. In one example, one or more seam portions 36 of the support layer 32 may be co-planar with at least a portion of the associating layer 42, in other words, the at least one seam portion 36 of the support layer 32 does not extend into the associating layer 42.

Figure 39:
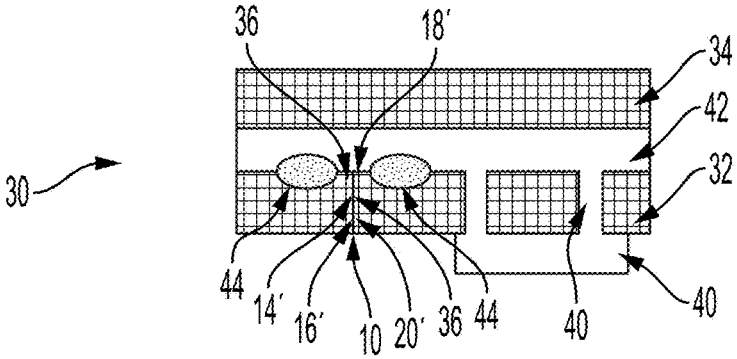
FIG. 39 is a cross-sectional representation of an example of a support layer, a structuring layer, a backing layer, an associating layer and a bonding material prior to forming a web material structuring belt according to the present invention.

As shown in FIG. 39, a seam-containing web material structuring belt 30 comprising a support layer 32 comprising a seam 10, in this case an abut seam, and a structuring layer 34. The seam 10 of the support layer 32 is formed by one or more of a first support layer material edge 14' having a first terminus 16' and/or a second support layer material edge 18' having a second terminus 20' that abut each other resulting in the abut seam. In addition to the support layer 32 and the structuring layer 34, the seam-containing web material structuring belt 30 further comprises an associating layer 42 that associates the support layer 32 with the structuring layer 34, a backing layer 40 and a bonding material 44. In one example, the bonding material 44 is present as discrete bonding material portions that associate with one or more of the seam portions 36, in this case two seam portions 36, of the seam 10 of the support layer 32 by extending into, but less than entirely through the seam portion 36 of the support layer 32. In one example, one or more seam portions 36 of the support layer 32 may be co-planar with at least a portion of the associating layer 42, in other words, the at least one seam portion 36 of the support layer 32 does not extend into the associating layer 42. In one example, the backing layer 40 may be present on at least a portion of the support layer's 32 surface opposite the associating layer 42 and may extend through the support layer 32 into contact with the associating layer 42.

Figure 40:
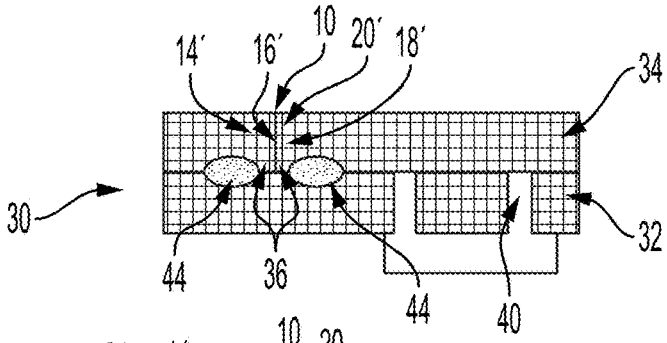
FIG. 40 is a cross-sectional representation of an example of a support layer, a structuring layer, a backing layer and a bonding material prior to forming a web material structuring belt according to the present invention.

As shown in FIG. 40, a seam-containing web material structuring belt 30 comprising a support layer 32 and a structuring layer 34 comprising a seam 10, in this case an abut seam, and a structuring layer 34. The seam 10 of the structuring layer 34 is formed by one or more of a first support layer material edge 14 having a first terminus 16 and/or a second support layer material edge 18 having a second terminus 20 that abut each other resulting in the abut seam. In addition to the support layer 32 and the structuring layer 34, the seam-containing web material structuring belt 30 further comprises a backing layer 40 and a bonding material 44. In one example, the bonding material 44 is present as discrete bonding material portions that associate with one or more of the seam portions 36, in this case two seam portions 36, of the seam 10 of the structuring layer 34 by extending into, but less than entirely through the seam portion 36 of the structuring layer 34. In one example, one or more seam portions 36 of the structuring layer 34 may be co-planar with at least a portion of the support layer 32, in other words, the at least one seam portion 36 of the structuring layer 34 does not extend into the support layer 32. In one example, the backing layer 40 may be present on at least a portion of the support layer's 32 surface opposite the associating layer 42 and may extend through the support layer 32 into contact with the structuring layer 34.

Figure 41:
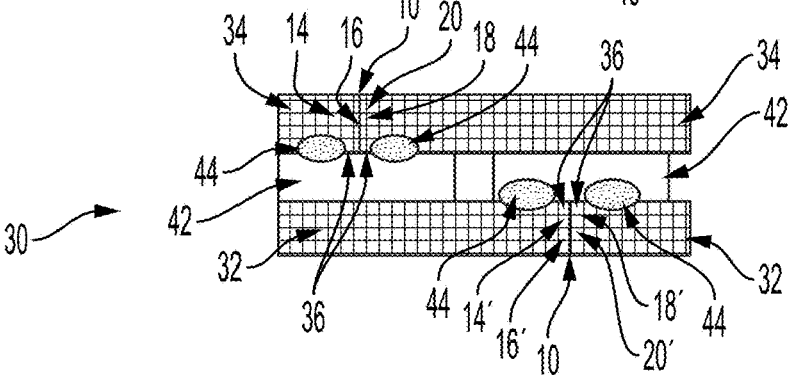
FIG. 41 is a cross-sectional representation of an example of a support layer, a structuring layer, an associating layer and a bonding material prior to forming a web material structuring belt according to the present invention.

As shown in FIG. 41, a seam-containing web material structuring belt 30 comprising a support layer 32 comprising a seam 10, in this case an abut seam, and a structuring layer 34 comprising a seam 10, in this case an abut seam. The seam 10 of the support layer 32 is formed by one or more of a first support layer material edge 14' having a first terminus 16' and/or a second support layer material edge 18' having a second terminus 20' that abut each other resulting in the abut seam. The seam 10 of the structuring layer 34 is formed by one or more of a first support layer material edge 14 having a first terminus 16 and/or a second support layer material edge 18 having a second terminus 20 that abut each other resulting in the abut seam. In addition to the support layer 32 and the structuring layer 34, the seam-containing web material structuring belt 30 further comprises an associating layer 42 that associates the support layer 32 with the structuring layer 34 and a bonding material 44. In one example, the associating layer 42 is present in discrete associating layer material portions. In one example, the bonding material 44 is present as discrete bonding material portions that associate with one or more of the seam portions 36, in this case two seam portions 36, of the seam 10 of the support layer 32 by extending into, but less than entirely through the seam portion 36 of the support layer 32. In one example, one or more seam portions 36 of the support layer 32 may be co-planar with at least a portion of the associating layer 42, in other words, the at least one seam portion 36 of the support layer 32 does not extend into the associating layer 42. In one example, the bonding material 44 is present as discrete bonding material portions that associate with one or more of the seam portions 36, in this case two seam portions 36, of the seam 10 of the structuring layer 34 by extending into, but less than entirely through the seam portion 36 of the structuring layer 34. In one example, one or more seam portions 36 of the structuring layer 34 may be co-planar with at least a portion of the associating layer 42, in other words, the at least one seam portion 36 of the structuring layer 34 does not extend into the associating layer 42.

Figure 42:
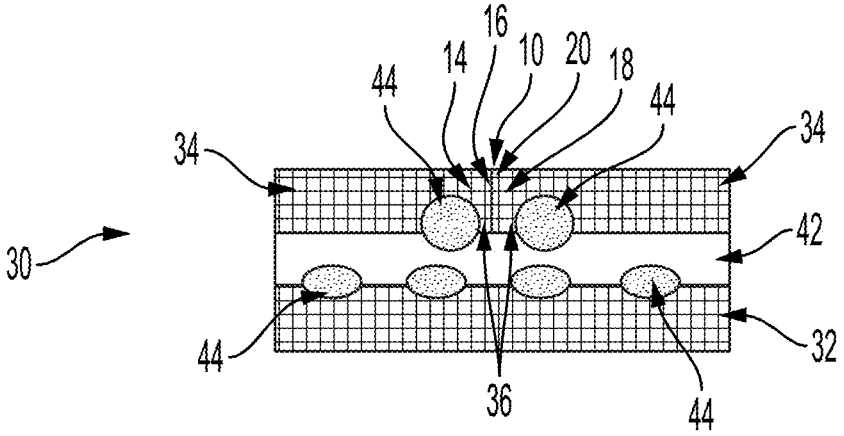
FIG. 42 is a cross-sectional representation of an example of a support layer, a structuring layer, an associating layer and a bonding material prior to forming a web material structuring belt according to the present invention.

As shown in FIG. 42, a seam-containing web material structuring belt 30 comprising a support layer 32 and a structuring layer 34 comprising a seam 10, in this case an abut seam. The seam 10 of the structuring layer 34 is formed by one or more of a first support layer material edge 14 having a first terminus 16 and/or a second support layer material edge 18 having a second terminus 20 that abut each other resulting in the abut seam. In addition to the support layer 32 and the structuring layer 34, the seam-containing web material structuring belt 30 further comprises an associating layer 42 that associates the support layer 32 with the structuring layer 34 and a bonding material 44. In one example, the bonding material 44 is present as discrete bonding material portions that associate with one or more of the seam portions 36, in this case two seam portions 36, of the seam 10 of the support layer 32 by extending into, but less than entirely through the seam portion 36 of the support layer 32. In one example, one or more seam portions 36 of the support layer 32 may be co-planar with at least a portion of the associating layer 42, in other words, the at least one seam portion 36 of the support layer 32 does not extend into the associating layer 42. In one example, the bonding material 44 is present as discrete bonding material portions that associate with one or more of the seam portions 36, in this case two seam portions 36, of the seam 10 of the structuring layer 34 by extending into, but less than entirely through the seam portion 36 of the structuring layer 34. In one example, one or more seam portions 36 of the structuring layer 34 may be co-planar with at least a portion of the associating layer 42, in other words, the at least one seam portion 36 of the structuring layer 34 does not extend into the associating layer 42.

Figure 43:
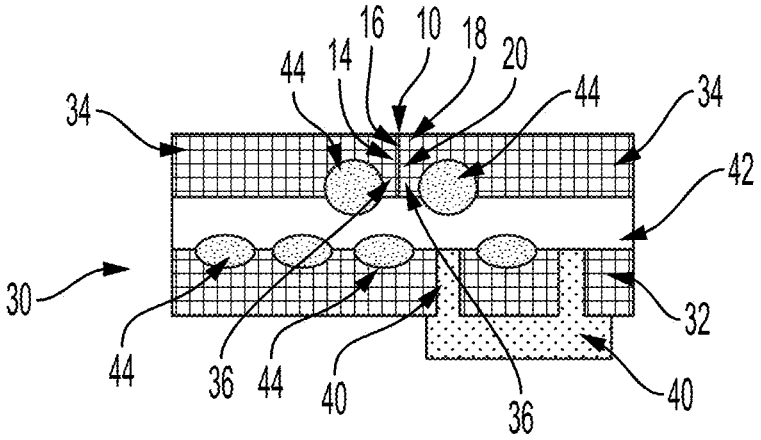
FIG. 43 is a cross-sectional representation of an example of a support layer, a structuring layer, a backing layer, an associating layer and a bonding material prior to forming a web material structuring belt according to the present invention.

As shown in FIG. 43, a seam-containing web material structuring belt 30 comprising a support layer 32 and a structuring layer 34 comprising a seam 10, in this case an abut seam. The seam 10 of the structuring layer 34 is formed by one or more of a first structuring layer material edge 14 having a first terminus 16 and/or a second structuring layer material edge 18 having a second terminus 20 that abut each other resulting in the abut seam. In addition to the support layer 32 and the structuring layer 34, the seam-containing web material structuring belt 30 further comprises an associating layer 42 that associates the support layer 32 with the structuring layer 34, a backing layer 40 and a bonding material 44. In one example, the bonding material 44 is present as discrete bonding material portions that associate with one or more of the seam portions 36, in this case two seam portions 36, of the seam 10 of the support layer 32 by extending into, but less than entirely through the seam portion 36 of the support layer 32. In one example, one or more seam portions 36 of the support layer 32 may be co-planar with at least a portion of the associating layer 42, in other words, the at least one seam portion 36 of the support layer 32 does not extend into the associating layer 42. In one example, the bonding material 44 is present as discrete bonding material portions that associate with one or more of the seam portions 36, in this case two seam portions 36 of the seam 10 of the structuring layer 34 by extending into, but less than entirely through the seam portion 36 of the structuring layer 34. In one example, one or more seam portions 36 of the structuring layer 34 may be co-planar with at least a portion of the associating layer 42, in other words, the at least one seam portion 36 of the structuring layer 34 does not extend into the associating layer 42. In one example, the backing layer 40 may be present on at least a portion of the support layer's 32 surface opposite the associating layer 42 and may extend through the support layer 32 into contact with the structuring layer 34.

Figure 44A:
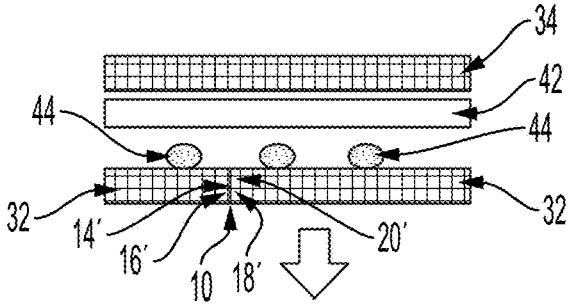
FIG. 44A is a cross-sectional representation of an example of a support layer, a structuring layer, an associating layer and a bonding material prior to forming a web material structuring belt according to the present invention.
Figure 44B:
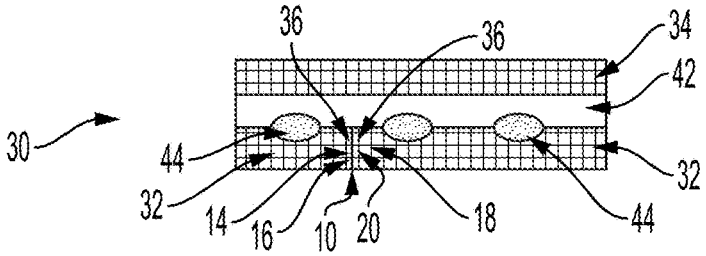
FIG. 44B is a cross-sectional representation of the web material structuring belt from FIG. 44A.

As shown in FIGS. 44A and 44B, a seam-containing web material structuring belt 30 comprising a support layer 32 comprising a seam 10, in this case an abut seam, and a structuring layer 34. The seam 10 of the support layer 32 is formed by one or more of a first support layer material edge 14' having a first terminus 16' and/or a second support layer material edge 18' having a second terminus 20' that abut each other resulting in the abut seam. In addition to the support layer 32 and the structuring layer 34, the seam-containing web material structuring belt 30 further comprises an associating layer 42 that associates the support layer 32 with the structuring layer 34 and a bonding material 44. In one example, the bonding material 44 is present as discrete bonding material portions that associate with one or more of the seam portions 36, in this case two seam portions 36 of the seam 10 of the support layer 32 by extending into, but less than entirely through the seam portion 36 of the support layer 32. In one example, one or more seam portions 36 of the support layer 32 may be co-planar with at least a portion of the associating layer 42, in other words, the at least one seam portion 36 of the support layer 32 does not extend into the associating layer 42.

Figure 45A:
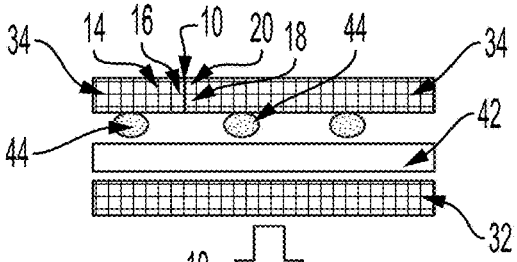
FIG. 45A is a cross-sectional representation of an example of a support layer, a structuring layer, an associating layer and a bonding material prior to forming a web material structuring belt according to the present invention.
Figure 45B:
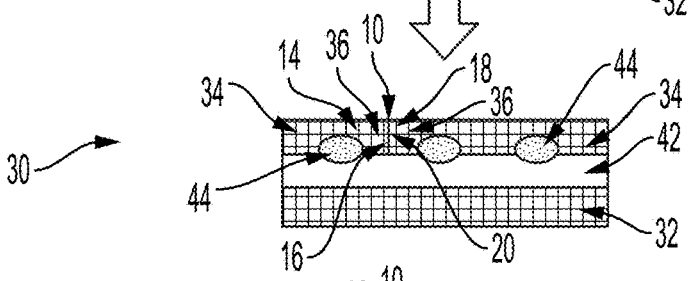
FIG. 45B is a cross-sectional representation of the web material structuring belt from FIG. 45A.

As shown in FIGS. 45A and 45B, a seam-containing web material structuring belt 30 comprising a support layer 32 and a structuring layer 34 comprising a seam 10, in this case an abut seam. The seam 10 of the structuring layer 34 is formed by one or more of a first structuring layer material edge 14 having a first terminus 16 and/or a second structuring layer material edge 18 having a second terminus 20 that abut each other resulting in the abut seam. In addition to the support layer 32 and the structuring layer 34, the seam-containing web material structuring belt 30 further comprises an associating layer 42 that associates the support layer 32 with the structuring layer 34 and a bonding material 44. In one example, the bonding material 44 is present as discrete bonding material portions that associate with one or more of the seam portions 36, in this case two seam portions 36 of the seam 10 of the structuring layer 34 by extending into, but less than entirely through the seam portion 36 of the structuring layer 34. In one example, one or more seam portions 36 of the structuring layer 34 may be co-planar with at least a portion of the associating layer 42, in other words, the at least one seam portion 36 of the structuring layer 34 does not extend into the associating layer 42.

Figure 46A:
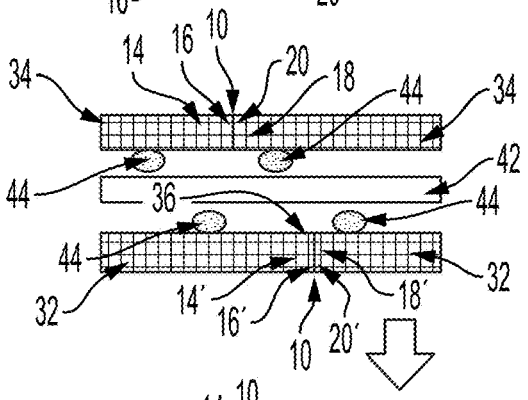
FIG. 46A is a cross-sectional representation of an example of a support layer, a structuring layer, an associating layer and a bonding material prior to forming a web material structuring belt according to the present invention.
Figure 46B:
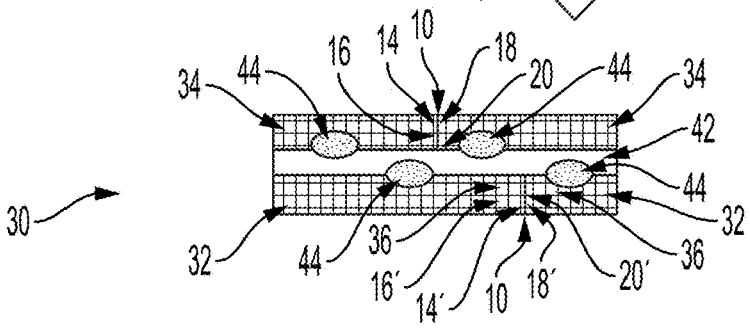
FIG. 46B is a cross-sectional representation of the web material structuring belt from FIG. 46A.

As shown in FIGS. 46A and 46B, a seam-containing web material structuring belt 30 comprising a support layer 32 comprising a seam 10, in this case an abut seam, and a structuring layer 34 comprising a seam 10, in this case an abut seam. The seam 10 of the support layer 32 is formed by one or more of a first support layer material edge 14' having a first terminus 16' and/or a second support layer material edge 18' having a second terminus 20' that abut each other resulting in the abut seam. The seam 10 of the structuring layer 34 is formed by one or more of a first structuring layer material edge 14 having a first terminus 16 and/or a second structuring layer material edge 18 having a second terminus 20 that abut each other resulting in the abut seam. In addition to the support layer 32 and the structuring layer 34, the seam-containing web material structuring belt 30 further comprises an associating layer 42 that associates the support layer 32 with the structuring layer 34 and a bonding material 44. In one example, the bonding material 44 is present as discrete bonding material portions that associate with one or more of the seam portions 36, in this case one seam portion 36 of the seam 10 of the support layer 32 by extending into, but less than entirely through the seam portion 36 of the support layer 32. In one example, one or more seam portions 36 of the support layer 32 may be co-planar with at least a portion of the associating layer 42, in other words, the at least one seam portion 36 of the support layer 32 does not extend into the associating layer 42. In one example, the bonding material 44 is present as discrete bonding material portions that associate with one or more of the seam portions 36, in this case one seam portion 36 of the seam 10 of the structuring layer 34 by extending into, but less than entirely through the seam portion 36 of the structuring layer 34. In one example, one or more seam portions 36 of the structuring layer 34 may be co-planar with at least a portion of the associating layer 42, in other words, the at least one seam portion 36 of the structuring layer 34 does not extend into the associating layer 42. In one example, one or more bonding material portions associate with one or more non-seam portions of the support layer 32 and/or the structuring layer 34 by extending into, but less than entirely through the support layer 32 and/or the structuring layer 34.

Even though the examples of web material structuring belts and layers and/or materials therein are described above with a seam in one or more of the layers and/or materials, in other examples, not shown, the seam (which may be any type of seam described herein) may be present in any one or more of the layers and/or materials of the web material structuring belts of the present invention such that one or more, for example at least two, seam portions of the seam are associated with another layer or material within the web material structuring belt. Further, the layers and/or materials and/or web material structuring belts of the present invention may comprise two or more different types of seam described herein.

In one example, the one or more protuberances 38 shown in the layers, materials and/or web material structuring belts of the present invention may extend into the a layer, for example uniformly or non-uniformly, such as at two or more and/or three or more and/or four or more different distances, for example z-direction thicknesses of the layer into which the protuberance(s) extend.

In one example of the present invention, at least one seam portion of a layer is mechanically entangled with another layer and/or material. In one example, mechanically entangled comprises wrapping and/or encircling of one or more components of a layer, such as one or more fibrous elements, for example one or more filaments, by the other layer's seam portion. In another example, mechanically entangled comprises at least one seam portion of a layer having a non-linear shape that extends into and locks into place due to its shape and its interaction with the other layer, for example, a hook and loop system. In one example, the mechanical entanglement results in a layer and/or seam portion of a layer, for example a structuring layer, becoming interwoven and/or interlocked with another layer, such as a support layer and/or the mechanical entanglement results in a layer and/or seam portion of a layer, for example a support layer, becoming interwoven and/or interlocked with another layer, such as a structuring layer.

In one example of the present invention, at least one seam portion of a layer is bonded to the another layer and/or material at one or more bond sites. In one example, at least one of the one or more bond sites are thermal bond sites. In one example, at least one of the one or more bond sites are chemical bond sites. In one example, at least one of the one or more bond sites are adhesive bond sites. In one example, two or more bond sites are different types of bond sites, for example one of the bond sites is a thermal bond site, chemical bond site or adhesive bond site and the other is a different type of bond site.

In one example, the at least one seam portion of the structuring layer may be associated with the support layer by lamination. In another example, the at least one seam portion of the support layer may be associated with the structuring layer by lamination. In another example, the at least one seam portion of the structuring layer may be associated with the support layer by lamination and the at least one seam portion of the support layer may be associated with the structuring layer by lamination. Lamination may be occur, for example by an adhesive, adhesive tape, mechanical fasteners, for example hook and loop, mechanical fastening, heat welding, ultrasonic welding, solvent welding, laser fusion and/or welding, covalent crosslinking between materials of the layers and/or within a layer's material itself, wrapping of components of one layer, for example yarns and/or threads and/or filaments of one layer, by another layer's material, thermosetting of one layer's material within another layer and/or solidifying of one layer's material within another layer.

Lamination (associating) of the at least one seam portion of structuring layer and/or the at least one seam portion of the support layer to the other layer may include at least a portion of one of the at least one seam portions exhibiting limited embedment, for example greater than 0 μm and/or greater than 30 μm and/or greater than 40 μm and/or greater than 50 μm and/or greater than 100 μm and/or to less than 5000 μm and/or to less than 4000 μm and/or to less than 3000 μm and/or to less than 2000 μm and/or in yet another example greater than the thickness of at least one yarn, thread and/or filament, for example at least one filament that forms at least a part of a surface of the structuring layer associated with the support layer, for example greater than 300 μm and/or greater than 400 μm and/or greater than 500 μm and/or greater than 600 μm and/or to less than 5000 μm and/or to less than 4000 μm and/or to less than 3000 μm and/or to less than 2000 μm and/or in even yet another example greater than 5% and/or greater than 10% and/or greater than 20% and/or greater than 30% and/or greater than 40% and/or to less than 95% and/or to less than 90% and/or to less than 80% and/or to less than 70% and/or to less than 60% of the thickness of the structuring layer), but less than entirely through the other layer.

In one example of the present invention, the at least one seam portion of the structuring layer 34 that extends into, but less than entirely through the support layer 32 associates with, such as wraps and/or envelopes a component, for example a fibrous element, such as a filament in the support layer 32. In another example, the at least one seam portion of the support layer 32 that extends into, but less than entirely through the structuring layer 34 associates with, such as wraps a component, for example a fibrous element, such as a filament in the structuring layer 34. In another example, the at least one seam portion of the support layer 32 that extends into, but less than entirely through the structuring layer 34 associates with, such as wraps a component, for example a physical feature, such as a particle and/or an additive manufacturing element, in the structuring layer 34.

In one example, the seam-containing web material structuring belt of the present invention is an endless belt comprising at least one seam in the support layer and/or the structuring layer.

In addition to seam portions of the support layer and/or structuring layer being associated with the other layer, non-seam portions of the support layer and/or the structuring layer may be associated with one another by any suitable lamination process.

Non-limiting examples of suitable lamination processes for associating a seam portion of the support layer and/or the structuring layer with the other layer according to the present invention include the following.

A seam of a structuring layer may be created on a pre-existing support layer by additive manufacturing such that at least one seam portion of the seam of the structuring layer penetrates into, but not entirely through the support layer, as described herein, for example by treating the structuring layer and/or treating the support layer as described herein.

A seam of a support layer may be created on a pre-existing structuring layer by additive manufacturing such that at least one seam portion of the seam of the support layer penetrates into, but not entirely through the structuring layer, as described herein, for example by treating the support layer and/or treating the structuring layer as described herein.

A seam portion of a support layer may be combined (brought into contact with a structuring layer) and then the seam portion may be treated, as described herein, such that the seam portion penetrates into, but not entirely through the structuring layer.

A seam portion of a structuring layer may be combined (brought into contact with a support layer) and then the seam portion may be treated, as described herein, such that the seam portion penetrates into, but not entirely through the support layer.

In one example, the support layer and the structuring layer may comprise the same material composition and/or similar classes of materials.

In one example, the support layer and the structuring layer may comprise compatible materials.

In one example, the support layer and the structuring layer may comprise incompatible materials. When the support layer and the structuring layer comprise incompatible materials, an associating layer material may be used that is compatible with one or both of the support layer and the structuring layer.

In one example, the support layer and the structuring layer may comprise different material compositions and/or different classes of materials.

In one example, a seam portion of a web material structuring belt exhibits less than a 5% and/or less than a 4% and/or less than a 3% and/or less than a 2% and/or less than a 1% and/or about 0% difference in air perm relative to a non-seam portion of the web material structuring belt.

The web material structuring belts, for example laminated web material structuring belts, of the present invention may exhibit a Peak Peel Force value of greater than 0.1 N and/or greater than 0.3 N and/or greater than 0.5 N and/or greater than 0.8 N to less than 12.0 N and/or to less than 10.0 N and/or to less than 8.0 N and/or to less than 6.0 N and/or to less than 4.0 N as measured according to the Seam 180° Free Peel Test Method described herein.

The web material structuring belts, for example laminated web material structuring belts, of the present invention may exhibit an Energy value of greater than 0.1 J/m and/or greater than 0.3 J/m and/or greater than 0.5 J/m and/or greater than 0.8 J/m and/or to less than 12.0 J/m and/or to less than 10.0 J/m and/or to less than 8.0 J/m and/or to less than 6.0 J/m and/or to less than 4.0 J/m as measured according to the Seam 180° Free Peel Test Method described herein.

In one example, the termini of one or more seam portions of a seam of the support layer material and/or the structuring layer material and/or associating layer material may comprise a bonding material, such as an adhesive, such that the bonding material associates, such as bonds, the termini of the seam portions together to form an abut seam and/or overlap seam.

In one example, one or more seam portions for example one or more structuring layer material seam portions and/or one or more support layer material seam portions may comprise one or more fibrous element, for example filament, ends that are associated with, for example bonded to, the other layer. In one example, at least one of the one or more fibrous element ends extends into the other layer, such as at least partially along the seam's length. In one example, the one or more fibrous element ends may extend into the other layer and terminate in the originating layer, for example, one or more fibrous element ends of a structuring layer, for example a structuring layer material seam, such as a structuring layer material seam portion, may extend, for example at least partially extend into the support layer along the structuring layer material seam's length and terminate into a portion, for example the same portion or different portion of the structuring layer, such as a different structuring layer material seam portion. In one example, one or more fibrous element ends of a seam portion, for example a structuring layer material seam portion, may at least partially pass through a different structuring layer material seam portion of the structuring layer material seam. In one example, one or more fibrous element ends of a seam portion may extend into a non-seam portion of the structuring layer. In another example, one or more fibrous element ends of a first seam portion may at least partially pass through a second seam portion and/or a non-seam portion of a layer, for example a structuring layer and/or a support layer. In one example, one or more fibrous element ends of a seam portion of a layer may extends into a non-seam portion of a layer. In still another example, one or more fibrous element ends of a seam portion may be associated with the a non-seam portion of a layer and/or another seam portion of a layer. In one example, a layer, for example a support layer and/or a structuring layer, may comprise a woven and/or a nonwoven material and/or a batt material and/or a felt material comprising a plurality of fibrous elements, one or more of which comprise fibrous elements ends that may associate and/or extend into and/or bond to one or more non-seam portions and/or one or more seam portions of a layer, the same or different layer. As mentioned hereinbefore, the fibrous element ends may be present in one or more the layers, for example support layer, structuring layer, associating layer, of the web material structuring belt and/or portions thereof, such as seam portions of the layer and/or non-seam portions of the layer, and the above description fully applies to whichever layer the fibrous element ends are present in.

In one example, a seam and/or seam portion may be present in one or more and/or two or more and/or three or more layers, for example support layer, structuring layer and associating layer, and may be associated, for example extends into, one or more of the other layers.

In one example, the seam of the layer, for example support layer and/or structuring layer and/or associating layer, exhibits a seam strength of the layer of greater than 2 pli.

Associating Methods

Non-limiting examples of associating methods used in the present invention to associate at least a portion, which may be a seam and/or one or more seam portions of a seam, of a material, for example a support layer material and/or a structuring layer material and/or an associating layer material and/or bonding material with a portion, which may be a seam and/or one or more seam portions of a seam, of a different material, such as a support layer material and/or a structuring layer material and/or an associating layer material and/or a bonding material include embedment methods where a material, such as a seam and/or at least one or more seam portions of a seam of one of the support layer and/or structuring layer and/or associating layer and/or bonding material extend (penetrate) into, but less than entirely through the z-direction thickness of the other material, such as the support layer and/or the structuring layer and/or the associating layer and/or bonding material, for example extends into, but less than entirely through the other material.

In one example, association of at least one seam portion of a seam of a structuring layer and/or a support layer and/or an associating layer and/or a bonding material to another material and/or layer requires sufficient lamination that the resulting seam-containing web material structuring belt is suitable for running in web material making processes for long periods of time, for example at least 500 and/or at least 750 and/or at least 900 and/or at least 1000 hours. Unexpectedly it has been found that improved lamination is deliverable by improving contacting area between the at least one seam portion of a seam of a support layer and/or the structuring layer and the other layer by causing one or more seam portions to extend into the other layer. One or more seam portions of the support layer and/or the structuring layer may comprise a material that is able to penetrate and extend into the other layer, for example the material may be capable of being treated such that it softens and/or flows to permit it to penetrate and extend into the other layer when subjected to certain conditions (heated, solvated, etc. and allowed to flow or forced to flow, etc.) and/or is pressed into the other layer. The seam portions that extend into the other layer may then solidify or be treated (for example by cooling and/or crosslinking and/or curing) to solidify causing the seam portions to remain in place within the other layer, thus at least mechanically locking in place the seam portion within the other layer, for example such that the seam portion of the structuring layer and/or the seam portion of the support layer are associated with another layer according to the present invention. In one example, as long as one or more of the seam portions of the structuring layer and/or the support layer extends into, but less than entirely through a different layer and/or material, for example a structuring layer and/or a support layer and/or an associating layer and/or a bonding material, the resulting seam-containing web material structuring belt of the present invention is formed. In addition to one or more of the seam portions of the structuring layer and/or the support layer extending into, but less than entirely through the other layer, in one example one or more additional seam portions may not extend into the other layer and/or may extend entirely through the other layer. In one example, the seam-containing web material structuring belt comprises one or more seam portions of the structuring layer and/or the support layer that extend at different distances into the other layer. In one example, this associating method is suitable when the seam portions of the structuring layer and/or the support layer comprise incompatible materials with the layer into which they extend, but can still be used when the seam portions of the support layer and/or the structuring layer comprise compatible materials with the layer into which they extend.

In another example of the present invention, an embedment method includes creating and/or forming and/or adding material to a surface of a seam portion of the support layer and/or the structuring layer such that one or more protrusions are formed on the surface of the seam portion. The protrusions can then be softened and/or flow and/or pressed into the other layer. In one example, one of more surfaces of the support layer and/or structuring layer, including portions thereof that extend into the other layer, may be made of material and/or be treated to cause increased friction between the one or more surfaces and one or more surfaces of the other layer, for example such that a friction difference between the one or more surfaces of the layer and the other layer results.

In yet another example of the present invention, an embedment method includes creating and/or forming and/or adding at least one fibrous element layer, for example at least one filament layer, to a surface of a support layer and/or structuring layer such that the at least one fibrous element layer can be treated such that at least a portion of the at least one fibrous element layer softens and/or flows to permit it to penetrate and extend into the other layer, for example when in contact with the other layer, and when subjected to certain conditions (heated, solvated, etc. and allowed to flow or forced to flow, etc.) and/or is pressed into the other layer. The portions that extend into the other layer may then solidify or be treated (for example by cooling and/or cross-linking and/or curing) to solidify causing the portions to remain in place within the other layer, thus at least mechanically locking in place the one layer within the other layer such that the structuring layer and support layer are associated according to the present invention. In one example, the support layer and/or structuring layer may comprise three or more and/or four or more and/or five or more fibrous element layers. In one example, one of the support layer and/or structuring layer comprises a mono-layer (single layer) of fibrous elements.

In one example of the present invention, a web material structuring belt is made by forming a structuring layer on a support layer, where the structuring layer comprises one or more sub-layers of filaments, for example extruded filaments and/or a netting of filaments. Such sub-layers, for example a first filament layer (sub-layer) comprising a plurality of filaments may be extruded and/or laid onto a surface of a support layer, wherein the first filament layer comprises a first material and/or first pattern and/or first diameter of filaments. Next, a second filament layer (sub-layer) comprising a plurality of filaments may be extruded and/or laid at least partially upon the first filament layer, wherein the second filament layer comprises a second material and/or second pattern and/or second diameter of filaments. One or more additional filament layers (sub-layers), for example a third filament layer (sub-layer) comprising a third material and/or third pattern and/or third diameter of filaments may be extruded and/or laid at least partially upon the second filament layer as desired. The first, second, third, and so forth materials, patterns, diameters of filaments may be the same or different from one or more of the others. Next, treat the first filament layer to soften at least a portion of the first filament layer and then apply a force to the first filament layer such that the portion penetrates and extends into, but less than entirely through the support layer and/or the second filament layer. The portion of the first filament layer is then treated to cause the portion of the first filament layer to solidify within the support layer and/or second filament layer.

In addition to the embedment methods described herein, the associating of a support layer and a structuring layer may further comprise adhesively associating two or more portions of the support layer and structuring layer surfaces together. Non-limiting examples of adhesives may be selected from the group consisting of: air activated adhesives, light activated adhesives (both UV and IR), heat activated adhesives, moisture activated adhesives, single part adhesives, multipart adhesives, and combinations thereof. In on example, suitable adhesives include, but are not limited to, adhesives that have low (about 1 to 100 cP at room temperature), medium (101 to 10000 cP at room temperature) and high viscosity (10001 to about 1000000 cP at room temperature) and may exhibit Newtonian or non-Newtonian behavior when deformed prior to curing and may exist as a liquid, gel, paste; epoxies, non-amine epoxy, anhydride-cured epoxy, amine-cured epoxy, high temperature epoxies, modified epoxies, filled epoxies, aluminum filled epoxy, rubber modified epoxies, vinyl epoxies, nitrile epoxy, single and multipart epoxies, phenolics, nitrile phenolics, nitrile phenolic elastomer, nitrile adhesives, modified phenolics, epoxy-phenolics, neoprene phenolics, neoprene phenolic elastomer, second generation acrylics, cyanoacrylates, silicone rubbers, vinyl plastisols, single and multipart polyurethanes, PBI and PI (polyimide) adhesives, acetylenic modified PI, perfluoro-alkylene modified PI, aromatic PI, perfluoro-alkylene modified aromatic PI, epoxy-nylon, polyamides, vinyl-phenolic, polyisocyanates, melamines, melamine formaldehyde, neoprenes, acrylics, modified acrylics, natural rubber (latex), chlorinated natural rubber, reclaimed rubber, styrene-butadiene rubber (SBR), carboxylated styrene butadiene copolymer, styrene butadiene, butadiene-acrylonitrile sulfide, silicone rubber, bitumen, soluble silicates, polyphenylquinoxaline, (solvent adhesive) hexafluoroacetone sesquihydrate (structural adhesive) thermosets: epoxy, polyester with isocyanate curing, styrene-unsaturated polyester, unsaturated polyesters, polyester-polyisocyanates, cyanoacrylate (non-structural adhesive) one component: thermoplastic resins, rubbers, synthetic rubber, phenolic resin and/or elastomers dispersed in solvents; room temperature curing based on thermoplastic resins, rubbers, synthetic rubber, SBR (styrene phenolic resin and/or elastomers dispersed in solvents; elastomeric adhesives, neoprene (polychloroprene) rubber, rubber based adhesives, resorcinol, ethylene vinyl acetate, polyurethane, polyurethane elastomer, polyurethane rubber (bodied solvent cements) epoxies, urethanes, second generation acrylics, vinyls, nitrile-phenolics, solvent type nitrile-phenolic, cyanoacrylates, Polyvinyl acetate, polyacrylate (carboxylic), phenoxy, resorcinol-formaldehyde, urea-formaldehyde, Polyisobutylene rubber, polyisobutyl rubber, polyisobutylene, butyl rubber, nitrile rubber, nitrile rubber phenolic, modified acrylics, cellulose nitrate in solution (household cement), synthetic rubber, thermoplastic resin combined with thermosetting resin, Nylon-phenolic, vulcanizing silicones, room-temperature vulcanizing silicones, hot melts, polyamide hot melts, Epoxy-polyamide, polyamide, epoxy-polysulfide, polysulfides, silicone sealant, silicone elastomers, Anaerobic adhesive, vinyl acetate/vinyl chloride solution adhesives, PMMA, pressure sensitive adhesives, polyphenylene sulfide, Phenolic polyvinyl butyral, furans, furane, phenol-formaldehyde, polyvinyl formal-phenolic, polyvinyl butyral, butadiene nitrile rubber, resorcinol-polyvinyl butyral, urethane elastomers, PVC, polycarbonate copolymer, polycarbonate copolymer with resorcinol, siloxane and/or bisphenol-A, and flexible epoxy-polyamides. Other possible adhesives include natural adhesives such as casein, natural rubber, latex and gels from fish skins, and adhesives that provide temporary adhesion such as water soluble glues (e.g., Elmer's® glue and Elmer's® glue stick).

In one example, one or more of the support layer and/or structuring layer may be pre-treated prior to associating. Non-limiting examples of pre-treating include pre-treating a surface of the layer with adhesive and/or solvent. In one example, the pre-treating includes applying primers to a surface, subjecting a surface to corona/plasma treatments, swelling a surface, subjecting a surface to heat and/or flame, smoothing a surface, subjecting a surface to UV radiation and/or IR radiation and/or microwave radiation, and sanding and/or roughening a surface.

In one example, an auxiliary bonding technique, for example melt bonding and auxiliary bonding, for example laser and/or IR, solvent welding, and/or using an energy absorbing material may help bonding between the support layer and the structuring layer.

Even though the present invention is directed to associating a support layer and a structuring layer by having one or both layers penetrate and extend into the other layer as described herein to form a web material structuring belt according to the present invention, other associating methods such as bonding, for example mechanical, chemical and/or adhesive bonding, and/or use of connecting threads and/or yarns and/or filaments to "tie" the support layer and structuring layer together at one or more sites, use of an associating layer that facilitates the bonding may be present in the web material structuring belts of the present invention.

In one example, the support layer may comprise an additional material, for example an air perm controlling material, which is different from the support layer material, that can be present in and/or on the support layer in one or more x-y regions and/or z-regions to impact the support layer's air perm.

In another example, one or more open areas (such as gaps and/or voids) between the associated structuring layer and support layer may be present in the web material structuring belt. For example, the open areas may provide air perm benefits and/or air leakage and/or drying benefits as a result of the air passing through the web material structuring belt.

Support Layer

A support layer of the web material structuring belt may be any suitable material. In one example, the support layer may comprise a woven material. In another example, the support layer may comprise a nonwoven material. In still another example, the support layer may comprise a film, for example an apertured film and/or porous film and/or laser-abraded film and/or laser-etched film and/or perforated film, In yet another example, the support layer may comprise a wire, for example a wire mesh and/or a wire screen, such as a metallic wire mesh and/or metallic wire screen and/or plastic wire mesh and/or plastic wire screen. In still another example, the support layer comprises paper, for example carton board and/or cardboard. In one example, the support layer is an additive manufacturing support layer, for example a fused deposition modeling (FDM) support layer or a selective laser sintering (SLS) support layer. In another example, the support layer and/or the structuring layer may comprise components, for example additive manufactured elements, for example segments made from additive manufacturing, for example fused deposition modeling (FDM) and/or stereolithography (SLA).

When the support layer is a woven material, the support layer may comprise woven threads and/or woven yarns and/or woven yarn arrays. The woven material support layer may comprise one or more polymers, such as a polymer resin, for example one or more polymer filaments, such as thermoplastic polymers and/or non-thermoplastic polymers and/or thermoset polymers, biodegradable polymers and/or compostable polymers and/or non-biodegradable polymer. In one example, the filaments of the woven material support layer comprises polymer filaments, such as polyolefin filaments, for example polypropylene filaments and/or polyethylene filaments, polyester filaments, such as polyethyleneterephthalate filaments, copolyester filaments, polyamide filaments, such as nylon filaments, copolyamide filaments, polyphenylene sulfide filaments, polyether ether ketone filaments, polyurethane filaments, polylactic acid filaments, polyhydroxyalkanoate filaments, polycaprolactone filaments, polyesteramide filaments and mixtures thereof. The woven material support layer may comprise a single layer or multi-layers. The filaments in the woven material support layer may be monocomponent filaments and/or multi-component filaments, such as bicomponent filaments.

When the support layer is a nonwoven material, the support layer may comprise nonwoven threads and/or nonwoven yarns and/or nonwoven yarn arrays. The nonwoven material support layer may comprise one or more polymers, such as a polymer resin, for example one or more polymer filaments, such as thermoplastic polymers and/or non-thermoplastic polymers and/or thermoset polymers, biodegradable polymers and/or compostable polymers and/or non-biodegradable polymer. In one example, the filaments of the nonwoven material support layer comprises polymer filaments, such as polyolefin filaments, for example polypropylene filaments and/or polyethylene filaments, polyester filaments, such as polyethyleneterephthalate filaments, copolyester filaments, polyamide filaments, such as nylon filaments, copolyamide filaments, polyphenylene sulfide filaments, polyether ether ketone filaments, polyurethane filaments, polylactic acid filaments, polyhydroxyalkanoate filaments, polycaprolactone filaments, polyesteramide filaments and mixtures thereof. The nonwoven material support layer may comprise a single layer or multi-layers. The filaments in the nonwoven material support layer may be monocomponent filaments and/or multi-component filaments, such as bicomponent filaments.

In one example, the support layer comprise any one or more of textile materials—which includes any woven supporting substrate such as woven yarns, yarn arrays, spiral links, knits, braids, spiral wound strips of any of the above-listed forms. When present, the textile materials used to form the support layer may be any one of those well known in the art such as, for example, polymers, such as polyethylene terephthalate ("PET"), polyamide ("PA"), polyethylene ("PE"), polypropylene ("PP"), polyphenylene sulfide ("PPS"), polyether ether ketone ("PEEK"), and combinations thereof.

In one example, one or more surfaces of the support layer, for example the surface of the support layer that contacts the structuring layer, may be sanded and/or abraded to increase the surface area of the surface of the support layer and thus increase the potential contact between support layer and the structuring layer of the web material structuring belt.

In one example, the support layer exhibits an air perm of greater than 400 scfm and/or greater than 500 scfm and/or greater than 600 scfm and/or greater than 700 scfm and/or greater than 800 scfm and/or to about 1500 scfm and/or to about 1400 scfm and/or to about 1300 scfm and/or to about 1200 scfm and/or to about 1100 scfm and/or to about 1000 scfm.

In one example, the support layer is a non-batted support layer, for example a non-felt support layer.

In one example, the support layer comprises two or more layers of fibrous elements, for example two or more layers of yarns, threads and/or filaments, such as two or more layers of filaments.

In one example, the support layer of the present invention is an endless material. In another example, the support layer of the present invention is an endless material comprising a permanent seam.

In one example, the support layer at least partially functions to provide integrity, stability, and/or durability of the structuring layer.

In one example, the support layer is at least partially or wholly fluid-permeable.

In one example, the support layer is a woven fibrous structure, for example a woven fibrous structure comprising a plurality of yarns, threads, and/or fibrous elements, for example filaments, and may comprise any suitable weave pattern, including, but not limited to Jacquard-type.

The materials used to form the support layer may be any one of those well known in the art such as, for example, polymers, such as polyethylene terephthalate ("PET"), polyamide ("PA"), polyethylene ("PE"), polypropylene ("PP"), polyphenylene sulfide ("PPS"), polyether ether ketone ("PEEK"), polyethylene naphthalate ("PEN"), or a combination thereof. When the support layer is a woven fabric, it can comprise monofilament, multifilament, and plied multifilament yarns. More broadly, however, the base substrate may be a woven, nonwoven or knitted fabric comprising yarns of any of the varieties used in the production of paper machine clothing or of belts used to manufacture nonwoven articles and fabrics. These yarns may be obtained by extrusion from any of the polymeric resin materials used for this purpose by those of ordinary skill in the art. Accordingly, resins from the families of polyamide, polyester, polyurethane, polyaramid, polyolefin and other resins may be used. (U.S. Pat. No. 7,014,735B2, NTT belts)

A support layer of the present disclosure may comprise one or more materials selected from the group consisting of woven, Spun or Bonded filaments; composed of natural and/or synthetic fibers; metallic fibers, carbon fibers, silicon carbide fibers, fiberglass, mineral fibers, and] or polymer fibers including polyethylene terephthalate ("PET") or PBT polyester, phenol-formaldehyde (PF); polyvinyl chloride fiber (PVC); polyolefins (PP and PE); acrylic polyesters; aromatic polyamides (aramids) such as Twaron®, Kevlar® and Nomex®; polytetrafluoroethylene such as Teflon® commercially available from DuPont®; polyethylene (PE), including with extremely long chains HMPE (e.g. Dyneema or Spectra); polyphenylene sulfide ("PPS"); and] or elastomers. In one non-limiting form, the woven filaments of reinforcing member are filaments as disclosed in U.S. Pat. No. 9,453,303 issued Sep. 27, 2016 in the name of Aberg et. al. and described by Brent, Jr. et. al., 2018 in U.S. Application 2018/0119347.

In one example, the support layers may comprise a woven and/or nonwoven material (i.e., base fabric) such as woven yarns, nonwovens, yarn arrays, spiral links, knits, braids; spiral wound strips of any of above-listed forms, independent rings, and other extruded element forms. For example, the support layer can be made from polymers such as polyethylene terephthalate ("PET"), polyamide ("PA"), polyethylene ("PE"), polypropylene ("PP"), polyphenylene sulfide ("PPS"), polyether ether ketone ("PEEK"), polyethylene naphthalate ("PEN"), metal, or a combination of polymers and metal.

In one example, the support layer may comprise polymeric materials, which may be applied either by piezojet array or by bulk-jet array, and may include polymeric materials in the following four classes: 1) hot melts and moisture-cured hot melts; 2) two-part reactive systems based on urethanes and epoxies; 3) photopolymer compositions consisting of reactive acrylated monomers and acrylated oligomers derived from urethanes, polyesters, polyethers, and silicones; and 4) aqueous-based latexes and dispersions and particle-filled formulations including acrylics and polyurethanes.

The support layer may be made using an additive manufacturing process that lays down successive layers or zones of material. Each layer has a thickness within the range of 1 to 1000 microns, and preferably within the range of 7 to 200 microns. The materials used in each layer may be composed of polymers with a Young's Modulus within the range of 10 to 500 MPa, and preferably 40 to 95 MPa. Such polymers may include nylons, aramids, polyesters such as polyethylene terephthalate or polybutyrate, or combinations thereof.

The support layer is formed from a material having tear strengths ranging from about 10 to about 50 N/mm with hardness ranging from about 20 to about 75 on the Shore A scale. In other instances, it may be preferable that the support layer is formed from a material having a Young's Modulus greater than about 0.5 Mpa, such as from about 0.5 to about 6.0 MPa, such as from about 1.0 to about 4.0 MPa. For example, in one example, the support layer may comprise a support layer material having a hardness from about 50 to about 70 on the Shore A scale and a modulus from about 2.0 to about 5.0 MPa.

In one example, the support layer is made using an additive manufacturing process that lays down successive layers or zones of material. Each layer has a thickness within the range of 1 to 1000 microns, and preferably within the range of 7 to 200 microns. The materials used in each layer may be composed of polymers with a Young's Modulus within the range of 10 to 500 MPa, and preferably 40 to 95 MPa. Such polymers may include nylons, aramids, polyesters such as polyethylene terephthalate or polybutyrate, or combinations thereof.

In another example, the support layer may be made by an additive manufacturing approach such as by stereolithography (SLA), continuous liquid interface production (CLIP), large area maskless photopolymerization (LAMP), high area rapid printing (HARP), selective deposition, or jetting. These approaches utilize a photopolymer resin. The photopolymer resin(s) applicable to these additive manufacturing methods may include cross-linkable polymers selected from light activated polymers (e.g., UV light activated, e-beam activated, etc.). The photopolymer resins may be blended with other resins (e.g. epoxy or epoxies) to have hybrid curing systems similarly described in UV- and thermal curing behaviors of dual-curable adhesives based on epoxy acrylate oligomers by Y. J. Park et. al. in Int. J. Adhesion & Adhesives 2009 710-717. The photopolymer resin may include any of the cross-linkable polymers as described in U.S. Pat. No. 4,514,345 issued Apr. 30, 1985 in the name of Johnson et al., and/or as described in U.S. Pat. No. 6,010,598 issued Jan. 4, 2000 in the name of Boutilier et al. In addition, the photopolymer resin may include any of the cross-linkable polymers as described in U.S. Pat. No. 7,445,831 issued Nov. 4, 2008 in the name of Ashraf et al., described in WO Publication No. 2015/183719 A1 filed on May 22, 2015 in the name of Herlihy et al., and/or described in WO Publication No. 2015/183782 A1 filed on May 26, 2015 in the name of Ha et al., and/or described in US Publication No. 2019/0160733 filed May 31, 2017 in the name of Mirkin et al. Other suitable cross-linkable and filler materials known in the art may also be employed as the photopolymer resin as described in US Publication No. 2015/0160733 filed on May 31, 2017 in the name of Mirkin et al, and/or as described in U.S. Pat. No. 10,245,785 issued Apr. 2, 2019 in the name of Adzima. The photopolymer resin may be comprised of monomers as described in US20200378067 etc.

In another example, the support layer may be made using a casting process as described in U.S. Pat. No. 4,514,345 issued Apr. 30, 1985 in the name of Johnson et al. This process creates a film of photopolymer resin which is then cured with radiation to form a support layer. The photopolymer resin used in this process may include any of the cross-linkable polymers as described in U.S. Pat. No. 4,514, 345 issued Apr. 30, 1985 in the name of Johnson et al., and/or as described in U.S. Pat. No. 6,010,598 issued Jan. 4, 2000 in the name of Boutilier et al. In addition, the photopolymer resin may include any of the cross-linkable polymers as described in U.S. Pat. No. 7,445,831 issued Nov. 4, 2008 in the name of Ashraf et al.

Structuring Layer

A structuring layer of the web material structuring belt may be any suitable material. In one example, the structuring layer may comprise a woven material. In another example, the structuring layer may comprise a nonwoven material. In still another example, the structuring layer may comprise a film, for example an apertured film and/or porous film and/or laser-abraded film and/or laser-etched film and/or perforated film, In yet another example, the structuring layer may comprise a wire, for example a wire mesh and/or a wire screen, such as a metallic wire mesh and/or metallic wire screen and/or plastic wire mesh and/or plastic wire screen. In still another example, the structuring layer comprises paper, for example carton board and/or cardboard. In one example, the structuring layer is an additive manufacturing structuring layer, for example a fused deposition modeling (FDM) structuring layer or a selective laser sintering (SLS) structuring layer. In yet another example, the structuring layer comprises a foam, for example an open-celled foam.

When the structuring layer is a woven material, the structuring layer may comprise woven threads and/or woven yarns and/or woven yarn arrays. The woven material structuring layer may comprise one or more polymers, for example one or more polymer filaments, such as thermoplastic polymers and/or non-thermoplastic polymers and/or thermoset polymers, biodegradable polymers and/or compostable polymers and/or non-biodegradable polymer. In one example, the filaments of the woven material structuring layer comprises polymer filaments, such as polyolefin filaments, for example polypropylene filaments and/or polyethylene filaments, polyester filaments, such as polyethyleneterephthalate filaments, copolyester filaments, polyamide filaments, such as nylon filaments, copolyamide filaments, polyphenylene sulfide filaments, polyether ether ketone filaments, polyurethane filaments, polylactic acid filaments, polyhydroxyalkanoate filaments, polycaprolactone filaments, polyesteramide filaments and mixtures thereof. The woven material structuring layer may comprise a single layer or multi-layers. The filaments in the woven material structuring layer may be monocomponent filaments and/or multi-component filaments, such as bicomponent filaments.

When the structuring layer is a nonwoven material, the structuring layer may comprise nonwoven threads and/or nonwoven yarns and/or nonwoven yarn arrays. The nonwoven material structuring layer may comprise one or more polymers, for example one or more polymer filaments, such as thermoplastic polymers and/or non-thermoplastic polymers and/or thermoset polymers, biodegradable polymers and/or compostable polymers and/or non-biodegradable polymer. In one example, the filaments of the nonwoven material structuring layer comprises polymer filaments, such as polyolefin filaments, for example polypropylene filaments and/or polyethylene filaments, polyester filaments, such as polyethyleneterephthalate filaments, copolyester filaments, polyamide filaments, such as nylon filaments, copolyamide filaments, polyphenylene sulfide filaments, polyether ether ketone filaments, polyurethane filaments, polylactic acid filaments, polyhydroxyalkanoate filaments, polycaprolactone filaments, polyesteramide filaments and mixtures thereof. The nonwoven material structuring layer may comprise a single layer or multi-layers. The filaments in the nonwoven material structuring layer may be monocomponent filaments and/or multi-component filaments, such as bicomponent filaments.

In one example, one or more surfaces of the structuring layer, for example the surface of the structuring layer that contacts the structuring layer, may be sanded and/or abraded to increase the surface area of the surface of the structuring layer and thus increase the potential contact between structuring layer and the structuring layer of the web material structuring belt.

In one example, the structuring layer exhibits an air perm of greater than 400 scfm and/or greater than 500 scfm and/or greater than 600 scfm and/or greater than 700 scfm and/or greater than 800 scfm and/or to about 1500 scfm and/or to about 1400 scfm and/or to about 1300 scfm and/or to about 1200 scfm and/or to about 1100 scfm and/or to about 1000 scfm.

In one example, the structuring layer is a non-batted structuring layer, for example a non-felt structuring layer.

In one example, the structuring layer may comprise a material, for example a thermoplastic resin and/or silicone rubber and/or non-silicone vulcanized rubber and/or film and/or woven material and/or nonwoven material.

In one example, the structuring layer may comprise an epoxy.

When the structuring layer comprises a thermoplastic resin, the thermoplastic resin may be selected from the group consisting of: polyvinyl fluoride, polyvinylidene fluoride, polyvinyl chloride, polyethylene, polypropylene, polyethers, styrene-butadiene copolymers, polybutylenes, and the like. When the structuring layer comprises a film, for example a thermoplastic polymer film, for example a thermoplastic polymer film comprising a thermoplastic polymer selected from the group consisting of: polyethylene ("PE"), polypropylene ("PP"), polyphenylene sulfide ("PPS"), polyimides, polyamides, polysulfones, polysulfides, cellulosic resins, polyarylate acrylics, polyarylsulfones, polyurethanes, epoxies, poly(amide-imides), copolyesters, polyethersulfones, polyetherimides, polyarylethers, and the like.

In another example, the structuring layer material may be selected from the group consisting of: extruded and/or printed polymeric material, for example polymeric materials such as silicones, polyesters, polyurethanes, epoxies, polyphenylsulfides and polyetherketones; thermoplastic polyurethane, for example thermoplastic polyurethane with Shore A Hardness 65-75; extruded netting, for example formed of a thermoplastic polymeric material and/or 3-D printed material, such as polybutylene terephthalate (PBT), polyester, polyamide, polyurethane, polypropylene, polyethylene, polyethylene terephthalate (PET), polyether ether ketone resins and combinations thereof; extruded film, such as elastic extruded film, for example film comprising polyurethane, for example thermoplastic polyurethane, rubber, silicone or that sold under trademarks Lycra® by Invista or Estane® by Lubrizol.

In one example, the structuring layer may comprise a silicone rubber.

In another example, the structuring layer may comprise a fluoroelastomer layer bonded to a silicone rubber layer.

In one example, the structuring layer comprises a thermoset polymer and/or UV light curable polymer.

In one example, the structuring layer comprises a thermoplastic polymer, for example a thermoplastic elastomer, such as rubber materials.

In one example, the structuring layer comprises a plurality of filaments and/or a plurality of fibers, such as polymeric fibers, for example staple fibers.

In one example, the structuring layer may be made by any suitable technique, for example, molding and/or extruding and/or thermoforming. In one example, the structuring layer comprises distinct portions or components that are joined together to form the structuring layer.

In one example, the structuring layer comprises a pattern, for example a 3D pattern, such as a non-random 3D pattern, for example a non-random repeating 3D pattern, that imparts texture, for example a pattern, such as a 3D pattern to a surface of a web material formed on the web material structuring belt according to the present invention.

In one example, the structuring layer of the present invention is an endless material. In another example, the structuring layer of the present invention is an endless material comprising a permanent seam.

In one example, the structuring layer is mechanically entangled with the support layer.

In one example, at least a portion of the structuring layer that extends into, but less than entirely through the support layer is bonded to the support layer at one or more bond sites, for example wherein less than the entire amount of the structuring layer that extends into, but less than entirely through the support layer is bonded to the support layer. Non-limiting example of suitable bond sites include thermal bond sites, chemical bond sites, adhesive bond sites and mixtures thereof.

The structuring layer may be formed from a thermoplastic material and/or a non-thermoplastic material.

In one example, the structuring layer may comprise a material selected from one of polyethylene terephthalate (PET), polyethylene-naphthalate (PEN), polyetheretherketone (PEEK), polyamide (PA), polyphenylene sulfide (PPS), cyanate esters, isocyanate, benzoxazine, polyimide, bismaleimide, phthalonitrile resin (PN), bismaleimide-triazine (BT), epoxy, silicone resins, epoxy-cyanate, polyolefins, and mixtures thereof.

The structuring layer may comprise a thermoplastic polymer. Suitable thermoplastic polymer which can be employed include, but are not limited to, polyvinyl fluoride, polyvinylidene fluoride, polyvinyl chloride, polyethylene, polypropylene, polyethers, styrene-butadiene copolymers, polybutylenes, polyethylene ("PE"), polypropylene ("PP"), polyphenylene sulfide ("PPS"), polyimides, polyamides, polysulfones, polysulfides, cellulosic resins, polyarylate acrylics, polyarylsulfones, polyurethanes, epoxies, poly (amide-imides), copolyesters, polyethersulfones, polyetherimides, polyarylethers, and the like.

In one example, the structuring layer may comprise a material selected from the group consisting of: polyethylene terephthalate, polyethylene-naphthalate, polyetheretherketone, polyamides, polyphenylene sulfide, cyanate esters, isocyanate, benzoxazine, polyimides, bismaleimide, phthalonitrile resin, bismaleimide-triazine, epoxy, silicone resins, epoxy-cyanate, polyvinyl fluoride, polyvinylidene fluoride, polyvinyl chloride, polyethylene, polypropylene, polyethers, styrene-butadiene copolymers, polybutylenes, polysulfones, polysulfides, cellulosic resins, polyarylate acrylics, polyarylsulfones, polyurethanes, epoxies, poly (amide-imides), copolyesters, polyethersulfones, polyetherimides, polyarylethers, and combinations thereof.

In one example, the structuring layer may comprise polymeric materials, which may be applied either by piezo-jet array or by bulk-jet array, and may include polymeric materials in the following four classes: 1) hot melts and moisture-cured hot melts; 2) two-part reactive systems based on urethanes and epoxies; 3) photopolymer compositions consisting of reactive acrylated monomers and acrylated oligomers derived from urethanes, polyesters, polyethers, and silicones; and 4) aqueous-based latexes and dispersions and particle-filled formulations including acrylics and polyurethanes.

The structuring layer may comprise a silicone rubber, or a non-silicone vulcanized rubber made from at least a majority by weight of fluoroelastomer having good heat and chemical resistance. In other instances, the nonwoven layer may comprise a silicone rubber. In still other instances the nonwoven may comprise a fluoroelastomer layer bonded to a silicone rubber layer.

The structuring layer is formed from a material having tear strengths ranging from about 10 to about 50 N/mm with hardness ranging from about 20 to about 75 on the Shore A scale. In other instances, it may be preferable that the structuring layer is formed from a material having a Young's Modulus greater than about 0.5 Mpa, such as from about 0.5 to about 6.0 MPa, such as from about 1.0 to about 4.0 MPa. For example, in one example, the structuring layer may comprise a structuring layer material having a hardness from about 50 to about 70 on the Shore A scale and a modulus from about 2.0 to about 5.0 MPa.

In one example, the structuring layer is made using an additive manufacturing process that lays down successive layers or zones of material. Each layer has a thickness within the range of 1 to 1000 microns, and preferably within the range of 7 to 200 microns. The materials used in each layer may be composed of polymers with a Young's Modulus within the range of 10 to 500 MPa, and preferably 40 to 95 MPa. Such polymers may include nylons, aramids, polyesters such as polyethylene terephthalate or polybutyrate, or combinations thereof.

In another example, the structuring layer may be made by an additive manufacturing approach such as by stereolithography (SLA), continuous liquid interface production (CLIP), large area maskless photopolymerization (LAMP), high area rapid printing (HARP), selective deposition, or jetting. These approaches utilize a photopolymer resin. The photopolymer resin(s) applicable to these additive manufacturing methods may include cross-linkable polymers selected from light activated polymers (e.g., UV light activated, e-beam activated, etc.). The photopolymer resins may be blended with other resins (e.g. epoxy or epoxies) to have hybrid curing systems similarly described in UV- and thermal curing behaviors of dual-curable adhesives based on epoxy acrylate oligomers by Y. J. Park et. al. in Int. J. Adhesion & Adhesives 2009 710-717. The photopolymer resin may include any of the cross-linkable polymers as described in U.S. Pat. No. 4,514,345 issued Apr. 30, 1985 in the name of Johnson et al., and/or as described in U.S. Pat. No. 6,010,598 issued Jan. 4, 2000 in the name of Boutilier et al. In addition, the photopolymer resin may include any of the cross-linkable polymers as described in U.S. Pat. No. 7,445,831 issued Nov. 4, 2008 in the name of Ashraf et al., described in WO Publication No. 2015/183719 A1 filed on May 22, 2015 in the name of Herlihy et al., and/or described in WO Publication No. 2015/183782 A1 filed on May 26, 2015 in the name of Ha et al., and/or described in US Publication No. 2019/0160733 filed May 31, 2017 in the name of Mirkin et al. Other suitable cross-linkable and filler materials known in the art may also be employed as the photopolymer resin as described in US Publication No. 2015/0160733 filed on May 31, 2017 in the name of Mirkin et al, and/or as described in U.S. Pat. No. 10,245,785 issued Apr. 2, 2019 in the name of Adzima. The photopolymer resin may be comprised of monomers as described in US20200378067 etc.

In another example, the structuring layer may be made using a casting process as described in U.S. Pat. No. 4,514,345 issued Apr. 30, 1985 in the name of Johnson et al. This process creates a film of photopolymer resin which is then cured with radiation to form a structuring layer. The photopolymer resin used in this process may include any of the cross-linkable polymers as described in U.S. Pat. No. 4,514,345 issued Apr. 30, 1985 in the name of Johnson et al., and/or as described in U.S. Pat. No. 6,010,598 issued Jan. 4, 2000 in the name of Boutilier et al. In addition, the photopolymer resin may include any of the cross-linkable polymers as described in U.S. Pat. No. 7,445,831 issued Nov. 4, 2008 in the name of Ashraf et al.

Any suitable polymerizable liquid can be used to enable the present invention. The liquid (sometimes also referred to as "resin" herein) can include a monomer, particularly photopolymerizable and/or free radical polymerizable monomers, and a suitable initiator such as a free radical initiator, and combinations thereof. Examples include, but are not limited to, acrylics, methacrylics, acrylamides, styrenics, olefins, halogenated olefins, cyclic alkenes, maleic anhydride, alkenes, alkynes, carbon monoxide, functionalized oligomers, multifunctional cute site monomers, functionalized PEGs, etc., including combinations thereof. Examples of liquid resins, monomers and initiators include but are not limited to those set forth in U.S. Pat. Nos. 8,232,043; 8,119,214; 7,935,476; 7,767,728; 7,649,029; WO 2012129968 A1; CN 102715751 A; JP 2012210408 A. (taken from U.S. Pat. No. 10,144,181B2, which includes some acid catalyzed polymers, silicone resins, biodegradable resins, etc. which could also work. It also includes a bunch of cited literature). Carbon 3D also lists materials in U.S. Pat. Nos. 10,647,873B2, 10,596,755B2, 11,141,910B2.

Alternatively, the polymeric resin material may be deposited onto or within the base substrate by spraying, jetting, blade coating, single-pass-spiral (SPS) coating, multiple-thin-pass (MTP) coating, or any other methods known in the art to apply a liquid material to a textile substrate.

In one example, the structuring layer is present in the web material structuring belt in the form a pattern, for example a 3D pattern, such as a non-random 3D pattern, for example a non-random repeating 3D pattern, that contacts a web material upon making and/or structuring of the web material on the web material structuring belt. The structuring layer's pattern may comprise continuous, substantially continuous, semi-continuous, and/or discrete knuckles formed by a material, for example a solid material, such as a polymer, present on the support layer that imprint knuckle regions into a web material structured on the web material structuring belt. The structuring layer's pattern may comprise continuous, substantially continuous, semi-continuous and/or discrete deflection conduits formed by the absence or at least partial absence of a material, for example a solid material, such as a polymer, within the structuring layer so that voids and/or holes and/or depressions in and/or through the structuring layer are present in the web material structuring belt, that imprint pillow regions into a web material structured on the web material structuring belt as the fibrous elements of the web material deflect into the deflection conduits during the web material making and/or structuring process.

Additive Manufacturing Materials

As described herein, the support layer and/or structuring layer of the web material structuring belt of the present invention may comprise additive manufacturing materials. The additive manufacturing materials may be any known additive manufacturing materials suitable for the web material structuring belts and processes for making such web material structuring belts and/or processes for using web material structuring belts of the present invention. Non-limiting examples of suitable additive manufacturing materials include digital alloys, such as polyurethanes and/or acrylics, that may provide strength, flexibility, chemical resistance, and/or abrasion resistance.

In one example, the additive manufacturing materials may comprise thermoplastic materials selected from the group consisting of: polylactic acid (PLA), acrylonitrile butadiene styrene (ABS), polyether ether ketone (PEEK), polyaryletherketone (PAEK), polytetrafluoroethylene (PTFE), polyurethane (PU) (NinjaFlex), Nylon, or any other suitable thermoplastic material. In one example, the additive manufacturing materials may comprise composite print materials include both thermoplastic materials and fillers, for example (soft or hard) wood filled thermoplastics, (copper, bronze, stainless steel) metal filled thermoplastics and any other suitable filler materials.

In certain examples the polymeric material used in the additive manufacturing process may comprise PET (polyester), PPS (polyphenylene sulphide), PCTA (poly 1,4 cyclohexane dimethylene terephthalate), PEN (polyethylene naphthalate), PVDF (polyvinylidene fluoride) or PEEK (polyetheretherketone), either alone or in combination. Generally, such materials are capable of withstanding temperatures found in the papermaking process (up to or above 500° F.) in the presence of air and water vapor.

In one example, the polymeric material used in the additive manufacturing process may comprise a thermoplastic resin, a silicone rubber, or a non-silicone vulcanized rubber made from at least a majority by weight of fluoroelastomer having good heat and chemical resistance. Suitable thermoplastic resins which can be employed include, but are not limited to, polyvinyl fluoride, polyvinylidene fluoride, polyvinyl chloride, polyethylene, polypropylene, polyethers, styrene butadiene copolymers, polybutylenes, and the like and combinations thereof. Other suitable thermoplastic film forming polymers include polyethylene ("PE"), polypropylene ("PP"), polyphenylene sulfide ("PPS"), polyimides, polyamides, polysulfones, polysulfides, cellulosic resins, polyarylate acrylics, polyarylsulfones, polyurethanes, epoxies, poly(amide-imides), copolyesters, polyethersulfones, polyetherimides, polyarylethers, and the like and combinations thereof.

In one example, the polymeric material used in the additive manufacturing process may comprise photo-curable and/or self-curing resins. Photocurable resins may include resins curable by UV curing, visible light curing, electron beam curing, gamma radiation curing, radiofrequency curing, microwave curing, infrared curing, or other known curing methods involving application of radiation to cure a resin. Suitable resins may also include those that may be cured via chemical reaction without the need for added radiation as in the curing of an epoxy resin, extrusion of an autocuring polymer such as polyurethane mixture, thermal curing, solidifying of an applied hotmelt or molten thermoplastic.

In certain examples, the polymeric material may comprise PET (polyester), PPS (polyphenylene sulphide), PCTA (poly 1,4 cyclohexane dimethylene terephthalate), PEN (polyethylene naphthalate), PVDF (polyvinylidene fluoride) or PEEK (polyetheretherketone), either alone or in combination.

In other examples the polymeric material used in the additive manufacturing process comprises thermoplastics such as, for example, a thermoplastic comprising from about 0.5 and 10 weight percent silicone and a base polymer selected from the group consisting of polyethersulfones, polyetherimides, polyphenylsulfones, polyphenylenes, polycarbonates, high-impact polystyrenes, polysulfones, polystyrenes, acrylics, amorphous polyamides, polyesters, nylons, PEEK, PEAK and ABS.

In one example, the additive manufacturing materials may comprise polymeric materials, which may be applied either by piezojet array or by bulk-jet array, and may include polymeric materials in the following four classes: 1) hot melts and moisture-cured hot melts; 2) two-part reactive systems based on urethanes and epoxies; 3) photopolymer compositions consisting of reactive acrylated monomers and acrylated oligomers derived from urethanes, polyesters, polyethers, and silicones; and 4) aqueous-based latexes and dispersions and particle-filled formulations including acrylics and polyurethanes.

Any suitable polymerizable liquid can be used with CLIP to form the belt. Preferred polymerizable materials can include those sufficient of withstanding high temperatures and humid environments in which the papermaking belt may be employed in manufacturing of tissue webs. Polymerizable materials can include a monomer, particularly photopolymerizable and/or free radical polymerizable monomers, and a suitable initiator such as a free radical initiator, and combinations thereof. Examples include, but are not limited to, acrylics, methacrylics, acrylamides, styrenics, olefins, halogenated olefins, cyclic alkenes, maleic anhydride, alkenes, alkynes, carbon monoxide, functionalized oligomers, multifunctional cute site monomers, functionalized PEGs, etc., including combinations thereof.

In certain instances the polymerizable material may include solid particles suspended or dispersed therein. Any suitable solid particle can be used, depending upon the end product being fabricated. The particles can be metallic, organic/polymeric, inorganic, or composites or mixtures thereof. In certain examples the polymerizable materials may include a semi-conductive, or conductive material, such as a conductive metal, to improve or facilitate heat transfer.

In still other examples the materials may comprise a polymeric material having a viscosity greater than 70,000 Centipoise (cP) and preferably in a range from about 100,000 to about 150,000 cP, measured according to ASTM D790-10 at 120° C. In certain preferred examples the polymer material comprises at least one of a polyurethane, a silicone, or a polyureas and has a viscosity from about 120,000 to about 140,000 cP.

If additive manufacturing is used to make one or both of the support layer and structuring layer, non-limiting examples of additive manufacturing processes that may be used are described below and/or may be selected from the group consisting of: continuous liquid interphase printing (CLIP), fused deposition modeling (FDM), electron-beam freeform fabrication (EBF3), direct metal laser sintering (DMLS), electron-beam melting (EBM), selective laser sintering (SLS), selective heat sintering (SHS), laminated object manufacturing (LOM), stereolithography (SLA), digital light processing (DLP), multi-jet modeling (MJM) and mixtures thereof.

With additive manufacturing, a 3D structure of a substrate or portion of a substrate, for example support layer or structuring layer, is digitized via computer-aided solid modeling or the like. The coordinates defining the substrate are then transferred to a device that uses the digitized data to build the substrate. Typically, a processor subdivides the substrate into thin slices or layers. Based on these subdivisions, the printer or other application device then applies thin layers of material sequentially to build the three-dimensional configuration of the substrate. Some methods melt or soften material to produce the layers, while others cure liquid materials using different methods.

One such technique is multi-jet modeling (MJM). With this technique, multiple printer heads apply layers of structural material to form the substrate. Often, layers of a support material are also applied in areas where no material is present to serve as a support layer. The structural material is cured, then the support material is removed. As an example, the structural material may comprise a curable polymeric resin, and the support material may comprise a paraffin wax that can be easily melted and removed.

Another such technique is fused deposition modeling (FDM). This technique also works on an "additive" principle by laying down material in layers. A plastic filament or metal wire is unwound from a coil and supplies material to an extrusion nozzle which can turn the flow on and off. The nozzle is heated to melt the material and can be moved in both horizontal and vertical directions by a numerically controlled mechanism, directly controlled by a computer-aided manufacturing (CAM) software package. The model or part is produced by extruding small beads of thermoplastic material, such as ABS, polycarbonate, and the like, to form layers; typically, the material hardens immediately after extrusion from the nozzle, such that no support layer is employed.

Still another class of alternative technique involves the use of a selective laser, which can either be selective laser sintering (SLS) or selective laser melting (SLM). Like other methods of additive manufacturing, an object formed with an SLS/SLM machine starts as a computer-aided design (CAD) file. CAD files are converted to a data format (e.g., an .stl format), which can be understood by an additive manufacturing apparatus. A powder material, most commonly a polymeric material such as nylon, is dispersed in a thin layer on top of the build platform inside an SLS machine. A laser directed by the CAD data pulses down on the platform, tracing a cross-section of the object onto the powder. The laser heats the powder either to just below its boiling point (sintering) or above its melting point (melting), which fuses the particles in the powder together into a solid form. Once the initial layer is formed, the platform of the SLS machine drops—usually by less than 0.1 mm—exposing a new layer of powder for the laser to trace and fuse together. This process continues again and again until the entire object has been formed. When the object is fully formed, it is left to cool in the machine before being removed.

Still other techniques of additive manufacturing processes include stereolithography (which employs light-curable material and a precise light source) and laminated object manufacturing.

The web material structuring belts of the present invention may be manufactured using any suitable additive manufacturing technique, for example Fused Deposition Modeling™ (commonly known as fused filament fabrication) and PolyJet Technology (Stratasys Ltd, Eden Prairie, Minn., USA) Selective Laser Melting (SLM), Direct Metal Laser Sintering (DMLS), Selective Laser Sintering (SLS), Stereolithography (SLA), and Laminated Object Manufacturing (LOM).

Associating Layer

The associating layer may comprise any of the materials used in the support layer and/or the structuring layer so long as an associating layer according to the present invention is formed and so long as a web material structuring belt according to the present invention is formed comprising a support layer, a structuring layer and an associating layer of the present invention.

Bonding Material

The bonding material may comprise any material, including those described herein, suitable for bonding, chemically and/or adhesively, including thermally, to one or more of the support layer, the structuring layer, the associating layer and/or the backing layer, for example bonding to a material within any of those layers. The bonding material may comprise an adhesive and/or a thermoplastic polymer. In one example, two layers can be associated, for example bonded, together by a bonding material present in a first layer associating, for example bonding, with another bonding material, the same or different from the bonding material in the first layer, present in a second layer.

The bonding material may be a component of a support layer and/or a structuring layer and/or an associating layer and/or a backing layer, for example the bonding material may be present as a sub-layer within a support layer and/or a structuring layer and/or an associating layer and/or a backing layer.

The bonding material may be present in and/or on one or more components of a support layer and/or structuring layer and/or an associating layer and/or a backing layer, for example present in and/or on MD filaments of a woven layer, but not present in and/or on CD filaments of the woven layer and vice versa.

The bonding material may remain at the surfaces of the two or more layers being associated, for example bonded, together and/or may penetrate and/or extend into and/or through one or more of the layers, for example the support layer and/or structuring layer and/or the associating layer and/or the backing layer.

Backing Layer

In one example, a backing layer is a layer of material that contacts at least one or more portions of a surface of the support layer opposite the surface of the support layer associated with the structuring layer, associating layer and/or bonding material. The backing layer may comprise the same or a similar material as the structuring layer and/or associating material and/or may be a compatible material with the material of the structuring layer and/or the material of the associating layer such that the structuring layer and/or associating layer bonds with the backing layer.

Method for Making a Web Material Structuring Belt

In one example of the present invention, a method for making a web material structuring belt, for example a web material structuring papermaking belt, such as a structure-imparting papermaking belt, comprises the steps of:

a. providing a support layer in accordance with the present invention;

b. providing a structuring layer in accordance with the present invention;

wherein the support layer comprises a support layer material seam having a least one support layer material seam portion and/or the structuring layer comprises a structuring layer material seam having at least one structuring layer material seam portion; and c. associating at least the structuring layer material seam portion, when present, with the support layer, and/or the support layer material seam portion, when present, with the structuring layer, such that a web material structuring belt comprising the structuring layer material seam portion that extends into, but less than entirely through the support layer and/or the support layer material seam portion that extends into, but less than entirely through the structuring layer is formed.

In another example of the present invention, a method for making a web material structuring belt, for example a web material structuring papermaking belt, such as a structure-imparting papermaking belt, comprises the steps of:

a. providing a support layer in accordance with the present invention;

b. providing a structuring layer in accordance with the present invention;

wherein the support layer comprises a support layer material seam having a least one support layer material seam portion and/or the structuring layer comprises a structuring layer material seam having at least one structuring layer material seam portion; and c. associating at least the structuring layer material seam portion, when present, with the support layer, and/or the support layer material seam portion, when present, with the structuring layer, such that a web material structuring belt comprising at least a portion of the support layer that extends into, but less than entirely through the structuring layer material seam portion and/or the structuring layer that extends into, but less than entirely through the support layer material seam portion is formed.

In yet another example of the present invention, a method for making a web material structuring belt, for example a web material structuring papermaking belt, such as a structure-imparting papermaking belt, comprises the steps of:

a. providing a support layer; in accordance with the present invention; and b. forming a structuring layer in accordance with the present invention on the support layer wherein the structuring layer comprises a structuring layer material seam having at least one structuring layer material seam portion that extends into, but less than entirely through the support layer such that a web material structuring belt, for example a web material structuring papermaking belt, such as a structure-imparting papermaking belt is formed.

In even another example of the present invention, a method for making a web material structuring belt, for example a web material structuring papermaking belt, such as a structure-imparting papermaking belt, comprises the steps of:

a. providing a structuring layer in accordance with the present invention; and b. forming a support layer in accordance with the present invention on the structuring layer wherein the support layer comprises a support layer material seam having at least one support layer material seam portion that extends into, but less than entirely through the structuring layer such that a web material structuring belt, for example a web material structuring papermaking belt, such as a structure-imparting papermaking belt such that a web material structuring belt, for example a web material structuring papermaking belt, such as a structure-imparting papermaking belt is formed.

Non-Limiting Example of Processes for Making Web Material Structuring Belts

The following definitions are especially applicable to the non-limiting examples of processes for making web material structuring belts according to the present invention.

"Treat" and/or "Treating a layer" and/or "Treatment of a layer" as used herein means that a layer, for example a support layer, a structuring layer and/or an associating layer is exposed to conditions (treated) that allows them to change their physical characteristics and/or properties, for example soften and/or flow and/or solidify.

In one example, a layer is treated to allow it to deform and/or flow and/or migrate and/or penetrate into one or more other layers. Non-limiting examples of such conditions (treatments) that allow a layer to deform and/or flow and/or migrate and/or penetrate include the following:

a) heating a material to soften it, to allow it to deform and/or to flow. For example, to soften could be to heat above the Tg (glass transition temperature) and/or above the melting temperature;
b) applying a plasticizer to soften a material to allow it to deform (A plasticizer is a substance that is added to a material to make it softer and more flexible, to increase its plasticity, to decrease its viscosity, or to decrease friction during its handling in manufacture such as, for example, by reducing its Tg so that the Tg is below the processing temperature); and/or
c) applying an external force to encourage or force the materials to flow such as applying a differential pressure (via vacuum applied to one side, increased pressure on one side, gravity, physical compression applied via a bladder or a roll or multiple rolls, etc.) or by physically pushing the material into the pores of a layer utilizing a patterned penetrating surface (formed on a roll or fabric, etc.).

In one example, a layers is treated to allow it to bond to one or more other layers. Non-limiting examples of such conditions (treatments) that allow a layer to bond include the following:

a) cooling a material to cause it to solidify or to cause an increase in modulus;
b) remove the plasticizing condition;
c) crosslinking a material to cause it to solidify where the crosslinking is driven by heat, moisture, exposure to energy, exposure to a 2nd material, etc.; and/or
d) causing the layer of material to chemically bond to the materials found in the other layer that it is penetrating, for example a support layer and/or a structuring layer.

"Creating a layer" and/or "Creation of a layer" as used herein means a layer is formed from a material by one or more layer creating processes. Non-limiting examples of layer creating processes include the following:

a) physical application of a material using various printing techniques such as additive manufacturing printing, screen printing, gravure printing, roll coating, curtain coating, etc;
b) casting a film in a nip or a vat or extruding a flat layer of material. This film can be modified to create textures upon one or both surfaces, to create apertures, by having materials applied to one or both surfaces of the film to aid in lamination or some other function of the layer (such as process hygiene or lubricity across process rolls, etc.). The film can comprise more than one layer with each layer comprising the same material as the other layer or a different material than the other layer(s);
c) casting a film with a mask to form a layer, where that mask can be patterned, textured or wherein the casting surface is smooth or textured; and/or
d) extrusion of elements other than a film, such as filaments.

"Modifying a layer" and/or "Modification of layer" as used herein means exposing a layer's surface to conditions to result in a physical change of the layer's surface to form a different physical surface of the layer. Non-limiting examples of conditions that modify a layer's surface including the following:

a) application of additional materials to a layer's surface to create additional zones (which may comprise protuberances, discrete and/or continuous regions, etc.). The zones can be used to improve lamination and/or can be part of a structuring layer's surface, for example a structuring layer's web material contacting surface;
b) subjecting a layer's surface to laser engraving and/or laser ablation 1) to create protuberances on the layer's surface and/or at least two of the layer's surfaces, such as a opposing surfaces of the layer, and/or 2) to create apertures in the layer's surface, which in one example penetrate entirely through the layer; and/or
c) application of additional materials in quantities necessary to improve adhesion between the layer's surface being modified and a separate layer of material; and/or
d) treatment of a layer's surface to soften it, then application of a textured surface to the softened layer's surface to transfer a texture from the textured surface to the layer's surface. The treatment to soften the layer can comprise temperature, plasticizers, etc. The textured surface can comprise a woven fabric, a non-woven fabric, a textured belt, a textured roll (such as a hard roll such as steel or another metal or a hardened rubber, etc.), or any other technique.

"Embedment material" as used herein with respect to a support layer and/or structuring layer and/or associating layer means a material present in a support layer and/or structuring layer and/or associating layer that can be treated to penetrate and extend into a support layer or a structuring layer or an associating layer resulting in a web material structuring belt.

Belt Making Example 1—Structuring Layer Extends into Support Layer

First, in one example of FIGS. 14A-14B, create a structuring layer 34 comprising a structuring layer material seam 10, which in this case is an abut seam, wherein the structuring layer material seam 10 has at least one structuring layer material seam portion 36, in this case two structuring layer material seam portions 36. The structuring layer material seam portions 36 comprise an embedment material. Next, position the structuring layer 34 and a support layer 32 in contact with one another, for example at respective surfaces 24, 26 of the layers 32, 34, respectively. Next, treat the structuring layer 34 such that the structuring layer material seam portions' embedment material within the structuring layer material seam 10 is allowed to penetrate and extend into the support layer 32. Then, treat the embedment material so that it remains in the support layer 32 associating the structuring layer 34 with the support layer 32 thus forming a web material structuring belt 30 according to the present invention where the structuring layer 34 and support layer 32 are associated.

Belt Making Example 2: Support Layer Extends into Structuring Layer

First, similar to Belt Making Example 1 above except the seam is present in the support layer rather than in the structuring layer, create a support layer comprising a support layer material seam, which in this case is an abut seam, wherein the support layer material seam has at least one support layer material seam portion, in this case two support layer material seam portions. The support layer material seam portions comprise an embedment material. Next, position the support layer and a structuring layer in contact with one another, for example at respective surfaces of the layers, respectively. Next, treat the support layer such that the support layer material seam portions' embedment material is allowed to penetrate and extend into the structuring layer. Then, treat the embedment material so that it remains in the structuring layer associating the support layer with the structuring layer thus forming a web material structuring belt according to the present invention where the structuring layer and support layer are associated.

Belt Making Example 3: Both Support and Structuring Layers Extend into Each Other Similar to both Belt Making Examples 1 and 2, except seams are present in both the support layer and the structuring layer as shown for example in FIGS. 24A-26B, create a structuring layer 34 comprising a structuring layer material seam 10, which in this case is an abut seam, wherein the structuring layer material seam 10 has at least one structuring layer material seam portion 36, in this case two structuring layer material seam portions 36. The structuring layer material seam portions 36 comprise an embedment material. Next, position the structuring layer 34 and a support layer 32 in contact with one another, for example at respective surfaces 24, 26 of the layers 32, 34, respectively. Next, treat the structuring layer 34 such that the structuring layer material seam portions' embedment material within the structuring layer material seam 10 is allowed to penetrate and extend into, but less than entirely through, the support layer 32. Then, treat the embedment material so that it remains in the support layer 32 associating the structuring layer 34 with the support layer 32 thus forming a web material structuring belt 30 according to the present invention where the structuring layer 34 and support layer 32 are associated. Also the support layer 32 used in this example is created with a support layer material seam 10, which in this case is an abut seam, present therein, wherein the support layer material seam 10 has at least one support layer material seam portion 36, in this case two support layer material seam portions 36. The support layer material seam portions 36 comprise an embedment material. Next, position the support layer 32 and a structuring layer 34 in contact with one another, for example at respective surfaces 24, 26 of the layers 32, 34, respectively. Next, treat the support layer 32 such that the support layer material seam portions' embedment material is allowed to penetrate and extend into, but less than entirely through, the structuring layer 34. Then, treat the embedment material so that it remains in the structuring layer 34 associating the support layer 32 with the structuring layer 34 thus forming a web material structuring belt 30 according to the present invention where the structuring layer 34 and support layer 32 are associated.

The support layer 32 and the structuring layer 34 may be positioned and/or associated with each other such that the support layer material seam 10 and structuring layer material seam 10 are or are not aligned or phase registered with each other in the MD, CD and/or z-direction.

Belt Making Example 4: Additive Manufacturing

Additive manufacture a structuring layer comprising a structuring layer material seam utilizing an additive manufacturing apparatus (such as an FDM). First, the structuring layer comprising a structuring layer material seam, which in this case is an abut seam, is additive manufactured to form at least one structuring layer material seam portion, in this case two structuring layer material seam portions, which are in the form of protuberances the structuring layer. It may also comprise protuberances upon the second surface (opposite surface from the first surface) of the structuring layer. Position the additive manufactured structuring layer material seam portions in contact with a support layer so that the structuring layer material seam portions contact the support layer. Heat the structuring layer material seam portions so that the protuberances soften. Pass the composite (structuring layer and support layer) through a calendar nip to push the two layers together, allowing the structuring layer material seam portions' protuberances to penetrate and extend into the support layer. The calender nip may be heated. An external force may also be applied to the composite to assist the structuring layer material seam portions' protuberances to flow into the support layer. The softened structuring layer material seam portions' protuberances will flow into the empty voids within the support layer and can fill the voids in the support layer and/or just coat the surfaces of the voids (for example the surfaces of the filaments that form the support layer). When sufficient flow of the structuring layer material seam portions' protuberances has occurred, cool the composite quickly so as to solidify the structuring layer material seam portions' protuberances thereby locking the structuring layer material seam portions' protuberances of the additive manufactured structuring layer into place in the support layer forming a web material structuring belt according to the present invention.

Another web material structuring belt of the present invention, may be made by a similar additive manufacturing process where the support layer material seam portions' protuberances are created on the support layer rather than the structuring layer and then are treated, softened and penetrate into the structuring layer.

Belt Making Example 5—Additive Manufacturing

First, a support layer comprising a support layer material seam comprising at least one support layer material seam portion, in this case two support layer material seam portions in the form of protuberances extending from a surface of the support layer is created by additive manufacturing. Next, a structuring layer comprising a structuring layer material seam comprising at least one structuring layer material seam portion, in this case two structuring layer material seam portions in the form of protuberances extending from a surface of the structuring layer is created by additive manufacturing. The support layer and structuring layer are placed in contact with each other in a face-to-face/surface-to-surface arrangement such that one or more of the support layer material seam portions' protuberances of the support layer are in contact with the structuring layer and such that one or more of the structuring layer material seam portions' protuberances of the structuring layer are in contact with the support layer. Next, at least one of the support layer material seam portions' protuberances of the support layer and/or at least one of the structuring layer material seam portions' protuberances of the structuring layer are softened, such as by heating to a temperature above about the melting point of the material of the one or more structuring layer material seam portions' protuberances and the support layer material seam portions' protuberances, to permit the material of the one or more protuberances to flow into, but less than entirely through the support layer and/or structuring layer, respectively, as described herein. The resulting web material structuring belt comprises at least a support layer material seam portion of the support layer and/or at least a structuring layer material seam portion of the structuring layer that extends into, but less than entirely through the other layer. Optionally, the flow of the support layer material seam portions' protuberance material and/or the structuring layer material seam portions' protuberance material may be assisted with an outside force such as gravity, vacuum, air pressure, compression, etc. Once the support layer material seam portions' protuberance material and/or the structuring layer material seam portions' protuberance material has flowed into, but less than entirely through the other layer, the support layer material seam portions' protuberance material and/or the structuring layer material seam portions' protuberance material is solidified, for example by letting the support layer material seam portions' protuberance material and/or the structuring layer material seam portions' protuberance material cool and/or exposing the support layer material seam portions' protuberance material and/or the structuring layer material seam portions' protuberance material to energy and/or exposing the support layer material seam portions' protuberance material and/or the structuring layer material seam portions' protuberance material to a co-reactant and/or letting the support layer material seam portions' protuberance material and/or the structuring layer material seam portions' protuberance material dry.

Belt Making Example 6—Additive Manufacturing

The web material structuring belt is initially made according generally to Belt Making Example 4 or 5 except at least one of the support layer material seam portions' protuberances and/or the structuring layer material seam portions' protuberances of one of the layers is mechanically pushed into the other layer, for example by a textured belt and/or textured roll that is registered with the at least one support layer material seam portions' protuberance and/or structuring layer material seam portions' protuberance. The support layer material seam portions' protuberance material and/or the structuring layer material seam portions' protuberance material may be softened, such as by heating to a temperature above about the melting point of the support layer material seam portions' protuberance material and/or the structuring layer material seam portions' protuberance material of the one or more support layer material seam portions' protuberances and/or structuring layer material seam portions' protuberances to permit the material of the one or more protuberances to flow into, but less than entirely through the support and/or structuring layer as described herein. The resulting web material structuring belt comprises at least a support layer material seam portion and/or at least a structuring layer material seam portion that extends into, but less than entirely through the other layer. Optionally, the flow of the protuberance material may be assisted with an outside force such as gravity, vacuum, air pressure, compression, etc. Once the protuberance material has flowed into, but less than entirely through the other layer, the protuberance material is solidified, for example by letting the protuberance material cool and/or exposing the protuberance material to energy and/or exposing the protuberance material to a co-reactant and/or letting the protuberance material dry.

Belt Making Example 7—Additive Manufacturing

The web material structuring belt of this example is initially made according generally to Belt Making Example 4, wherein first, a structuring layer comprising a structuring layer material seam, which in this case is an abut seam, having at least one structuring layer material seam portions, in this case two structuring layer material seam portions in the form of protuberances extending from a surface of the structuring layer is created by additive manufacturing. Next, a support layer according to the present invention, for example a woven material support layer, such as a through-air-drying fabric, is placed in contact at least one of the structuring layer material seam portions' protuberances of the structuring layer in a face-to-face/surface-to-surface arrangement. Then, at least one of the structuring layer material seam portions' protuberances of the structuring layer is softened, such as by heating to a temperature above about the melting point of the material of the one or more structuring layer material seam portions' protuberances to permit the material of the one or more protuberances to flow into, but less than entirely through the support layer as described herein. The resulting web material structuring belt comprises at least a structuring layer material seam portion of the structuring layer extending into, but less than entirely through the support layer. Optionally, the flow of the structuring layer material seam portions' protuberance material may be assisted with an outside force such as gravity, vacuum, air pressure, compression, push and/or pull forces, etc. Once the structuring layer material seam portions' protuberance material has flowed into, but less than entirely through the support layer, the protuberance material is solidified, for example by letting the protuberance material cool and/or exposing the protuberance material to energy and/or exposing the protuberance material to a co-reactant and/or letting the protuberance material dry.

Another web material structuring belt of the present invention may be made by a similar additive manufacturing process where the support layer comprises a support layer material seam comprising at least one support layer material seam portion in the form of one or more protuberances are created on the support layer rather than the structuring layer, and wherein the structuring layer may be a woven material structuring layer, such as a through-air-drying fabric, and then where the support layer material seam portions' protuberances are treated, softened and penetrate into the structuring layer.

Belt Making Example 8—Additive Manufacturing

The web material structuring belt is initially made according Belt Making Example 7 except at least one of the structuring layer material seam portions' protuberances and/or the support layer material seam portions' protuberances is mechanically pushed into the other layer, for example by a textured belt and/or textured roll that is registered with the at least one structuring layer material seam portions' protuberance and/or support layer material seam portions' protuberance. The protuberance material may be softened, such as by heating to a temperature above about the melting point of the material of the one or more protuberances to permit the material of the one or more protuberances to flow into the support and/or structuring layer. The resulting web material structuring belt comprises at least a support layer material seam portion of the support layer and/or at least a structuring layer material seam portion of the structuring layer that extends into, but less than entirely through the other layer as described herein. Optionally, the flow of the structuring layer material seam portions' protuberance material and/or the support layer material seam portions' protuberance material may be assisted with an outside force such as gravity, vacuum, air pressure, compression, etc. Once the structuring layer material seam portions' protuberance material and/or the support layer material seam portions' protuberance material has flowed into, but less than entirely through the other layer, the protuberance material is solidified, for example by letting the protuberance material cool and/or exposing the protuberance material to energy and/or exposing the protuberance material to a co-reactant and/or letting the protuberance material dry.

Belt Making Example 9—Cast

First, a support layer according to the present invention, for example a woven material support layer, such as a through-air-drying fabric is provided. Next, a structuring layer, for example a polymer resin casted structuring layer is applied to a surface of the support layer such that a structuring layer material seam having at least one structuring layer material seam portions, in this case two structuring layer material seam portions in the form of two protuberances, at least one of which flows into, but less than entirely through the support layer as described herein is formed. The resulting web material structuring belt comprises at least a structuring layer material seam portion of the structuring layer extending into, but less than entirely through the support layer. In one example, at least one of the protuberances of the structuring layer material seam portions extends entirely through the support layer. Optionally, the flow of the structuring layer material seam portions' protuberance material may be assisted with an outside force such as gravity, vacuum, air pressure, compression, push and/or pull forces, etc. Once the protuberance material has flowed into, but less than entirely through the support layer, the protuberance material is solidified, for example by letting the protuberance material cool and/or exposing the protuberance material to energy and/or exposing the protuberance material to a co-reactant and/or letting the protuberance material dry.

Belt Making Example 10—Cast

Similar to Belt Making Example 9 above, a polymer resin casted structuring layer is applied to a surface of a support layer, for example a woven material support layer, such as a through-air-drying fabric, to form a structuring layer comprising a structuring layer material seam having at least one structuring layer material seam portion, in this case two structuring layer material seam portions in the form of one or more protuberances. At least one of the structuring layer material seam portions' protuberances of the polymer resin casted structuring layer is then mechanically pushed into the other layer, for example by a textured belt and/or textured roll. The structuring layer material seam portions' protuberance material may be softened, such as by heating to a temperature above about the melting point of the structuring layer material seam portions' protuberance material to permit the structuring layer material seam portions' protuberance material to flow into the support layer. The resulting web material structuring belt comprises at least one structuring layer material seam portion that extends into, but less than entirely through the support layer as described herein. Optionally, the flow of the structuring layer material seam portions' protuberance material may be assisted with an outside force such as gravity, vacuum, air pressure, compression, etc. Once the structuring layer material seam portions' protuberance material has flowed into, but less than entirely through the support layer, the structuring layer material seam portions' protuberance material is solidified, for example by letting the structuring layer material seam portions' protuberance material cool and/or exposing the structuring layer material seam portions' protuberance material to energy and/or exposing the structuring layer material seam portions' protuberance material to a co-reactant and/or letting the structuring layer material seam portions' protuberance material dry.

Belt Making Example 11—Film Structuring Layer

First, cast and/or extrude a structuring layer, for example a film, comprising a structuring layer material seam having at least one structuring layer material seam portion, in this case two structuring layer material seam portions in the form of one or more protuberances. Create apertures in the film, for example by stamping and/or by laser ablating. Next, a support layer according to the present invention, for example a woven material support layer, such as a through-air-drying fabric, is placed in contact at least one of the structuring layer material seam portions' protuberances in a face-to-face/surface-to-surface arrangement. Then, at least one of the structuring layer material seam portions' protuberances is softened, such as by heating to a temperature above about the melting point of the structuring layer material seam portions' protuberance material to permit the structuring layer material seam portions' protuberance material to flow into, but less than entirely through the support layer as described herein. The resulting web material structuring belt comprises at least one structuring layer material seam portion that extends into, but less than entirely through the support layer as described herein. Optionally, the flow of the structuring layer material seam portions' protuberance material may be assisted with an outside force such as gravity, vacuum, air pressure, compression, etc. Once the structuring layer material seam portions' protuberance material has flowed into, but less than entirely through the support layer, the structuring layer material seam portions' protuberance material is solidified, for example by letting the structuring layer material seam portions' protuberance material cool and/or exposing the structuring layer material seam portions' protuberance material to energy and/or exposing the structuring layer material seam portions' protuberance material to a co-reactant and/or letting the structuring layer material seam portions' protuberance material dry.

Belt Making Example 12—Film Structuring Layer

First, this example is similar to Belt Making Example 11 above, wherein the structuring layer, for example a cast and/or extruded film, comprising a structuring layer material seam having at least one structuring layer material seam portion, in this case two structuring layer material seam portions in the form of one or more protuberances. Texture the film, for example by pressing a woven material and/or patterned roll into a surface of the film and/or laser ablating the surface of the film. Next, a support layer according to the present invention, for example a woven material support layer, such as a through-air-drying fabric, is placed in contact at least one of the structuring layer material seam portions' protuberances in a face-to-face/surface-to-surface arrangement. Then, at least one of the structuring layer material seam portions' protuberances is softened, such as by heating to a temperature above about the melting point of the structuring layer material seam portions' protuberance material to permit the material of the one or more structuring layer material seam portions' protuberances to flow into, but less than entirely through the support layer as described herein. The resulting web material structuring belt comprises at least one structuring layer material seam portion that extends into, but less than entirely through the support layer as described herein. Optionally, the flow of the structuring layer material seam portions' protuberance material may be assisted with an outside force such as gravity, vacuum, air pressure, compression, etc. Once the structuring layer material seam portions' protuberance material has flowed into, but less than entirely through the support layer, the structuring layer material seam portions' protuberance material is solidified, for example by letting the structuring layer material seam portions' protuberance material cool and/or exposing the structuring layer material seam portions' protuberance material to energy and/or exposing the structuring layer material seam portions' protuberance material to a co-reactant and/or letting the structuring layer material seam portions' protuberance material dry.

Belt Making Example 13—Structuring Layer Extends into Support Layer

First, any void areas of a support layer, for example a woven support layer, such as a through-air-drying fabric, according to the present invention is filled from the support layer's lower surface to its upper surface (the surface that becomes associated with the structuring layer, which is opposite the lower surface) with a white wallboard joint compound commercially available as DAP, Baltimore, MD. Once dry, the white wallboard joint compound present on and in the support layer is removed such that one or more void areas of at least the thickness of the top layer of filaments that define the upper surface of the support layer is created within the support layer suitable for receiving at least a portion of a photosensitive resinous material that ultimately forms the structuring layer as described below. The white wallboard joint compound is removed by contacting it with a water-dampened drywall sponge. Next, at least the upper surface of the support layer is dried. A photosensitive resinous material, which ultimately forms the structuring layer, is then directly applied to the upper surface of the support layer such that at least a portion of the photosensitive resinous material forms a structuring layer material seam having at least one, in this case two structuring layer material seam portions in the form of structuring layer material seam portion protuberances that at least partially fill one or more of the void areas of the support layer. The photosensitive resinous material of the structuring layer material seam portions is then cured. In addition, the remaining photosensitive resinous material is also cured using a mask having a pattern of transparent and opaque regions, for example as described in U.S. Pat. No. 5,624,790 and a light of an activating wavelength. The cured photosensitive resinous material forms the structuring layer having two structuring layer material seam portions that extend into the support layer. After curing of the photosensitive resinous material through the transparent regions of the mask, the remaining white wallboard joint compound present in the support layer and any uncured photosensitive resinous material present is removed, for example by a shower, such as a resin wash shower. One or more portions of the cured photosensitive resinous material extends above the upper surface of the support layer by about 28 mils and/or extends into, but less than entirely through the support layer at one or more of the previously present void areas. The resulting web material structuring belt comprises the support layer and the structuring layer, which is present in the form of a pattern according to the mask and extends into, but less than entirely through the support layer according to the present invention as described herein. The resulting web material structuring belt structuring layer material seam exhibits the following properties: 1) a Peak Peel Force value of 2.0 N; 2) an Energy value of 1.0 J/m both as measured according to the Seam 180° Free Peel Test Method described herein.

Belt Making Example 14—Structuring Layer Extends into Support Layer

First, any void areas of a support layer, for example a woven support layer, such as a through-air-drying fabric, according to the present invention is filled from the support layer's lower surface to its upper surface (the surface that becomes associated with the structuring layer), which is opposite the lower surface) with a white wallboard joint compound commercially available as DAP, Baltimore, MD comprising 5% by weight of a black dye commercially available as Liquid Black, Rit Dye, Bridgeview, IL. (black wallboard joint compound), which is added to attempt to minimize any backscattering of the activating wavelengths of the curing light describe below. Once dry, the black wallboard joint compound present on and in the support layer is removed such that one or more void areas of at least the thickness of the top layer of filaments that define the upper surface of the support layer is created within the support layer suitable for receiving at least a portion of a photosensitive resinous material that ultimately forms the structuring layer as described below. The black wallboard joint compound is removed by contacting it with a water-dampened drywall sponge. Next, at least the upper surface of the support layer is dried. A photosensitive resinous material, which ultimately forms the structuring layer, is then directly applied to the upper surface of the support layer such that at least a portion of the photosensitive resinous material forms a structuring layer material seam having at least one, in this case two structuring layer material seam portions in the form of structuring layer material seam portion protuberances that at least partially fill one or more of the void areas of the support layer. The photosensitive resinous material of the structuring layer material seam portions is then cured. In addition, the remaining photosensitive resinous material is also cured using a mask having a pattern of transparent and opaque regions, for example as described in U.S. Pat. No. 5,624,790 and a light of an activating wavelength. The cured photosensitive resinous material forms the structuring layer having two structuring layer material seam portions that extend into the support layer. After curing of the photosensitive resinous material through the transparent regions of the mask, the remaining black wallboard joint compound present in the support layer and any uncured photosensitive resinous material present is removed, for example by a shower, such as a resin wash shower. One or more portions of the cured photosensitive resinous material extends above the upper surface of the support layer by about 28 mils and/or extends into, but less than entirely through the support layer at one or more of the previously present void areas. The resulting web material structuring belt comprises the support layer and the structuring layer, which is present in the form of a pattern according to the mask and extends less than entirely through the support layer according to the present invention as described herein. The resulting web material structuring belt structuring layer material seam exhibits the following properties: 1) a Peak Peel Force value of 2.2 N; 2) an Energy value of 1.6 J/m both as measured according to the Seam 180° Free Peel Test Method described herein.

Belt Making Example 15: Associating Layer Extends into Support Layer

First, create an associating layer comprising an embedment layer on a first surface. Next, associate the associating layer with a support layer, for example a surface of the support layer. Next, treat the associating layer embedment layer to allow it to penetrate into the support layer. Next, treat the embedment layer so that it bonds forming a laminate with the support layer where the associating layer and support layer are associated. Then, associate the laminate with a structuring layer comprising a structuring layer material seam having at least one, in this case two structuring layer material seam portions in the form of protuberances, which penetrate into the associating layer thus resulting in the web material structuring belt according to the present invention.

If the associating layer comprises an associating layer material seam, then the support layer and the associating layer may be positioned and/or associated with each other such that the support layer material seam and associating layer material seam are or are not aligned or phase registered with each other in the MD, CD and/or z-direction.

Belt Making Example 16: Associating Layer Extends into Structuring Layer

First, create an associating layer comprising an embedment layer on a first surface. Next, associate the associating layer with a structuring layer comprising a structuring layer material seam having at least one, in this case two structuring layer material seam portions. Next, treat the associating layer embedment layer to allow it to penetrate into the structuring layer material seam portions. Next, treat the embedment layer so that it bonds to the structuring layer material seam portions to form a laminate of the associating layer and the structuring layer. Then, associate the laminate with a support layer. Finally, treat the associating layer and/or the support layer so that the associating layer and/or the support layer bond to the other layer forming a web material structuring belt according to the present invention.

If the associating layer comprises an associating layer material seam, then the structuring layer and the associating layer may be positioned and/or associated with each other such that the structuring layer material seam and associating layer material seam are or are not aligned or phase registered with each other in the MD, CD and/or z-direction.

Belt Making Example 17: Associating Layer Extends into Both Support Layer and Structuring Layer First, create an associating layer comprising an embedment layer on both the first and second surfaces. Next, associate the associating layer with a support layer, which may comprise a support layer material seam having at least one support layer material seam portions, and with a structuring layer comprising a structuring layer material seam having at least one, in this case two structuring layer material seam portions. Next, treat the associating layer embedment layer(s) to allow it/them to penetrate both the support layer and the structuring layer material seam portions. Finally, treat the embedment layer(s) so that it/they bond with both the support layer and structuring layer material seam portions forming a web material structuring belt according to the present invention.

If the associating layer comprises an associating layer material seam, then the support layer, the structuring layer and the associating layer may be positioned and/or associated with each other such that two or more of the support layer material seam, the structuring layer material seam and the associating layer material seam are or are not aligned or phase registered with each other in the MD, CD and/or z-direction.

Belt Making Example 18: Backing Layer and Associating Layer

First, create an associating layer comprising an embedment layer on a first surface or on both a first surface and second surface, opposite the first surface. Second, create a backing layer different from the associating layer. Next, associate the associating layer and the backing layer with the support layer placed between them so that the associating layer and the backing layer are in contact with opposite surfaces of the support layer. Next, treat the associating layer embedment layer to allow it to penetrate the support layer until it contacts the backing layer. Then, treat the embedment layer of the associating layer so that it bonds with the support layer forming a laminate. Next, place the structuring layer comprising a structuring layer material seam having at least one, in this case two structuring layer material seam portions onto the laminate so that it is in contact with an embedment layer of the associating layer. Finally, treat the embedment layer so that it bonds with the structuring layer material seam portions forming a web material structuring belt according to the present invention.

If the associating layer comprises an associating layer material seam, then the structuring layer and the associating layer may be positioned and/or associated with each other such that the structuring layer material seam and associating layer material seam are or are not aligned or phase registered with each other in the MD, CD and/or z-direction.

Belt Making Example 19: Two Associating Layers Between Support Layer and Structuring Layer First, create a first associating layer comprising an embedment layer on a first surface or on both the first and second surfaces. Second, create a second associating layer comprising an embedment layer on a first surface or on both the first and second surfaces. Next, associate the two associating layers with a support layer and with a structuring layer comprising a structuring layer material seam having at least one, in this case two structuring layer material seam portions where the associating layers are placed between the support layer and structuring layer. Next, treat the embedment layers of the first and second associating layers to allow them to penetrate the structuring layer material seam portions and the support layer. Finally, treat the embedment layers so that they bond with the structuring layer material seam portions and the support layer forming a web material structuring belt according to the present invention.

If one or more of the associating layers comprises an associating layer material seam, then the support layer, the structuring layer and the associating layer may be positioned and/or associated with each other such that two or more of the support layer material seam, the structuring layer material seam and the associating layer material seam are or are not aligned or phase registered with each other in the MD, CD and/or z-direction.

Belt Making Example 20: Associating Layer Created within the Support Layer

First, create an associating layer that is in intimate contact with a support layer. Create the associating layer so that it also comprises an embedment layer. Second, associate the support layer comprising the associating layer with a structuring layer comprising a structuring layer material seam having at least one structuring layer material seam portions. Next, treat the embedment layer to allow it to penetrate the at least one structuring layer material seam portions. Finally, treat the embedment layer so that it bonds with the at least one structuring layer forming a web material structuring belt according to the present invention.

Belt Making Example 21: Associating Layer Created within the Structuring Layer

First, create an associating layer that is in intimate contact with a structuring layer. Second, create the associating layer so that it also comprises an embedment layer. Next, associate the structuring layer comprising the associating layer with a support layer comprising a support layer material seam having at least one support layer material seam portions. Next, treat the embedment layer to allow it to penetrate the at least one support layer material seam portions. Finally, treat the embedment layer so that it bonds with the at least one support layer forming a web material structuring belt according to the present invention.

Belt Making Example 22: Associating Layer Extends into Support Layer and Structuring Layer First, as generally described in U.S. Pat. No. 5,624,790, a sufficient amount of photosensitive resinous material, a portion of which ultimately forms a structuring layer comprising a structuring layer material seam having at least one structuring layer material seam portion, is directly applied to a surface of a clear barrier film, for example Clear Dura-Lar film commercially available from Grafix, Maple Heights, Ohio, such that the resulting structuring layer exhibits a maximum height of about 28 mils. The photosensitive resinous material is then cured using a mask having a pattern of transparent and opaque regions, for example as described in U.S. Pat. No. 5,624,790 and a light of an activating wavelength. The mask pattern is similar to that shown in U.S. Pat. No. 6,200,419. After curing of the photosensitive resinous material through the transparent regions of the mask, the mask is removed, any uncured photosensitive resinous material are removed by a shower, such as a resin wash shower, and then cured resin still on the barrier film is dried. The cured photosensitive resinous material, which forms the structuring layer, exhibits a maximum height of about 28 mils. After drying of the structuring layer, an associating layer is applied to the structuring layer; namely, 2 mm wide lines of silicone adhesive commercially available as GE500 Silicone, Henkel Corporation, Bridgewater, NJ (associating layer) spaced 15 mm apart are applied to the structuring layer surface opposite the clear barrier film. The structuring layer surface with silicone adhesive present thereon while the structuring layer is still carried on the clear barrier film is then brought into contact with a surface of a support layer according to the present invention. 345 N/m$^2$ of pressure is then applied to the support layer/associating layer/structuring layer multi-layer structure and is maintained until the silicone adhesive has cured. The silicone adhesive penetrates into the support layer and the at least one structuring layer material seam portion and entangles and/or wraps the components, for example filaments and/or fibers of one or more of the support layer and the structuring layer material seam portion, rather than physically and/or chemically bonding to the components, such that a silicone adhesive layer having a thickness of about 0.7 mm between the layers is formed. This silicone adhesive layer included void regions. Once cured, the clear barrier film is removed from the structuring layer and discarded. The resulting web material structuring belt comprises the support layer, the associating layer (silicone adhesive) and the structuring layer, which is present in the form of a pattern according to the mask. The resulting web material structuring belt support layer material seam and/or structuring layer material seam exhibits the following properties: 1) a Peak Peel Force value of 5.5 N; 2) an Energy value of 1.3 J/m both as measured according to the Seam 180° Free Peel Test Method described herein.

Belt Making Example 23: Associating Layer Extends into Support Layer and Structuring Layer First, as generally described in U.S. Pat. No. 5,624,790, a sufficient amount of photosensitive resinous material, a portion of which ultimately forms a structuring layer comprising a structuring layer material seam having at least one structuring layer material seam portion, is directly applied to a surface of a clear barrier film, for example Clear Dura-Lar film commercially available from Grafix, Maple Heights, Ohio, such that the resulting structuring layer exhibits a maximum height of about 28 mils. The photosensitive resinous material is then cured using a mask having a pattern of transparent and opaque regions, for example as described in U.S. Pat. No. 5,624,790 and a light of an activating wavelength. The mask pattern is similar to that shown in U.S. Pat. No. 6,200,419. After curing of the photosensitive resinous material through the transparent regions of the mask, the mask is removed, any uncured photosensitive resinous material are removed by a shower, such as a resin wash shower, and then cured resin still on the barrier film is dried. The cured photosensitive resinous material, which forms the structuring layer, exhibits a maximum height of about 28 mils. After drying of the structuring layer, an associating layer is applied to the structuring layer; namely, 2 mm wide lines of silicone adhesive commercially available as GE500 Silicone, Henkel Corporation, Bridgewater, NJ (associating layer) spaced 15 mm apart are applied to the structuring layer surface opposite the clear barrier film. The structuring layer surface with silicone adhesive present thereon while the structuring layer is still carried on the clear barrier film is then brought into contact with a surface of a support layer according to the present invention. 345 N/m$^2$ of pressure is then applied to the support layer/associating layer/structuring layer multi-layer structure and is maintained until the silicone adhesive has cured. The silicone adhesive penetrates into the support layer and the at least one structuring layer material seam portion and entangles and/or wraps the components, for example filaments and/or fibers of one or more of the support layer and the structuring layer material seam portion, rather than physically and/or chemically bonding to the components, such that a silicone adhesive layer having a thickness of about 0.7 mm between the layers is formed. This silicone adhesive layer included void regions. Once cured, the clear barrier film is removed from the structuring layer and discarded. The resulting web material structuring belt comprises the support layer, the associating layer (silicone adhesive) and the structuring layer, which is present in the form of a pattern according to the mask. The resulting web material structuring belt structuring layer material seam exhibits the following properties: 1) a Peak Peel Force value of 3.8 N; 2) an Energy value of 1.1 J/m both as measured according to the Seam 180° Free Peel Test Method described herein.

Belt Making Example 24: Associating Layer Extends into Support Layer and Structuring Layer First, as generally described in U.S. Pat. No. 5,624,790, a sufficient amount of photosensitive resinous material, a portion of which ultimately forms the structuring layer comprising a structuring layer material seam having at least one structuring layer material seam portion, is directly applied to a surface of a clear barrier film, for example Clear Dura-Lar film commercially available from Grafix, Maple Heights, Ohio, such that the resulting structuring layer exhibits a maximum height of about 28 mils. The photosensitive resinous material is then cured using a mask having a pattern of transparent and opaque regions, for example as described in U.S. Pat. No. 5,624,790 and a light of an activating wavelength. The mask pattern comprises a continuous knuckle similar to that shown in FIG. 8A of U.S. Pat. No. 6,200,419. After curing of the photosensitive resinous material through the transparent regions of the mask, the mask is removed and any uncured photosensitive resinous material are removed by a shower, such as a resin wash shower, and then cured resin still on the barrier film is dried. The cured photosensitive resinous material, which forms the structuring layer, exhibits a maximum height of about 28 mils. Next, ethylcyanoacrylate adhesive commercially available as Gorilla Super Glue Gel, The Gorilla Glue Company, Cincinnati, OH, is applied to a support layer, for example a woven support layer, such as a through-air-drying fabric, according to the present invention. The ethylcyanoacrylate adhesive is applied to the support layer in about 2 mm by about 10 mm dashed lines pattern that mirrors the network pattern of the structuring layer. The support layer surface with ethylcyanoacrylate adhesive present thereon is then brought into contact with a surface of the structuring layer while the structuring layer is still carried on the clear barrier film. 345 $N/m^2$ of pressure is then applied to the support layer/associating layer/structuring layer multi-layer structure and is maintained until the ethylcyanoacrylate adhesive has cured. The ethylcyanoacrylate adhesive penetrates into the support layer and the at least one structuring layer material seam portion and physically and/or chemically bonds to the components, for example filaments and/or fibers, of at least one of the support layer and the structuring layer material seam portion, such that no measurable thickness of the ethylcyanoacrylate adhesive is formed between the support layer and the structuring layer and thus no measurable gap or spacing between the support layer and the structuring layer is formed. Once cured, the clear barrier film is removed from the structuring layer and discarded. The resulting web material structuring belt comprises the support layer, the associating layer (ethylcyanoacrylate adhesive) and the structuring layer, which is present in the form of a pattern according to the mask. The resulting web material structuring belt structuring layer material seam exhibits the following properties: 1) a Peak Peel Force value of 8.2. N; 2) an Energy value of 2.4 J/m both as measured according to the Seam 180° Free Peel Test Method described herein.

Belt Making Example 25: Associating Layer Extends into Support Layer and Structuring Layer First, as generally described in U.S. Pat. No. 5,624,790, a sufficient amount of photosensitive resinous material, a portion of which ultimately forms the structuring layer comprising a structuring layer material seam having at least one structuring layer material seam portion, is directly applied to a surface of a clear barrier film, for example Clear Dura-Lar film commercially available from Grafix, Maple Heights, Ohio, such that the resulting structuring layer exhibits a maximum height of about 28 mils. The photosensitive resinous material is then cured using a mask having a pattern of transparent and opaque regions, for example as described in U.S. Pat. No. 5,624,790 and a light of an activating wavelength. The mask pattern comprises discrete knuckles similar to that shown in FIG. 8C of U.S. Pat. No. 6,200,419. After curing of the photosensitive resinous material through the transparent regions of the mask, the mask is removed and any uncured photosensitive resinous material are removed by a shower, such as a resin wash shower, and then cured resin still on the barrier film is dried. The cured photosensitive resinous material, which forms the structuring layer, exhibits a maximum height of about 28 mils. Next, ethylcyanoacrylate adhesive commercially available as Gorilla Super Glue Gel, The Gorilla Glue Company, Cincinnati, OH, is applied to a support layer, for example a woven support layer, such as a through-air-drying fabric, according to the present invention. The ethylcyanoacrylate adhesive is applied to the support layer in about 2 mm by about 10 mm dashed lines pattern that mirrors the network pattern of the structuring layer. The support layer surface with ethylcyanoacrylate adhesive present thereon is then brought into contact with a surface of the structuring layer while the structuring layer is still carried on the clear barrier film. 345 $N/m^2$ of pressure is then applied to the support layer/associating layer/structuring layer multi-layer structure and is maintained until the ethylcyanoacrylate adhesive has cured. The ethylcyanoacrylate adhesive penetrates into the support layer and the at least one structuring layer material seam portion and physically and/or chemically bonds to the components, for example filaments and/or fibers, of at least one of the support layer and the structuring layer material seam portion, such that no measurable thickness of the ethylcyanoacrylate adhesive is formed between the support layer and the structuring layer and thus no measurable gap or spacing between the support layer and the structuring layer is formed. Once cured, the clear barrier film is removed from the structuring layer and discarded. The resulting web material structuring belt comprises the support layer, the associating layer (ethylcyanoacrylate adhesive) and the structuring layer, which is present in the form of a pattern according to the mask.

Belt Making Example 26: Associating Layer Extends into Support Layer and Structuring Layer First, as generally described in U.S. Pat. No. 5,624,790, a sufficient amount of photosensitive resinous material, a portion of which ultimately forms the structuring layer comprising a structuring layer material seam having at least one structuring layer material seam portion, is directly applied to a surface of a clear barrier film, for example Clear Dura-Lar film commercially available from Grafix, Maple Heights, Ohio, such that the resulting structuring layer exhibits a maximum height of about 28 mils. The photosensitive resinous material is then cured using a mask having a pattern of transparent and opaque regions, for example as described in U.S. Pat. No. 5,624,790 and a light of an activating wavelength. The mask pattern is similar to that shown in U.S. Pat. No. 6,200,419. After curing of the photosensitive resinous material through the transparent regions of the mask, the mask is removed and any uncured photosensitive resinous material are removed by a shower, such as a resin wash shower, and then dried. The cured photosensitive resinous material, which forms the structuring layer, exhibits a maximum height of about 28 mils. Next, ethylcyanoacrylate adhesive commercially available as Gorilla Super Glue Gel, The Gorilla Glue Company, Cincinnati, OH, is applied to a support layer, for example a woven support layer, such as a through-air-drying fabric, according to the present invention, which is different from the support layer of Example 26, according to the present invention. The ethylcyanoacrylate adhesive is applied to the support layer in a about 2 mm by about 10 mm dashed lines pattern that mirrors the network pattern of the structuring layer. The support layer surface with ethylcyanoacrylate adhesive present thereon is then brought into contact with a surface of the structuring layer while the structuring layer is still carried on the clear barrier film. 345 $N/m^2$ of pressure is then applied to the support layer/associating layer/structuring layer multi-layer structure and is maintained until the ethylcyanoacrylate adhesive has cured. The ethylcyanoacrylate adhesive penetrates into the support layer and the at least one structuring layer material seam portion and physically and/or chemically bonds to the components, for example filaments and/or fibers, of at least one of the support layer and the structuring layer material seam portion, such that no measurable thickness of the ethylcyanoacrylate adhesive is formed between the support layer and the structuring layer and thus no measurable gap or spacing between the support layer and the structuring layer is formed. Once cured, the clear barrier film is removed from the structuring layer and discarded. The resulting web material structuring belt comprises the support layer, the associating layer (ethylcyanoacrylate adhesive) and the structuring layer, which is present in the form of a pattern according to the mask. The resulting web material structuring belt structuring layer material seam exhibits the following properties: 1) a Peak Peel Force value of 9.5 N; 2) an Energy value of 2.5 J/m both as measured according to the Seam 180° Free Peel Test Method described herein.

Belt Making Example 27: Associating Layer Extends into Support Layer and Structuring Layer First, a bead of silicone adhesive commercially available as GE500 Silicone, Henkel Corporation, Bridgewater, NJ, (associating layer) is applied to one side of an ABS plastic mesh "chicken wire" commercially available from Maporch, Ha Noi City, Vietnam (structuring layer) comprising a structuring layer material seam having at least one structuring layer material seam portion. The ABS plastic mesh has 8 mm circular openings connected with 2 mm wide plastic beams. The silicone adhesive is generally applied continuously along the continuous network of 2 mm wide plastic beams.

The silicone adhesive carried by the ABS plastic mesh is then placed in contact with a surface, for example an upper surface of a support layer, for example a woven support layer, such as a through-air-drying fabric, according to the present invention comprising a support layer material seam having at least one support layer material seam portion. 345 $N/m^2$ of pressure is then applied to the support layer/associating layer/structuring layer multi-layer structure and is maintained until the silicone adhesive has cured. The silicone adhesive penetrates into at least the support layer material seam portion and at least the structuring layer material seam portion, and entangles and/or wraps the components, for example filaments and/or fibers of the support layer material seam portion and the structuring layer material seam portion, rather than physically and/or chemically bonding to the components, such that a silicone adhesive layer having a thickness of about 1.0 mm between the layers is formed. The resulting web material structuring belt comprises one or more void volumes between the support layer and the structuring layer. The resulting web material structuring belt comprises the support layer, the associating layer (silicone adhesive) and the structuring layer (ABS plastic mesh). The resulting web material structuring belt support layer material seam and/or structuring layer material seam exhibits the following properties: 1) a Peak Peel Force value of 0.6 N; 2) an Energy value of 0.4 J/m both as measured according to the Seam 180° Free Peel Test Method described herein. The air permeability of this resulting web material structuring belt is about 731 scfm as measured using a Textest Portair FX 3360, TEXTEST AG, Schwerzenbach, Switzerland, using a 20.7 mm orifice at a pressure differential of 125 Pascals.

Belt Making Example 28: Associating Layer Extends into Support Layer and Structuring Layer First, a bead of silicone adhesive commercially available as GE500 Silicone, Henkel Corporation, Bridgewater, NJ (associating layer) is applied to one side of an ABS plastic mesh "chicken wire" commercially available from Maporch, Ha Noi City, Vietnam (structuring layer) comprising a structuring layer material seam having at least one structuring layer material seam portion. The ABS plastic mesh has 8 mm circular openings connected with 2 mm wide plastic beams. The silicone adhesive is generally applied continuously along the continuous network of 2 mm wide plastic beams. The silicone adhesive carried by the ABS plastic mesh is then placed in contact with a surface, for example an upper surface of a support layer, for example a woven support layer, such as a through-air-drying fabric, according to the present invention comprising a support layer material seam having at least one support layer material seam portion. 345 $N/m^2$ of pressure is then applied to the support layer/associating layer/structuring layer multi-layer structure and is maintained until the silicone adhesive has cured. The silicone adhesive penetrates into at least the support layer material seam portion and at least the structuring layer material seam portion, and entangles and/or wraps the components, for example filaments and/or fibers of the support layer material seam portion and the structuring layer material seam portion, rather than physically and/or chemically bonding to the components, such that a silicone adhesive layer having a thickness of about 0.7 to 1.0 mm between the layers is formed. The resulting web material structuring belt comprises the support layer, the associating layer (silicone adhesive) and the structuring layer (ABS plastic mesh). The resulting web material structuring belt comprises one or more void volumes between the support layer and the structuring layer. The resulting web material structuring belt support layer material seam and/or structuring layer material seam exhibits the following properties: 1) a Peak Peel Force value of 0.8 N; 2) an Energy value of 0.4 J/m both as measured according to the Seam 180° Free Peel Test Method described herein.

Belt Making Example 29: Associating Layer Extends into Support Layer and Structuring Layer First, drops of ethylcyanoacrylate adhesive commercially available as Gorilla Super Glue Gel, The Gorilla Glue Company, Cincinnati, OH, (associating layer) is applied to one side of a ¾ inch Black Polypropylene Net "bird netting" commercially available from Bird-X, Inc. Elmhurst, IL (structuring layer) comprising a structuring layer material seam having at least one structuring layer material seam portion. The ¾ inch Black Propylene Net has 15 mm rectangular openings connected with 0.3 mm wide plastic beams. The ethylcyanoacrylate adhesive is applied as a drop at every intersection of the plastic beams and feathered out along each plastic beam. The ethylcyanoacrylate adhesive carried by the Black Polypropylene Net is then placed in contact with a surface, for example an upper surface of a support layer, for example a woven support layer, such as a through-air-drying fabric, according to the present invention. 345 $N/m^2$ of pressure is then applied to the support layer/associating layer/structuring layer multi-layer structure and is maintained until the ethylcyanoacrylate adhesive has cured. The ethylcyanoacrylate adhesive penetrates into at least the support layer material seam portion and at least the structuring layer material seam portion, and entangles and/or wraps the components, for example filaments and/or fibers of the support layer material seam portion and the structuring layer material seam portion, such that no measurable thickness of the ethylcyanoacrylate adhesive is formed between the support layer and the structuring layer and thus no measurable gap or spacing between the support layer and the structuring layer is formed. The resulting web material structuring belt comprises the support layer, the associating layer (ethylcyanoacrylate adhesive) and the structuring layer (¾ inch Black Propylene Net). The resulting web material structuring belt support layer material seam and/or structuring layer material seam exhibits the following properties: 1) a Peak Peel Force value of 4.7 N; 2) an Energy value of 0.5 J/m both as measured according to the Seam 180° Free Peel Test Method described herein.

Belt Making Example 30: Associating Layer Extends into Support Layer and Structuring Layer First, silicone adhesive commercially available as GE500 Silicone, Henkel Corporation, Bridgewater, NJ (associating layer) is applied to one side of a ¾ inch Black Polypropylene Net "bird netting" commercially available from Bird-X, Inc. Elmhurst, IL (structuring layer) comprising a structuring layer material seam having at least one structuring layer material seam portion. The ¾ inch Black Propylene Net has 15 mm rectangular openings connected with 0.3 mm wide plastic beams. The silicone adhesive is applied in approximately 2 mm diameter discrete drops at every intersection of the plastic beams. The silicone adhesive carried by the Black Polypropylene Net is then placed in contact with a surface, for example an upper surface of a support layer, for example a woven support layer, such as a through-air-drying fabric, according to the present invention. 345 $N/m^2$ of pressure is then applied to the support layer/associating layer/structuring layer multi-layer structure and is maintained until the silicone adhesive has cured. The silicone adhesive penetrates into at least the support layer material seam portion and at least the structuring layer material seam portion, and entangles and/or wraps the components, for example filaments and/or fibers of the support layer material seam portion and the structuring layer material seam portion, rather than physically and/or chemically bonding to the components. The resulting web material structuring belt comprises the support layer, the associating layer (silicone adhesive) and the structuring layer (¾ inch Black Polypropylene Net). The resulting web material structuring belt support layer material seam and/or structuring layer material seam exhibits the following properties: 1) a Peak Peel Force value of 2.2 N; 2) an Energy value of 0.3 J/m both as measured according to the Seam 180° Free Peel Test Method described herein.

Belt Making Example 31: Structuring Layer Extends into Support Layer

First, as shown for example in FIGS. 16C and 16D, create a structuring layer 34 comprising a structuring layer material seam 10, which in this case is a gap seam, wherein the structuring layer material seam 10 has a continuous structuring layer material seam portion 36 that joins both termini 14, 18 of the structuring layer material seam 10. The structuring layer material seam portion 36 comprises an embedment material. Next, position the structuring layer 34 and a support layer 32 in contact with one another, for example at respective surfaces 24, 26 of the layers 32, 34, respectively. Next, treat the structuring layer 34 such that the structuring layer material seam portions' embedment material within the structuring layer material seam 10 is allowed to penetrate and extend into the support layer 32. Then, treat the embedment material so that it remains in the support layer 32 associating the structuring layer 34 with the support layer 32 thus forming a web material structuring belt 30 according to the present invention where the structuring layer 34 and support layer 32 are associated.

Belt Making Example 32: Structuring Layer Extends into Support Layer

First, as shown for example in FIGS. 17C and 17D, create a structuring layer 34 comprising a structuring layer material seam 10, which in this case is a gap seam, wherein the structuring layer material seam 10 has a continuous structuring layer material seam portion 36 that joins both termini 14, 18 of the structuring layer material seam. In addition, create the structuring layer 34 such that the structuring layer 34 comprise one or more protrusions 38. The structuring layer material seam portion 36 and the one or more protrusions 38 comprise an embedment material. Next, position the structuring layer 34 and a support layer 32 in contact with one another, for example at respective surfaces 24, 26 of the layers 32, 34, respectively. Next, treat the structuring layer 34 such that the structuring layer material seam portions' embedment material within the structuring layer material seam and the one or more protrusions' embedment material within the structuring layer 34 are allowed to penetrate and extend into the support layer 32. Then, treat the embedment material so that it remains in the support layer 32 associating the structuring layer 34 with the support layer 32 thus forming a web material structuring belt 30 according to the present invention where the structuring layer 34 and support layer 32 are associated.

Belt Making Example 33: Structuring Layer Extends into Support Layer

First, create a structuring layer comprising a structuring layer material seam, which in this case is a gap seam, using screen printing to deposit a structuring layer material onto a support layer, for example a woven support layer, such as a through-air-drying fabric, according to the present invention. The structuring layer material seam comprising one or more structuring layer material seam portions that penetrate and extend into, but less than entirely through the support layer thus forming a web material structuring belt according to the present invention.

Belt Making Example 34: Structuring Layer Extends into Support Layer

First, create a structuring layer comprising a structuring layer material seam, which in this case is a gap seam, by extruding a structuring layer material, for example in the form of one or more extruded lines of polymer, onto a support layer, for example a woven support layer, such as a through-air-drying fabric, according to the present invention. The structuring layer material seam comprising one or more structuring layer material seam portions that penetrate and extend into, but less than entirely through the support layer thus forming a web material structuring belt according to the present invention.

Belt Making Example 35: Structuring Layer Extends into Support Layer

Figure 47A:
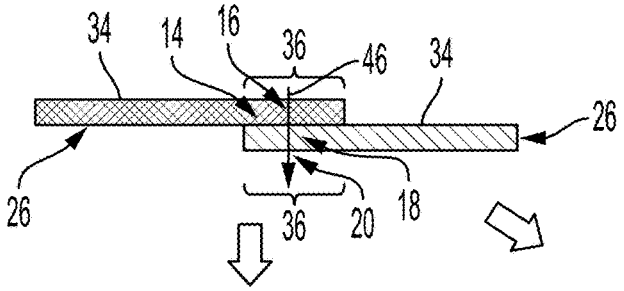
FIG. 47A is a cross-sectional representation of an example of a structuring layer according to the present invention.
Figure 47B:
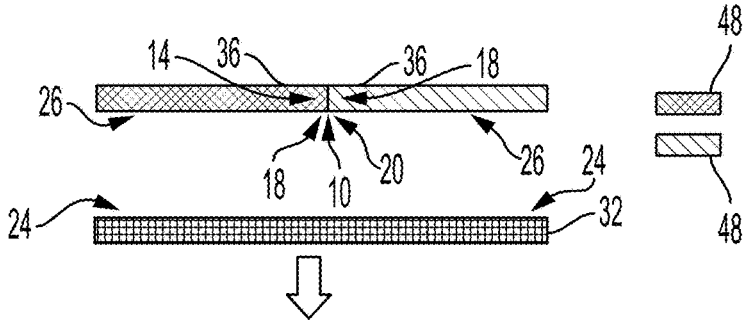
FIG. 47B is a cross-sectional representation of an example of a structuring layer from FIG. 47A and a support layer prior to forming a web material structuring belt according to the present invention.
Figure 47C:
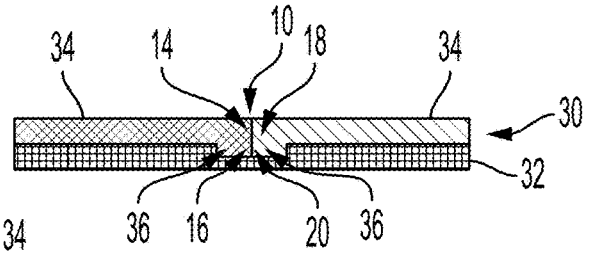
FIG. 47C is a cross-sectional representation of the web material structuring belt from FIG. 47B according to the present invention.

First, as shown for example in FIGS. 47A-47C, bring a first structuring layer material seam portion 36 of a structuring layer 34 into superposition with a second structuring layer material seam portion 36 of the structuring layer 34 such that the first structuring layer material seam portion 36 is overlaying the second structuring layer material seam portion 36. Any pattern features from the first structuring layer material seam portion 36 may be aligned with self-similar pattern features in the second structuring layer material seam portion 36. Next, cut through the thickness of the overlaying first and second structuring layer material seam portions 36 to form a cutline 46. The cutline 46 may be made by a blade, laser, water jet, or any other suitable cutting tool or cutting process. In one example, the cutline 46 may exhibit a constant angle along the cutline's length relative to the z-direction of the structuring layer material seam portions 36 of greater than 0° to less than 90°. In one example, the cutline 46 may be straight, curvilinear, saw-toothed, tapered, or any other suitable shape and/or combination thereof, for example in the z-direction and/or in the x-y plane. In one example, the major axis of the cutline 46 may be oriented at an angle of greater than 0° to 90° relative to the machine direction of the web material structuring belt 30 according to the present invention where the structuring layer 34 and support layer 32 are associated. In still another example, the major axis of the cutline 46 may be oriented at an angle of 0° to less than 90° relative to the cross machine direction of the web material structuring belt 30 according to the present invention where the structuring layer 34 and support layer 32 are associated. After cutting, remove and discard remnant structuring layer material seam portions 48 such that a structuring layer material seam 10, in this case an abut seam, is formed by the first and second structuring layer material seam portions 36. In one example, a bonding material may be applied to at least one of the structuring layer material seam portions' 36 termini 16 or 20 to associate, for example bond, the structuring layer material seam portions' 36 termini 16 and 20 together. Next, position the structuring layer 34 with the structuring layer material seam 10 in contact with a support layer 32, for example at respective surfaces 24, 26 of the layers 32, 34 such that at least one structuring layer material seam portion 36 of the structuring layer material seam 10, in this case two structuring layer material seam portions 36 extend into, but less than entirely through the support layer 32. The structuring layer material seam portions 36 may comprise an embedment material. The structuring layer material seam portions 36 may be treated such that the structuring layer material seam portions' embedment material within the structuring layer material seam 10 is allowed to penetrate and extend into the support layer 32, in this case, extend into, but less than entirely through the support layer 32. Then, treat the embedment material so that it remains in the support layer 32 associating the structuring layer 34 with the support layer 32 thus forming a web material structuring belt 30 according to the present invention where the structuring layer 34 and support layer 32 are associated.

Belt Making Example 36: Structuring Layer Extends into Support Layer

Figure 48A:
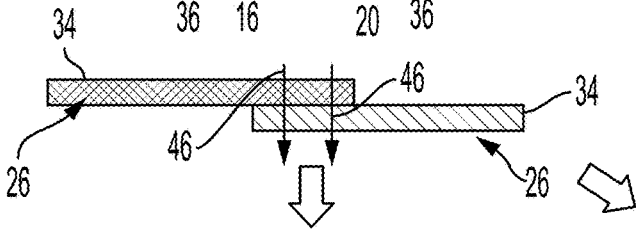
FIG. 48A is a cross-sectional representation of an example of a structuring layer according to the present invention.
Figure 48B:
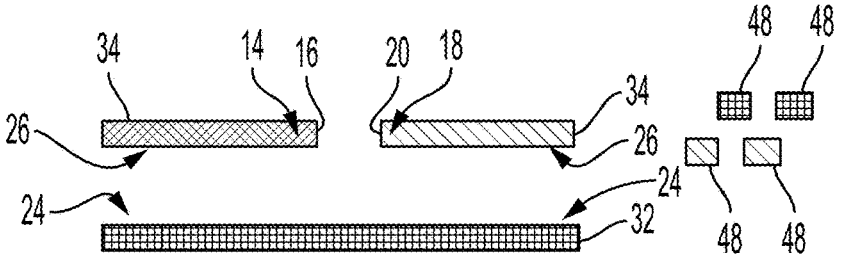
FIG. 48B is a cross-sectional representation of an example of a structuring layer from FIG. 48A and a support layer prior to forming a web material structuring belt according to the present invention.
Figure 48C:
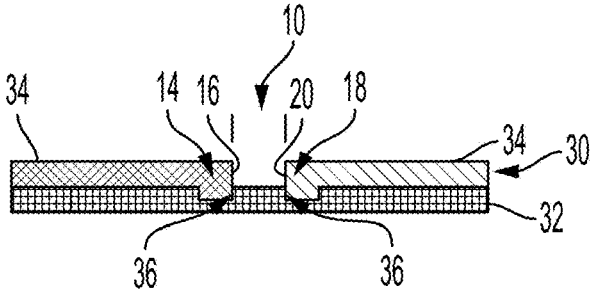
FIG. 48C is a cross-sectional representation of the web material structuring belt from FIG. 48B according to the present invention.

First, as shown for example in FIGS. 48A-48C, bring a first structuring layer material seam portion 36 of a structuring layer 34 into superposition with a second structuring layer material seam portion 36 of the structuring layer 34 such that the first structuring layer material seam portion 36 is overlaying the second structuring layer material seam portion 36. Any pattern features from the first structuring layer material seam portion 36 may be aligned with self-similar pattern features in the second structuring layer material seam portion 36. Next, make two separate cuts through the thickness of the overlaying first and second structuring layer material seam portions 36 to form two cutlines 46. The cutlines 46 may be spaced apart from each other, for example from about 0.05 inches to about 0.5 inches. The cutlines 46 may be made by a blade, laser, water jet, or any other suitable cutting tool or cutting process. In one example, the cutlines 46 may independently exhibit a constant angle along its cutline's length relative to the z-direction of the structuring layer material seam portions 36 of greater than 0° to less than 90°. In one example, the cutlines 46 may independently be straight, curvilinear, saw-toothed, tapered, or any other suitable shape and/or combination thereof, for example in the z-direction and/or in the x-y plane. In one example, the major axis of each cutline 46 may independently be oriented at an angle of greater than 0° to 90° relative to the machine direction of the web material structuring belt 30 according to the present invention where the structuring layer 34 and support layer 32 are associated. In still another example, the major axis of each cutline 46 may independently be oriented at an angle of 0° to less than 90° relative to the cross machine direction of the web material structuring belt 30 according to the present invention where the structuring layer 34 and support layer 32 are associated. After cutting, remove and discard remnant structuring layer material seam portions 48 such that a structuring layer material seam 10, in this case a gap seam, is formed by the first and second structuring layer material seam portions 36. Next, position the structuring layer 34 with the structuring layer material seam 10 in contact with a support layer 32, for example at respective surfaces 24, 26 of the layers 32, 34 such that at least one structuring layer material seam portion 36 of the structuring layer material seam 10, in this case two structuring layer material seam portions 36 extend into, but less than entirely through the support layer 32. The structuring layer material seam portions 36 may comprise an embedment material. The structuring layer material seam portions 36 may be treated such that the structuring layer material seam portions' embedment material within the structuring layer material seam 10 is allowed to penetrate and extend into the support layer 32. Then, treat the embedment material so that it remains in the support layer 32 associating the structuring layer 34 with the support layer 32 thus forming a web material structuring belt 30 according to the present invention where the structuring layer 34 and support layer 32 are associated.

Methods for Making Web Materials

Web materials, for example structured web materials, of the present invention may be made by any suitable process so long as a web material structuring belt is used to make the web material and optionally, impart structure the web material.

In one example of the present invention, a method for making a web material, for example a structured web material, for example a structured fibrous structure, such as a structured wet laid fibrous structure, for example a structured sanitary tissue product comprises the step of depositing web material components onto a web material structuring belt according to the present invention such that a web material, for example a structured web material is formed.

In another example of the present invention, a method for making a web material, for example a structured web material, for example a structured fibrous structure, such as a structured wet laid fibrous structure, for example a structured sanitary tissue product, comprises the step of depositing a plurality of fibrous elements, for example a plurality of fibers and/or filaments, such as a plurality of pulp fibers, for example a plurality of wood pulp fibers, onto a web material structuring belt according to the present invention such that a web material, for example a structured web material is formed.

In even another example of the present invention, a method for making a wet laid fibrous structure, for example a wet laid structured fibrous structure, for example a structured through-air-dried wet laid fibrous structure, comprises the step of depositing a plurality of pulp fibers, for example a plurality of wood pulp fibers, onto a web material structuring belt according to the present invention such that a structured wet laid fibrous structure is formed.

In yet another example of the present invention, a method for making a film, for example a structured film, comprises the step of depositing a film-forming material, for example a polymer, such as a hydroxyl polymer, for example polyvinyl alcohol, onto a web material structuring belt according to the present invention such that a film, for example a structured film is formed.

In still another example of the present invention, a method for making a foam, for example a structured foam, comprises the steps of depositing a foam-forming material, for example a polymer, such as a polyurethane, on to a web material structuring belt according to the present invention such that a foam, for example a structured foam is formed.

In one example, a web material structuring belt according to the present invention can be used in an NTT process. In one example, a description of the NTT process is described in U.S. Pat. No. 10,208,426.

In one example, a web material structuring belt according to the present invention can be used in a PrimeLineTEX and/or PrimeLineTAD process and/or line commercially available from Andritz AG, Austria.

In one example, a web material structuring belt according to the present invention can be used in a QRT process. In one example, a description of the QRT process is described in U.S. Pat. No. 7,811,418.

In one example, a web material structuring belt according to the present invention can be used in a through-air-dried (TAD) process, for example a creped TAD process. In one example, a description of the TAD process is described in U.S. Pat. Nos. 3,994,771, 4,102,737, 4,529,480, 5,510,002 and 8,293,072, and US Patent Publication No. 20210087748.

In one example, a web material structuring belt according to the present invention can be used in an uncreped through-air-dried (UCTAD) process, for example an uncreped TAD process. In one example, a description of the UCTAD process is described in U.S. Pat. Nos. 5,607,551, 6,736,935, 6,887,348, 6,953,516 and 7,300,543.

In one example, a web material structuring belt according to the present invention can be used in an ATMOS process. In one example, a description of the ATMOS process is described in U.S. Pat. No. 7,550,061.

In one example, a web material structuring belt according to the present invention can be used in a conventional wet press (CWP) process. In one example, a description of the CWP process is described in U.S. Pat. No. 6,197,154, and WO9517548.

In one example, a web material structuring belt according to the present invention can be used in a fabric creped and/or belt creped process. In one example, a description of the fabric crepe process is described in U.S. Pat. Nos. 7,399,378, 8,293,072 and 8,864,945.

In one example of the present invention, a method for making a structured web material comprises the step of depositing a plurality of fibrous elements, for example filaments, for example meltblown filaments and/or spunbond filaments, and/or fibers, such as pulp fibers, for example wood pulp fibers, onto a web material structuring belt according to the present invention such that a web material, for example a structured web material is formed. In one example, the method may produce a nonwoven, for example a through-air-bonded, spunbond nonwoven.

Non-Limiting Examples of Web Material Making Processes

Web Material Making Example 1A—NTT Process—Paper Towel

A structured web material, for example a structured fibrous structure, is made using the NTT process generally described in U.S. Pat. No. 10,208,426.

A 3% by weight aqueous slurry of northern softwood kraft (NSK) pulp fibers and southern softwood kraft (SSK) pulp fibers ("softwood furnish") is prepared in a conventional re-pulper. The softwood furnish is refined gently and a 2% solution of a permanent wet strength resin, for example Kymene 5221 marketed by Solenis Incorporated of Wilmington, DE, is added to the softwood furnish stock pipe at a rate of 1% by weight of the dry fibers. Kynene 5221 is added as a wet strength additive. The adsorption of Kymene 5221 to NSK is enhanced by an in-line mixer. A 1% solution of dry strength additive, for example Carboxy Methyl Cellulose (CMC), such as FinnFix 700 available from C. P. Kelco U.S. Inc. of Atlanta, GA, is added after the in-line mixer at a rate of 0.2% by weight of the dry fibers to enhance the dry strength of the fibrous structure.

A 3% by weight aqueous slurry of Eucalyptus pulp fibers, hardwood fibers, is prepared in a conventional re-pulper. A 1% solution of defoamer, for example BuBreak 4330 available from Buckman Labs, Memphis, TN, is added to the Eucalyptus slurry stock pipe at a rate of 0.25% by weight of the dry fibers and its adsorption is enhanced by an in-line mixer.

The softwood fibers and the Eucalyptus fibers are combined in a headbox and deposited onto a press fabric, for example a batted fabric, such as a felt, composed of woven monofilaments and/or multi-filamentous yarns needled with fine synthetic batt fibers, running at a first velocity $V_1$, homogenously to form an embryonic web material. The embryonic web material is then transferred at a shoe press and, optionally, a suction pressure roll, from the press fabric to a web material structuring belt, for example a structure-imparting papermaking belt according to the present invention at a consistency of 40 to 50%. The web material structuring belt is moving at a second velocity, $V_2$, which is approximately the same as the first velocity, $V_1$. The web material is then forwarded on the web material structuring belt along a looped path and can optionally pass over a vacuum box to draw out minute folds and further shape the structured web material into the web material structuring belt resulting in a structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 45° and is positioned with respect to the drying cylinder to provide an impact angle of about 101°. This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried structured web material can be made more stable for any further converting operations, such as embossing. The calendar stack gap is set to decrease caliper, for example decrease caliper 10% from the uncalendared sheet to provide a gentle surface smoothing to the dried structured web material.

The single ply reel properties are targeted to a total tensile of 1000 g/in, a basis weight of 16 #/ream (about 26 gsm) and a caliper of 18 mils.

Two or more plies of the dried structured web material can be combined into a multi-ply structured web material, for example a two-ply paper towel product by embossing and laminating the plies together using, for example using a polyvinyl alcohol adhesive, perforating into sheets and winding on a core, or even winding on itself (coreless). Either the air side (side not in contact with the web material structuring belt) or the web material structuring belt side (side contacting the web material structuring belt) of each ply of dried structured web material, independently, may be positioned facing out with respect to the exterior plies of the multi-ply structured web material. A sheet length of 5.6 inches and 110 sheets are targeted to be wound for the rolled product. Rolled product would have about a 32 #/ream (52 g/m$^2$) basis weight and contain 45% by weight Northern Softwood Kraft fibers, 25% Southern Softwood Kraft fibers and 30% by weight Eucalyptus fibers. The multi-ply structured web material, for example two-ply paper towel product is bulky and absorbent.

Web Material Making Example 1B—NTT Process—Bath Tissue

A structured web material, for example a structured fibrous structure, is made using the NTT process generally described in U.S. Pat. No. 10,208,426.

An aqueous slurry of Eucalyptus pulp fibers, hardwood fibers, is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top and bottom chambers of a multi-layered, three-chambered headbox of a Fourdrinier wet laid papermaking machine.

Additionally, an aqueous slurry of Eucalyptus pulp fibers, hardwood fibers, is prepared at about 1.5% fiber by weight using a conventional repulper, then transferred to another hardwood fiber stock chest. The Eucalyptus fiber slurry of the hardwood stock chest is pumped through a stock pipe and mixed with an aqueous slurry of Northern Softwood Kraft (NSK) pulp fibers, softwood fibers.

The aqueous slurry of NSK pulp fibers is prepared at about 3% fiber by weight using a conventional repulper, then transferred to the softwood fiber stock chest. The NSK fiber slurry of the softwood stock chest is pumped through a stock pipe to be gently refined. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center chamber of the multi-layered, three-chambered headbox of the Fourdrinier wet laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.26% temporary wet strengthening additive based on the dry weight of the NSK fibers. The absorption of the temporary wet strengthening additive is enhanced by passing the treated slurry through an in-lined mixer.

All three fiber layers delivered from the multi-layered, three-chambered headbox are delivered simultaneously in superposed relation onto a press fabric, for example a batted fabric, such as a felt, composed of woven monofilaments or multi-filamentous yarns needled with fine synthetic batt fibers, running at a first velocity $V_1$, to form a layered embryonic web. The web is then transferred at the shoe press and, optionally, a suction pressure roll from the press fabric to a web material structuring belt, for example a structure-imparting papermaking belt, of the present invention, at a consistency of 40 to 50%. The web material structuring belt is moving at a second velocity, $V_2$, which is approximately the same as the first velocity, $V_1$. The web material is then forwarded on the web material structuring belt along a looped path and can optionally pass over a vacuum box (not shown) to draw out minute folds and further shape the structured web material into the web material structuring belt resulting in a structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 25° and is positioned with respect to the drying cylinder to provide an impact angle of about 81°.

This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried structured web material can be made more stable for any further converting operations, such as embossing. The calendar stack gap is set to decrease caliper, for example decrease caliper 20% from the uncalendared sheet to provide a gentle surface smoothing to the dried structured web material.

The single ply reel properties are targeted to a total tensile of 700 g/in, a basis weight of 12 #/ream (20 gsm) and a caliper of 12 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 150 sheets are targeted to be wound for the rolled product. Rolled product would have about a 24 #/ream (39 g/m$^2$) basis weight and contain 40% by weight Northern Softwood Kraft fibers and 60% by weight Eucalyptus fibers. The two-ply bath tissue product is soft, flexible and absorbent.

Web Material Making Example 1C—NTT Process—Bath Tissue

A structured web material, for example a structured fibrous structure, is made using the NTT process generally described in U.S. Pat. No. 10,208,426.

A single ply structured web material, for example a single ply structured fibrous structure may be made according to Web Material Making Example 1B, with the exception that its single ply reel properties are targeted to a total tensile of 600 g/in, a basis weight of 14 #/ream (23 gsm) and a caliper of 16 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material, if the air side is positioned out, the proportion of Eucalyptus slurry directed to the top and bottom chambers of the multi-layered headbox can be reversed. A sheet length of 4.0 inches and 130 sheets are targeted to be wound for the rolled product. Rolled product would have about a 28 #/ream (46 g/m$^2$) basis weight and contain 40% by weight Northern Softwood Kraft fibers and 60% by weight Eucalyptus fibers. The two-ply bath tissue product is soft, flexible and absorbent.

Web Material Making Example 1D—NTT Process—Bath Tissue

A structured web material, for example a structured fibrous structure, is made using the NTT process generally described in U.S. Pat. No. 10,208,426.

A single ply structured web material, for example a single ply structured fibrous structure may be made according to Example 1B, with the exception that its single ply reel properties are targeted to a total tensile of 500 g/in, a basis weight of 11 #/ream (18 gsm) and a caliper of 10 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a three-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 140 sheets are targeted to be wound for the rolled product. Rolled product would have about a 30 #/ream (49 g/m$^2$) basis weight and contain 40% by weight Northern Softwood Kraft fibers and 60% by weight Eucalyptus fibers. The three-ply bath tissue product is soft, flexible and absorbent.

Web Material Making Example 2A—QRT Process—Paper Towel

A structured web material, for example a structured fibrous structure, is made using the QRT process generally described in U.S. Pat. No. 7,811,418.

A 3% by weight aqueous slurry of northern softwood kraft (NSK) pulp fibers and southern softwood kraft (SSK) pulp fibers ("softwood furnish") is prepared in a conventional re-pulper. The softwood furnish is refined gently and a 2% solution of a permanent wet strength resin, for example Kymene 5221 marketed by Solenis Incorporated of Wilmington, DE, is added to the softwood furnish stock pipe at a rate of 1% by weight of the dry fibers. Kymene 5221 is added as a wet strength additive. The adsorption of Kyrnene 5221 to NSK is enhanced by an in-line mixer. A 1% solution of dry strength additive, for example Carboxy Methyl Cellulose (CMC), such as FinnFix 700 available from C. P. Kelco U.S. Inc. of Atlanta, GA, is added after the in-line mixer at a rate of 0.2% by weight of the dry fibers to enhance the dry strength of the fibrous structure.

A 3% by weight aqueous slurry of Eucalyptus pulp fibers, hardwood fibers, is prepared in a conventional re-pulper. A 1% solution of defoamer, for example BuBreak 4330 available from Buckman Labs, Memphis, TN, is added to the Eucalyptus slurry stock pipe at a rate of 0.25% by weight of the dry fibers and its adsorption is enhanced by an in-line mixer.

The softwood furnish and the Eucalyptus fibers are combined in a headbox and deposited onto a forming wire, running at first velocity $V_1$, homogeneously to form an embryonic web material and then transferred to a batted fabric, such as a felt, composed of woven monofilaments and/or multi-filamentous yarns needled with fine synthetic batt fibers, running at a second velocity $V_2$. The embryonic web material is compressively dewatered further with an extended nip press. The web material is then pressed against a smooth belt and at the exit of the extended nip press is transferred to the smooth belt running at a third velocity, $V_3$. The web is then forwarded on the smooth belt to a transfer point with a web material structuring belt, for example a structure-imparting papermaking belt, according to the present invention. The web material is transferred to the web material structuring belt, which is running a velocity $V_4$ with suction roll assist. Velocity $V_4$ is approximately 5% slower than velocity $V_3$. The web material is then forwarded on the web material structuring belt along a looped path and can optionally pass over a vacuum box to draw out minute folds and further shape the structured web material into the web material structuring belt resulting in a structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a fifth velocity, $V_5$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 45° and is positioned with respect to the drying cylinder to provide an impact angle of about 101°. This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a sixth velocity, $V_6$, that is about 20% slower than the fifth velocity, $V_5$, of the drying cylinder so that the microfeatures of the structured web material are preserved. The calendar stack gap is set to decrease caliper, for example decrease caliper 10% from the uncalendared sheet to provide a gentle surface smoothing to the dried structured web material.

The single ply reel properties are targeted to a total tensile of 1000 g/in, a basis weight of 16 #/ream (26 gsm) and a caliper of 18 mils.

Two or more plies of the dried structured web material can be combined into a multi-ply structured web material, for example a two-ply paper towel product by embossing and laminating the plies together using, for example using a polyvinyl alcohol adhesive, perforating into sheets and winding on a core, or even winding on itself (coreless). Either the air side or the web material structuring belt side of each ply of dried structured web material, independently, may be positioned facing out with respect to the exterior plies of the multi-ply structured web material. A sheet length of 5.6 inches and 110 sheets are targeted to be wound for the rolled product. Rolled product would have about a 32 #/ream (52 g/m$^2$) basis weight and contain 45% by weight Northern Softwood Kraft fibers, 25% Southern Softwood Kraft fibers and 30% by weight Eucalyptus fibers.

Web Material Making Example 2B—QRT Process—Bath Tissue

A structured web material, for example a structured fibrous structure, is made using the QRT process generally described in U.S. Pat. No. 7,811,418.

An aqueous slurry of Eucalyptus pulp fibers, hardwood fibers, is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top and bottom chambers of a multi-layered, three-chambered headbox of a Fourdrinier wet laid papermaking machine.

Additionally, an aqueous slurry of Eucalyptus pulp fibers, hardwood fibers, is prepared at about 1.5% fiber by weight using a conventional repulper, then transferred to another hardwood fiber stock chest. The Eucalyptus fiber slurry of the hardwood stock chest is pumped through a stock pipe and mixed with an aqueous slurry of Northern Softwood Kraft (NSK) pulp fibers, softwood fibers.

The aqueous slurry of NSK pulp fibers is prepared at about 3% fiber by weight using a conventional repulper, then transferred to the softwood fiber stock chest. The NSK fiber slurry of the softwood stock chest is pumped through a stock pipe to be gently refined. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center chamber of the multi-layered, three-chambered headbox of the Fourdrinier wet laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.26% temporary wet strengthening additive based on the dry weight of the NSK fibers. The absorption of the temporary wet strengthening additive is enhanced by passing the treated slurry through an in-line mixer.

All three fiber layers delivered from the multi-layered, three-chambered headbox are delivered simultaneously in superposed relation onto a forming wire, running at first velocity $V_1$, to form a layered embryonic web material and then transferred to a batted fabric, such as a felt, composed of woven monofilaments and/or multi-filamentous yarns needled with fine synthetic batt fibers, running at a second velocity $V_2$. The embryonic web material is compressively dewatered further with an extended nip press. The web material is then pressed against a smooth belt and at the exit of the extended nip press is transferred to the smooth belt running at a third velocity, $V_3$. The web is then forwarded on the smooth belt to a transfer point with a web material structuring belt, for example a structure-imparting papermaking belt, according to the present invention. The web material is transferred to the web material structuring belt, which is running a velocity $V_4$, with suction roll assist. Velocity $V_4$ is approximately 5% slower than velocity $V_3$. The web material is then forwarded on the web material structuring belt along a looped path and can optionally pass over a vacuum box to draw out minute folds and further shape the structured web material into the web material structuring belt resulting in a structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a fifth velocity, $V_5$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 25° and is positioned with respect to the drying cylinder to provide an impact angle of about 81°. This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a sixth velocity, $V_6$, that is about 20% slower than the fifth velocity, $V_5$, of the drying cylinder so that the microfeatures of the structured web material are preserved. The calendar stack gap is set to decrease caliper, for example decrease caliper 10% from the uncalendared sheet to provide a gentle surface smoothing to the dried structured web material.

The single ply reel properties are targeted to a total tensile of 700 g/in, a basis weight of 12 #/ream (20 gsm) and a caliper of 12 mils. The web material structuring belt side layer of the single ply is predominately Eucalyptus fibers and 15% by weight of the sheet, the center layer is a blend of NSK fibers (40% by weight of the sheet) and about 5% by weight of the sheet Eucalyptus fibers and the air side layer is predominately Eucalyptus fibers and about 40% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 150 sheets are targeted to be wound for the rolled product. Rolled product would have about a 24 #/ream (39 g/m$^2$) basis weight and contain 40% by weight Northern Softwood Kraft fibers and 60% by weight Eucalyptus fibers. The two-ply bath tissue product is soft, flexible and absorbent.

Web Material Making Example 2C—QRT Process—Bath Tissue

A structured web material, for example a structured fibrous structure, is made using the QRT process generally described in U.S. Pat. No. 7,811,418.

A single ply structured web material, for example a single ply structured fibrous structure may be made according to Web Material Making Example 2B, with the exception that its single ply reel properties are targeted to a total tensile of 600 g/in, a basis weight of 14 #/ream (23 gsm) and a caliper of 16 mils. The web material structuring belt side layer of the single ply is predominately Eucalyptus fibers and 15% by weight of the sheet, the center layer is a blend of NSK fibers (40% by weight of the sheet) and about 5% by weight of the sheet Eucalyptus fibers and the air side layer is predominately Eucalyptus fibers and about 40% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 130 sheets are targeted to be wound for the rolled product. Rolled product would have about a 28 #/ream (46 g/m$^2$) basis weight and contain 40% by weight Northern Softwood Kraft fibers and 60% by weight Eucalyptus fibers. The two-ply bath tissue product is soft, flexible and absorbent.

Web Material Making Example 2D—QRT Process—Bath Tissue

A structured web material, for example a structured fibrous structure, is made using the QRT process generally described in U.S. Pat. No. 7,811,418.

A single ply structured web material, for example a single ply structured fibrous structure may be made according to Web Material Making Example 2B, with the exception that its single ply reel properties are targeted to a total tensile of 500 g/in, a basis weight of 11 #/ream (18 gsm) and a caliper of 10 mils. The web material structuring belt side layer of the single ply is predominately Eucalyptus fibers and 15% by weight of the sheet, the center layer is a blend of NSK fibers (40% by weight of the sheet) and about 5% by weight of the sheet Eucalyptus fibers and the air side layer is predominately Eucalyptus fibers and about 40% by weight of the sheet.

Two or more plies of the dried structured web material can be combined into a multi-ply structured web material, for example a three-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 140 sheets are targeted to be wound for the rolled product. Rolled product would have about a 30 #/ream (49 g/m$^2$) basis weight and contain 40% by weight Northern Softwood Kraft fibers and 60% by weight Eucalyptus fibers. The three-ply bath tissue product is soft, flexible and absorbent.

Web Material Making Example 3A—TAD Process—Paper Towel

A structured web material, for example a structured fibrous structure, is made using the TAD process generally described in U.S. Pat. Nos. 3,994,771, 4,102,737, 4,529,480, 5,510,002 and 8,293,072, and US Patent Publication No. 20210087748.

A 3% by weight aqueous slurry of northern softwood kraft (NSK) pulp fibers and southern softwood kraft (SSK) pulp fibers ("softwood furnish") is prepared in a conventional re-pulper. The softwood furnish is refined gently and a 2% solution of a permanent wet strength resin, for example Kymene 5221 marketed by Solenis Incorporated of Wilmington, DE, is added to the softwood furnish stock pipe at a rate of 1% by weight of the dry fibers. Kymene 5221 is added as a wet strength additive. The adsorption of Kymene 5221 to NSK is enhanced by an in-line mixer. A 1% solution of dry strength additive, for example Carboxy Methyl Cellulose (CMC), such as FinnFix 700 available from C. P. Kelco U.S. Inc. of Atlanta, GA, is added after the in-line mixer at a rate of 0.2% by weight of the dry fibers to enhance the dry strength of the fibrous structure.

A 3% by weight aqueous slurry of Eucalyptus pulp fibers, hardwood fibers, is prepared in a conventional re-pulper. A 1% solution of defoamer, for example BuBreak 4330 available from Buckman Labs, Memphis, TN, is added to the Eucalyptus slurry stock pipe at a rate of 0.25% by weight of the dry fibers and its adsorption is enhanced by an in-line mixer.

The softwood furnish and the Eucalyptus fibers are combined in a headbox and deposited onto a forming wire, running at first velocity $V_1$, homogeneously to form an embryonic web material and then transferred at a transfer nip with approximately 10 in Hg vacuum to a web material structuring belt, for example a structure-imparting papermaking belt, according to the present invention at 10% to 25% solids moving at a second velocity, $V_2$ which is about 5% to about 25% slower than the first velocity, $V_1$. The web material is then forwarded on the web material structuring belt along a looped path and passes through at least one, in this case two pre-dryers structuring and at least partially drying the web material to a consistency of from about 55% to about 90% resulting in a dried structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 45° and is positioned with respect to the drying cylinder to provide an impact angle of about 101°. This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried structured web material can be made more stable for any further converting operations, such as embossing. The calendar stack gap is set to decrease caliper, for example decrease caliper 10% from the uncalendared sheet to provide a gentle surface smoothing to the dried structured web material.

The single ply reel properties are targeted to a total tensile of 1000 g/in, a basis weight of 16 #/ream (26 gsm) and a caliper of 24 mils.

Two or more plies of the dried structured web material can be combined into a multi-ply structured web material, for example a two-ply paper towel product by embossing and laminating the plies together using, for example using a polyvinyl alcohol adhesive, perforating into sheets and winding on a core, or even winding on itself (coreless). Either the air side or the web material structuring belt side of each ply of dried structured web material, independently, may be positioned facing out with respect to the exterior plies of the multi-ply structured web material. A sheet length of 5.6 inches and 110 sheets are targeted to be wound for the rolled product. Rolled product would have about a 32 #/ream (52 g/m$^2$) basis weight and contain 45% by weight Northern Softwood Kraft fibers, 25% Southern Softwood Kraft fibers and 30% by weight Eucalyptus fibers. The multi-ply structured web material, for example two-ply paper towel product is bulky and absorbent.

Web Material Making Example 3B—TAD Process—Bath Tissue

A structured web material, for example a structured fibrous structure, is made using the TAD process generally described in U.S. Pat. Nos. 3,994,771, 4,102,737, 4,529,480, 5,510,002 and 8,293,072, and US Patent Publication No. 20210087748.

An aqueous slurry of Eucalyptus pulp fibers, hardwood fibers, is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top and bottom chambers of a multi-layered, three-chambered headbox of a Fourdrinier wet laid papermaking machine.

Additionally, an aqueous slurry of Eucalyptus pulp fibers, hardwood fibers, is prepared at about 15% fiber by weight using a conventional repulper, then transferred to another hardwood fiber stock chest. The Eucalyptus fiber slurry of the hardwood stock chest is pumped through a stock pipe and mixed with an aqueous slurry of Northern Softwood Kraft (NSK) pulp fibers, softwood fibers.

The aqueous slurry of NSK pulp fibers is prepared at about 3% fiber by weight using a conventional repulper, then transferred to the softwood fiber stock chest. The NSK fiber slurry of the softwood stock chest is pumped through a stock pipe to be gently refined. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center chamber of the multi-layered, three-chambered headbox of the Fourdrinier wet laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.26% temporary wet strengthening additive based on the dry weight of the NSK fibers. The absorption of the temporary wet strengthening additive is enhanced by passing the treated slurry through an in-line mixer.

All three fiber layers delivered from the multi-layered, three-chambered headbox are delivered simultaneously in superposed relation onto a forming wire, running at first velocity $V_1$, to form a layered embryonic web material and then transferred at a transfer nip with approximately 10 in Hg vacuum to a web material structuring belt, for example a structure-imparting papermaking belt, according to the present invention at 10% to 25% solids moving at a second velocity, $V_2$, which is about 0% to about 10% faster than the first velocity, $V_1$. The web material is then forwarded on the web material structuring belt along a looped path and passes through at least one, in this case two pre-dryers structuring and at least partially drying the web material to a consistency of from about 55% to about 90% resulting in a dried structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 25° and is positioned with respect to the drying cylinder to provide an impact angle of about 81°.

This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried structured web material can be made more stable for any further converting operations, such as embossing. The calendar stack gap is set to decrease caliper, for example decrease caliper 20% from the uncalendared sheet to provide a gentle surface smoothing to the dried structured web material.

The single ply reel properties are targeted to a total tensile of 700 g/in, a basis weight of 12 #/ream (20 gsm) and a caliper of 18 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 150 sheets are targeted to be wound for the rolled product. Rolled product would have about a 24 #/ream (39 g/m$^2$) basis weight and contain 40% by weight Northern Softwood Kraft fibers and 60% by weight Eucalyptus fibers. The two-ply bath tissue product is soft, flexible and absorbent.

Web Material Making Example 3C—TAD Process—Bath Tissue

A structured web material, for example a structured fibrous structure, is made using the TAD process generally described in U.S. Pat. Nos. 3,994,771, 4,102,737, 4,529,480, 5,510,002 and 8,293,072, and US Patent Publication No. 20210087748.

A single ply structured web material, for example a single ply structured fibrous structure may be made according to Web Material Making Example 3B, with the exception that its single ply reel properties are targeted to a total tensile of 600 g/in, a basis weight of 14 #/ream (23 gsm) and a caliper of 16 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 130 sheets are targeted to be wound for the rolled product. Rolled product would have about a 28 #/ream (46 g/m$^2$) basis weight and contain 40% by weight Northern Softwood Kraft fibers and 60% by weight Eucalyptus fibers. The two-ply bath tissue product is soft, flexible and absorbent.

Web Material Making Example 3D—TAD Process—Bath Tissue

A structured web material, for example a structured fibrous structure, is made using the TAD process generally described in U.S. Pat. Nos. 3,994,771, 4,102,737, 4,529,480, 5,510,002 and 8,293,072, and US Patent Publication No. 20210087748.

A single ply structured web material, for example a single ply structured fibrous structure may be made according to Example 3B, with the exception that its single ply reel properties are target to a total tensile of 500 g/in, a basis weight of 11 #/ream (18 gsm) and a caliper of 10 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a three-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 140 sheets are targeted to be wound for the rolled product. Rolled product would have about a 30 #/ream (49 g/m$^2$) basis weight and contain 40% by weight Northern Softwood Kraft fibers and 60% by weight Eucalyptus fibers. The three-ply bath tissue product is soft, flexible and absorbent.

Web Material Making Example 4A—UCTAD Process—Paper Towel

A structured web material, for example a structured fibrous structure, is made using the UCTAD process generally described in U.S. Pat. Nos. 5,607,551, 6,736,935, 6,887,348, 6,953,516 and 7,300,543.

A 3% by weight aqueous slurry of northern softwood kraft (NSK) pulp fibers and southern softwood kraft (SSK) pulp fibers ("softwood furnish") is prepared in a conventional re-pulper. The softwood furnish is refined gently and a 2% solution of a permanent wet strength resin, for example Kymene 5221 marketed by Solenis Incorporated of Wilmington, DE, is added to the softwood furnish stock pipe at a rate of 1% by weight of the dry fibers. Kymene 5221 is added as a wet strength additive. The adsorption of Kymene 5221 to NSK is enhanced by an in-line mixer. A 1% solution of dry strength additive, for example Carboxy Methyl Cellulose (CMC), such as FinnFix 700 available from C. P. Kelco U.S. Inc. of Atlanta, GA, is added after the in-line mixer at a rate of 0.2% by weight of the dry fibers to enhance the dry strength of the fibrous structure.

A 3% by weight aqueous slurry of Eucalyptus pulp fibers, hardwood fibers, is prepared in a conventional re-pulper. A 1% solution of defoamer, for example BuBreak 4330 available from Buckman Labs, Memphis, TN, is added to the Eucalyptus slurry stock pipe at a rate of 0.25% by weight of the dry fibers and its adsorption is enhanced by an in-line mixer.

The softwood furnish and the Eucalyptus fibers are combined in a headbox and deposited onto a forming wire, running at first velocity $V_1$, homogeneously to form an embryonic web material. The web is dewatered to a consistency of approximately 30% using vacuum suction and then transferred to a transfer fabric, running at a second velocity $V_2$, with vacuum shoe assist. The web material is then transferred to a web material structuring belt, for example a structure-imparting papermaking belt, according to the present invention running at a third velocity $V_3$, with vacuum shoe assist, where third velocity, $V_3$ is approximately equal to second velocity, $V_2$ and second velocity, $V_2$ is approximately 20% slower than first velocity, $V_1$. The web material is then forwarded on the web material structuring belt along a looped path and passes through at least one, in this case two pre-dryers structuring and drying the web material to a consistency of greater than 95% resulting in a dried structured web material. The dried structured web material is then conveyed to a reel and wound.

The single ply reel properties are targeted to a total tensile of 1000 g/in, a basis weight of 16 #/ream (26 gsm) and a caliper of 28 mils.

Two or more plies of the dried structured web material can be combined into a multi-ply structured web material, for example a two-ply paper towel product by embossing and laminating the plies together using, for example using a polyvinyl alcohol adhesive, perforating into sheets and winding on a core, or even winding on itself (coreless). Either the air side or the web material structuring belt side of each ply of dried structured web material, independently, may be positioned facing out with respect to the exterior plies of the multi-ply structured web material. A sheet length of 5.6 inches and 110 sheets are targeted to be wound for the rolled product. Rolled product would have about a 32 #/ream (52 g/m$^2$) basis weight and contain 45% by weight Northern Softwood Kraft fibers, 25% Southern Softwood Kraft fibers and 30% by weight Eucalyptus fibers. The multi-ply structured web material, for example two-ply paper towel product is bulky and absorbent.

Web Material Making Example 4B—UCTAD Process—Bath Tissue

A structured web material, for example a structured fibrous structure, is made using the UCTAD process generally described in U.S. Pat. Nos. 5,607,551, 6,736,935, 6,887, 348, 6,953,516 and 7,300,543.

An aqueous slurry of Eucalyptus pulp fibers, hardwood fibers, is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top and bottom chambers of a multi-layered, three-chambered headbox of a Fourdrinier wet laid papermaking machine.

Additionally, an aqueous slurry of Eucalyptus pulp fibers, hardwood fibers, is prepared at about 15% fiber by weight using a conventional repulper, then transferred to another hardwood fiber stock chest. The Eucalyptus fiber slurry of the hardwood stock chest is pumped through a stock pipe and mixed with an aqueous slurry of Northern Softwood Kraft (NSK) pulp fibers, softwood fibers.

The aqueous slurry of NSK pulp fibers is prepared at about 3% fiber by weight using a conventional repulper, then transferred to the softwood fiber stock chest. The NSK fiber slurry of the softwood stock chest is pumped through a stock pipe to be gently refined. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center chamber of the multi-layered, three-chambered headbox of the Fourdrinier wet laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.26% temporary wet strengthening additive based on the dry weight of the NSK fibers. The absorption of the temporary wet strengthening additive is enhanced by passing the treated slurry through an in-line mixer.

All three fiber layers delivered from the multi-layered, three-chambered headbox are delivered simultaneously in superposed relation onto a forming wire running at first velocity $V_1$, to form a layered embryonic web material. The web is dewatered to a consistency of approximately 30% using vacuum suction and then transferred to a transfer fabric, running at a second velocity $V_2$, with vacuum shoe assist. The web material is then transferred to a web material structuring belt, for example a structure-imparting papermaking belt, according to the present invention running at a third velocity $V_3$, with vacuum shoe assist, where third velocity, $V_3$ is approximately equal to second velocity, $V_2$ and second velocity, $V_2$ is approximately 20% slower than first velocity, $V_1$. The web material is then forwarded on the web material structuring belt along a looped path and passes through at least one, in this case two pre-dryers structuring and drying the web material to a consistency of greater than 95% resulting in a dried structured web material. The dried structured web material is then conveyed to a reel and wound.

The single ply reel properties are targeted to a total tensile of 700 g/in, a basis weight of 12 #/ream (20 gsm) and a caliper of 22 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 150 sheets are targeted to be wound for the rolled product. Rolled product would have about a 24 #/ream (39 g/m$^2$) basis weight and contain 40% by weight Northern Softwood Kraft fibers and 60% by weight Eucalyptus fibers. The two-ply bath tissue product is soft, flexible and absorbent.

Web Material Making Example 4C—UCTAD Process—Bath Tissue

A structured web material, for example a structured fibrous structure, is made using the UCTAD process generally described in U.S. Pat. Nos. 5,607,551, 6,736,935, 6,887, 348, 6,953,516 and 7,300,543.

A single ply structured web material, for example a single ply structured fibrous structure may be made according to Web Material Making Example 4B, with the exception that its single ply reel properties are targeted to a total tensile of 600 g/in, a basis weight of 14 #/ream (23 gsm) and a caliper of 20 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 130 sheets are targeted to be wound for the rolled product. Rolled product would have about a 28 #/ream (46 g/m$^2$) basis weight and contain 40% by weight Northern Softwood Kraft fibers and 60% by weight Eucalyptus fibers. The two-ply bath tissue product is soft, flexible and absorbent.

Web Material Making Example 4D—UCTAD Process—Bath Tissue

A structured web material, for example a structured fibrous structure, is made using the UCTAD process generally described in U.S. Pat. Nos. 5,607,551, 6,736,935, 6,887,348, 6,953,516 and 7,300,543.

A single ply structured web material, for example a single ply structured fibrous structure may be made according to Web Material Making Example 4B, with the exception that its single ply reel properties are target to a total tensile of 500 g/in, a basis weight of 11 #/ream (18 gsm) and a caliper of 14 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a three-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 140 sheets are targeted to be wound for the rolled product. Rolled product would have about a 30 #/ream (49 g/m$^2$) basis weight and contain 40% by weight Northern Softwood Kraft fibers and 60% by weight Eucalyptus fibers. The three-ply bath tissue product is soft, flexible and absorbent.

Web Material Making Example 5A—ATMOS Process—Paper Towel

A structured web material, for example a structured fibrous structure, is made using the ATMOS process generally described in U.S. Pat. No. 7,550,061.

A 3% by weight aqueous slurry of northern softwood kraft (NSK) pulp fibers and southern softwood kraft (SSK) pulp fibers ("softwood furnish") is prepared in a conventional re-pulper. The softwood furnish is refined gently and a 2% solution of a permanent wet strength resin, for example Kymene 5221 marketed by Solenis Incorporated of Wilmington, DE, is added to the softwood furnish stock pipe at a rate of 1% by weight of the dry fibers. Kymene 5221 is added as a wet strength additive. The adsorption of Kymene 5221 to NSK is enhanced by an in-line mixer. A 1% solution of dry strength additive, for example Carboxy Methyl Cellulose (CMC), such as FinnFix 700 available from C. P. Kelco U.S. Inc. of Atlanta, GA, is added after the in-line mixer at a rate of 0.2% by weight of the dry fibers to enhance the dry strength of the fibrous structure.

A 3% by weight aqueous slurry of Eucalyptus pulp fibers, hardwood fibers, is prepared in a conventional re-pulper. A 1% solution of defoamer, for example BuBreak 4330 available from Buckman Labs, Memphis, TN, is added to the Eucalyptus slurry stock pipe at a rate of 0.25% by weight of the dry fibers and its adsorption is enhanced by an in-line mixer.

The softwood furnish and the Eucalyptus fibers are combined in a headbox and deposited onto a forming wire running at a first velocity $V_1$, and a web material structuring belt running at a second velocity $V_2$ homogeneously to form an embryonic web material. The approximately 15% consistency embryonic web material is then transferred on the web material structuring belt through a dewatering fabric belt press and suction roll zone increasing the consistency of the web to 30-40%.

The web material being conveyed on the web material structuring belt is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 45° and is positioned with respect to the drying cylinder to provide an impact angle of about 101°. This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll), the surface of the take up roll moving a fourth velocity, $V_4$ that is approximately equal to the third velocity, $V_3$ of the drying cylinder. The calendar stack gap is set to decrease caliper, for example decrease caliper 10% from the uncalendared sheet to provide a gentle surface smoothing to the dried structured web material.

The single ply reel properties are targeted to a total tensile of 1000 g/in, a basis weight of 16 #/ream (26 gsm) and a caliper of 12 mils.

Two or more plies of the dried structured web material can be combined into a multi-ply structured web material, for example a two-ply paper towel product by embossing and laminating the plies together using, for example using a polyvinyl alcohol adhesive, perforating into sheets and winding on a core, or even winding on itself (coreless). Either the air side or the web material structuring belt side of each ply of dried structured web material, independently, may be positioned facing out with respect to the exterior plies of the multi-ply structured web material. A sheet length of 5.6 inches and 110 sheets are targeted to be wound for the rolled product. Rolled product would have about a 32 #/ream (52 g/m$^2$) basis weight and contain 45% by weight Northern Softwood Kraft fibers, 25% Southern Softwood Kraft fibers and 30% by weight Eucalyptus fibers. The multi-ply structured web material, for example two-ply paper towel product is bulky and absorbent.

Web Material Making Example 5B—ATMOS Process—Bath Tissue

A structured web material, for example a structured fibrous structure, is made using the ATMOS process generally described in U.S. Pat. No. 7,550,061.

An aqueous slurry of Eucalyptus pulp fibers, hardwood fibers, is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top and bottom chambers of a multi-layered, three-chambered headbox of a Fourdrinier wet laid papermaking machine.

Additionally, an aqueous slurry of Eucalyptus pulp fibers, hardwood fibers, is prepared at about 1.5% fiber by weight using a conventional repulper, then transferred to another hardwood fiber stock chest. The Eucalyptus fiber slurry of the hardwood stock chest is pumped through a stock pipe and mixed with an aqueous slurry of Northern Softwood Kraft (NSK) pulp fibers, softwood fibers.

The aqueous slurry of NSK pulp fibers is prepared at about 3% fiber by weight using a conventional repulper, then transferred to the softwood fiber stock chest. The NSK fiber slurry of the softwood stock chest is pumped through a stock pipe to be gently refined. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center chamber of the multi-layered, three-chambered headbox of the Fourdrinier wet laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.26% temporary wet strengthening additive based on the dry weight of the NSK fibers. The absorption of the temporary wet strengthening additive is enhanced by passing the treated slurry through an in-line mixer.

All three fiber layers delivered from the multi-layered, three-chambered headbox are delivered simultaneously in superposed relation onto a forming wire running at a first velocity $V_1$, and a web material structuring belt running at a second velocity $V_2$ to form a layered embryonic web material. The approximately 15% consistency embryonic web material is then transferred on the web material structuring belt through a dewatering fabric belt press and suction roll zone increasing the consistency of the web to 30-40%.

The web material being conveyed on the web material structuring belt is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 25° and is positioned with respect to the drying cylinder to provide an impact angle of about 81°. This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll), the surface of the take up roll moving a fourth velocity, $V_4$ that is approximately equal to the third velocity, $V_3$ of the drying cylinder. The calendar stack gap is set to decrease caliper, for example decrease caliper 10% from the uncalendared sheet to provide a gentle surface smoothing to the dried structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 25° and is positioned with respect to the drying cylinder to provide an impact angle of about 81°.

This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried structured web material can be made more stable for any further converting operations, such as embossing. The calendar stack gap is set to decrease caliper, for example decrease caliper 20% from the uncalendared sheet to provide a gentle surface smoothing to the dried structured web material.

The single ply reel properties are targeted to a total tensile of 700 g/in, a basis weight of 12 #/ream (20 gsm) and a caliper of 10 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 150 sheets are targeted to be wound for the rolled product. Rolled product would have about a 24 #/ream (39 g/m$^2$) basis weight and contain 40% by weight Northern Softwood Kraft fibers and 60% by weight Eucalyptus fibers. The two-ply bath tissue product is soft, flexible and absorbent.

Web Material Making Example 5C—ATMOS Process—Bath Tissue

A structured web material, for example a structured fibrous structure, is made using the ATMOS process generally described in U.S. Pat. No. 7,550,061.

A single ply structured web material, for example a single ply structured fibrous structure may be made according to Web Material Making Example 5B, with the exception that its single ply reel properties are targeted to a total tensile of 600 g/in, a basis weight of 14 #/ream (23 gsm) and a caliper of 9 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 130 sheets are targeted to be wound for the rolled product. Rolled product would have about a 28 #/ream (46 g/m$^2$) basis weight and contain 40% by weight Northern Softwood Kraft fibers and 60% by weight Eucalyptus fibers. The two-ply bath tissue product is soft, flexible and absorbent.

Web Material Making Example 5D—ATMOS Process—Bath Tissue

A structured web material, for example a structured fibrous structure, is made using the AT MOS process generally described in U.S. Pat. No. 7,550,061.

A single ply structured web material, for example a single ply structured fibrous structure may be made according to Web Material Making Example 5B, with the exception that its single ply reel properties are target to a total tensile of 500 g/in, a basis weight of 11 #/ream (18 gsm) and a caliper of 8 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a three-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 140 sheets are targeted to be wound for the rolled product. Rolled product would have about a 30 #/ream (49 g/m$^2$) basis weight and contain 40% by weight Northern Softwood Kraft fibers and 60% by weight Eucalyptus fibers. The three-ply bath tissue product is soft, flexible and absorbent.

Web Material Making Example 6A—CWP Process—Paper Towel

A structured web material, for example a structured fibrous structure, is made using the CWP process generally described in U.S. Pat. No. 6,197,154, and WO9517548.

A 3% by weight aqueous slurry of northern softwood kraft (NSK) pulp fibers and southern softwood kraft (SSK) pulp fibers ("softwood furnish") is prepared in a conventional re-pulper. The softwood furnish is refined gently and a 2% solution of a permanent wet strength resin, for example Kymene 5221 marketed by Solenis Incorporated of Wilmington, DE, is added to the softwood furnish stock pipe at a rate of 1% by weight of the dry fibers. Kymene 5221 is added as a wet strength additive. The adsorption of Kymene 5221 to NSK is enhanced by an in-line mixer. A 1% solution of dry strength additive, for example Carboxy Methyl Cellulose (CMC), such as FinnFix 700 available from C. P. Kelco U.S. Inc. of Atlanta, GA, is added after the in-line mixer at a rate of 0.2% by weight of the dry fibers to enhance the dry strength of the fibrous structure.

A 3% by weight aqueous slurry of Eucalyptus pulp fibers, hardwood fibers, is prepared in a conventional re-pulper. A 1% solution of defoamer, for example BuBreak 4330 available from Buckman Labs, Memphis, TN, is added to the Eucalyptus slurry stock pipe at a rate of 0.25% by weight of the dry fibers and its adsorption is enhanced by an in-line mixer.

The softwood fibers and the Eucalyptus fibers are combined in a headbox and deposited onto a forming wire running at a first velocity $V_1$ homogeneously to form an embryonic web material. The embryonic web material is then transferred at a wet transfer roll to a web material structuring belt running at a second velocity $V_2$, which is approximately equal to the first velocity $V_1$. The web material is then forwarded, at the second velocity $V_2$, on the web material structuring belt and pressed to a consistency of 30-40%. Optionally, the embryonic web material can be transferred to an intermediate wire for further dewatering before being transferred to the web material structuring belt where the speed of the intermediate wire could be equal to or greater than the second velocity $V_2$. The pressing of the web material structuring belt can be accomplished by a nip between two felts.

While being conveyed on the web material structuring belt, the web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the web material is increased, for example to an estimated 97%, before dry creping the web material with a doctor blade off the drying cylinder. The doctor blade may have a bevel angle, for example the doctor blade has a bevel angle of about 45° and is positioned with respect to the drying cylinder to provide an impact angle of about 101°. This doctor blade position permits an adequate amount of force to be applied to the web material to remove it from the drying cylinder while minimally disturbing any previously generated structure in the web material that may have been imparted to the web material via the web material structuring belt. After removal from the drying cylinder, the dried web material then travels through a gapped calendar stack (not shown) before the dried web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried web material can be made more stable for any further converting operations, such as embossing. The calendar stack gap is set to decrease caliper, for example decrease caliper 10% from the uncalendared sheet to provide a gentle surface smoothing to the dried web material.

The single ply reel properties are targeted to a total tensile of 1000 g/in, a basis weight of 16 #/ream (26 gsm) and a caliper of 12 mils.

Two or more plies of the dried web material can be combined into a multi-ply web material, for example a two-ply paper towel product by embossing and laminating the plies together using, for example using a polyvinyl alcohol adhesive, perforating into sheets and winding on a core, or even winding on itself (coreless). Either the air side or the web material structuring belt side of each ply of dried web material, independently, may be positioned facing out with respect to the exterior plies of the multi-ply web material. A sheet length of 5.6 inches and 110 sheets are targeted to be wound for the rolled product. Rolled product would have about a 32 #/ream ($5^2$ g/m$^2$) basis weight and contain 45% by weight Northern Softwood Kraft fibers, 25% Southern Softwood Kraft fibers and 30% by weight Eucalyptus fibers. The multi-ply web material, for example two-ply paper towel product is bulky and absorbent.

Web Material Making Example 6B—CWP Process—Bath Tissue

A structured web material, for example a structured fibrous structure, is made using the CWP process generally described in U.S. Pat. No. 6,197,154, and WO9517548.

An aqueous slurry of Eucalyptus pulp fibers, hardwood fibers, is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top and bottom chambers of a multi-layered, three-chambered headbox of a Fourdrinier wet laid papermaking machine.

Additionally, an aqueous slurry of Eucalyptus pulp fibers, hardwood fibers, is prepared at about 1.5% fiber by weight using a conventional repulper, then transferred to another hardwood fiber stock chest. The Eucalyptus fiber slurry of the hardwood stock chest is pumped through a stock pipe and mixed with an aqueous slurry of Northern Softwood Kraft (NSK) pulp fibers, softwood fibers.

The aqueous slurry of NSK pulp fibers is prepared at about 3% fiber by weight using a conventional repulper, then transferred to the softwood fiber stock chest. The NSK fiber slurry of the softwood stock chest is pumped through a stock pipe to be gently refined. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center chamber of the multi-layered, three-chambered headbox of the Fourdrinier wet laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.26% temporary wet strengthening additive based on the dry weight of the NSK fibers. The absorption of the temporary wet strengthening additive is enhanced by passing the treated slurry through an in-line mixer.

All three fiber layers delivered from the multi-layered, three-chambered headbox are delivered simultaneously in superposed relation onto a forming wire running at a first velocity $V_1$, to form a layered embryonic web material. The layered embryonic web material is then transferred at a wet transfer roll to a web material structuring belt running at a second velocity $V_2$, which is approximately equal to the first velocity $V_1$. The web material is then forwarded, at the second velocity $V_2$, on the web material structuring belt and pressed to a consistency of 30-40%. Optionally, the embryonic web material can be transferred to an intermediate wire for further dewatering before being transferred to the web material structuring belt where the speed of the intermediate wire could be equal to or greater than the second velocity $V_2$. The pressing of the web material structuring belt can be accomplished by a nip between two felts.

The web material being conveyed on the web material structuring belt is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 25° and is positioned with respect to the drying cylinder to provide an impact angle of about 81°. This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll), the surface of the take up roll moving a fourth velocity, $V_4$ that is approximately equal to the third velocity, $V_3$ of the drying cylinder. The calendar stack gap is set to decrease caliper, for example decrease caliper 10% from the uncalendared sheet to provide a gentle surface smoothing to the dried structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 25° and is positioned with respect to the drying cylinder to provide an impact angle of about 81°.

This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried structured web material can be made more stable for any further converting operations, such as embossing. The calendar stack gap is set to decrease caliper, for example decrease caliper 20% from the uncalendared sheet to provide a gentle surface smoothing to the dried structured web material.

The single ply reel properties are targeted to a total tensile of 700 g/in, a basis weight of 12 #/ream (20 gsm) and a caliper of 10 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 150 sheets are targeted to be wound for the rolled product. Rolled product would have about a 24 #/ream (39 g/m$^2$) basis weight and contain 40% by weight Northern Softwood Kraft fibers and 60% by weight Eucalyptus fibers. The two-ply bath tissue product is soft, flexible and absorbent.

Web Material Making Example 6C—CWP Process—Bath Tissue

A structured web material, for example a structured fibrous structure, is made using the CWP process generally described in U.S. Pat. No. 6,197,154, and WO9517548.

A single ply structured web material, for example a single ply structured fibrous structure may be made according to Web Material Making Example 6B, with the exception that its single ply reel properties are targeted to a total tensile of 600 g/in, a basis weight of 14 #/ream (23 gsm) and a caliper of 9 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 130 sheets are targeted to be wound for the rolled product. Rolled product would have about a 28 #/ream (46 g/m$^2$) basis weight and contain 40% by weight Northern Softwood Kraft fibers and 60% by weight Eucalyptus fibers. The two-ply bath tissue product is soft, flexible and absorbent.

Web Material Making Example 6D—CWP Process—Bath Tissue

A structured web material, for example a structured fibrous structure, is made using the CWP process generally described in U.S. Pat. No. 6,197,154, and WO9517548.

A single ply structured web material, for example a single ply structured fibrous structure may be made according to Web Material Making Example 6B, with the exception that its single ply reel properties are target to a total tensile of 500 g/in, a basis weight of 11 #/ream (18 gsm) and a caliper of 8 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a three-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 140 sheets are targeted to be wound for the rolled product. Rolled product would have about a 30 #/ream (49 g/m$^2$) basis weight and contain 40% by weight Northern Softwood Kraft fibers and 60% by weight Eucalyptus fibers. The three-ply bath tissue product is soft, flexible and absorbent.

Web Material Making Example 7A—Fabric Creped/Belt Creped Process—Paper Towel

A structured web material, for example a structured fibrous structure, is made using the fabric creped/belt creped process generally described in U.S. Pat. Nos. 7,399,378, 8,293,072 and 8,864,945.

A 3% by weight aqueous slurry of northern softwood kraft (NSK) pulp fibers and southern softwood kraft (SSK) pulp fibers ("softwood furnish") is prepared in a conventional re-pulper. The softwood furnish is refined gently and a 2% solution of a permanent wet strength resin, for example Kymene 5221 marketed by Solenis Incorporated of Wilmington, DE, is added to the softwood furnish stock pipe at a rate of 1% by weight of the dry fibers. Kymene 5221 is added as a wet strength additive. The adsorption of Kymene 5221 to NSK is enhanced by an in-line mixer. A 1% solution of dry strength additive, for example Carboxy Methyl Cellulose (CMC), such as FinnFix 700 available from C. P. Kelco U.S. Inc. of Atlanta, GA, is added after the in-line mixer at a rate of 0.2% by weight of the dry fibers to enhance the dry strength of the fibrous structure.

A 3% by weight aqueous slurry of Eucalyptus pulp fibers, hardwood fibers, is prepared in a conventional re-pulper. A 1% solution of defoamer, for example BuBreak 4330 available from Buckman Labs, Memphis, TN, is added to the Eucalyptus slurry stock pipe at a rate of 0.25% by weight of the dry fibers and its adsorption is enhanced by an in-line mixer.

The softwood fibers and the Eucalyptus fibers are combined in a headbox and deposited onto a batted fabric, such as a felt, composed of woven monofilaments and/or multi-filamentous yarns needled with fine synthetic batt fibers, running at a first velocity $V_1$, homogenously to form an embryonic web material. The embryonic web material is then transferred at a belt crepe nip from the felt at a fiber consistency of from about 30 to about 60% to a web material structuring belt moving at a second velocity, $V_2$. The web is then forwarded, at the second velocity, $V_2$, on the web material structuring belt along a looped path, the second velocity, $V_2$ being from about 5% to about 60% slower than the first velocity, $V_1$. The web material structuring belt and web material pass over a vacuum box at about 20 in Hg to draw out minute folds and further shape the web material into the web material structuring belt resulting in a structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 45° and is positioned with respect to the drying cylinder to provide an impact angle of about 101°. This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried structured web material can be made more stable for any further converting operations, such as embossing. The calendar stack gap is set to decrease caliper, for example decrease caliper 10% from the uncalendared sheet to provide a gentle surface smoothing to the dried structured web material.

The single ply reel properties are targeted to a total tensile of 1000 g/in, a basis weight of 16 #/ream (26 gsm) and a caliper of 18 mils.

Two or more plies of the dried structured web material can be combined into a multi-ply structured web material, for example a two-ply paper towel product by embossing and laminating the plies together using, for example using a polyvinyl alcohol adhesive, perforating into sheets and winding on a core, or even winding on itself (coreless). Either the air side or the web material structuring belt side of each ply of dried structured web material, independently, may be positioned facing out with respect to the exterior plies of the multi-ply structured web material. A sheet length of 5.6 inches and 110 sheets are targeted to be wound for the rolled product. Rolled product would have about a 32 #/ream (52 g/m$^2$) basis weight and contain 45% by weight Northern Softwood Kraft fibers, 25% Southern Softwood Kraft fibers and 30% by weight Eucalyptus fibers. The multi-ply structured web material, for example two-ply paper towel product is bulky and absorbent.

Web Material Making Example 7B—Fabric Creped/Belt Creped Process—Bath Tissue

A structured web material, for example a structured fibrous structure, is made using the fabric creped/belt creped process generally described in U.S. Pat. Nos. 7,399,378, 8,293,072 and 8,864,945.

An aqueous slurry of Eucalyptus pulp fibers, hardwood fibers, is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top and bottom chambers of a multi-layered, three-chambered headbox of a Fourdrinier wet laid papermaking machine.

Additionally, an aqueous slurry of Eucalyptus pulp fibers, hardwood fibers, is prepared at about 1.5% fiber by weight using a conventional repulper, then transferred to another hardwood fiber stock chest. The Eucalyptus fiber slurry of the hardwood stock chest is pumped through a stock pipe and mixed with an aqueous slurry of Northern Softwood Kraft (NSK) pulp fibers, softwood fibers.

The aqueous slurry of NSK pulp fibers is prepared at about 3% fiber by weight using a conventional repulper, then transferred to the softwood fiber stock chest. The NSK fiber slurry of the softwood stock chest is pumped through a stock pipe to be gently refined. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center chamber of the multi-layered, three-chambered headbox of the Fourdrinier wet laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.26% temporary wet strengthening additive based on the dry weight of the NSK fibers. The absorption of the temporary wet strengthening additive is enhanced by passing the treated slurry through an in-line mixer.

All three fiber layers delivered from the multi-layered, three-chambered headbox are delivered simultaneously in superposed relation onto a batted fabric, such as a felt, composed of woven monofilaments and/or multi-filamentous yarns needled with fine synthetic batt fibers, running at a first velocity $V_1$, homogenously to form an embryonic web material. The embryonic web material is then transferred at a belt crepe nip from the felt at a fiber consistency of from about 30 to about 60% to a web material structuring belt moving at a second velocity, $V_2$. The web is then forwarded, at the second velocity, $V_2$, on the web material structuring belt along a looped path, the second velocity, $V_2$ being from about 5% to about 60% slower than the first velocity, $V_1$. The web material structuring belt and web material pass over a vacuum box at about 20 in Hg to draw out minute folds and further shape the web material into the web material structuring belt resulting in a structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 25° and is positioned with respect to the drying cylinder to provide an impact angle of about 81°.

This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried structured web material can be made more stable for any further converting operations, such as embossing. The calendar stack gap is set to decrease caliper, for example decrease caliper 20% from the uncalendared sheet to provide a gentle surface smoothing to the dried structured web material.

The single ply reel properties are targeted to a total tensile of 700 g/in, a basis weight of 12 #/ream (20 gsm) and a caliper of 12 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 150 sheets are targeted to be wound for the rolled product. Rolled product would have about a 24 #/ream (39 g/m$^2$) basis weight and contain 40% by weight Northern Softwood Kraft fibers and 60% by weight Eucalyptus fibers. The two-ply bath tissue product is soft, flexible and absorbent.

Web Material Making Example 7C—Fabric Creped/Belt Creped Process—Bath Tissue A structured web material, for example a structured fibrous structure, is made using the fabric creped/belt creped process generally described in U.S. Pat. Nos. 7,399,378, 8,293,072 and 8,864,945.

A single ply structured web material, for example a single ply structured fibrous structure may be made according to Web Material Making Example 7B, with the exception that its single ply reel properties are targeted to a total tensile of 600 g/in, a basis weight of 14 #/ream (23 gsm) and a caliper of 16 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 130 sheets are targeted to be wound for the rolled product. Rolled product would have about a 28 #/ream (46 g/m$^2$) basis weight and contain 40% by weight Northern Softwood Kraft fibers and 60% by weight Eucalyptus fibers. The two-ply bath tissue product is soft, flexible and absorbent.

Web Material Making Example 7D—Fabric Creped/Belt Creped Process—Bath Tissue

A structured web material, for example a structured fibrous structure, is made using the fabric creped/belt creped process generally described in U.S. Pat. Nos. 7,399,378, 8,293,072 and 8,864,945.

A single ply structured web material, for example a single ply structured fibrous structure may be made according to Web Material Making Example 7B, with the exception that its single ply reel properties are target to a total tensile of 500 g/in, a basis weight of 11 #/ream (18 gsm) and a caliper of 10 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a three-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 140 sheets are targeted to be wound for the rolled product. Rolled product would have about a 30 #/ream (49 g/m$^2$) basis weight and contain 40% by weight Northern Softwood Kraft fibers and 60% by weight Eucalyptus fibers. The three-ply bath tissue product is soft, flexible and absorbent.

Web Material Making Example 8A—PrimeLineTEX Process—Paper Towel

A structured web material, for example a structured fibrous structure, is made using the PrimeLineTEX process commercially available from Andritz AG, Austria.

A 3% by weight aqueous slurry of northern softwood kraft (NSK) pulp fibers and southern softwood kraft (SSK) pulp fibers ("softwood furnish") is prepared in a conventional re-pulper. The softwood furnish is refined gently and a 2% solution of a permanent wet strength resin, for example Kymene 5221 marketed by Solenis Incorporated of Wilmington, DE, is added to the softwood furnish stock pipe at a rate of 1% by weight of the dry fibers. Kymene 5221 is added as a wet strength additive. The adsorption of Kymene 5221 to NSK is enhanced by an in-line mixer. A 1% solution of dry strength additive, for example Carboxy Methyl Cellulose (CMC), such as FinnFix 700 available from C. P. Kelco U.S. Inc. of Atlanta, GA, is added after the in-line mixer at a rate of 0.2% by weight of the dry fibers to enhance the dry strength of the fibrous structure.

A 3% by weight aqueous slurry of Eucalyptus pulp fibers, hardwood fibers, is prepared in a conventional re-pulper. A 1% solution of defoamer, for example BuBreak 4330 available from Buckman Labs, Memphis, TN, is added to the Eucalyptus slurry stock pipe at a rate of 0.25% by weight of the dry fibers and its adsorption is enhanced by an in-line mixer.

The softwood fibers and the Eucalyptus fibers are combined in a headbox and deposited onto a press fabric, for example a batted fabric, such as a felt, composed of woven monofilaments and/or multi-filamentous yarns needled with fine synthetic batt fibers, running at a first velocity $V_1$, homogenously to form an embryonic web material. The embryonic web material is then transferred at a shoe press and, optionally, a suction pressure roll, from the press fabric to a web material structuring belt, for example a structure-imparting papermaking belt according to the present invention at a consistency of 40 to 50%. The web material structuring belt is moving at a second velocity, $V_2$, which is approximately the same as the first velocity, $V_1$. The web material is then forwarded on the web material structuring belt along a looped path and can optionally pass over a vacuum box to draw out minute folds and further shape the structured web material into the web material structuring belt resulting in a structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 45° and is positioned with respect to the drying cylinder to provide an impact angle of about 101°. This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried structured web material can be made more stable for any further converting operations, such as embossing. The calendar stack gap is set to decrease caliper, for example decrease caliper 10% from the uncalendared sheet to provide a gentle surface smoothing to the dried structured web material.

The single ply reel properties are targeted to a total tensile of 1000 g/in, a basis weight of 16 #/ream (about 26 gsm) and a caliper of 18 mils.

Two or more plies of the dried structured web material can be combined into a multi-ply structured web material, for example a two-ply paper towel product by embossing and laminating the plies together using, for example using a polyvinyl alcohol adhesive, perforating into sheets and winding on a core, or even winding on itself (coreless). Either the air side (side not in contact with the web material structuring belt) or the web material structuring belt side (side contacting the web material structuring belt) of each ply of dried structured web material, independently, may be positioned facing out with respect to the exterior plies of the multi-ply structured web material. A sheet length of 5.6 inches and 110 sheets are targeted to be wound for the rolled product. Rolled product would have about a 32 #/ream (52 g/m$^2$) basis weight and contain 45% by weight Northern Softwood Kraft fibers, 25% Southern Softwood Kraft fibers and 30% by weight Eucalyptus fibers. The multi-ply structured web material, for example two-ply paper towel product is bulky and absorbent.

Web Material Making Example
8B—PrimeLineTEX Process—Bath Tissue

A structured web material, for example a structured fibrous structure, is made using the PrimeLineTEX process commercially available from Andritz AG, Austria.

An aqueous slurry of Eucalyptus pulp fibers, hardwood fibers, is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top and bottom chambers of a multi-layered, three-chambered headbox of a Fourdrinier wet laid papermaking machine.

Additionally, an aqueous slurry of Eucalyptus pulp fibers, hardwood fibers, is prepared at about 1.5% fiber by weight using a conventional repulper, then transferred to another hardwood fiber stock chest. The Eucalyptus fiber slurry of the hardwood stock chest is pumped through a stock pipe and mixed with an aqueous slurry of Northern Softwood Kraft (NSK) pulp fibers, softwood fibers.

The aqueous slurry of NSK pulp fibers is prepared at about 3% fiber by weight using a conventional repulper, then transferred to the softwood fiber stock chest. The NSK fiber slurry of the softwood stock chest is pumped through a stock pipe to be gently refined. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center chamber of the multi-layered, three-chambered headbox of the Fourdrinier wet laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.26% temporary wet strengthening additive based on the dry weight of the NSK fibers. The absorption of the temporary wet strengthening additive is enhanced by passing the treated slurry through an in-lined mixer.

All three fiber layers delivered from the multi-layered, three-chambered headbox are delivered simultaneously in superposed relation onto a press fabric, for example a batted fabric, such as a felt, composed of woven monofilaments or multi-filamentous yarns needled with fine synthetic batt fibers, running at a first velocity $V_1$, to form a layered embryonic web. The web is then transferred at the shoe press and, optionally, a suction pressure roll from the press fabric to a web material structuring belt, for example a structure-imparting papermaking belt, of the present invention, at a consistency of 40 to 50%. The web material structuring belt is moving at a second velocity, $V_2$, which is approximately the same as the first velocity, $V_1$. The web material is then forwarded on the web material structuring belt along a looped path and can optionally pass over a vacuum box (not shown) to draw out minute folds and further shape the structured web material into the web material structuring belt resulting in a structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 25° and is positioned with respect to the drying cylinder to provide an impact angle of about 81°.

This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried structured web material can be made more stable for any further converting operations, such as embossing. The calendar stack gap is set to decrease caliper, for example decrease caliper 20% from the uncalendared sheet to provide a gentle surface smoothing to the dried structured web material.

The single ply reel properties are targeted to a total tensile of 700 g/in, a basis weight of 12 #/ream (20 gsm) and a caliper of 12 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 150 sheets are targeted to be wound for the rolled product. Rolled product would have about a 24 #/ream (39 g/m$^2$) basis weight and contain 40% by weight Northern Softwood Kraft fibers and 60% by weight Eucalyptus fibers. The two-ply bath tissue product is soft, flexible and absorbent.

Web Material Making Example
8C—PrimeLineTEX Process—Bath Tissue

A structured web material, for example a structured fibrous structure, is made using the PrimeLineTEX process commercially available from Andritz AG, Austria.

A single ply structured web material, for example a single ply structured fibrous structure may be made according to Web Material Making Example 8B, with the exception that its single ply reel properties are targeted to a total tensile of 600 g/in, a basis weight of 14 #/ream (23 gsm) and a caliper of 16 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 130 sheets are targeted to be wound for the rolled product. Rolled product would have about a 28 #/ream (46 g/m$^2$) basis weight and contain 40% by weight Northern Softwood Kraft fibers and 60% by weight Eucalyptus fibers. The two-ply bath tissue product is soft, flexible and absorbent.

Web Material Making Example
8D—PrimeLineTEX Process—Bath Tissue

A structured web material, for example a structured fibrous structure, is made using the PrimeLineTEX process commercially available from Andritz AG, Austria.

A single ply structured web material, for example a single ply structured fibrous structure may be made according to Web Material Making Example 8B, with the exception that its single ply reel properties are targeted to a total tensile of 500 g/in, a basis weight of 11 #/ream (18 gsm) and a caliper of 10 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a three-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 140 sheets are targeted to be wound for the rolled product. Rolled product would have about a 30 #/ream (49 g/m$^2$) basis weight and contain 40% by weight Northern Softwood Kraft fibers and 60% by weight Eucalyptus fibers. The three-ply bath tissue product is soft, flexible and absorbent.

Web Material Making Example
9A—PrimeLineTAD Process—Paper Towel

A structured web material, for example a structured fibrous structure, is made using the PrimeLineTAD process commercially available from Andritz AG, Austria.

A 3% by weight aqueous slurry of northern softwood kraft (NSK) pulp fibers and southern softwood kraft (SSK) pulp fibers ("softwood furnish") is prepared in a conventional re-pulper. The softwood furnish is refined gently and a 2% solution of a permanent wet strength resin, for example Kymene 5221 marketed by Solenis Incorporated of Wilmington, DE, is added to the softwood furnish stock pipe at a rate of 1% by weight of the dry fibers. Kymene 5221 is added as a wet strength additive. The adsorption of Kymene 5221 to NSK is enhanced by an in-line mixer. A 1% solution of dry strength additive, for example Carboxy Methyl Cellulose (CMC), such as FinnFix 700 available from C. P. Kelco U.S. Inc. of Atlanta, GA, is added after the in-line mixer at a rate of 0.2% by weight of the dry fibers to enhance the dry strength of the fibrous structure.

A 3% by weight aqueous slurry of Eucalyptus pulp fibers, hardwood fibers, is prepared in a conventional re-pulper. A 1% solution of defoamer, for example BuBreak 4330 available from Buckman Labs, Memphis, TN, is added to the Eucalyptus slurry stock pipe at a rate of 0.25% by weight of the dry fibers and its adsorption is enhanced by an in-line mixer.

The softwood furnish and the Eucalyptus fibers are combined in a headbox and deposited onto a forming wire, running at first velocity $V_1$, homogeneously to form an embryonic web material and then transferred at a transfer nip with approximately 10 in Hg vacuum to a web material structuring belt, for example a structure-imparting papermaking belt, according to the present invention at 10% to 25% solids moving at a second velocity, $V_2$, which is about 5% to about 25% slower than the first velocity, $V_1$. The web material is then forwarded on the web material structuring belt along a looped path and passes through at least one, in this case two pre-dryers structuring and at least partially drying the web material to a consistency of from about 55% to about 90% resulting in a dried structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 45° and is positioned with respect to the drying cylinder to provide an impact angle of about 101°. This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried structured web material can be made more stable for any further converting operations, such as embossing. The calendar stack gap is set to decrease caliper, for example decrease caliper 10% from the uncalendared sheet to provide a gentle surface smoothing to the dried structured web material.

The single ply reel properties are targeted to a total tensile of 1000 g/in, a basis weight of 16 #/ream (26 gsm) and a caliper of 24 mils.

Two or more plies of the dried structured web material can be combined into a multi-ply structured web material, for example a two-ply paper towel product by embossing and laminating the plies together using, for example using a polyvinyl alcohol adhesive, perforating into sheets and winding on a core, or even winding on itself (coreless). Either the air side or the web material structuring belt side of each ply of dried structured web material, independently, may be positioned facing out with respect to the exterior plies of the multi-ply structured web material. A sheet length of 5.6 inches and 110 sheets are targeted to be wound for the rolled product. Rolled product would have about a 32 #/ream (52 g/m$^2$) basis weight and contain 45% by weight Northern Softwood Kraft fibers, 25% Southern Softwood Kraft fibers and 30% by weight Eucalyptus fibers. The multi-ply structured web material, for example two-ply paper towel product is bulky and absorbent.

Web Material Making Example
9B—PrimeLineTAD Process—Bath Tissue

A structured web material, for example a structured fibrous structure, is made using the PrimeLineTAD process commercially available from Andritz AG, Austria.

An aqueous slurry of Eucalyptus pulp fibers, hardwood fibers, is prepared at about 3% fiber by weight using a conventional repulper, then transferred to a hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and distributed in the top and bottom chambers of a multi-layered, three-chambered headbox of a Fourdrinier wet laid papermaking machine.

Additionally, an aqueous slurry of Eucalyptus pulp fibers, hardwood fibers, is prepared at about 1.5% fiber by weight using a conventional repulper, then transferred to another hardwood fiber stock chest. The Eucalyptus fiber slurry of the hardwood stock chest is pumped through a stock pipe and mixed with an aqueous slurry of Northern Softwood Kraft (NSK) pulp fibers, softwood fibers.

The aqueous slurry of NSK pulp fibers is prepared at about 3% fiber by weight using a conventional repulper, then transferred to the softwood fiber stock chest. The NSK fiber slurry of the softwood stock chest is pumped through a stock pipe to be gently refined. The refined NSK fiber slurry is then mixed with the 1.5% aqueous slurry of Eucalyptus fibers (described in the preceding paragraph) and directed to a fan pump where the NSK slurry consistency is reduced from about 3% by fiber weight to about 0.15% by fiber weight. The 0.15% Eucalyptus/NSK slurry is then directed and distributed to the center chamber of the multi-layered, three-chambered headbox of the Fourdrinier wet laid papermaking machine.

In order to impart temporary wet strength to the finished fibrous structure, a 1% dispersion of temporary wet strengthening additive (e.g., Fennorez® 91 commercially available from Kemira) is prepared and is added to the NSK fiber stock pipe at a rate sufficient to deliver 0.26% temporary wet strengthening additive based on the dry weight of the NSK fibers. The absorption of the temporary wet strengthening additive is enhanced by passing the treated slurry through an in-line mixer.

All three fiber layers delivered from the multi-layered, three-chambered headbox are delivered simultaneously in superposed relation onto a forming wire, running at first velocity $V_1$, to form a layered embryonic web material and then transferred at a transfer nip with approximately 10 in Hg vacuum to a web material structuring belt, for example a structure-imparting papermaking belt, according to the present invention at 10% to 25% solids moving at a second velocity, $V_2$, which is about 0% to about 10% faster than the first velocity, $V_1$. The web material is then forwarded on the web material structuring belt along a looped path and passes through at least one, in this case two pre-dryers structuring and at least partially drying the web material to a consistency of from about 55% to about 90% resulting in a dried structured web material.

The structured web material is then pressed & adhered via a nip and chemistry onto a drying cylinder, for example a Yankee dryer, which is sprayed with a creping adhesive, for example a creping adhesive comprising 0.25% aqueous solution of polyvinyl alcohol. The drying cylinder is moving at a third velocity, $V_3$, for example about 1200 fpm. The fiber consistency of the structured web material is increased, for example to an estimated 97%, before dry creping the structured web material with a doctor blade off the drying cylinder. The doctor blade may have a bevel angle, for example the doctor blade has a bevel angle of about 25° and is positioned with respect to the drying cylinder to provide an impact angle of about 81°.

This doctor blade position permits an adequate amount of force to be applied to the structured web material to remove it from the drying cylinder while minimally disturbing the previously generated structure in the structured web material that was imparted to the web material via the web material structuring belt. After removal from the drying cylinder, the dried structured web material then travels through a gapped calendar stack (not shown) before the dried structured web material is reeled onto a take up roll (known as a parent roll). The surface of the take up roll may be moving at a fourth velocity, $V_4$, that is faster, for example about 7% faster, than the third velocity, $V_3$, of the drying cylinder. By reeling at the fourth velocity, $V_4$, some of the foreshortening provided by the creping step is "pulled out," sometimes referred to as a "positive draw," so that the dried structured web material can be made more stable for any further converting operations, such as embossing. The calendar stack gap is set to decrease caliper, for example decrease caliper 20% from the uncalendared sheet to provide a gentle surface smoothing to the dried structured web material.

The single ply reel properties are targeted to a total tensile of 700 g/in, a basis weight of 12 #/ream (20 gsm) and a caliper of 18 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 150 sheets are targeted to be wound for the rolled product. Rolled product would have about a 24 #/ream (39 g/m$^2$) basis weight and contain 40% by weight Northern Softwood Kraft fibers and 60% by weight Eucalyptus fibers. The two-ply bath tissue product is soft, flexible and absorbent.

Web Material Making Example
9C—PrimeLineTAD Process—Bath Tissue

A structured web material, for example a structured fibrous structure, is made using the PrimeLineTAD process commercially available from Andritz AG, Austria.

A single ply structured web material, for example a single ply structured fibrous structure may be made according to Web Material Making Example 9B, with the exception that its single ply reel properties are targeted to a total tensile of 600 g/in, a basis weight of 14 #/ream (23 gsm) and a caliper of 16 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a two-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 130 sheets are targeted to be wound for the rolled product. Rolled product would have about a 28 #/ream (46 g/m$^2$) basis weight and contain 40% by weight Northern Softwood Kraft fibers and 60% by weight Eucalyptus fibers. The two-ply bath tissue product is soft, flexible and absorbent.

Web Material Making Example
9D—PrimeLineTAD Process—Bath Tissue

A structured web material, for example a structured fibrous structure, is made using the TAD process generally described in U.S. Pat. Nos. 3,994,771, 4,102,737, 4,529,480, 5,510,002 and 8,293,072, and US Patent Publication No. 20210087748.

A single ply structured web material, for example a single ply structured fibrous structure may be made according to Web Material Making Example 9B, with the exception that its single ply reel properties are target to a total tensile of 500 g/in, a basis weight of 11 #/ream (18 gsm) and a caliper of 10 mils. The web material structuring belt side layer of the single ply is predominately Eucalyptus fibers and 40% by weight of the sheet, the center layer is a blend of NSK fibers (40% by weight of the sheet) and about 5% by weight of the sheet Eucalyptus fibers and the air side layer is predominately Eucalyptus fibers and about 15% by weight of the sheet.

Two or more plies of the dried structured web material can be combined into a multi-ply structured web material, for example a three-ply bath tissue product by embossing and laminating the plies together using, for example using a polyvinyl alcohol adhesive, applying a surface additive for softening, perforating into sheets and winding on a core, or even winding on itself (coreless). Either the air side or the web material structuring belt side of each ply of dried structured web material, independently, may be positioned facing out with respect to the exterior plies of the multi-ply structured web material. If the air side is positioned out, the proportion of Eucalyptus slurry directed to the top and bottom chambers of the multi-layered headbox can be reversed. A sheet length of 4.0 inches and 140 sheets are targeted to be wound for the rolled product. Rolled product would have about a 30 #/ream (49 g/m$^2$) basis weight and contain 40% by weight Northern Softwood Kraft fibers and 60% by weight Eucalyptus fibers. The three-ply bath tissue product is soft, flexible and absorbent.

Each of the Example Claim Embodiments of U.S. Pub. No. US 2024-0368837, including Example Claim Embodiments [0754] through [0780], are incorporated herein by reference.

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 2 hours prior to the test. The samples tested are "usable units." "Usable units" as used herein means sheets, flats from roll stock, pre-converted flats, and/or single or multi-ply products unless otherwise stated.

All tests are conducted in such conditioned room. Do not test samples that have defects such as wrinkles, tears, holes, and like. All instruments are calibrated according to manufacturer's specifications.

EMTEC Test Method

TS7 and TS750 values are measured using an EMTEC Tissue Softness Analyzer ("Emtec TSA") (Emtec Electronic GmbH, Leipzig, Germany) interfaced with a computer running Emtec TSA software (version 3.19 or equivalent). According to Emtec, the TS7 value correlates with the real material softness, while the TS750 value correlates with the felt smoothness/roughness of the material. The Emtec TSA comprises a rotor with vertical blades which rotate on the test sample at a defined and calibrated rotational speed (set by manufacturer) and contact force of 100 mN. Contact between the vertical blades and the test piece creates vibrations, which create sound that is recorded by a microphone within the instrument. The recorded sound file is then analyzed by the Emtec TSA software. The sample preparation, instrument operation and testing procedures are performed according the instrument manufacture's specifications.

Sample Preparation

Test samples are prepared by cutting square or circular samples from a finished product. Test samples are cut to a length and width (or diameter if circular) of no less than about 90 mm, and no greater than about 120 mm, in any of these dimensions, to ensure the sample can be clamped into the TSA instrument properly. Test samples are selected to avoid perforations, creases or folds within the testing region. Prepare 8 substantially similar replicate samples for testing. Equilibrate all samples at TAPPI standard temperature and relative humidity conditions (23° C.±2 C.° and 50%±2%) for at least 1 hour prior to conducting the TSA testing, which is also conducted under TAPPI conditions.

Testing Procedure

Calibrate the instrument according to the manufacturer's instructions using the 1-point calibration method with Emtec reference standards ("ref. 2 samples"). If these reference samples are no longer available, use the appropriate reference samples provided by the manufacturer. Calibrate the instrument according to the manufacturer's recommendation and instruction, so that the results will be comparable to those obtained when using the 1-point calibration method with Emtec reference standards ("ref. 2 samples").

Mount the test sample into the instrument, and perform the test according to the manufacturer's instructions. When complete, the software displays values for TS7 and TS750. Record each of these values to the nearest 0.01 dB $V^2$ rms. The test piece is then removed from the instrument and discarded. This testing is performed individually on the top surface (outer facing surface of a rolled product) of four of the replicate samples, and on the bottom surface (inner facing surface of a rolled product) of the other four replicate samples.

The four test result values for TS7 and TS750 from the top surface are averaged (using a simple numerical average); the same is done for the four test result values for TS7 and TS750 from the bottom surface. Report the individual average values of TS7 and TS750 for both the top and bottom surfaces on a particular test sample to the nearest 0.01 dB $V^2$ rms. Additionally, average together all eight test value results for TS7 and TS750, and report the overall average values for TS7 and TS750 on a particular test sample to the nearest 0.01 dB $V^2$ rms.

Roll Diameter Test Method

For this test, the actual web material roll, for example sanitary tissue product roll, is the test sample. Remove all of the test web material rolls from any packaging and allow them to condition at about 23° C.±2 C.° and about 50%±2% relative humidity for 24 hours prior to testing. Web material rolls with cores that are crushed, bent or damaged should not be tested.

The diameter of the test web material roll is measured as the Original Roll Diameter described in the Percent Compressibility Test Method below.

Basis Weight Test Method

Basis weight of a fibrous structure and/or sanitary tissue product is measured on stacks of twelve usable units using a top loading analytical balance with a resolution of ±0.001 g. The balance is protected from air drafts and other disturbances using a draft shield. A precision cutting die, measuring 3.500 in±0.007 in by 3.500 in±0.007 in is used to prepare all samples.

Stack six usable units aligning any perforations or folds on the same side of stack. With a precision cutting die, cut the stack into squares. Select six more usable units of the sample; stack and cut in like manner. Combine the two stacks to form a single stack twelve squares thick. Measure the mass of the sample stack and record the result to the nearest 0.001 g.

The Basis Weight is calculated in lbs/3000 $ft^2$ or $g/m^2$ as follows:

$$\text{Basis Weight} = (\text{Mass of stack})/[(\text{Area of 1 layer in stack}) \times (\text{Number of layers})]$$

For example, $$\text{Basis Weight } (\text{lbs}/3000\ \text{ft}^2) = [[\text{Mass of stack (g)}/453.6(\text{g/lbs})]/[12.25(\text{in}^2)/144(\text{in}^2/\text{ft}^2) \times 12]] \times 3000$$

Or, $$\text{Basis Weight } (\text{g/m}^2) = \text{Mass of stack (g)}/[79.032(\text{cm}^2)/10{,}000(\text{cm}^2/\text{m}^2) \times 12]$$

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

Dry Tensile Test Method

Elongation, Tensile Strength, TEA and Tangent Modulus are measured on a constant rate of extension tensile tester with computer interface (a suitable instrument is the EJA Vantage from the Thwing-Albert Instrument Co. West Berlin, NJ) using a load cell for which the forces measured are within 10% to 90% of the limit of the load cell. Both the movable (upper) and stationary (lower) pneumatic jaws are fitted with smooth stainless steel faced grips, with a design suitable for testing 1 inch wide sheet material (Thwing-Albert item #733GC). An air pressure of about 60 psi is supplied to the jaws.

Twenty usable units of sanitary tissue product or web are divided into four stacks of five usable units each. The usable units in each stack are consistently oriented with respect to machine direction (MD) and cross direction (CD). Two of the stacks are designated for testing in the MD and two for CD. Using a one inch precision cutter (Thwing Albert) take a CD stack and cut two, 1.00 in±0.01 in wide by at least 3.0 in long strips from each CD stack (long dimension in CD). Each strip is five usable unit layers thick and will be treated as a unitary specimen for testing. In like fashion cut the remaining CD stack and the two MD stacks (long dimension in MD) to give a total of 8 specimens (five layers each), four CD and four MD.

Program the tensile tester to perform an extension test, collecting force and extension data at an acquisition rate of 20 Hz as the crosshead raises at a rate of 4.00 in/min (10.16 cm/min) until the specimen breaks. The break sensitivity is set to 50%, i.e., the test is terminated when the measured force drops to 50% of the maximum peak force, after which the crosshead is returned to its original position.

Set the gage length to 2.00 inches. Zero the crosshead and load cell. Insert the specimen into the upper and lower open grips such that at least 0.5 inches of specimen length is contained each grip. Align specimen vertically within the upper and lower jaws, then close the upper grip. Verify specimen is aligned, then close lower grip. The specimen should be under enough tension to eliminate any slack, but less than 0.05 N of force measured on the load cell. Start the tensile tester and data collection. Repeat testing in like fashion for all four CD and four MD specimens.

Program the software to calculate the following from the constructed force (g) verses extension (in) curve:

Tensile Strength is the maximum peak force (g) divided by the product of the specimen width (1 in) and the number of usable units in the specimen (5), and then reported as g/in to the nearest 1 g/in.

Adjusted Gage Length is calculated as the extension measured at 11.12 g of force (in) added to the original gage length (in).

Elongation is calculated as the extension at maximum peak force (in) divided by the Adjusted Gage Length (in) multiplied by 100 and reported as % to the nearest 0.1%.

Tensile Energy Absorption (TEA) is calculated as the area under the force curve integrated from zero extension to the extension at the maximum peak force (g*in), divided by the product of the adjusted Gage Length (in), specimen width (in), and number of usable units in the specimen (5). This is reported as g*in/in$^2$ to the nearest 1 g*in/in$^2$.

Replot the force (g) verses extension (in) curve as a force (g) verses strain curve. Strain is herein defined as the extension (in) divided by the Adjusted Gage Length (in).

Program the software to calculate the following from the constructed force (g) verses strain curve:

Tangent Modulus is calculated as the least squares linear regression using the first data point from the force (g) verses strain curve recorded after 190.5 g (38.1 g×5 layers) force and the 5 data points immediately preceding and the 5 data points immediately following it. This slope is then divided by the product of the specimen width (2.54 cm) and the number of usable units in the specimen (5), and then reported to the nearest 1 g/cm.

The Tensile Strength (g/in), Elongation (%), TEA (g*in/in$^2$) and Tangent Modulus (g/cm) are calculated for the four CD specimens and the four MD specimens. Calculate an average for each parameter separately for the CD and MD specimens.

Calculations:

$$\text{Geometric Mean Tensile} = \text{Square Root of}\left[MD\ \text{Tensile Strength}\ (\text{g/in}) \times CD\ \text{Tensile Strength}\ (\text{g/in})\right]$$

$$\text{Geometric Mean Peak Elongation} = \text{Square Root of}\ [MD\ \text{Elongation}\ (\%) \times CD\ \text{Elongation}\ (\%)]$$

$$\text{Geometric Mean } TEA = \text{Square Root of}\left[MD\ TEA\ (\text{g}*\text{in/in}^2) \times CD\ TEA\ (\text{g}*\text{in/in}^2)\right]$$

$$\text{Geometric Mean Modulus} = \text{Square Root of}\left[MD\ \text{Modulus}\ (\text{g/cm}) \times CD\ \text{Modulus}\ (\text{g/cm})\right]$$

$$\text{Total Dry Tensile Strength } (TDT) = MD\ \text{Tensile Strength}\ (\text{g/in}) + CD\ \text{Tensile Strength}\ (\text{g/in})$$

$$\text{Total } TEA = MD\ TEA\ (\text{g}*\text{in/in}^2) + CD\ TEA\ (\text{g}*\text{in/in}^2)$$

$$\text{Total Modulus} = MD\ \text{Modulus}\ (\text{g/cm}) + CD\ \text{Modulus}\ (\text{g/cm})$$

$$\text{Tensile Ratio} = MD\ \text{Tensile Strength}\ (\text{g/in})/CD\ \text{Tensile Strength}\ (\text{g/in})$$

Percent Compressibility Test Method

Percent Compressibility of a web material roll is determined using a Roll Tester 1000 as shown in FIG. 6. It is comprised of a support stand made of two aluminum plates, a base plate 1001 and a vertical plate 1002 mounted perpendicular to the base, a sample shaft 1003 to mount the web material test roll, and a bar 1004 used to suspend a precision diameter tape 1005 that wraps around the circumference of the web material test roll. Two different weights 1006 and 1007 are suspended from the diameter tape to apply a confining force during the uncompressed and compressed measurement. All testing is performed in a conditioned room maintained at about 23° C.±2 C.° and about 50%±2% relative humidity.

The diameter of the web material test roll 1009, for example a sanitary tissue product roll, is measured directly using a Pi® tape or equivalent precision diameter tape (e.g. an Executive Diameter tape available from Apex Tool Group, LLC, Apex, NC, Model No. W606PD) which converts the circumferential distance into a diameter measurement, so the roll diameter is directly read from the scale. The diameter tape is graduated to 0.01 inch increments with accuracy certified to 0.001 inch and traceable to NIST. The tape is 0.25 in wide and is made of flexible metal that conforms to the curvature of the test roll but is not elongated under the 1100 g loading used for this test. If necessary the diameter tape is shortened from its original length to a length that allows both of the attached weights to hang freely during the test yet is still long enough to wrap completely around the test roll being measured. The cut end of the tape is modified to allow for hanging of a weight (e.g. a loop). All weights used are calibrated, Class F hooked weights, traceable to NIST.

The aluminum support stand is approximately 600 mm tall and stable enough to support the test roll horizontally throughout the test. The sample shaft 1003 is a smooth aluminum cylinder that is mounted perpendicularly to the vertical plate 1002 approximately 485 mm from the base. The shaft has a diameter that is at least 90% of the inner diameter of the web material test roll and longer than the width of the web material test roll. A small steal bar 1004 approximately 6.3 mm diameter is mounted perpendicular to the vertical plate 1002 approximately 570 mm from the base and vertically aligned with the sample shaft. The diameter tape is suspended from a point along the length of the bar corresponding to the midpoint of a mounted web material test roll. The height of the tape is adjusted such that the zero mark is vertically aligned with the horizontal midline of the sample shaft when a web material test roll is not present.

Condition the samples at about 23° C.±2 C.° and about 50%±2% relative humidity for 2 hours prior to testing. Web material test rolls with cores that are crushed, bent or damaged should not be tested. Place the web material test roll 1009 on the sample shaft 1003 such that the direction the web material was rolled onto its core is the same direction the diameter tape will be wrapped around the web material test roll. Align the midpoint of the web material test roll's width with the suspended diameter tape. Loosely loop the diameter tape 1004 around the circumference of the web material test roll 1009, placing the tape edges directly adjacent to each other with the surface of the tape lying flat against the web material test roll. Carefully, without applying any additional force, hang the 100 g weight 1006 from the free end of the tape, letting the weighted end hang freely without swinging. Wait 3 seconds. At the intersection of the diameter tape 1008, read the diameter aligned with the zero mark of the diameter tape and record as the Original Roll Diameter to the nearest 0.01 inches. With the diameter tape still in place, and without any undue delay, carefully hang the 1000 g weight 1007 from the bottom of the 100 g weight, for a total weight of 1100 g. Wait 3 seconds. Again, read the roll diameter from the tape and record as the Compressed Roll Diameter to the nearest 0.01 inch. Calculate percent compressibility to the according to the following equation and record to the nearest 0.1%:

$$\%\ \text{Compressibility} = \frac{(\text{Orginal Roll Diameter}) - (\text{Compressed Roll Diameter})}{\text{Original Roll Diameter}} \times 100$$

Repeat the testing on 10 replicate web material test rolls and record the separate results to the nearest 0.1%. Average the 10 results and report as the Percent Compressibility to the nearest 0.1%.

Seam 180° Free Peel Test Method

The Seam 180° Free Peel of a web material structuring belt, for example a laminated web material structuring belt, comprising two identifiable material layers, for example a support layer and a structuring layer with a seam, for example a support layer material seam and/or a structuring layer material seam, is measured on a constant rate of extension tensile tester (a suitable instrument is the MTS Alliance or Criterion using Testworks 4.0 or Testsuite TWe Software, as available from MTS Systems Corp., Eden Prairie, MN) using a load cell for which the forces measured are within 10% to 90% of the limit of the cell. Both the movable (upper) and stationary (lower) jaws of the constant rate of extension tensile tester are fitted with rubber faced grips, wider than the width of a sample of the web material structuring belt, for example laminated web material structuring belt, to be tested (described below). All testing is performed in a room controlled at 23° C.±3 C.° and 50%±2% relative humidity.

Samples of the web material structuring belt, for example laminated web material structuring belt, to be tested are conditioned at about 23° C.±2 C.° and about 50° C.±2 C.° % relative humidity for at least two hours before testing. A sample is prepared for testing by cutting a testing strip sample from the web material structuring belt, 25.4 mm±0.1 mm wide, centered along the longitudinal axis of a seam, for example a support layer material seam and/or a structuring layer material seam, of the web material structuring belt, using a cutting die, razor knife or other appropriate means. The testing strip sample must be at least 150 mm in length.

Next, select one end of the testing strip sample and identify the interface where the two identifiable material layers, for example the support layer and the structuring layer, of the web material structuring belt are adjacent to one another. Manually initiate a peel by separating the two ends of the two identifiable material layers longitudinally 50 mm into the testing strip sample to create two leads to grip the testing strip sample for testing. A total of three testing strip samples for a web material structuring belt are prepared for testing.

Program the tensile tester for an extension test collecting force (N) and extension (m) data at 20 Hz with the crosshead being raised at speed of 16.5 mm/s during testing until the testing strip sample is completely separated into two discrete material layers. Ensure the programming only calculates from actual peel data and not from slack at the beginning of the test or zero forces at the end of the test. Slack preload should be set to 20 g. The test should be programmed to end when the testing strip sample is completely separated into two discrete material layers.

Set the gage length to 50 mm. Zero the crosshead and load cell. Insert one of the testing strip sample leads in the upper grip and close. Insert the other testing strip sample lead into the lower grip and close. Ensure less than 20 g registers on the load cell prior to starting the testing. Start the test and acquire data. Repeat in like fashion for all three testing strip samples.

Construct a force (N) versus extension (m) curve from the data. Record the Peak Peel Force (N) to the nearest 0.1 N for each sample. From the force (N) versus extension (m) curve calculate the Energy. Energy is the area under the force-extension curve in Joules (J), where 1 J=1N*m. Divide this Energy value (J) by the total peel length for the testing strip sample in meters (m) to normalize testing strip samples of different lengths (150 mm or greater) for comparison purposes. Record the Energy per meter of total peel length for the testing strip sample length (J/m) to the nearest 0.1 J/m for each testing strip sample. Calculate and report the arithmetic mean of the Peak Peel Force (N) and Energy (J/m) values for the three replicate testing strip samples.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A web material structuring belt comprising:

a. a support layer; and b. a structuring layer;

wherein at least one of the support layer and the structuring layer comprises a seam that is associated with the other layer; and wherein the structuring layer material seam comprises three-dimensional features that extend into the support layer by a depth of from between about 30 μm and about 5000 μm.

2. The web material structuring belt according to claim 1 wherein the structuring layer material seam extends into, but less than entirely through the support layer.

3. The web material structuring belt according to claim 1 wherein the structuring layer material seam extends entirely through the support layer.

4. The web material structuring belt according to claim 1 wherein less than the entire amount of the structuring layer material seam that extends into the support layer is bonded to the support layer.

5. The web material structuring belt according to claim 4 wherein the structuring layer material seam is bonded to the support layer at one or more bond sites.

6. The web material structuring belt according to claim 5 wherein at least one of the one or more bond sites comprises a thermal bond site.

7. The web material structuring belt according to claim 5 wherein at least one of the one or more bond sites comprises a chemical bond site.

8. The web material structuring belt according to claim 5 wherein at least one of the one or more bond sites comprises an adhesive bond site.

9. The web material structuring belt according to claim 1 wherein the structuring layer material seam is mechanically entangled with the support layer.

10. The web material structuring belt according to claim 9 wherein the structuring layer material seam is interwoven with the support layer.

11. The web material structuring belt according to claim 9 wherein the structuring layer material seam is interlocked with the support layer.

12. The web material structuring belt according to claim 1 wherein the structuring layer material seam comprises at least one structuring layer material seam portion that is associated with the support layer.

13. The web material structuring belt according to claim 12 wherein the structuring layer material seam comprises two or more structuring layer material seam portions that are associated with the support layer.

14. The web material structuring belt according to claim 12 wherein the at least one structuring layer material seam portion extends into the support layer.

15. The web material structuring belt according to claim 14 wherein the at least one structuring layer material seam portion extends into, but less than entirely through the support layer.

16. The web material structuring belt according to claim 14 wherein the at least one structuring layer material seam portion extends entirely through the support layer.

17. The web material structuring belt according to claim 14 wherein less than the entire amount of the at least one structuring layer material seam portion that extends into the support layer is bonded to the support layer.

18. The web material structuring belt according to claim 17 wherein the at least one structuring layer material seam portion is bonded to the support layer at one or more bond sites.

* * * * *